US007012053B1

(12) United States Patent
Barnabas et al.

(10) Patent No.: US 7,012,053 B1
(45) Date of Patent: Mar. 14, 2006

(54) FABRIC CARE COMPOSITION AND METHOD COMPRISING A FABRIC CARE POLYSACCHARIDE AND WRINKLE CONTROL AGENT

(75) Inventors: Mary Vijayarani Barnabas, West Chester, OH (US); Toan Trinh, Maineville, OH (US); Freddy Arthur Barnabas, West Chester, OH (US); Michael Stanford Showell, Cincinnati, OH (US); Mark Richard Sine, Morrow, OH (US); Johan Smets, Lubbeek (BE); Helen Bernado Tordil, West Chester, OH (US); Todd Michael Wernicke, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/807,367

(22) PCT Filed: Oct. 22, 1999

(86) PCT No.: PCT/US99/24942

§ 371 (c)(1),
(2), (4) Date: Apr. 12, 2001

(87) PCT Pub. No.: WO00/24856

PCT Pub. Date: May 4, 2000

(51) Int. Cl.
*C11D 3/22* (2006.01)

(52) U.S. Cl. ..... 510/287; 510/276; 510/292; 510/308; 510/322; 510/327; 510/382; 510/101; 510/394; 510/470; 510/515; 510/520

(58) Field of Classification Search ..... 510/276, 510/287, 292, 308, 322, 327, 382, 101, 394, 510/470, 515, 520
See application file for complete search history.

(56) References Cited

U.S. PATENT DOCUMENTS

| | | | | |
|---|---|---|---|---|
| 3,600,325 | A | 8/1971 | Kaufman et al. | |
| 4,169,064 | A | 9/1979 | Sagel et al. | |
| 5,668,097 | A | 9/1997 | Trinh et al. | |
| 5,686,376 | A | 11/1997 | Rusche et al. | |
| 5,798,107 | A | 8/1998 | Vogel et al. | |
| 5,885,306 | A * | 3/1999 | Hamaya et al. | 8/401 |
| 5,914,443 | A * | 6/1999 | Kalum | 8/401 |
| 5,968,813 | A * | 10/1999 | Kofod et al. | 435/263 |
| 6,290,978 | B1 * | 9/2001 | Mak et al. | 424/401 |

FOREIGN PATENT DOCUMENTS

| | | | |
|---|---|---|---|
| EP | 703243 A1 | | 3/1996 |
| JP | 5209195 | | 8/1993 |
| JP | 2131387 | * | 4/1994 |
| JP | 6116586 | | 4/1994 |
| JP | 6184943 | * | 5/1994 |
| JP | 6184943 | | 7/1994 |
| WO | WO 91/15564 | | 10/1991 |
| WO | WO 95/34625 | | 12/1995 |
| WO | WO 96/04937 | | 2/1996 |
| WO | WO 96/15310 | | 5/1996 |
| WO | WO 96/21714 | | 7/1996 |
| WO | WO 97/41292 | | 11/1997 |
| WO | WO 97/45510 | | 12/1997 |
| WO | WO 99/55736 | | 11/1999 |

* cited by examiner

*Primary Examiner*—Charles Boyer
(74) *Attorney, Agent, or Firm*—Mark A. Charles; Kim W. Zerby; Steven W. Miller

(57) ABSTRACT

The present invention relates to fabric care compositions, methods, and articles of manufacture for treating fabrics, comprising an effective amount of fabric care polysaccharides with globular structure. Optionally, the composition can contain other ingredients to improve performance and formulatability. The compositions can be applied to fabric by spraying, soaking, dipping, and can also be used for pre-wash treatment, adding to the wash cycle, adding to the rinse cycle, and/or adding to the drying cycle. Preferably the compositions are applied from spray containers which preferably are in association with instructions for use.

87 Claims, No Drawings

FABRIC CARE COMPOSITION AND METHOD COMPRISING A FABRIC CARE POLYSACCHARIDE AND WRINKLE CONTROL AGENT

TECHNICAL FIELD

The present invention relates to fabric care compositions, methods, and articles of manufacture for treating fabrics in order to improve various properties of fabrics, in particular, reduction and/or removal of unwanted wrinkles; fabric wear reduction; fabric pill prevention and/or reduction; and/or fabric color maintenance and/or fading reduction.

BACKGROUND OF THE INVENTION

There is a continuous need for textile technologists to produce compositions and products that provide useful benefits to fabrics, especially clothing, such as maintaining and/or improving a good appearance, and maintaining fabric condition, e.g., strength and/or size, and reducing fabric wear, through a simple and convenient application of a product.

Consumers commonly judge the desirability and wearability of a garment by many appearance criteria, such as, absence of wrinkles, absence of color fading, absence of soiling and staining, absence of damage such as pilling, absence of malodor, and the like. Other benefits that consumers value include fabric longevity, e.g., fabric wear prevention or reduction, shrinkage prevention or reduction, and the like. These benefits can be more or less provided via textile finishing compositions that are applied to fabrics in textile mills and/or garment manufacturing facilities, but it is preferable that these benefits are provided via simple and convenient consumer compositions, methods and products, to be applied in the consumer's home. These consumer compositions and products are preferably safe, and do not involve complicated and/or unsafe treatments and/or applications. Desirably they comprise treatments that are familiar to the consumers, such as spraying, soaking, adding to the wash cycle, adding to the rinse cycle, and/or adding to the drying cycle.

The present invention relates to compositions, methods, and articles of manufacture that provide some important fabric care benefits, including at least one of the following: wrinkle removal and/or reduction, fabric strengthening, fabric wear resistance and/or reduction, fabric pilling prevention and/or reduction, fabric color maintenance and/or fading reduction, color restoration, fabric soiling reduction, fabric shape retention, and/or fabric shrinkage reduction.

SUMMARY OF THE INVENTION

The present invention relates to fabric care compositions, fabric care methods, and articles of manufacture that contain such fabric care composition. The fabric care composition comprises:

(A) an effective amount of fabric care polysaccharide for providing a fabric with at least one of the following fabric care benefits: wrinkle removal, wrinkle reduction, wrinkle resistance, fabric wear reduction, fabric wear resistance, fabric pilling reduction, fabric color maintenance, fabric color restoration, fabric color fading reduction, fabric soiling reduction, fabric soil release, fabric shape retention, and/or fabric shrinkage reduction, said fabric care polysaccharide comprises polysaccharides with globular structure and with molecular weight of from about 5,000 to about 500,000; branched versions of said polysaccharides; derivatised versions of said polysaccharides; substituted versions of said polysaccharides; and mixtures thereof;

(B) optionally, from about 0.01% to about 20%, by weight of the composition, of adjunct fabric care oligosaccharide, selected from the group consisting of oligosaccharides, oligosaccharide mixtures, substituted versions of said oligosaccharides and/or mixtures, derivatised versions of said oligosaccharides and/or mixtures, and mixtures thereof;

(C) optionally, to remove and/or reduce wrinkles, an effective amount of adjunct wrinkle control agent, preferably selected from the group consisting of fiber lubricant, fabric shape retention polymer, lithium salts, and mixtures thereof;

(D) optionally, to reduce surface tension, and/or to improve performance and formulatability, an effective amount of surfactant;

(E) optionally, an effective amount to absorb malodor, of odor control agent;

(F) optionally, an effective amount to provide olfactory effects of perfume;

(G) optionally, an effective amount, to kill, or reduce the growth of microbes, of antimicrobial active;

(H) optionally, an effective amount to provide improved antimicrobial action of aminocarboxylate chelator;

(I) optionally, an effective amount of antimicrobial preservative, in addition to, or in place of said antimicrobial active; and (J) optionally, an aqueous carrier; said composition optionally being essentially free of any material that would soil or stain fabric under usage conditions.

A preferred fabric care composition for treating fabric comprises an effective amount of said fabric care polysaccharide with a globular structure and is applied to fabric and/or an entire fabric garment via, e.g., dipping, soaking, misting and/or spraying processes followed by a drying step. The present invention also relates to the fabric care compositions incorporated into a spray dispenser and/or mist generator, to create an article of manufacture that can facilitate treatment of fabric articles and/or entire fabric garments and/or surfaces with said compositions containing fabric care polysaccharide with globular structure and other optional ingredients at a level that is effective, yet is not discernible when dried on the surfaces.

Also preferred are aqueous or solid, preferably powder, fabric care compositions for treating fabric in the rinse step, comprising an effective amount of fabric care polysaccharide with globular structure, and optionally, adjunct fabric care oligosaccharide, fabric softening actives, perfume, and mixtures thereof.

Other preferred aqueous liquid, or solid, preferably powder or granular, fabric care compositions to be used in the wash cycle comprises an effective amount of said fabric care polysaccharide with globular structure, and optionally, adjunct fabric care oligosaccharide, surfactants, builders, perfume, and mixtures thereof.

Also preferred are fabric care compositions for treating fabric in the drying step, comprising an effective amount of said fabric care polysaccharide with globular structure, and optionally, adjunct fabric care oligosaccharide, fabric softening actives, perfume, and mixtures thereof. The dryer-added fabric care composition is preferably provided as part of an article of manufacture in combination with a dispensing means such as a flexible substrate or a sprayer which effectively releases the fabric care composition in an automatic tumble clothes dryer.

The fabric care polysaccharides with globular structure can provide at least some fabric care benefits to all types of fabrics, including fabrics made of natural fibers, synthetic fibers, and mixtures thereof.

DETAILED DESCRIPTION OF THE INVENTION

The present invention relates to solid or stable, preferably translucent, more preferably clear, aqueous fabric care compositions, fabric care methods, and articles of manufacture that use such fabric care composition. It also relates to the use of fabric care polysaccharide in a fabric care composition for providing a fabric with at least one of the following fabric care benefits: wrinkle removal, wrinkle reduction, wrinkle resistance, fabric wear reduction, fabric wear resistance, fabric pilling reduction, fabric color maintenance, fabric color fading reduction, fabric color restoration, fabric soiling reduction, fabric soil release, fabric shape retention, and/or fabric shrinkage reduction, said fabric care polysaccharide comprising polysaccharides with globular structure and with molecular weight of from about 5,000 to about 500,000; branched versions of said polysaccharides; derivatised versions of said polysaccharides; substituted versions of said polysaccharides; and mixtures thereof.

Said polysaccharides are preferably selected from the group consisting of arabinogalactan, pachyman, curdlan, callose, paramylon, sceleroglucan, lentinan, lichenan, laminarin, szhizophyllan, grifolan, *sclerotinia sclerotiorum* glucan (SSG), Ompharia lapidescence glucan (OL-2), pustulan, dextran, pullulan and mixtures thereof, branched versions thereof, substituted versions thereof, derivatised versions thereof, and mixtures thereof. One class of preferred fabric care polysaccharides are those having 1,3-β-linked backbone, such as, arabinogalactan, pachyman, curdlan, callose, paramylon, sceleroglucan, lentinan, lichenan, laminarin, szhizophyllan, grifolan, *sclerotinia sclerotiorum* glucan (SSG), Ompharia lapidescence glucan (OL-2), , and mixtures thereof, branched versions thereof, substituted versions thereof, derivatised versions thereof, and mixtures thereof, more preferably arabinogalactan, its derivatised versions, its substituted versions, and mixtures thereof, typically from about 0.001% to about 20%, preferably from about 0.01% to about 10%, more preferably from about 0.1% to about 5%, and even more preferably from about 0.1% to about 2%, by weight of the composition.

Generally, depending on the method of application, the fabric care compositions of the present invention can be in solid (powder, granules, bars, tablets), dimple tablets, liquid, paste, gel, spray, stick or foam forms.

A preferred fabric care composition for treating fabric comprises an effective amount of said fabric care polysaccharides with globular structure, and, optionally, one, or more ingredients selected from the group consisting of: adjunct fabric care oligosaccharides, perfume, fiber lubricant, fabric shape retention polymer, lithium salt, hydrophilic plasticizer, odor control agent including cyclodextrin, antimicrobial active and/or preservative, surfactant, fabric softening active, static control agent, enzymes, antioxidant, chelating agent, e.g., aminocarboxylate chelating agent, heavy metal chelating agent, dye transfer inhibiting agent, dye fixative agent, soil release agent, colorant, suds suppressor, insect repelling agent and/or moth repelling agent, and mixtures thereof. The composition is typically applied to fabric and/or an entire fabric garment via a, e.g., dipping, soaking, misting and/or spraying process, followed by a drying step, including the process comprising a step of treating and/or spraying and/or misting the fabric and/or entire fabric garment with the fabric care composition either outside or inside an automatic clothes dryer followed by, or concurrently with, the drying step in said clothes dryer. The application can be done industrially by large scale processes on textiles and/or finished garments and clothing, or in a consumer's home by the use of commercial product.

The fabric care composition of present invention can also be applied directly on an entire garment via an applicator, preferably a spray mechanism and/or mist mechanism. When applying the fabric care composition of the present invention to an entire garment, it is desirable that the spraying and/or misting of the entire garment occurs in a manner such that excessive amounts of the fabric/garment care composition are prevented from being released to the open environment. For example, the spraying and/or misting of the entire garment can occur within a bag or other article suitable for containing the garment.

The present invention also relates to concentrated liquid or solid fabric care compositions, which are diluted to form compositions with the usage concentrations, as given hereinabove and/or hereinbelow, for use in the "usage conditions". Concentrated compositions for use in the laundry process such as pre-wash treatment compositions, wash-added compositions, and rinse-added compositions, comprise a higher level of fabric care polysaccharide with globular structure, typically from about 1% to about 99%, preferably from about 2% to about 65%, more preferably from about 3% to about 25%, by weight of the concentrated fabric care composition. Concentrated compositions for use to apply directly to fabric and/or entire garment, such as in the spraying process and/or misting process and/or dipping/soaking process, comprise a lower level; of fabric care polysaccharide with globular structure, typically from about 1% to about 40%, preferably from about 1% to about 25%, more preferably from about 2% to about 15%, by weight of the concentrated fabric care composition. The concentrated compositions optionally comprise at least one ingredient selected from the group consisting of: perfume, fiber lubricant, shape retention polymer, lithium salt, odor control agent including cyclodextrin, hydrophilic plasticizer, surfactant, antimicrobial active and/or antibacterial preservative, aminocarboxylate chelating agent, fabric softening active, static control agent, enzyme, antioxidant, suds suppressor, dye transfer inhibiting agent, dye fixing agent, insect repelling agent including moth repelling agent, and/or liquid carrier, and mixtures thereof. Concentrated compositions are used in order to provide a less expensive product per use. When a concentrated product is used, i.e., when the fabric care polysaccharide with globular structure is from about 1% to about 99%, by weight of the concentrated composition, it is preferable to dilute the composition before treating fabric. Preferably, the concentrated fabric care is diluted with about 50% to about 10,000%, more preferably from about 50% to about 8,000%, and even more preferably from about 50% to about 5,000%, by weight of the composition, of water. Depending on the target fabric care benefit to be provided, the concentrated compositions should also comprise proportionally higher levels of the desired optional ingredients to be diluted to be the usage compositions.

The present invention also relates to aqueous fabric care compositions incorporated into a spray dispenser and/or mist generator to create an article of manufacture that can facilitate treatment of fabric articles and/or entire fabric garments and/or surfaces with said compositions containing said fabric care polysaccharide with globular structure and other optional ingredients at a level that is effective, yet is not discernible when dried on the surfaces. The spray dispenser comprises manually activated and non-manual powered (operated) spray means and a container containing the fabric care composition. The articles of manufacture preferably are in association with instructions for use to direct the consumer to apply at least an effective amount of the fabric care composition and/or fabric care polysaccharide with globular structure to the fabric to provide the desired benefit.

The present invention also relates to an article of manufacture comprising the above aqueous fabric care compositions, to be applied directly via an applicator, preferably a spray mechanism and/or mist mechanism, more preferably via misting mechanism, on said fabric and/or entire garment in a manner such that excessive amounts of the fabric/garment care composition are prevented from being released to the open environment, preferably in association with instructions for use which direct the consumer to apply at least an effective amount of said fabric care polysaccharide with globular structure and/or said composition to said fabric and/or entire garment is this manner.

The compositions of the present invention can also be used as ironing aids. An effective amount of the composition can be sprayed onto fabric and the fabric is ironed at the normal temperature at which it should be ironed. The fabric can either be sprayed with an effective amount of the composition, allowed to dry and then ironed, or sprayed and ironed immediately. The fabric care polysaccharides of the current invention have a molecular weight range that is high enough so that they are easily damaged by the hot temperature of the ironing process, as is the case of lower molecular weight oligosaccharides and monosaccharides.

Also preferred is a liquid, preferably aqueous, or solid, preferably powder, fabric care composition for treating fabric in the rinse step, comprising an effective amount of said fabric care polysaccharide with globular structure, typically from about 0.05% to about 50%, preferably from about 1% to about 35%, more preferably from about 2% to about 18%, and even more preferably from about 3% to about 10%, by weight of the fabric care composition. The fabric care composition optionally comprises of: adjunct fabric care oligosaccharide, fabric softening active, perfume, electrolyte, chlorine scavenging agent, dye transfer inhibiting agent, dye fixing agent, phase stabilizer, chemical stabilizer including antioxidant, silicone, antimicrobial actives and/or preservative, chelating agent including aminocarboxylate chelating agent, colorant, enzyme, brightener, soil release agent, or mixtures thereof. Said composition is preferably packaged into an article of manufacture in association with instructions for use to ensure that the consumer knows what benefits can be achieved, and how best to obtain these benefits. The present invention also relates to concentrated liquid or solid compositions, which are diluted to form rinse-added fabric care compositions with the usage concentrations, as given hereinabove, for use in the "usage conditions".

Another preferred aqueous or solid, preferably powder or granular, fabric care composition of this invention to be used in the wash cycle comprises an effective amount of said fabric care polysaccharide with globular structure, and optionally, adjunct fabric care oligosaccharide, surfactants, builder, perfume, chlorine scavenging agent, dye transfer inhibiting agent, dye fixing agent, dispersant, detergent enzyme, heavy metal chelating agent, suds suppressor, fabric softening active, chemical stabilizers including antioxidant, silicone, antimicrobial active and/or preservative, soil suspending agent, soil release agent, optical brightener, colorant, and the like, or mixtures thereof. Other wash-added fabric care compositions can be in the form of tablets, bar, paste, gel, spray, stick, foam, and can optionally be contained in a pouch or attached to a releasable substrate. These wash-added compositions which can be wash additive compositions or detergent compositions are preferably packaged into an article of manufacture in association with instructions for use to ensure that the consumer knows what benefits can be achieved, and how best to obtain these benefits.

Also preferred are fabric care compositions for treating fabric in the drying step, comprising an effective amount of said fabric care polysaccharide with globular structure, and optionally, adjunct fabric care oligosaccharides, fabric softening actives, distributing agent, perfume, fiber lubricants, fabric shape retention polymers, lithium salts, phase stabilizers, chlorine scavenging agents, dye transfer inhibiting agents, dye fixing agents, chemical stabilizers including antioxidants, silicones, antimicrobial actives and/or preservatives, heavy metal chelating agents, aminocarboxylate chelating agents, enzymes, brighteners, soil release agents, and mixtures thereof. The fabric care composition can take a variety of physical forms including liquid, foams, gel and solid forms such as solid particulate forms. However, in the preferred substrate product embodiment, the dryer-added fabric care composition of the present invention is provided as part of an article of manufacture in combination with a dispensing means such as a flexible substrate which effectively releases the fabric care composition in an automatic tumble clothes dryer. Such dispensing means can be designed for single usage or for multiple uses. Preferably the composition is applied onto a sheet substrate to form a dryer sheet product. The substrates in such products are typically non-woven fabric substrates, paper, foams, etc. Typical and preferred dispensing means are described in U.S. Pat. No. 5,102,564, issued Apr. 7, 1992 to Gardlik et al., incorporated herein by reference. Since the characteristics of the fabric care polysaccharides with globular structure and other optional ingredients that provide the various fabric care benefits can be different and interfering, it can be desirable to provide some of the fabric care compositions as one, or more, separate compositions, e.g., as separate areas on a substrate, as disclosed hereinafter. Said composition is preferably packaged with or without a dispensing means into an article of manufacture in association with instructions for use to ensure that the consumer knows what benefits can be achieved. Another preferred dispensing means is a sprayer which dispense the liquid fabric care composition at the beginning and/or during the drying cycle.

The present invention also relates to fabric care compositions for dipping and/or soaking pre-wash treatment containing an effective amount of fabric care polysaccharide with globular structure, and optionally, adjunct fabric care oligosaccharide, surfactants, builders, perfume, chlorine scavenging agents, dye transfer inhibiting agents, dye fixing agents, dispersants, detergent enzymes, heavy metal chelating agents, fabric softening actives, chemical stabilizers including antioxidants, silicones, antimicrobial actives and/or preservatives, soil suspending agents, soil release agents, optical brighteners, colorants, and the like, or mixtures thereof. Said composition is preferably packaged in association with instructions for use to ensure that the consumer knows what benefits can be achieved, and how best to obtain these benefits. The present invention also relates to concentrated liquid or solid compositions, which are diluted to form pre-wash fabric care compositions with the usage concentrations, for use in the "usage conditions".

The present invention also relates to fabric care methods and articles of manufacture that use such fabric care compositions. Thus the present invention relates to the compositions incorporated into a spray dispenser to create an article of manufacture that can facilitate treatment of fabric surfaces with said fabric care compositions containing a fabric care polysaccharide with globular structure and other optional ingredients at a level that is effective, yet is not discernible when dried on the surfaces. The spray dispenser comprises manually activated and non-manual powered spray means and a container containing the fabric care composition. Alternatively, the article of manufacture can comprise a fabric care composition and a dispensing means to distribute said composition onto the fabrics in a automatic tumble clothes dryer. Preferably the dispensing means is a flexible substrate, e.g., in sheet configuration with the fabric care composition releasably affixed onto the substrate. For wash-added and rinse-added methods, the article of manufacture can simply comprise a liquid or granular solid fabric care composition and a suitable container.

Preferably the articles of manufacture are in association with instructions for how to use the composition to treat fabrics correctly, to obtain the desirable fabric care results, viz, wrinkle removal and/or reduction, wrinkle resistance, fiber strengthening/anti-wear, fabric wear reduction, fabric shrinkage prevention and/or reduction, fabric pill prevention and/or reduction, shrinkage prevention and/or reduction, fabric color maintenance, fabric color restoration, fabric color fading reduction, soiling prevention and/or reduction, soil release, and/or fabric shape retention, and mixtures thereof, including, e.g., the manner and/or amount of composition to used, and the preferred ways of stretching and/or smoothing of the fabrics. It is important that the instructions be as simple and clear as possible, so that using pictures and/or icons is desirable.

I. Composition

Fabric Care Polysaccharides

Suitable fabric care polysaccharides for use in the fabric care composition of the present invention are those which have a globular conformation in dilute aqueous solution, via a random coiling structure. Said polysaccharides include homo- and/or hetero-polysaccharides with simple helical structure with or without branching, e.g., with 1,4-α-linked backbone structure (e.g., 1,4-α-glucan, 1,4-α-xylan) with or without branching, 1,3-β-linked backbone with or without branching (e.g., galactan), and all 1,6-linked backbones with or without branching (e.g., dextran, pullulan, pustulan), and with a weight-average molecular weight of from about 5,000 to about 500,000, preferably from about 8,000 to about 250,000, more preferably from about 10,000 to about 150,000, typically with sizes ranging from about 2 nm to about 300 nm, preferably from about 3 nm to about 100 nm, more preferably from about 4 nm to about 30 nm. The size is defined as the gyration length occupied by the molecule in dilute aqueous solutions.

Preferably the fabric care polysaccharide is selected from the group consisting of arabinogalactan, pachyman, curdlan, callose, paramylon, sceleroglucan, lentinan, lichenan, laminarin, szhizophyllan, grifolan, *sclerotinia sclerotiorum* glucan (SSG), Ompharia lapidescence glucan (OL-2), pustulan, dextran, pullulan, substituted versions thereof, derivatised versions thereof, and mixtures thereof. More preferably the fabric care polysaccharide is selected from the group consisting of arabinogalactan, dextran, curdlan, substituted versions thereof, derivatised versions thereof, and mixtures thereof, and even more preferably the fabric care polysaccharide comprises arabinogalactan, substituted versions thereof, derivatised versions thereof, and mixtures thereof. Substituted and/or derivatised materials of the fabric care polysaccharides listed hereinabove are also preferred in the present invention. Nonlimiting examples of these materials include: carboxyl and hydroxymethyl substitutions (e.g., some uronic acid instead of neutral sugar units); amino polysaccharides (amine substitution); cationic quaternized polysaccharides; $C_1$–$C_{18}$ alkylated polysaccharides; acetylated polysaccharide ethers; polysaccharides having amino acid residues attached (small fragments of glycoprotein); polysaccharides containing silicone moieties, and the like. Some hydrophobic derivatives of the polysaccharides help the polysaccharides maintaining the globular conformation.

A preferred class of fabric care polysaccharides suitable for use in the present invention include those that have the backbone comprising at least some, but preferably almost entirely of 1,3-β-glycosidic linkages, preferably branched, preferably with either side chains attached with 1,6-linkages or derivatised for better water solubility and/or to maintain the globular structure. The 1,6-linked branched polysaccharides with 1,3-β-linked backbone have higher water solubility and/or dispersibility than the non-branched polysaccharides, so that branched polysaccharides can be used at higher molecular weight ranges. Inserting other types of linkages, such as some 1,4-β-linkages in the 1,3-β-linked backbone also improves the solubility of the polysaccharides. Nonlimiting examples of useful fabric care polysaccharides with 1,3-β-linked backbone include arabinogalactan, pachyman, curdlan, callose, paramylon, sceleroglucan, lentinan, lichenan, laminarin, szhizophyllan, grifolan, *sclerotinia sclerotiorum* glucan (SSG), Ompharia lapidescence glucan (OL-2), and mixtures thereof. Low molecular weight materials are preferred for polysaccharides with less or no branching, such as curdlan, while higher molecular weight materials for highly branched polysaccharides, such as arabinogalactan, can be used. Higher molecular weight polysaccharides with mixed 1,3-β and 1,4-β, linkages, such as lichenan, can also be used.

A preferred fabric care branched polysaccharide with 1,3-β-linked backbone is arabinogalactan (also named as galactoarabinan or epsilon-galactan). Arabinogalactans are long, densely branched high-molecular weight polysaccharides. Arabinogalactan that is useful in the composition of the present invention has a molecular weight range of from about 5,000 to about 500,000, preferably from about 6,000 to about 250,000, more preferably from about 10,000 to about 150,000. These polysaccharides are highly branched, consisting of a galactan backbone with side-chains of galactose and arabinose units (consisting of β-galactopyranose, β-arabinofuranose, and β-arabinopyranose). The major source of arabinogalactan is the larch tree. The genus *Larix* (larches) is common throughout the world. Two main sources of larch trees are western larch (*Larix occidentalis*) in Western North America and Mongolian larch (*Larix dahurica*). Examples of other larches are eastern larch (*Larix laricina*) in eastern North America, European larch (*Larix dicidua*), Japanese larch (*Larix leptolepis*), and Siberian larch (*Larix siberica*). Most commercial arabinogalactan is produced from western larch, through a counter-current extraction process. Larch arabinogalactan is water soluble and is composed of arabinose and galactose units in about a 1:6 ratio, with a trace of uronic acid. Glycosyl linkage analysis of larch arabinogalactan is consistent with a highly branched structure comprising a backbone of 1,3-β-linked galactopyranose connected by 1,3-β-glycosidic linkages, comprised of 3,4,6-, 3,6-, and 3,4- as well as 3-linked residues. The molecular weights of the preferred fractions of larch arabinogalactan include one fraction in the range of from about 14,000 to about 22,000, mainly from about 16,000 to about 21,000, and the other in the range of from about 60,000 to about 500,000, mainly from about 80,000 to about 120,000. The fraction that has the average molecular weight of from about 16,000 to about 20,000 is highly preferred for use in direct applications to fabric, such as in spray-on products. The high molecular weight fraction (of about 100,000 molecular weight), as well as the low molecular weight fraction are suitable for use in processes that involve subsequent water treatments, such as, pre-soak, wash-added and/or rinse-added laundry processes and products. High grade larch arabinogalactan is composed of greater than about 98% arabinogalactan. Larch arabinogalactan and some of its derivatives, such as cationic derivatives are commercially available from Larex, Inc., St Paul, Minn.

Arabinogalactans are also present as minor, water-soluble components of softwoods such as hemlock, black spruce, parana pine, mugo pine, Douglas fir, incense cedar, juniper, and the sapwood of sugar maple. Many edible and inedible plants are also rich sources of arabinogalactans, mostly in glycoprotein form, bound to a protein spine of either threonine, proline, or serine ("arabinogalactan-protein"). These plants include leek seeds, carrots, radish, black gram beans, pear, maize, wheat, red wine, Italian ryegrass, tomatoes, ragweed, sorghum, bamboo grass, and coconut meat and milk. Many herbs with well established immune-enhancing properties, such as *Echinacea purpurea, Baptisia tintoria, Thuja occidentalis, Angelica acutiloba*, and *Curcuma longa* contain significant amounts of arabinogalactans. Small quantities of arabinogalactans also occur in other plants, such as, green coffee bean (sugar ratio about 2:5), centrosema seeds (sugar ratio about 1:13), and wheat flour (sugar ratio about 7:3). About 70% of the water solubles from soybean flour is an arabinogalactan with a sugar ratio of about 1:2.

Examples of other fabric care polysaccharides that have 1,3-β-linkage as a part of the backbone include: 1,3-β-xylan (from, e.g., *Pencillus dumetosus*), curdlen, a 1,3-β-glucan (from e.g., *Alcaligenes faecalis*), paramylon B, a 1,3-β-glucan (from, e.g., *Euglena gracilis*), lichenin, a (1,3),(1,4)-β-glucan (from various sources including *Cetraria islandica*), sceleroglucan, a (1,3),(1,6)-β-glucan (from, e.g., *Sclerotium rolfii*), and lentinen, a (1,3),(1,6)-β-glucan (from, e.g., *Lentinus edodes*). More details about these and other polysaccharides with 1,3-β-linked backbone are given in "Chemistry and Biology of (1→3)-β-Glucans", B. A. Stone and A. E. Clarke, La Trobe University Press, Victoria, Australia, 1992, pp. 68–71, and 82–83, incorporated herein by reference.

Substituted and/or derivatised materials of arabinogalactans are also preferred in the present invention. Nonlimiting examples of these materials include: carboxyl and hydroxymethyl substitutions (e.g., some uronic acid instead of neutral sugar units); amino polysaccharides (amine substitution); cationic quaternized polysaccharides; $C_1$–$C_{18}$ alkylated polysaccharides; acetylated polysaccharide ethers; polysaccharides having amino acid residues attached (small fragments of glycoprotein); polysaccharides containing silicone moieties. These substituted and/or derivatised polysaccharides can provide additional benefits, such as: amine substitution can bind and/or condense with oxidatively damaged regions of the fiber to rejuvenate aged fabrics; acetylated sugar ethers can serve as bleach activators in subsequent processes where hydrogen peroxide is present; polysaccharides having amino acid residues can improve delivery of fabric care benefits for fabrics containing proteinaceous fibers, e.g., wool and silk; and silicone-derivatised polysaccharides can provide additional fabric softness and lubricity. Examples of derivatised arabinogalactan include the 3-chloro-2-hydroxypropyltrimethyl ammonium chloride derivative, available from Larex, Inc and the arabinogalactan-proteins given hereinabove.

The 1,3-β-linked backbone of the fabric care polysaccharides of the present invention (as in 1,3-β-galactans, 1,3-β-D-mannans, 1,3-β-D-xylans and 1,3-β-D-glucans) has a pseudohelical conformation. As such, these polysaccharides have a backbone chain that is flexible and in aqueous solution, has a tendency to coil into a globular structure to substantially reduce their apparent dimension (gyration volume), as opposed to the backbone chain of 1,4-β-glucan which has an extended dimension. The polysaccharides with 1,3-β-linked backbone and extensive branching via 1,6-linkages, or polysaccharides with helical confirmation or polysaccharides with 1,6-linked backbone have added flexibility due to the "coiling" nature of the 1,6-linkages. In water these polysaccharides with 1,3-β-linked backbone and 1,6-branching, e.g., arabinogalactans, have a globular conformation with high flexibility to coil into compact, flexible and deformable microscopic particles. For example, an arabinogalactan having a nominal molecular weight of about 18,000 has a size (gyration length) of only from 5 nm to about 10 nm in dilute aqueous solutions. This structural feature of the globular polysaccharides with helical conformation and random coiling nature improves physical properties such as water-solubility, low viscosity and emulsification. It is believed that the globular, compact and flexible structural property and low viscosity of the fabric care polysaccharides with 1,3-β-linked backbone of the present invention, such as arabinogalactans, is important for providing the fabric care benefits, either via efficient deposition of the polysaccharide globules on the rough fabric surface or via appropriate fitting/filling of these globules in the openings and/or defective spaces on the fabric fiber surface, where they can orient itself to conform to the space available. Furthermore, it is believed that at low levels, these low molecular weight (about 10,000 to about 150,000) polysaccharide globules of the present invention can very effectively bond fibers and/or microfibrils together by "spot bonding". This way, the fabric care polysaccharide globules can provide many desired benefits such as: fabric strengthening, fabric wear resistance and/or reduction, wrinkle removal and/or reduction, fabric pilling prevention and/or reduction, fabric color maintenance and/or fading reduction, color restoration, fabric soiling reduction, fabric shape retention, fabric shrinkage reduction, and/or improving fabric feel/smoothness, scratchiness reduction, for different types of fabrics such as cellulosic (cotton, rayon, etc.), wool, silk, and the like.

Polysaccharides with helical conformation, but not within the range of the molecular weight range specified above have different physical properties such as low solubility and gelling characteristics (e.g., starch, a high molecular weight 1,4-α-D-glucan).

The fabric care polysaccharides with globular structure of the present invention can provide at least some fabric care benefits to all types of fabrics, including fabrics made of natural fibers, synthetic fibers, and mixtures thereof. Nonlimiting examples of fabric types that can be treated with the fabric care compositions of the present invention, to obtain fabric care benefits include fabrics made of (1) cellulosic fibers such as cotton, rayon, linen, Tencel, (2) proteinaceous fibers such as silk, wool and related mammalian fibers, (3) synthetic fibers such as polyester, acrylic, nylon, and the like, (4) long vegetable fibers from jute, flax, ramie, coir, kapok, sisal, henequen, abaca, hemp and sunn, and (5) mixtures thereof. Other unanimated substrates and/or surfaces made with natural fibers and/or synthetic fibers, and/or materials, such as non-woven fabrics, paddings, carpets, paper, disposable products, films, foams, can also be treated with the fabric care polysaccharides with 1,3-β-linked backbone to improve their properties.

For specific applications, the composition can contain from about 0.001% to about 20% of fabric care polysaccharide with globular structure, preferably from about 0.01% to about 10%, more preferably from about 0.1% to about 5%, by weight of the usage composition. The present invention also relates to concentrated liquid or solid compositions, which are diluted to form compositions with the usage concentrations, for use in the "usage conditions". Concentrated compositions comprise a higher level of fabric care polysaccharide, typically from about 1% to about 99%, preferably from about 2% to about 65%, more preferably from about 3% to about 40%, by weight of the concentrated fabric care composition. Depending on the target fabric care benefit to be provided, the concentrated compositions should also comprise proportionally higher levels of the desired optional ingredients.

Typical composition to be dispensed from a sprayer contains a level of fabric care polysaccharide with globular structure of from about 0.01% to about 5%, preferably from about 0.05% to about 2%, more preferably from about 0.1% to about 1%, by weight of the usage composition. Typical usage compositions for a direct dipping and/or soaking treatment followed by a drying step, contain a level of fabric care polysaccharide of from about 0.001% to about 2%, preferably from about 0.05% to about 1%, more preferably from about 0.1% to about 0.5%, by weight of the usage composition. It is also common and practical to provide a more concentrated composition containing typically from about 0.5% to about 40%, preferably from about 1% to about 25%, more preferably from about 2% to about 15%, by weight of the concentrated composition, of fabric care polysaccharide with globular structure, to be diluted down in use to obtain the desirable usage dipping or soaking composition. Depending on the target fabric care benefit to be provided, the concentrated compositions should also comprise proportionally higher levels of the desired optional ingredients. A concentrated composition can also be used, and is provided, e.g., as a refill, to prepare usage composition for the spray product.

Wash-added compositions, including liquid and granular detergent compositions and wash additive compositions typically contain a level of fabric care polysaccharide with globular structure of from about 0.2% to about 30%, preferably from about 1% to about 20%, more preferably from about 2% to about 10%, by weight of the wash-added compositions.

Typical rinse-added compositions, including liquid fabric conditioner and other rinse additive compositions, contain a level of fabric care polysaccharide with globular structure of from about 0.3% to about 40%, preferably from about 1% to about 25%, more preferably from about 2% to about 15%, by weight of the rinse-added compositions.

Typical usage compositions for a dipping and/or soaking pre-wash treatment and/or for use as a wash-cycle additive contain a level of fabric care polysaccharide with globular structure of from about 0.05% to about 40%, preferably from about 0.1% to about 20%, more preferably from about 0.5% to about 10%, by weight of the usage composition. More concentrated compositions comprise a higher level of fabric care polysaccharide, typically from about 1% to about 99%, preferably from about 2% to about 65%, more preferably from about 3% to about 40%, by weight of the concentrated fabric care composition. Depending on the target fabric care benefit to be provided, the concentrated compositions should also comprise proportionally higher levels of the desired optional ingredients.

Dryer-added compositions typically contain a level of fabric care polysaccharide with globular structure of from about 0.01% to about 40% by weight of the dryer-added compositions.

Adjunct Fabric Care Oligosaccharides

An optional but preferred adjunct fabric care agent in the present invention is selected from the group consisting of oligosaccharides, especially mixtures of oligosaccharides, especially, isomaltooligosaccharides (IMO) (including mixtures), the individual components of said mixtures, substituted versions thereof, derivatised versions thereof, and mixtures thereof. The adjunct fabric fabric care oligosaccharides help to provide some fabric benefits, such as wrinkle removal and/or reduction, anti-pilling, anti-wear, fabric color maintenance, and overall appearance benefits, especially to cellulosic fibers/fabrics, such as cotton, rayon, ramie, jute, flax, linen, polynosic-fibers, Lyocell (Tencel®), polyester/cotton blends, other cotton blends, and the like, especially cotton, rayon, linen, polyester/cotton blends, and mixtures thereof.

Suitable adjunct fabric care oligosaccharides that are useful in the present invention include oligosaccharides with a degree of polymerization (DP) of from about 1 to about 15, preferably from about 2 to about 10, and wherein each monomer is selected from the group consisting of reducing saccharide containing 5 and/or 6 carbon atoms, including isomaltose, isomaltotriose, isomaltotetraose, isomaltooligosaccharide, fructooligosaccharide, levooligosaccharides, galactooligosaccharide, xylooligosaccharide, gentiooligosaccharides, disaccharides, glucose, fructose, galactose, xylose, mannose, arabinose, rhamnose, maltose, sucrose, lactose, maltulose, ribose, lyxose, allose, altrose, gulose, idose, talose, trehalose, nigerose, kojibiose, lactulose, oligosaccharides, maltooligosaccharides, trisaccharides, tetrasaccharides, pentasaccharides, hexasaccharides, oligosaccharides from partial hydrolysates of natural polysaccharide sources, and the like, and mixtures thereof, preferably mixtures of isomaltooligosaccharides, especially mixtures including isomaltooligosaccharides, comprising from about 3 to about 7 units of glucose, respectively, and which are linked by 1,2-α, 1,3-α, 1,4-α- and 1,6-α-linkages, and mixtures of these linkages. Oligosaccharides containing β-linkages are also preferred. Preferred oligosaccharides are acyclic and have at least one linkage that is not an α-1,4-glycosidic bond. A preferred oligosaccharide is a mixture containing IMO: from 0 to about 20% by weight of glucose, from about 10 to about 65% of isomaltose, from about 1% to about 45% of each of isomaltotriose, isomaltetraose and isomaltopentaose, from 0 to about 3% of each of isomaltohexaose, isomaltoheptaose, isomaltooctaose and isomaltononaose, from about 0.2% to about 15% of each of isomaltohexaose and isomaltoheptaose, and from 0 to about 50% by weight of said mixture being isomaltooligosaccharides of 2 to 7 glucose units and from 0 to about 10% by weight of said mixture being isomaltooligosaccharides of about 7 to about 10 glucose units. Other nonlimiting examples of preferred acyclic oligosaccharides, with approximate content by weight percent, are:

Isomaltooligosaccharide Mixture I

| Isomaltooligosaccharide Mixture I | |
|---|---|
| Trisaccharides (maltotriose, panose, isomaltotriose) | 40–65% |
| Disaccharides (maltose, isomaltose) | 5–15% |
| Monosaccharide (glucose) | 0–20% |
| Higher branched sugars (4 < DP < 10) | 10–30% |
| Isomaltooligosaccharide Mixture II | |
| Trisaccharides (maltotriose, panose, isomaltotriose) | 10–25% |
| Disaccharides (maltose, isomaltose) | 10–55% |
| Monosaccharide (glucose) | 10–20% |
| Higher branched sugars (4 < DP < 10) | 5–10% |
| Isomaltooligosaccharide Mixture III | |
| Tetrasaccharides (stachyose) | 10–40% |
| Trisaccharides (raffinose) | 0–10% |
| Disaccharides (sucrose, trehalose) | 10–50% |
| Monosaccharide (glucose, fructose) | 0–10% |
| Other higher branched sugars (4 < DP < 10) | 0–5% |

Oligosaccharide mixtures are either prepared by enzymatic reactions or separated as natural products from plant materials. The enzymatic synthesis of oligosaccharides involves either adding monosaccharides, one at a time, to a di- or higher saccharide to produce branched oligosaccharides, or it can involve the degradation of polysaccharides followed by transfer of saccharides to branching positions. For instance, Oligosaccharide Mixtures I and II are prepared by enzymatic hydrolysis of starch to maltooligosaccharides, which are then converted to isomaltooligosaccharides by a transglucosidase reaction. Oligosaccharide Mixture III, for example, is a mixture of oligosaccharides isolated from soybean. Soybean oligosaccharides such as Mixture III, are of pure natural origin.

Cyclic oligosaccharides can also be useful in the fabric care composition of the present invention. Preferred cyclic oligosaccharides include α-cyclodextrin, β-cyclodextrin, γ-cyclodextrin, their branched derivatives such as glucosyl-α-cyclodextrin, diglucosyl-α-cyclodextrin, maltosyl-α-cyclodextrin, glucosyl-β-cyclodextrin, diglucosyl-β-cyclodextrin, and mixtures thereof. The cyclodextrins also provide an optional but very important benefit of odor control, and are disclosed more fully hereinbelow.

Substituted and/or derivatised materials of the oligosaccharides listed hereinabove are also preferred in the present invention. Nonlimiting examples of these materials include: carboxyl and hydroxymethyl substitutions (e.g., glucuronic acid instead of glucose); amino oligosaccharides (amine substitution, e.g., glucosamine instead of glucose); cationic quaternized oligosaccharides; $C_1$–$C_6$ alkylated oligosaccharides; acetylated oligosaccharide ethers; oligosaccharides having amino acid residues attached (small fragments of glycoprotein); oligosaccharides containing silicone moieties. These substituted and/or derivatised oligosaccharides can provide additional benefits, such as: carboxyl and hydroxymethyl substitutions can introduce readily oxidizable materials on and in the fiber, thus reducing the probability of the fiber itself being oxidized by oxidants, such as bleaches; amine substitution can bind and/or condense with oxidatively damaged regions of the fiber to rejuvenate aged fabrics; acetylated sugar ethers can serve as bleach activators in subsequent processes where hydrogen peroxide is present; oligosaccharides having amino acid residues can improve delivery of fabric care benefits for fabrics containing proteinaceous fibers, e.g., wool and silk; and silicone-derivatised oligosaccharides can provide additional fabric softness and lubricity. $C_6$ alkyl oligosaccharide is disclosed (along with other higher, viz., $C_6$–$C_{30}$, alkyl polysaccharides) in U.S. Pat. No. 4,565,647, issued Jan. 21, 1986 to Llenado, for use as foaming agent in foaming compositions such as laundry detergents, personal and hair cleaning compositions, and fire fighting compositions. The $C_6$ alkyl oligosaccharide is a poor surfactant and not preferred for use as surfactant in the detergent compositions of the present invention, but preferably can be used to provide the fabric care benefits that are not known, appreciated and/or disclosed in U.S. Pat. No. 4,565,647. U.S. Pat. No. 4,488,981, issued Dec. 18, 1984 discloses the use of some $C_1$–$C_6$ alkylated oligosaccharides (lower alkyl glycosides) in aqueous liquid detergents to reduce their viscosity and to prevent phase separation. $C_1$–$C_6$ alkylated oligosaccharides are not preferred for use as viscosity and phase modifiers in the liquid detergent compositions of the present invention, but can be used to provide the fabric care benefits that are not known, appreciated and/or disclosed in U.S. Pat. No. 4,488,981. These patents are incorporated herein by reference.

It is believed that the fabric care oligosaccharide is adsorbed and binds with cellulosic fabrics to improve the properties of the fabrics. It is believed that the fabric care oligosaccharide is bound to the cellulosic fibers, diffuses in and fills the defect sites (the amorphous region) of the fiber, to provide the above dewrinkling, increased strength and improved appearance benefits. The extent of the amorphous, non-crystalline region varies with cellulosic fiber types, e.g., the relative crystallinity of cotton is about 70. % and for regenerated cellulose, such as, rayon it is about 30. %, as reported by P. H. Hermans and A. Weidinger, "X-ray studies on the crystallinity of cellulose" in the *Journal of Polymer Science*, Vol IV, p135–144, 1949. It is believed that the amorphous regions are accessible for chemical and physical modifications, and that in the durable press treatment, the amorphous regions are filled with molecules that can crosslink cellulose polymers by covalent bonds, to deliver wrinkle-free benefits (cf. S. P. Rawland, in "Modified Cellulosics," R. M. Rowell and R. A. Young, Eds., Academic Press, New York, 1978, pp. 147–167, cited by G. C. Tesoro, in 'Crosslinking of cellulosics', Handbook of Fiber Science and Technology, Vol. II, p. 6, edited by M. Lewin and S. B. Sello, published by Marcel Dekker, 1983. These publications are incorporated herein by reference.

For specific applications, the composition can contain from about 0.001% to about 20% of the optional, but preferred oligosaccharide, preferably from about 0.01% to about 10%, more preferably from about 0.1% to about 5%, by weight of the usage composition. The present invention also relates to concentrated liquid or solid compositions, which are diluted to form compositions with the usage concentrations, for use in the "usage conditions". Concentrated compositions comprise a higher level of the optional fabric care oligosaccharide, typically from about 1% to about 50%, preferably from about 2% to about 40%, more preferably from about 3% to about 20%, by weight of the concentrated fabric care composition.

Typical composition to be dispensed from a sprayer contains a level of optional fabric care oligosaccharide of from about 0.01% to about 3%, preferably from about 0.05% to about 2%, more preferably from about 0.1% to about 1%, by weight of the usage composition. Typical usage compositions for a direct dipping and/or soaking treatment followed by a fabric drying step, contain a level of optional fabric care oligosaccharide of from about 0.001% to about 2%, preferably from about 0.05% to about 1%, more preferably from about 0.1% to about 0.5%, by weight of the usage composition. It is also common and more practical to provide a more concentrated composition containing typically from about 1% to about 40%, preferably from about 1% to about 25%, more preferably from about 2% to about 15%, by weight of the concentrated composition, of the optional fabric care oligosaccharide, to be diluted down in use to obtain the desirable usage dipping or soaking compositions. A concentrated composition can also be used, and is provided, e.g., as a refill, to prepare usage composition for the spray product.

Wash-added compositions, including liquid and granular detergent compositions and wash additive compositions typically contain a level of optional fabric care oligosaccharide of from about 0.2% to about 30%, preferably from about 1% to about 20%, more preferably from about 2% to about 12%, by weight of the wash-added compositions. Typical rinse-added compositions, including liquid fabric conditioner and other rinse additive compositions, contain a level of optional fabric care oligosaccharide of from about 0.1% to about 50%, preferably from about 1% to about 35%, more preferably from about 2% to about 18%, and even more preferably from about 2% to about 10%, by weight of the rinse-added compositions.

Dryer-added compositions typically contain a level of optional fabric care oligosaccharide of from about 0.01% to about 40%, preferably from about 0.1% to about 20%, more preferably from about 1% to about 10%, by weight of the dryer-added compositions. Aqueous dryer-added compositions to be applied directly to the fabric, e.g., via a spraying mechanism, contain lower levels of fabric care polysaccharide, typically from about 0.01% to about 25%, preferably from about 0.1% to about 10%, more preferably from about 0.2% to about 5%, even more preferably from about 0.3% to about 3%, by weight of the compositions.

Both the fabric care polysaccharides and the optional fabric care oligosaccharides have a compact structure, but they have different sizes. The smaller oligosaccharides are believed to be able to diffuse and penetrate into small defective sites, such as the amorphous region of cotton fibers, while the larger polysaccharides can fill in larger openings and/or defective sites on the fabric fiber surface. Therefore depending on the fabric care benefit target, the fabric care polysaccharides can be used alone, or in mixtures with the optional fabric care oligosaccharides. When the optional fabric care oligosaccharides are present, the weight ratio between said oligosaccharides and the fabric care polysaccharides is typically from about 1:99 to about 99:1, preferably from about 15:85 to about 85:15, and more preferably from about 30:70 to about 70:30.

Nonlimiting examples of other optional ingredients are given hereinbelow.

Other Optional Ingredients

The fabric care compositions of the present invention can contain other optional ingredients either to improve the performance of the fabric care polysaccharide with globular structure, e.g., in the areas of wrinkle control, anti-wear, soil release, and the like, or to provide additional benefits, such as odor control, antimicrobial, and the like. Nonlimiting examples of optional ingredients are given hereinbelow.

Fiber Lubricants

The fabric care composition of the present invention can comprise optional fiber lubricants to impart a lubricating property, or increased gliding ability, to fibers in fabric, particularly clothing. Not to be bound by theory, it is believed that fiber lubricants facilitate the movement of fibers with respect to one another (glide) to release the fibers from the wrinkle condition in wet or damp fabrics. After the fabric is dried, the fiber lubricant, especially silicone, can provide lubricity to reduce the tendency of fabric to rewrinkle.

(a). Silicone

The present invention can use silicone, a preferred fiber lubricant, to impart a lubricating property, or increased gliding ability, to fibers in fabric, particularly clothing. Nonlimiting examples of useful silicones in the composition of the present invention include noncurable silicones such as polydimethylsilicone and volatile silicones, and curable silicones such as aminosilicones, phenylsilicones and hydroxysilicones. The word "silicone" as used herein preferably refers to emulsified silicones, including those that are commercially available and those that are emulsified in the composition, unless otherwise described. Preferably, the silicones are hydrophobic; are neither irritating, toxic, nor otherwise harmful when applied to fabric or when they come in contact with human skin; are chemically stable under normal use and storage conditions; and are capable of being deposited on fabric.

When the composition of this invention is to be dispensed from a spray dispenser in a consumer household setting, the noncurable silicones such as polydimethylsilicone, especially the volatile silicones, are preferred. Curable and/or reactive silicones such as amino-functional silicones and silicones with reactive groups such as Si—OH, Si—H, silanes, and the like, are less preferred in this situation, because the portion of the composition that is sprayed but misses the garment, and falls instead on flooring surfaces, such as rug, carpet, concrete floor, tiled floor, linoleum floor, bathtub floor, can leave a silicone layer that is cured and/or bonded to the flooring surfaces. Such silicones that are bonded to surfaces are difficult to be removed from the flooring surfaces. Flooring surfaces thus become slippery and can present a safety hazard to the household members. The curable and reactive silicones can be used in compositions specifically designed for use in articles such as a flexible bag, and in other, non-spray fabric treatment processes, such as dipping, soaking, in-the-wash, in-the-rinse, and in-the-dryer processes. Many types of aminofunctional silicones also cause fabric yellowing. Thus, the silicones that cause fabric discoloration are also not preferred.

The preferred silicone is volatile silicone fluid which can be a cyclic silicone fluid of the formula $[(CH_3)_2SiO]_n$ where n ranges between about 3 to about 7, preferably about 5 (D5), or a linear silicone polymer fluid having the formula $(CH_3)_3SiO[(CH_3)_2SiO]_mSi(CH_3)_3$ where m can be 0 or greater and has an average value such that the viscosity at 25° C. of the silicone fluid is preferably about 5 centistokes or less.

The non-volatile silicones that are useful and preferred in the composition of the present invention is polyalkyl and/or phenylsilicones silicone fluids and gums with the following structure:

$$A—Si(R_2)—O—[Si(R_2)—O—]_q—Si(R_2)—A$$

The alkyl groups substituted on the siloxane chain (R) or at the ends of the siloxane chains (A) can have any structure as long as the resulting silicones remain fluid at room temperature.

Each R group preferably can be alkyl, aryl, hydroxy, or hydroxyalkyl group, and mixtures thereof, more preferably, each R is methyl, ethyl, propyl or phenyl group, most preferably R is methyl. Each A group which blocks the ends of the silicone chain can be hydrogen, methyl, methoxy, ethoxy, hydroxy, propoxy, and aryloxy group, preferably methyl. Suitable A groups include hydrogen, methyl, methoxy, ethoxy, hydroxy, and propoxy. q is preferably an integer from about 7 to about 8,000. The preferred silicones are polydimethyl siloxanes; more preferred silicones are polydimethyl siloxanes having a viscosity of from about 50 to about 1000,000 centistokes at 25° C. Mixtures of volatile silicones and non-volatile polydimethyl siloxanes are also preferred. Suitable examples include silicones offered by Dow Corning Corporation and General Electric Company.

Other useful silicone materials, but less preferred than polydimethyl siloxanes, include materials of the formula:

$$HO—[Si(CH_3)_2—O]_x—\{Si(OH)[(CH_2)_3—NH—(CH_2)_2—NH_2]O\}_y—H$$

wherein x and y are integers which depend on the molecular weight of the silicone, preferably having a viscosity of from about 10,000 cst to about 500,000 cst at 25° C. This material is also known as "amodimethicone". Although silicones with a high number, e.g., greater than about 0.5 millimolar equivalent of amine groups can be used, they are not preferred because they can cause fabric yellowing.

Similarly, silicone materials which can be used correspond to the formulas:

$$(R^1)_aG_{3-a}—Si—(—OSiG_2)_n—(OSiG_b(R^1)_{2-b})_m—O—SiG_{3-a}(R^1)_a$$

wherein G is selected from the group consisting of hydrogen, phenyl, OH, and/or $C_1$–$C_8$ alkyl; a denotes 0 or an integer from 1 to 3; b denotes 0 or 1; the sum of n+m is a number from 1 to about 2,000; $R^1$ is a monovalent radical of formula $C_pH_{2p}L$ in which p is an integer from 2 to 8 and L is selected from the group consisting of:

$—N(R^2)CH_2—CH_2—N(R^2)_2$;

$—N(R^2)_2$;

$—N^+(R^2)_3\ A^-$; and $—N^+(R^2)CH_2—CH_2N^+H_2\ A^-$ wherein each $R^2$ is chosen from the group consisting of hydrogen, phenyl, benzyl, saturated hydrocarbon radical, and each $A^-$ denotes compatible anion, e.g., a halide ion; and $$R^3—N^+(CH_3)_2—Z—[Si(CH_3)_2O]_f—Si(CH_3)_2—Z—N^+(CH_3)_2—R^3.2CH_3COO^-$$

wherein $Z=—CH_2—CH(OH)—CH_2O—CH_2)_3—$ $R^3$ denotes a long chain alkyl group; and f denotes an integer of at least about 2.

In the formulas herein, each definition is applied individually and averages are included.

Another silicone material which can be used, but is less preferred than polydimethyl siloxanes, has the formula:

$$(CH_3)_3Si—[O—Si(CH_3)_2]_n—\{OSi(CH_3)[(CH_2)_3—NH—(CH_2)_2—NH_2]\}_m—OSi(CH_3)_3$$

wherein n and m are the same as before. The preferred silicones of this type are those which do not cause fabric discoloration.

Alternatively, the silicone material can be provided as a moiety or a part of a oligosaccharide molecule. These materials provide a lubricity benefit in addition to the expected fabric care benefits. Other examples of dual function silicone materials useful in the present invention are adjunct shape retention copolymers having siloxane macromers grafted thereto. The non-silicone backbone of such polymers should have a molecular weight of from about 5,000 to about 1,000,000, and the polymer should have a glass transition temperature (Tg), i.e., the temperature at which the polymer changes from a brittle vitreous state to a plastic state, of greater than about −20° C. Adjunct fabric shape retention silicone-containing polymers useful in the present invention are described in more detailed herein below along with other adjunct shape retention polymers.

When silicone is present, it is present at least an effective amount to provide lubrication of the fibers, typically from about 0.1% to about 5%, preferably from about 0.2% to about 3%, more preferably from about 0.3% to about 2%, by weight of the usage composition.

Silicone is also a useful optional ingredient in the rinse-added fabric care compositions of the present invention. The silicone can be either a polydimethyl siloxane (polydimethyl silicone or PDMS), or a derivative thereof, e.g., amino silicones, ethoxylated silicones, etc. The PDMS, is preferably one with a low molecular weight, e.g., one having a viscosity of from about 2 to about 5000 cSt, preferably from about 5 to about 500 cSt, more preferably from about 25 to about 200 cSt. Silicone emulsions can conveniently be used to prepare the compositions of the present invention. However, in compositions containing fabric softening actives, the silicone is preferably one that is, at least initially, not emulsified. I.e., the silicone should be emulsified in the composition itself. In the process of preparing the compositions, the silicone is preferably added to the "water seat", which comprises the water and, optionally, any other ingredients that normally stay in the aqueous phase.

Low molecular weight PDMS is preferred for use in the fabric softener compositions of this invention. The low molecular weight PDMS is easier to formulate without pre-emulsification.

Silicone derivatives such as amino-functional silicones, quaternized silicones, and silicone derivatives containing Si—OH, Si—H, and/or Si—Cl bonds, can be used. However, these silicone derivatives are normally more substantive to fabrics and can build up on fabrics after repeated treatments to actually cause a reduction in fabric absorbency.

When added to water, the fabric softener composition deposits the cationic fabric softening active on the fabric surface to provide fabric softening effects. However, in a typical laundry process, using an automatic washer, cotton fabric water absorbency can be appreciably reduced at high softening active levels and/or after multiple cycles. The silicone improves the fabric water absorbency, especially for freshly treated fabrics, when used with this level of fabric softening active without adversely affecting the fabric softening performance. The mechanism by which this improvement in water absorbency occurs is not well understood, since the silicones are inherently hydrophobic. It is very surprising that there is any improvement in water absorbency, rather than additional loss of water absorbency. The PDMS also improves the ease of ironing in addition to improving the rewettability characteristics of the fabrics.

The amount of PDMS needed to provide a noticeable improvement in water absorbency is dependent on the initial rewettability performance, which, in turn, is dependent on the detergent type used in the wash. Effective amounts range from about 2 ppm to about 50 ppm in the rinse water, preferably from about 5 to about 20 ppm. The PDMS to softening active ratio is from about 2:100 to about 50:100, preferably from about 3:100 to about 35:100, more preferably from about 4:100 to about 25:100. This typically requires from about 0.2% to about 20%, preferably from about 0.5% to about 10%, more preferably from about 1% to about 5% silicone.

(b). Synthetic Solid Particles

Solid polymeric particles of average particle size smaller than about 10 microns, preferably smaller than 5 microns, more preferably smaller than about 1 micron, e.g., Velustrol P-40 oxidized polyethylene emulsion available from Clariant, can be used as a lubricant, since they can provide a "roller-bearing" action. When solid polymeric particles are present, they are present at an effective amount to provide lubrication of the fibers, typically from about 0.01% to about 3%, preferably from about 0.05% to about 1%, more preferably from about 0.1% to about 0.5%, by weight of the usage composition.

Adjunct Fabric Shape Retention Polymer

These polymers can be natural, or synthetic, and can act by forming a film, and/or by providing adhesive properties. E.g., the present invention can optionally use film-forming and/or adhesive polymer to impart shape retention to fabric, particularly clothing. By "adhesive" it is meant that when applied as a solution or a dispersion to a fiber surface and dried, the polymer can attach to the surface. The polymer can form a film on the surface, or when residing between two fibers and in contact with the two fibers, it can bond the two fibers together. Other polymers such as starches can form a film and/or bond the fibers together when the treated fabric is pressed by a hot iron. Such a film will have adhesive strength, cohesive breaking strength, and cohesive breaking strain.

Nonlimiting examples for natural polymers are starches and their derivatives, and chitins and their derivatives.

The synthetic polymers useful in the present invention are comprised of monomers. Some nonlimiting examples of monomers which can be used to form the synthetic polymers of the present invention include: low molecular weight $C_1$–$C_6$ unsaturated organic mono-carboxylic and polycarboxylic acids, such as acrylic acid, methacrylic acid, crotonic acid, maleic acid and its half esters, itaconic acid, and mixtures thereof; esters of said acids with $C_1$–$C_{12}$ alcohols, such as methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, neodecanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, 1-decanol, 1-dodecanol, and the like, and mixtures thereof. Nonlimiting examples of said esters are methyl acrylate, ethyl acrylate, t-butyl acrylate, methyl methacrylate, hydroxyethyl methacrylate, methoxy ethyl methacrylate, and mixtures thereof; amides and imides of said acids, such as N,N-dimethylacrylamide, N-t-butyl acrylamide, maleimides; low molecular weight unsaturated alcohols such as vinyl alcohol (produced by the hydrolysis of vinyl acetate after polymerization), allyl alcohol; esters of said alcohols with low molecular weight carboxylic acids, such as, vinyl acetate, vinyl propionate; ethers of said alcohols such as methyl vinyl ether; aromatic vinyl such as styrene, alpha-methylstyrene, t-butylstyrene, vinyl toluene, polystyrene macromer, and the like; polar vinyl heterocyclics, such as vinyl pyrrolidone, vinyl caprolactam, vinyl pyridine, vinyl imidazole, and mixtures thereof; other unsaturated amines and amides, such as vinyl amine, diethylene triamine, dimethylaminoethyl methacrylate, ethenyl formamide; vinyl sulfonate; salts of acids and amines listed above; low molecular weight unsaturated hydrocarbons and derivatives such as ethylene, propylene, butadiene, cyclohexadiene, vinyl chloride; vinylidene chloride; and mixtures thereof and alkyl quaternized derivatives thereof, and mixtures thereof. Preferably, said monomers are selected from the group consisting of vinyl alcohol; acrylic acid; methacrylic acid; methyl acrylate; ethyl acrylate; methyl methacrylate; t-butyl acrylate; t-butyl methacrylate; n-butyl acrylate; n-butyl methacrylate; isobutyl methacrylate; 2-ethylhexyl methacrylate; dimethylaminoethyl methacrylate; N,N-dimethyl acrylamide; N,N-dimethyl methacrylamide; N-t-butyl acrylamide; vinylpyrrolidone; vinyl pyridine; adipic acid; diethylenetriamine; salts thereof and alkyl quaternized derivatives thereof, and mixtures thereof.

Preferably, said monomers form homopolymers and/or copolymers (i.e., the film-forming and/or adhesive polymer) having a glass transition temperature (Tg) of from about −20° C. to about 150° C., preferably from about −10° C. to about 150° C., more preferably from about 0° C. to about 100° C., most preferably, the adhesive polymer hereof, when dried to form a film will have a Tg of at least about 25° C., so that they are not unduly sticky, or "tacky" to the touch. Preferably said polymer is soluble and/or dispersible in water and/or alcohol. Said polymer typically has a molecular weight of at least about 500, preferably from about 1,000 to about 2,000,000, more preferably from about 5,000 to about 1,000,000, and even more preferably from about 30,000 to about 300,000 for some polymers.

Some non-limiting examples of homopolymers and copolymers which can be used as film-forming and/or adhesive polymers of the present invention are: adipic acid/dimethylaminohydroxypropyl diethylenetriamine copolymer; adipic acid/epoxypropyl diethylenetriamine copolymer; poly(vinylpyrrolidone/dimethylaminoethyl methacrylate); polyvinyl alcohol; polyvinylpyridine n-oxide; methacryloyl ethyl betaine/methacrylates copolymer; ethyl acrylate/methyl methacrylate/methacrylic acid/acrylic acid copolymer; polyamine resins; and polyquaternary amine resins; poly(ethenylformamide); poly(vinylamine) hydrochloride; poly(vinyl alcohol-co-6% vinylamine); poly (vinyl alcohol-co-12% vinylamine); poly(vinyl alcohol-co-6% vinylamine hydrochloride); and poly(vinyl alcohol-co-12% vinylamine hydrochloride). Preferably, said copolymer and/or homopolymers are selected from the group consisting of adipic acid/dimethylaminohydroxypropyl diethylenetriamine copolymer; poly(vinylpyrrolidone/dimethylaminoethyl methacrylate); polyvinyl alcohol; ethyl acrylate/methyl methacrylate/methacrylic acid/acrylic acid copolymer; methacryloyl ethyl betaine/methacrylates copolymer; polyquaternary amine resins; poly(ethenylformamide); poly (vinylamine) hydrochloride; poly(vinyl alcohol-co-6% vinylamine); poly(vinyl alcohol-co-12% vinylamine); poly (vinyl alcohol-co-6% vinylamine hydrochloride); and poly (vinyl alcohol-co-12% vinylamine hydrochloride).

Nonlimiting examples of the preferred polymer that are commercially available are: polyvinylpyrrolidone/dimethylaminoethyl methacrylate copolymer, such as Copolymer 958®, molecular weight of about 100,000 and Copolymer 937, molecular weight of about 1,000,000, available from GAF Chemicals Corporation; adipic acid/dimethylaminohydroxypropyl diethylenetriamine copolymer, such as Cartaretin F-4® and F-23, available from Sandoz Chemicals Corporation; methacryloyl ethyl betaine/methacrylates copolymer, such as Diaformer Z-SM®, available from Mitsubishi Chemicals Corporation; polyvinyl alcohol copolymer resin, such as Vinex 2019® available from Air Products and Chemicals or Moweol®, available from Clariant; adipic acid/epoxypropyl diethylenetriamine copolymer, such as Delsette 101®, available from Hercules Incorporated; polyamine resins, such as Cypro 515®, available from Cytec Industries; polyquaternary amine resins, such as Kymene 557H®, available from Hercules Incorporated; and polyvinylpyrrolidone/acrylic acid, such as Sokalan EG 310®, available from BASF.

Preferred polymers useful in the present invention are selected from the group consisting of copolymers of hydrophilic monomers and hydrophobic monomers. The polymer can be linear random or block copolymers, and mixtures thereof. Such hydrophobic/hydrophilic copolymers typically have a hydrophobic monomer/hydrophilic monomer ratio of from about 95:5 to about 20:80, preferably from about 90:10 to about 40:60, more preferably from about 80:20 to about 50:50 by weight of the copolymer. The hydrophobic monomer can comprise a single hydrophobic monomer or a mixture of hydrophobic monomers, and the hydrophilic monomer can comprise a single hydrophilic monomer or a mixture of hydrophilic monomers. The term "hydrophobic" is used herein consistent with its standard meaning of lacking affinity for water, whereas "hydrophilic" is used herein consistent with its standard meaning of having affinity for water. As used herein in relation to monomer units and polymeric materials, including the copolymers, "hydrophobic" means substantially water insoluble; "hydrophilic" means substantially water soluble. In this regard, "substantially water insoluble" shall refer to a material that is not soluble in distilled (or equivalent) water, at 25° C., at a concentration of about 0.2% by weight, and preferably not soluble at about 0.1% by weight (calculated on a water plus monomer or polymer weight basis). "Substantially water soluble" shall refer to a material that is soluble in distilled (or equivalent) water, at 25° C., at a concentration of about 0.2% by weight, and are preferably soluble at about 1% by weight. The terms "soluble", "solubility" and the like, for purposes hereof, corresponds to the maximum concentration of monomer or polymer, as applicable, that can dissolve in water or other solvents to form a homogeneous solution, as is well understood to those skilled in the art.

Nonlimiting examples of useful hydrophobic monomers are acrylic acid $C_1$–$C_{18}$ alkyl esters, such as methyl acrylate, ethyl acrylate, t-butyl acrylate; methacrylic $C_1$–$C_{18}$ alkyl esters, such as methyl methacrylate, 2-ethyl hexyl methacrylate, methoxy ethyl methacrylate; vinyl alcohol esters of carboxylic acids, such as, vinyl acetate, vinyl propionate, vinyl neodecanoate; aromatic vinyls, such as styrene, t-butyl styrene, vinyl toluene; vinyl ethers, such as methyl vinyl ether; vinyl chloride; vinylidene chloride; ethylene, propylene and other unsaturated hydrocarbons; and the like; and mixtures thereof. Some preferred hydrophobic monomers are methyl acrylate, methyl methacrylate, t-butyl acrylate, t-butyl methacrylate, n-butyl acrylate, n-butyl methacrylate, and mixtures thereof.

Nonlimiting examples of useful hydrophilic monomers are unsaturated organic mono-carboxylic and polycarboxylic acids, such as acrylic acid, methacrylic acid, crotonic acid, maleic acid and its half esters, itaconic acid; unsaturated alcohols, such as vinyl alcohol, allyl alcohol; polar vinyl heterocyclics, such as vinyl pyrrolidone, vinyl caprolactam, vinyl pyridine, vinyl imidazole; vinyl amine; vinyl sulfonate; unsaturated amides, such as acrylamides, e.g., N,N-dimethylacrylamide, N-t-butyl acrylamide; hydroxyethyl methacrylate; dimethylaminoethyl methacrylate; salts of acids and amines listed above; and the like; and mixtures thereof. Some preferred hydrophilic monomers are acrylic acid, methacrylic acid, N,N-dimethyl acrylamide, N,N-dimethyl methacrylamide, N-t-butyl acrylamide, dimethylamino ethyl methacrylate, vinyl pyrrolidone, salts thereof and alkyl quaternized derivatives thereof, and mixtures thereof.

Non limiting examples of polymers for use in the present invention include the following, where the composition of the copolymer is given as approximate weight percentage of each monomer used in the polymerization reaction used to prepare the polymer: vinyl pyrrolidone/vinyl acetate copolymers (at ratios of up to about 30% by weight of vinyl pyrrolidone); dimethyl acrylamide/t-butyl acrylate/ethyl hexyl methacrylate copolymer (10/45/45); vinyl pyrrolidone/vinyl acetate/butyl acrylate copolymer (10/78/12 and 10/70/20); vinyl pyrrolidone/vinyl propionate copolymer (5/95); vinyl caprolactam/vinyl acetate copolymer (5/95); acrylic acid/t-butyl acrylate (25/75) and styling resins sold under the trade names Ultrahold CA 8® by Ciba Geigy (ethyl acrylate/acrylic acid/N-t-butyl acrylamide copolymer); Resyn 28-1310® by National Starch and Luviset CA 66® by BASF (vinyl acetate/crotonic acid copolymer 90/10); Luviset CAP® by BASF (vinyl acetate/vinyl propionate/crotonic acid 50/40/10); Resyn 28-2930® by National Starch (vinyl acetate/vinyl neodecanoate/crotonic acid copolymer), Amerhold DR-25® by Union Carbide (ethyl acrylate/methacrylic acid/methyl methacrylate/acrylic acid copolymer), and Poligen A® by BASF (polyacrylate dispersion).

Preferably, the adjunct shape retention polymers contain an effective amount of monomers having carboxylic groups. Highly preferred adjunct shape retention copolymers contain hydrophobic monomers and hydrophilic monomers which comprise unsaturated organic mono-carboxylic and polycarboxylic acid monomers, such as acrylic acid, methacrylic acid, crotonic acid, maleic acid and its half esters, itaconic acid, and salts thereof, and mixtures thereof; and optionally other hydrophilic monomers. Examples of the hydrophilic unsaturated organic mono-carboxylic and polycarboxylic acid monomers are acrylic acid, methacrylic acid, crotonic acid, maleic acid and its half esters, itaconic acid, and mixtures thereof. Nonlimiting examples of the hydrophobic monomers are esters of the unsaturated organic mono-carboxylic and polycarboxylic acids cited hereinabove with $C_1$–$C_{12}$ alcohols, such as methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, and mixtures thereof, preferably methanol, ethanol, 1-propanol, 2-propanol, 1-butanol, 2-methyl-1-propanol, t-butanol, and mixtures thereof. One highly preferred copolymer contains acrylic acid and t-butyl acrylate monomeric units, preferably with acrylic acid/t-butyl acrylate ratios of from about 90:10 to about 10:90, preferably from about 70:30 to about 15:85, more preferably from about 40:60 to about 20:80. Nonlimiting examples of acrylic acid/tert-butyl acrylate copolymers useful in the present invention are those typically with a molecular weight of from about 1,000 to about 2,000,000, preferably from about 5,000 to about 1,000,000, and more preferably from about 30,000 to about 300,000, and with an approximate acrylic acid/tert-butyl acrylate weight ratio of about 25:75 and an average molecular weight of from about 70,000 to about 100,000, and those with an approximate acrylic acid/tert-butyl acrylate weight ratio of about 35:65 and an average molecular weight of from about 60,000 to about 90,000.

The film-forming and/or adhesive polymer of the present invention is present at least an effective amount to provide shape retention, typically from about 0.05% to about 10%, preferably from about 0.1% to about 5%, more preferably from about 0.2% to about 3%, even more preferably from about 0.3% to about 1.5%, by weight of the usage composition.

The adhesive polymer is present in the composition in a sufficient amount to result in an amount of from about 0.001% to about 1%, preferably from about 0.01% to about 0.5%, more preferably from about 0.02% to about 0.4% by weight of polymer per weight of dry fabrics.

It is not intended to exclude the use of higher or lower levels of the polymers, as long as an effective amount is used to provide adhesive and film-forming properties to the composition and the composition can be formulated and effectively applied for its intended purpose.

Silicones and film-forming polymers can be combined to produce preferred wrinkle reducing actives. Typically the weight ratio of silicone to film-forming polymer from about 10:1 to about 1:10, preferably from about 5:1 to about 1:5, and more preferably from about 2:1 to about 1:2. Typically, the preferred wrinkle reducing active of silicone plus polymer is present at a level of from about 0.1% to about 8%, preferably from about 0.3% to about 5%, more preferably from about 0.5% to about 3%, by weight of the composition.

Optional but preferred adhesive and/or film forming polymers that are useful in the composition of the present invention actually contain silicone moieties in the polymers themselves. These preferred polymers include graft and block copolymers of silicone with moieties containing hydrophilic and/or hydrophobic monomers described hereinbefore. The silicone-containing copolymers in the spray composition of the present invention provide shape retention, body, and/or good, soft fabric feel. Highly preferred silicone-containing copolymers contain hydrophobic monomers and hydrophilic monomers which comprise unsaturated organic mono-carboxylic and/or polycarboxylic acid monomers, such as acrylic acid, methacrylic acid, crotonic acid, maleic acid and its half esters, itaconic acid, and salts thereof, and mixtures thereof, and optionally other hydrophilic monomers.

Both silicone-containing graft and block copolymers useful in the present invention have the following properties:

(1) the silicone portion is covalently attached to the non-silicone portion;

(2) the molecular weight of the silicone portion is from about 1,000 to about 50,000; and (3) the non-silicone portion must render the entire copolymer soluble or dispersible in the wrinkle control composition vehicle and permit the copolymer to deposit on/adhere to the treated fabrics.

Suitable silicone copolymers include the following:

(a) Silicone Graft Copolymers

Preferred silicone-containing polymers are the silicone graft copolymers comprising acrylate groups described, along with methods of making them, in U.S. Pat. No. 5,658,557, Bolich et al., issued Aug. 19, 1997, U.S. Pat. No. 4,693,935, Mazurek, issued Sep. 15, 1987, and U.S. Pat. No. 4,728,571, Clemens et al., issued Mar. 1, 1988. Additional silicone-containing polymers are disclosed in U.S. Pat. No. 5,480,634, Hayama et al, issued Oct. 2, 1996, U.S. Pat. No. 5,166,276, Hayama et al., issued Nov. 24, 1992, U.S. Pat. No. 5,061,481, issued Oct. 29, 1991, Suzuki et al., U.S. Pat. No. 5,106,609, Bolich et al., issued Apr. 21, 1992, U.S. Pat. No. 5,100,658, Bolich et al., issued Mar. 31, 1992, U.S. Pat. No. 5,100,657, Ansher-Jackson, et al., issued Mar. 31, 1992, U.S. Pat. No. 5,104,646, Bolich et al., issued Apr. 14, 1992, all of which are incorporated herein by reference.

These polymers preferably include copolymers having a vinyl polymeric backbone having grafted onto it monovalent siloxane polymeric moieties, and components consisting of non-silicone hydrophilic and hydrophobic monomers.

The silicone-containing monomers are exemplified by the general formula:

$$X(Y)_nSi(R)_{3-m}Z_m$$

wherein X is a polymerizable group, such as a vinyl group, which is part of the backbone of the polymer; Y is a divalent linking group; R is a hydrogen, hydroxyl, lower alkyl (e.g. $C_1$–$C_4$), aryl, alkaryl, alkoxy, or alkylamino; Z is a monovalent polymeric siloxane moiety having an average molecular weight of at least about 500, is essentially unreactive under copolymerization conditions, and is pendant from the vinyl polymeric backbone described above; n is 0 or 1; and m is an integer from 1 to 3.

The preferred silicone-containing monomer has a weight average molecular weight of from about 1,000 to about 50,000, preferably from about 3,000 to about 40,000, most preferably from about 5,000 to about 20,000.

Nonlimiting examples of preferred silicone-containing monomers have the following formulas:

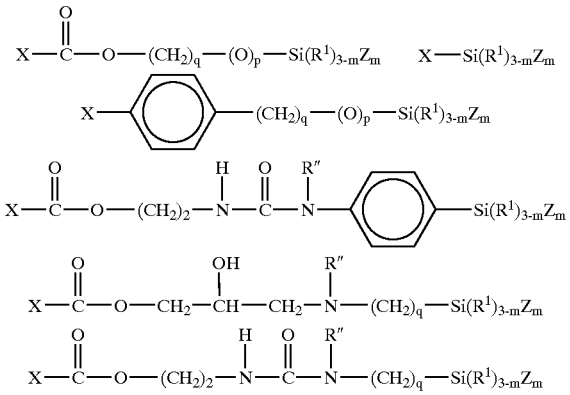

In these structures m is an integer from 1 to 3, preferably 1; p is 0 or 1; q is an integer from 2 to 6; n is an integer from 0 to 4, preferably 0 or 1, more preferably 0; $R^1$ is hydrogen, lower alkyl, alkoxy, hydroxyl, aryl, alkylamino, preferably $R^1$ is alkyl; R" is alkyl or hydrogen; X is $$CH(R^3)=C(R^4)—$$

$R^3$ is hydrogen or —COOH, preferably hydrogen; $R^4$ is hydrogen, methyl or —$CH_2$COOH, preferably methyl; Z is $$R^5—[Si(R^6)(R^7)—O—]_r$$

wherein $R^5$, $R^6$, and $R^7$, independently are lower alkyl, alkoxy, alkylamino, hydrogen or hydroxyl, preferably alkyl; and r is an integer of from about 10 to about 700, preferably from about 40 to about 600, more preferably from about 70 to about 300. Most preferably, $R^5$, $R^6$, and $R^7$ are methyl, p=0, and q=3.

Silicone-containing adhesive and/or film-forming copolymers useful in the present invention comprise from 0% to about 90%, preferably from about 10% to about 80%, more preferably from about 40% to about 75% of hydrophobic monomer, from about 0% to about 90%, preferably from about 5% to about 80% of hydrophilic monomer, and from about 5% to about 50%, preferably from about 10% to about 40%, more preferably from about 15% to about 25% of silicone-containing monomer.

The composition of any particular copolymer will help determine its formulation properties. In fact, by appropriate selection and combination of particular hydrophobic, hydrophilic and silicone-containing components, the copolymer can be optimized for inclusion in specific vehicles. For example, polymers which are soluble in an aqueous formulation preferably contain from 0% to about 70%, preferably from about 5% to about 70% of hydrophobic monomer, and from about 30% to about 98%, preferably from about 30% to about 80%, of hydrophilic monomer, and from about 1% to about 40% of silicone-containing monomer. Polymers which are dispersible preferably contain from 0% to about 70%, more preferably from about 5% to about 70%, of hydrophobic monomer, and from about 20% to about 80%, more preferably from about 20% to about 60%, of hydrophilic monomer, and from about 1% to about 40% of silicone-containing monomer.

The silicone-containing copolymers preferably have a weight average molecular weight of from about 10,000 to about 1,000,000, preferably from about 30,000 to about 300,000.

The preferred polymers comprise a vinyl polymeric backbone, preferably having a Tg or a Tm as defined above of about −20° C. and, grafted to the backbone, a polydimethylsiloxane macromer having a weight average molecular weight of from about 1,000 to about 50,000, preferably from about 5,000 to about 40,000, most preferably from about 7,000 to about 20,000. The polymer is such that when it is formulated into the finished composition, and then dried, the polymer phase separates into a discontinuous phase which includes the polydimethylsiloxane macromer and a continuous phase which includes the backbone. Exemplary silicone grafted polymers for use in the present invention include the following, where the composition of the copolymer is given with the approximate weight percentage of each monomer used in the polymerization reaction to prepare the copolymer: N,N-dimethylacrylamide/isobutyl methacrylate/(PDMS macromer —20,000 approximate molecular weight) (PDMS is polydimethylsiloxane) (20/60/20 w/w/w), copolymer of average molecular weight of about 400,000; N,N-dimethylacrylamide/(PDMS macromer —20,000 approximate molecular weight) (80/20 w/w), copolymer of average molecular weight of about 300,000; t-butylacrylate/N,N-dimethylacrylamide/(PDMS macromer —10,000 approximate molecular weight) (70/10/20), copolymer of average molecular weight of about 400,000; and (N,N,N-trimethylammonioethylmethacrylate chloride)/N,N-dimethylacrylamide/(PDMS macromer —15,000 approximate molecular weight) (40/40/20), copolymer of average molecular weight of about 150,000.

Highly preferred adjunct shape retention copolymers of this type contain hydrophobic monomers, silicone-containing monomers and hydrophilic monomers which comprise unsaturated organic mono- and polycarboxylic acid monomers, such as acrylic acid, methacrylic acid, crotonic acid, maleic acid and its half esters, itaconic acid, and salts thereof, and mixtures thereof. A highly preferred copolymer is composed of acrylic acid, t-butyl acrylate and silicone-containing monomeric units, preferably with from about 20% to about 90%, preferably from about 30% to about 80%, more preferably from about 50% to about 75% t-butyl acrylate; from about 5% to about 60%, preferably from about 8% to about 45%, more preferably from about 10% to about 30% of acrylic acid; and from about 5% to about 50%, preferably from about 7% to about 40%, more preferably from about 10% to about 30% of polydimethylsiloxane of an average molecular weight of from about 1,000 to about 50,000, preferably from about 5,000 to about 40,000, most preferably from about 7,000 to about 20,000. Nonlimiting examples of acrylic acid/tert-butyl acrylate/polydimethyl siloxane macromer copolymers useful in the present invention, with approximate monomer weight ratio, are: t-butylacrylate/acrylic acid/(polydimethylsiloxane macromer, 10,000 approximate molecular weight) (70/10/20 w/w/w), copolymer of average molecular weight of about 300,000; t-butylacrylate/acrylic acid/(polydimethylsiloxane macromer, 10,000 approximate molecular weight) (65/25/10 w/w/w), copolymer of average molecular weight of about 200,000; t-butyl acrylate/acrylic acid/(polydimethylsiloxane macromer, 10,000 approximate molecular weight) (63/20/17), copolymer of average molecular weight of from about 120,000 to about 150,000; and n-butylmethacrylate/acrylic acid/(polydimethylsiloxane macromer —20,000 approximate molecular weight) (70/10/20 w/w/w), copolymer of average molecular weight of about 100,000. A useful copolymer of this type is Diahold® ME from Mitsubishi Chemical Corp., which is a t-butyl acrylate/acrylic acid/(polydimethylsiloxane macromer, 12,000 approximate molecular weight) (60/20/20), copolymer of average molecular weight of about 128,000.

(b) Silicone Block Copolymers

Also useful herein are silicone block copolymers comprising repeating block units of polysiloxanes.

Examples of silicone-containing block copolymers are found in U.S. Pat. No. 5,523,365, to Geck et al., issued Jun. 4, 1996; U.S. Pat. No. 4,689,289, to Crivello, issued Aug. 25, 1987; U.S. Pat. No. 4,584,356, to Crivello, issued Apr. 22, 1986; *Macromolecular Design, Concept & Practice*, Ed: M. K. Mishra, Polymer Frontiers International, Inc., Hopewell Jct., NY (1994), and *Block Copolymers*, A. Noshay and J. E. McGrath, Academic Press, NY (1977), which are all incorporated by reference herein in their entirety. Other silicone block copolymers suitable for use herein are those described, along with methods of making them, in the above referenced and incorporated U.S. Pat. No. 5,658,577.

The silicone-containing block copolymers useful in the present invention can be described by the formulas A—B, A—B—A, and $—(A^{-}B)_n—$ wherein n is an integer of 2 or greater. A—B represents a diblock structure, A—B—A represents a triblock structure, and $—(A—B)_n—$ represents a multiblock structure. The block copolymers can comprise mixtures of diblocks, triblocks, and higher multiblock combinations as well as small amounts of homopolymers.

The silicone block portion, B, can be represented by the following polymeric structure $$—(SiR_2O)_m—,$$

wherein each R is independently selected from the group consisting of hydrogen, hydroxyl, $C_1$–$C_6$ alkyl, $C_1$–$C_6$ alkoxy, $C_2$–$C_6$ alkylamino, styryl, phenyl, $C_1$–$C_6$ alkyl or alkoxy-substituted phenyl, preferably methyl; and m is an integer of about 10 or greater, preferably of about 40 or greater, more preferably of about 60 or greater, and most preferably of about 100 or greater.

The non-silicone block, A, comprises monomers selected from the monomers as described hereinabove in reference to the non-silicone hydrophilic and hydrophobic monomers for the silicone grafted copolymers. Vinyl blocks are preferred co-monomers. The block copolymers preferably contain one or more non-silicone blocks, and up to about 50%, preferably from about 10% to about 20%, by weight of one or more polydimethyl siloxane blocks.

(c) Sulfur-Linked Silicone-Containing Copolymers

Also useful herein are sulfur-linked silicone containing copolymers, including block copolymers. As used herein in reference to silicone containing copolymers, the term "sulfur-linked" means that the copolymer contains a sulfur linkage (i.e., —S—), a disulfide linkage (i.e., —S—S—), or a sulfhydryl group (i.e., —SH).

These sulfur-linked silicone-containing copolymers are represented by the following general formula:

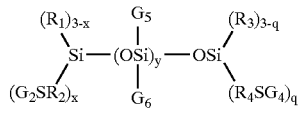

wherein each $G_5$ and $G_6$ is independently selected from the group consisting of alkyl, aryl, alkaryl, alkoxy, alkylamino, fluoroalkyl, hydrogen, and —ZSA, wherein A represents a vinyl polymeric segment consisting essentially of polymerized free radically polymerizable monomer, and Z is a divalent linking group (Useful divalent linking groups Z include but are not limited to the following: $C_1$ to $C_{10}$ alkylene, alkarylene, arylene, and alkoxyalkylene. Preferably, Z is selected from the group consisting of methylene and propylene for reasons of commercial availability.);

each $G_2$ comprises A;

each $G_4$ comprises A;

each $R_1$ is a monovalent moiety selected from the group consisting of alkyl, aryl, alkaryl, alkoxy, alkylamino, fluoroalkyl, hydrogen, and hydroxyl (Preferably, $R_1$ represents monovalent moieties which can independently be the same or different selected from the group consisting of $C_{1-4}$ alkyl and hydroxyl for reasons of commercial availability. Most preferably, $R_1$ is methyl.);

each $R_2$ is a divalent linking group (Suitable divalent linking groups include but are not limited to the following: $C_1$ to $C_{10}$ alkylene, arylene, alkarylene, and alkoxyalkylene. Preferably, $R_2$ is selected from the group consisting of $C_{1-3}$ alkylene and $C_7$–$C_{10}$ alkarylene due to ease of synthesis of the compound. Most preferably, $R_2$ is selected from the group consisting of —$CH_2$—, 1,3-propylene, and

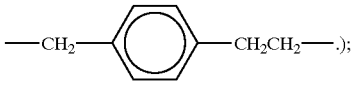

each $R_3$ represents monovalent moieties which can independently be the same or different and are selected from the group consisting of alkyl, aryl, alkaryl, alkoxy, alkylamino, fluoroalkyl, hydrogen, and hydroxyl (Preferably, $R_3$ represents monovalent moieties which can independently be the same or different selected from the group consisting of $C_{1-4}$ alkyl and hydroxyl for reasons of commercial availability. Most preferably, $R_3$ is methyl.);

each $R_4$ is a divalent linking group (Suitable divalent linking groups include but are not limited to the following: $C_1$ to $C_{10}$ alkylene, arylene, alkarylene, and alkoxyalkylene. Preferably, $R_4$ is selected from the group consisting of $C_{1-3}$ alkylene and $C_7$–$C_{10}$ alkarylene for ease of synthesis. Most preferably, $R_4$ is selected from the group consisting of —$CH_2$—, 1,3-propylene, and

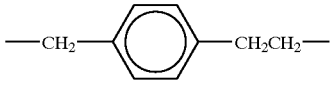

.);

x is an integer of 0–3;

y is an integer of 5 or greater (preferably y is an integer ranging from about 14 to about 700, preferably from about 20 to about 200); and q is an integer of 0–3;

wherein at least one of the following is true:

q is an integer of at least 1;

x is an integer of at least 1;

$G_5$ comprises at least one —ZSA moiety; or $G_6$ comprises at least one —ZSA moiety.

As noted above, A is a vinyl polymeric segment formed from polymerized free radically polymerizable monomers. The selection of A is typically based upon the intended uses of the composition, and the properties the copolymer must possess in order to accomplish its intended purpose. If A comprises a block in the case of block copolymers, a polymer having AB and/or ABA architecture will be obtained depending upon whether a mercapto functional group —SH is attached to one or both terminal silicon atoms of the mercapto functional silicone compounds, respectively. The weight ratio of vinyl polymer block or segment, to silicone segment of the copolymer can vary. The preferred copolymers are those wherein the weight ratio of vinyl polymer segment to silicone segment ranges from about 98:2 to 50:50, in order that the copolymer possesses properties inherent to each of the different polymeric segments while retaining the overall polymer's solubility.

Sulfur linked silicone copolymers are described in more detail in U.S. Pat. No. 5,468,477, to Kumar et al., issued Nov. 21, 1995, and PCT Application No. WO 95/03776, assigned to 3M, published Feb. 9, 1995, which are incorporated by reference herein in their entirety.

Other useful silicone-containing polymers are those containing hydrophilic portions, such as polyvinylpyrrolidone/quaternaries, polyacrylates, polyacrylamides, polysulfonates, and mixtures thereof, and are disclosed, e.g., in U.S. Pat. No. 5,120,812, incorporated herein by reference.

The film-forming and/or adhesive silicone-containing copolymer of the present invention is present at least an effective amount to provide shape retention, typically from about 0.05% to about 10%, preferably from about 0.1% to about 5%, more preferably from about 0.2% to about 3%, even more preferably from about 0.3% to about 1.5%, by weight of the usage composition.

The silicone-containing copolymer is present in the composition in a sufficient amount to result in an amount of from about 0.001% to about 1%, preferably from about 0.01% to about 0.5%, more preferably from about 0.02% to about 0.4% by weight of polymer per weight of dry fabrics.

When the optional cyclodextrin is present in the composition, the polymer useful in providing shape retention in the composition of the present invention should be cyclodextrin-compatible, that is it should not substantially form complexes with cyclodextrin so as to diminish performance of the cyclodextrin and/or the polymer. Complex formation affects both the ability of the cyclodextrin to absorb odors and the ability of the polymer to impart shape retention to fabric. In this case, the monomers having pendant groups that can complex with cyclodextrin are not preferred because they can form complexes with cyclodextrin. Examples of such monomers are acrylic or methacrylic acid esters of $C_7$–$C_{18}$ alcohols, such as neodecanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, and 1-decanol; aromatic vinyls, such as styrene; t-butylstyrene; vinyl toluene; and the like.

Starch

Starch is not normally preferred, since it makes the fabric resistant to deformation. However, it does provide increased "body" which is often desired. Starch is particularly preferred in compositions of this invention to be used with ironing. When used, starch is solubilized or dispersed in the composition. Any type of starch, e.g. those derived from corn, wheat, rice, grain sorghum, waxy grain sorghum, waxy maize or tapioca, or mixtures thereof and water soluble or dispersible modifications or derivatives thereof, can be used in the composition of the present invention. Low viscosity commercially available propoxylated and/or ethoxylated starches are useable in the present composition and are preferred since their low viscosity at relatively high solids concentrations make them very adaptable to spraying processes. Suitable alkoxylated, low viscosity starches are submicron sized particles of hydrophobic starch that are readily dispersed in water and are prepared by alkoxylation of granular starch with a monofunctional alkoxylating agent which provides the starch with ether linked hydrophilic groups. A suitable method for their preparation is taught in U.S. Pat. No. 3,462,283. In accordance with the invention, the propoxylated or ethoxylated starch derivatives are dispersed in the aqueous medium in an amount of from about 0.1% to about 10%, preferably from about 0.5% to about 6%, more preferably from about 1% to about 4% by weight of the usage composition.

Lithium Salts.

Optional lithium salts are useful in the fabric care compositions of the present invention for providing improved fabric wrinkle control. Nonlimiting examples of lithium salts that are useful in the present invention are lithium bromide, lithium chloride, lithium lactate, lithium benzoate, lithium acetate, lithium sulfate, lithium tartrate, and/or lithium bitartrate, preferably lithium bromide and/or lithium lactate. Some water soluble salts such as, lithium benzoate are not preferred when the optional cyclodextrin is present because they can form complexes with cyclodextrin. Useful levels of lithium salts are from about 0.1% to about 10%, preferably from about 0.5% to about 7%, more preferably from about 1% to about 5%, by weight of the usage composition.

Hydrophilic Plasticizer

Optionally, the composition can contain a hydrophilic plasticizer to soften both the fabric fibers, especially cotton fibers, and the adjunct adhesive and/or film-forming shape retention polymers. Examples of the preferred hydrophilic plasticizers are short chain low molecular weight polyhydric alcohols, such as is glycerol, ethylene glycol, propylene glycol, diethylene glycol, dipropylene glycol, sorbitol, erythritol or mixtures thereof, more preferably diethylene glycol, dipropylene glycol, ethylene glycol, propylene glycol and mixtures thereof. When a hydrophilic plasticizer is used, it is present in the at a level of from 0.01% to 5%, preferably from 0.05% to 2%, more preferably from 0.1% to 1% by weight of the usage composition.

Surfactant

Surfactant is an optional but highly preferred ingredient of the present invention. Surfactant is especially useful in the composition to facilitate the dispersion and/or solubilization of wrinkle control agents such as silicones and/or certain relatively water insoluble adjunct shape retention polymers. The surfactant can provide some plasticizing effect to the adjunct shape retention polymers resulting in a more flexible polymer network. Such surfactant is preferably included when the composition is used in a spray dispenser in order to enhance the spray characteristics of the composition and allow the composition, including the fabric care polysaccharide with globular structure, to distribute more evenly, and to prevent clogging of the spray apparatus. The spreading of the composition can also allow it to dry faster, so that the treated material is ready to use sooner. For concentrated compositions, the surfactant facilitates the dispersion of many actives such as antimicrobial actives and perfumes in the concentrated aqueous compositions. Suitable surfactant useful in the present invention is nonionic surfactant, anionic surfactant, cationic surfactant, amphoteric surfactant, and mixtures thereof. When surfactant is used in the composition of the present invention, it is added at an effective amount to provide one, or more of the benefits described herein, typically from about 0.01% to about 5%, preferably from about 0.05% to about 3%, more preferably from about 0.1% to about 2%, and even more preferably, from about 0.2% to about 1%, by weight of the usage composition.

A preferred type of surfactant is ethoxylated surfactant, such as addition products of ethylene oxide with fatty alcohols, fatty acids, fatty amines, etc. Optionally, addition products of mixtures of ethylene oxide and propylene oxide with fatty alcohols, fatty acids, fatty amines can be used. The ethoxylated surfactant includes compounds having the general formula:

$$R^8—Z—(CH_2CH_2O)_sB$$

wherein $R^8$ is an alkyl group or an alkyl aryl group, selected from the group consisting of primary, secondary and branched chain alkyl hydrocarbyl groups, primary, secondary and branched chain alkenyl hydrocarbyl groups, and/or primary, secondary and branched chain alkyl- and alkenyl-substituted phenolic hydrocarbyl groups having from about 6 to about 20 carbon atoms, preferably from about 8 to about 18, more preferably from about 10 to about 15 carbon atoms; s is an integer from about 2 to about 45, preferably from about 2 to about 20, more preferably from about 2 to about 15; B is a hydrogen, a carboxylate group, or a sulfate group; and linking group Z is —O—, —C(O)O—, —C(O)N(R)—, or —C(O)N(R)—, and mixtures thereof, in which R, when present, is $R^8$ or hydrogen.

The nonionic surfactants herein are characterized by an HLB (hydrophilic-lipophilic balance) of from 5 to 20, preferably from 6 to 15.

Nonlimiting examples of preferred ethoxylated surfactant are:

straight-chain, primary alcohol ethoxylates, with $R^8$ being $C_8$–$C_{18}$ alkyl and/or alkenyl group, more preferably $C_{10}$–$C_{14}$, and s being from about 2 to about 8, preferably from about 2 to about 6;

straight-chain, secondary alcohol ethoxylates, with $R^8$ being $C_8$–$C_{18}$ alkyl and/or alkenyl, e.g., 3-hexadecyl, 2-octadecyl, 4-eicosanyl, and 5-eicosanyl, and s being from about 2 to about 10;

alkyl phenol ethoxylates wherein the alkyl phenols having an alkyl or alkenyl group containing from 3 to 20 carbon atoms in a primary, secondary or branched chain configuration, preferably from 6 to 12 carbon atoms, and s is from about 2 to about 12, preferably from about 2 to about 8;

branched chain alcohol ethoxylates, wherein branched chain primary and secondary alcohols (or Guerbet alcohols) which are available, e.g., from the well-known "OXO" process or modification thereof are ethoxylated.

Especially preferred are alkyl ethoxylate surfactants with each $R^8$ being $C_8$–$C_{16}$ straight chain and/or branch chain alkyl and the number of ethyleneoxy groups s being from about 2 to about 6, preferably from about 2 to about 4, more preferably with $R^8$ being $C_8$–$C_{15}$ alkyl and s being from about 2.25 to about 3.5. These nonionic surfactants are characterized by an HLB of from 6 to about 11, preferably from about 6.5 to about 9.5, and more preferably from about 7 to about 9. Nonlimiting examples of commercially available preferred surfactants are Neodol 91-2.5 ($C_9$–$C_{10}$, s=2.7, HLB=8.5), Neodol 23-3 ($C_{12}$–$C_{13}$, s=2.9, HLB=7.9) and Neodol 25-3 ($C_{12}$–$C_{15}$, s=2.8, HLB=7.5). It is found, very surprisingly, that these preferred surfactants which are themselves not very water soluble (0.1% aqueous solutions of these surfactants are not clear), can at low levels, effectively dissolve and/or disperse adjunct shape retention polymers such as copolymers containing acrylic acid and tert-butyl acrylate and silicone-containing copolymers into clear compositions, even without the presence of a low molecular weight alcohol.

Also preferred is a nonionic surfactant selected from the group consisting of fatty acid ($C_{12-18}$) esters of ethoxylated ($EO_{5-100}$) sorbitans. More preferably said surfactant is selected from the group consisting of mixtures of laurate esters of sorbitol and sorbitol anhydrides; mixtures of stearate esters of sorbitol and sorbitol anhydrides; and mixtures of oleate esters of sorbitol and sorbitol anhydrides. Even more preferably said surfactant is selected from the group consisting of Polysorbite 20, which is a mixture of laurate esters of sorbitol and sorbitol anhydrides consisting predominantly of the monoester, condensed with about 20 moles of ethylene oxide; Polysorbate 60 which is a mixture of stearate esters of sorbitol and sorbitol anhydride, consisting predominantly of the monoester, condensed with about 20 moles of ethylene oxide; Polysorbate 80 which is a mixture of oleate esters of sorbitol and sorbitol anhydrides, consisting predominantly of the monoester, condensed with about 20 moles of ethylene oxide; and mixtures thereof. Most preferably, said surfactant is Polysorbate 60.

Other examples of preferred ethoxylated surfactant include carboxylated alcohol ethoxylate, also known as ether carboxylate, with $R^8$ having from about 12 to about 16 carbon atoms and s being from about 5 to about 13; ethoxylated quaternary ammonium surfactants, such as PEG-5 cocomonium methosulfate, PEG-15 cocomonium chloride, PEG-15 oleammonium chloride and bis(polyethoxyethanol)tallow ammonium chloride.

Other suitable nonionic ethoxylated surfactants are ethoxylated alkyl amines derived from the condensation of ethylene oxide with hydrophobic alkyl amines, with $R^8$ having from about 8 to about 22 carbon atoms and s being from about 3 to about 30.

Also suitable nonionic ethoxylated surfactants for use herein are alkylpolysaccharides which are disclosed in U.S. Pat. No. 4,565,647, Llenado, issued Jan. 21, 1986, having a hydrophobic group containing from about 8 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. The intersaccharide bonds can be, e.g., between the one position of the additional saccharide units and the 2-, 3-, 4-, and/or 6-positions on the preceding saccharide units. The preferred alkylpolyglycosides have the formula $$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably from about 1.3 to about 3, most preferably from about 1.3 to about 2.7. The glycosyl is preferably derived from glucose.

Another class of preferred surfactants that are useful in the formulation of the compositions of the present invention, to solubilize and/or disperse silicone lubricants and/or silicone-containing adjunct shape retention copolymers, are silicone surfactants. They can be used alone and/or preferably in combination with the preferred alkyl ethoxylate surfactants described herein above. Nonlimiting examples of silicone surfactants are the polyalkylene oxide polysiloxanes having a dimethyl polysiloxane hydrophobic moiety and one or more hydrophilic polyalkylene side chains, and having the general formula:

$$R^1—(CH_3)_2SiO—[(CH_3)_2SiO]_a—[(CH_3)(R^1)SiO]_b—Si(CH_3)_2—R^1$$

wherein a+b are from about 1 to about 50, preferably from about 3 to about 30, more preferably from about 10 to about 25, and each $R^1$ is the same or different and is selected from the group consisting of methyl and a poly(ethyleneoxide/propyleneoxide) copolymer group having the general formula:

$$—(CH_2)_n\,O(C_2H_4O)_c(C_3H_6O)_dR^2$$

with at least one $R^1$ being a poly(ethyleneoxy/propyleneoxy) copolymer group, and wherein n is 3 or 4, preferably 3; total c (for all polyalkyleneoxy side groups) has a value of from 1 to about 100, preferably from about 6 to about 100; total d is from 0 to about 14, preferably from 0 to about 3; and more preferably d is 0; total c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group. Each polyalkylene oxide polysiloxane has at least one $R^1$ group being a poly(ethyleneoxide/propyleneoxide) copolymer group.

Nonlimiting examples of this type of surfactants are the Silwet® surfactants which are available OSi Specialties, Inc., Danbury, Conn. Representative Silwet surfactants which contain only ethyleneoxy ($C_2H_4O$) groups are as follows.

| Name | Average MW | Average a + b | Average total c |
|---|---|---|---|
| L-7608 | 600 | 1 | 9 |
| L-7607 | 1,000 | 2 | 17 |
| L-77 | 600 | 1 | 9 |
| L-7605 | 6,000 | 20 | 99 |
| L-7604 | 4,000 | 21 | 53 |
| L-7600 | 4,000 | 11 | 68 |
| L-7657 | 5,000 | 20 | 76 |
| L-7602 | 3,000 | 20 | 29 |
| L-7622 | 10,000 | 88 | 75 |

Nonlimiting examples of surfactants which contain both ethyleneoxy ($C_2H_4$ 0) and propyleneoxy ($C_3H_6$ 0) groups are as follows.

| Name | Average MW | EO/PO ratio |
|---|---|---|
| Silwet L-720 | 12,000 | 50/50 |
| Silwet L-7001 | 20,000 | 40/60 |
| Silwet L-7002 | 8,000 | 50/50 |
| Silwet L-7210 | 13,000 | 20/80 |
| Silwet L-7200 | 19,000 | 75/25 |
| Silwet L-7220 | 17,000 | 20/80 |

The molecular weight of the polyalkyleneoxy group ($R^1$) is less than or equal to about 10,000. Preferably, the molecular weight of the polyalkyleneoxy group is less than or equal to about 8,000, and most preferably ranges from about 300 to about 5,000. Thus, the values of c and d can be those numbers which provide molecular weights within these ranges. However, the number of ethyleneoxy units (—$C_2H_4O$) in the polyether chain ($R^1$) must be sufficient to render the polyalkylene oxide polysiloxane water dispersible or water soluble. If propyleneoxy groups are present in the polyalkylenoxy chain, they can be distributed randomly in the chain or exist as blocks. Surfactants which contain only propyleneoxy groups without ethyleneoxy groups are not preferred. Preferred Silwet surfactants are L-7600, L-7602, L-7604, L-7605, L-7657, and mixtures thereof. The most preferred Silwet surfactant for solubilizing and/or dispersing the adjunct silicone-containing shape retention polymers and/or the volatile silicone is the low molecular weight L-77. Besides surface activity, polyalkylene oxide polysiloxane surfactants can also provide other benefits, such as antistatic benefits, lubricity and softness to fabrics.

Other useful silicone surfactants are those having a hydrophobic moiety and hydrophilic ionic groups, including, e.g., anionic, cationic, and amphoteric groups. Nonlimiting examples of anionic silicone surfactants are silicone sulfosuccinates, silicone sulfates, silicone phosphates, silicone carboxylates, and mixtures thereof, as disclosed respectively in U.S. Pat. Nos. 4,717,498, 4,960,845, 5,149,765, and 5,296,434. Nonlimiting examples of cationic silicone surfactants are silicone alkyl quats (quaternary ammoniums), silicone amido quats, silicone imidazoline quats, and mixtures thereof, as disclosed respectively in U.S. Pat. Nos. 5,098,979, 5,135,294, and 5,196,499. Nonlimiting examples of amphoteric silicone surfactants are silicone betaines, silicone amino proprionates, silicone phosphobetaines, and mixtures thereof, as disclosed respectively in U.S. Pat. Nos. 4,654,161, 5,073,619, and 5,237,035. All of these patents are incorporated herein by reference.

Fabric care composition of the present invention to be used in the wash cycle can be either used along with a general laundry detergent or actually a detergent composition comprising a fabric care polysaccharide with globular structure. The detergent compositions according to the present invention comprise a surfactant or surfactant system wherein the surfactant can be selected from nonionic and/or anionic and/or cationic and/or ampholytic and/or zwitterionic and/or semi-polar nonionic surfactants.

The surfactant is typically present at a level of from 0.1% to 60% by weight. More preferred levels of incorporation are 1% to 35% by weight, most preferably from 1% to 30% by weight of detergent compositions in accord with the invention.

The surfactant is preferably formulated to be compatible with the fabric care polysaccharide with globular structure present in the composition.

Examples of suitable nonionic, anionic, cationic, ampholytic, zwitterionic and semi-polar nonionic surfactants are disclosed in U.S. Pat. Nos. 5,707,950 and 5,576,282, incorporated herein by reference.

Highly preferred nonionic surfactants are polyhydroxy fatty acid amide surfactants of the formula:

$$R^2—C(O)—N(R^1)—Z,$$

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or $C_{16-18}$ alkyl or alkenyl chain such as coconut alkyl or mixtures thereof, and Z is derived from a reducing sugar such as glucose, fructose, maltose, lactose, in a reductive amination reaction.

Highly preferred anionic surfactants include alkyl alkoxylated sulfate surfactants hereof are water soluble salts or acids of the formula $RO(A)_mSO3M$ wherein R is an unsubstituted $C_{12}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein.

When included therein, the laundry detergent compositions of the present invention typically comprise from about 1% to about 40%, preferably from about 3% to about 20% by weight of such anionic surfactants.

The above individual Compounds (actives) can be used individually or as mixtures.

One type of optional but highly desirable cationic compound which can be used in combination with the above softening actives are compounds containing one long chain acyclic $C_8$–$C_{22}$ hydrocarbon group, selected from the group consisting of: wherein $R^7$ is hydrogen or a $C_1$–$C_4$ saturated alkyl or hydroxyalkyl group, and $R^1$ and $A^-$ are defined as herein above;

(12) Acyclic quaternary ammonium salts having the formula:

$$[R^1—N(R^5)_2—R^6]^+A^-$$

wherein $R^5$ and $R^6$ are $C_1$–$C_4$ alkyl or hydroxyalkyl groups, and $R^1$ and $A^-$ are defined as herein above;

(13) Substituted imidazolinium salts having the formula:

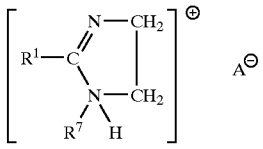

wherein $R^7$ is hydrogen or a $C_1$–$C_4$ saturated alkyl or hydroxyalkyl group, and $R^1$ and $A^-$ are defined as hereinabove;

(14) Substituted imidazolinium salts having the formula:

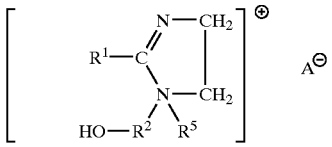

wherein $R^5$ is a $C_1$–$C_4$ alkyl or hydroxyalkyl group, and $R^1$, $R^2$, and $A^-$ are as defined above;

(15) Alkylpyridinium salts having the formula:

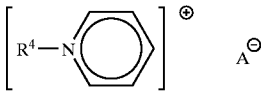

wherein $R^4$ is an acyclic aliphatic $C_8$–$C_{22}$ hydrocarbon group and $A^-$ is an anion;

(16) Alkanamide alkylene pyridinium salts having the formula:

Highly preferred cationic surfactants are the water-soluble quaternary ammonium compounds useful in the present composition having the formula:

$$R_1R_2R_3R_4N^+X^-$$

wherein $R_1$ is $C_8$–$C_{16}$ alkyl, each of $R_2$, $R_3$ and $R_4$ is independently $C_{1-C4}$ alkyl, $C_1$–$C_4$ hydroxy alkyl, benzyl, and $—(C_2H_{40})_xH$ where x has a value from 2 to 5, and X is an anion. Not more than one of $R_2$, $R_3$ or $R_4$ should be benzyl.

When included therein, the detergent compositions of the present invention typically comprise from 0.2% to about 25%, preferably from about 1% to about 8% by weight of such cationic surfactants.

When included therein, the detergent compositions of the present invention typically comprise from 0.2% to about 15%, preferably from about 1% to about 10% by weight of such ampholytic surfactants.

When included therein, the detergent compositions of the present invention typically comprise from 0.2% to about 15%, preferably from about 1% to about 10% by weight of such zwitterionic surfactants.

When included therein, the detergent compositions of the present invention typically comprise from 0.2% to about 15%, preferably from about 1% to about 10% by weight of such semi-polar nonionic surfactants.

The detergent composition of the present invention can further comprise a cosurfactant selected from the group of primary or tertiary amines.

Suitable primary amines for use herein include amines according to the formula $R_1NH_2$ wherein $R_1$ is a $C_6$–$C_{12}$, preferably $C_6$–$C_{10}$ alkyl chain or $R_4X(CH_2)_n$, X is —O—, —C(O)NH— or —NH—, $R_4$ is a $C_6$–$C_{12}$ alkyl chain n is between 1 to 5, preferably 3. $R_1$ alkyl chains can be straight or branched and can be interrupted with up to 12, preferably less than 5 ethylene oxide moieties.

Preferred amines according to the formula herein above are n-alkyl amines. Suitable amines for use herein can be selected from 1-hexylamine, 1-octylamine, 1-decylamine and laurylamine. Other preferred primary amines include C8–C10 oxypropylamine, octyloxypropylamine, 2-ethylhexyl-oxypropylamine, lauryl amido propylamine and amido propylamine.

Suitable tertiary amines for use herein include tertiary amines having the formula $R_1R_2R_3N$ wherein $R_1$ and $R_2$ are $C_1$–$C_8$ alkyl chains or

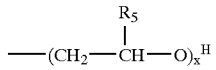

$R_3$ is either a $C_6$–$C_{12}$, preferably $C_6$–$C_{10}$ alkyl chain, or $R_3$ is $R_4X(CH_2)_n$, whereby X is —O—, —C(O)NH— or —NH—,$R_4$ is a $C_4$–$C_{12}$, n is between 1 to 5, preferably 2–3, $R_5$ is H or $C_1$–$C_2$ alkyl and x is between 1 to 6.

$R_3$ and $R_4$ can be linear or branched; $R_3$ alkyl chains can be interrupted with up to 12, preferably less than 5, ethylene oxide moieties.

Preferred tertiary amines are $R_1R_2R_3N$ where $R_1$ is a $C_6$–$C_{12}$ alkyl chain, $R_2$ and $R_3$ are $C_1$–$C_3$ alkyl or

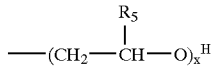

where $R_5$ is H or $CH_3$ and x=1–2.

Also preferred are the amidoamines of the formula:

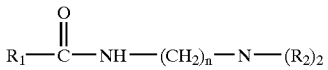

wherein $R_1$ is $C_6$–$C_{12}$ alkyl; n is 2–4, preferably n is 3; $R_2$ and $R_3$ is $C_1$–$C_4$ Most preferred amines of the present invention include 1-octylamine, 1-hexylamine, 1-decylamine, 1-dodecylamine,C8–10oxypropylamine, N coco 1–3diaminopropane, coconutalkyldimethylamine, lauryldimethylamine, lauryl bis(hydroxyethyl)amine, coco bis(hydroxyethyl)amine, lauryl amine 2 moles propoxylated, octyl amine 2 moles propoxylated, lauryl amidopropyldimethylamine, C8–10 amidopropyldimethylamine and C10 amidopropyldimethylamine.

The most preferred amines for use in the compositions herein are 1-hexylamine, 1-octylamine, 1-decylamine, 1-dodecylamine. Especially desirable are n-dodecyldimethylamine and bishydroxyethylcoconutalkylamine and oleylamine 7 times ethoxylated, lauryl amido propylamine and cocoamido propylamine.

Odor Control Agent

The compositions for odor control are of the type disclosed in U.S. Pat. Nos. 5,534,165; 5,578,563; 5,663,134; 5,668,097; 5,670,475; and 5,714,137, Trinh et al. issued Jul. 9, 1996; Nov. 26, 1996; Sep. 2, 1997; Sep. 16, 1997; Sep. 23, 1997; and Feb. 3, 1998 respectively, all of said patents being incorporated herein by reference. Fabric care compositions of the present invention can contain several different optional odor control agents, preferably cyclodextrins, water soluble zinc salts, water soluble copper salts, and mixtures thereof.

(a). Cyclodextrin

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet fabrics. As the water is being removed however, e.g., the fabric is being dried off, some low molecular weight organic amines and acids have more affinity and will complex with the cyclodextrins more readily.

The cavities within the cyclodextrin in the solution of the present invention should remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85% (about 1.85 g in 100 grams of water) at room temperature. Beta-cyclodextrin is not preferred in compositions which call for a level of cyclodextrin higher than its water solubility limit. Non-derivatised beta-cyclodextrin is generally not preferred when the composition contains surfactant since it affects the surface activity of most of the preferred surfactants that are compatible with the derivatised cyclodextrins.

Preferably, the odor absorbing solution of the present invention is clear. The term "clear" as defined herein means transparent or translucent, preferably transparent, as in "water clear," when observed through a layer having a thickness of less than about 10 cm.

Preferably, the cyclodextrins used in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio)propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3–6-anhydro-cyclomalto structure, e.g., the mono-3–6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. No. 3,426,011, Parmerter et al., issued Feb. 4, 1969; U.S. Pat. Nos. 3,453,257; 3,453,258; 3,453,259; and 3,453,260, all in the names of Parmerter et al., and all issued Jul. 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,678,598, Ogino et al., issued Jul. 7, 1987; U.S. Pat. No. 4,638,058, Brandt et al., issued Jan. 20, 1987; and U.S. Pat. No. 4,746,734, Tsuchiyama et al., issued May 24, 1988; all of said patents being incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrins is alpha-cyclodextrin and its derivatives thereof, gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

For controlling odor on fabrics, the composition is preferably used as a spray. Typical levels of cyclodextrin in usage compositions for usage conditions are from about 0.01% to about 5%, preferably from about 0.1% to about 4%, more preferably from about 0.5% to about 2% by weight of the composition. It is preferable that the treated fabric contains a level of less than about 5 mg of cyclodextrin per gram of fabric, more preferably less than about 2 mg of cyclodextrin per gram of fabric.

Low Molecular Weight Polyols

Low molecular weight polyols with relatively high boiling points, as compared to water, such as ethylene glycol, propylene glycol and/or glycerol are preferred optional ingredients for improving odor control performance of the composition of the present invention when cyclodextrin is present. Not to be bound by theory, it is believed that the incorporation of a small amount of low molecular weight glycols into the composition of the present invention enhances the formation of the cyclodextrin inclusion complexes as the fabric dries.

It is believed that the polyols' ability to remain on the fabric for a longer period of time than water, as the fabric dries allows it to form ternary complexes with the cyclodextrin and some malodorous molecules. The addition of the glycols is believed to fill up void space in the cyclodextrin cavity that is unable to be filled by some malodor molecules of relatively smaller sizes. Preferably the glycol used is glycerin, ethylene glycol, propylene glycol, diethylene glycol, dipropylene glycol or mixtures thereof, more preferably ethylene glycol and/or propylene glycol. Cyclodextrins prepared by processes that result in a level of such polyols are highly desirable, since they can be used without removal of the polyols.

Some polyols, e.g., dipropylene glycol, are also useful to facilitate the solubilization of some perfume ingredients in the composition of the present invention.

Typically, glycol is added to the composition of the present invention at a level of from about 0.01% to about 3%, by weight of the composition, preferably from about 0.05% to about 1%, more preferably from about 0.1% to about 0.5%, by weight of the composition. The preferred weight ratio of low molecular weight polyol to cyclodextrin is from about 2:1,000 to about 20:100, more preferably from about 3:1,000 to about 15:100, even more preferably from about 5:1,000 to about 10:100, and most preferably from about 1:100 to about 7:100.

(b). Metal Salts

Optionally, but highly preferred, the present invention can include metallic salts for added odor absorption and/or antimicrobial benefit for the cyclodextrin solution when cyclodextrin is present. The metallic salts are selected from the group consisting of copper salts, zinc salts, and mixtures thereof.

Copper salts have some antimicrobial benefits. Specifically, cupric abietate acts as a fungicide, copper acetate acts as a mildew inhibitor, cupric chloride acts as a fungicide, copper lactate acts as a fungicide, and copper sulfate acts as a germicide. Copper salts also possess some malodor control abilities. See U.S. Pat. No. 3,172,817, Leupold, et al., which discloses deodorizing compositions for treating disposable articles, comprising at least slightly water-soluble salts of acylacetone, including copper salts and zinc salts, all of said patents are incorporated herein by reference.

The preferred zinc salts possess malodor control abilities. Zinc has been used most often for its ability to ameliorate malodor, e.g., in mouth wash products, as disclosed in U.S. Pat. No. 4,325,939, issued Apr. 20, 1982 and U.S. Pat. No. 4,469,674, issued Sep. 4, 1983, to N. B. Shah, et al., all of which are incorporated herein by reference. Highly-ionized and soluble zinc salts such as zinc chloride, provide the best source of zinc ions. Zinc borate functions as a fungistat and a mildew inhibitor, zinc caprylate functions as a fungicide, zinc chloride provides antiseptic and deodorant benefits, zinc ricinoleate functions as a fungicide, zinc sulfate heptahydrate functions as a fungicide and zinc undecylenate functions as a fungistat.

Preferably the metallic salts are water-soluble zinc salts, copper salts or mixtures thereof, and more preferably zinc salts, especially $ZnCl_2$. These salts are preferably present in the present invention primarily to absorb amine and sulfur-containing compounds that have molecular sizes too small to be effectively complexed with the cyclodextrin molecules. Low molecular weight sulfur-containing materials, e.g., sulfide and mercaptans, are components of many types of malodors, e.g., food odors (garlic, onion), body/perspiration odor, breath odor, etc. Low molecular weight amines are also components of many malodors, e.g., food odors, body odors, urine, etc.

When metallic salts are added to the composition of the present invention they are typically present at a level of from about 0.1% to about 10%, preferably from about 0.2% to about 8%, more preferably from about 0.3% to about 5% by weight of the usage composition. When zinc salts are used as the metallic salt, and a clear solution is desired, it is preferable that the pH of the solution is adjusted to less than about 7, more preferably less than about 6, most preferably, less than about 5, in order to keep the solution clear.

(c). Soluble Carbonate and/or Bicarbonate Salts

Water-soluble alkali metal carbonate and/or bicarbonate salts, such as sodium bicarbonate, potassium bicarbonate, potassium carbonate, cesium carbonate, sodium carbonate, and mixtures thereof can be added to the composition of the present invention in order to help to control certain acid-type odors. Preferred salts are sodium carbonate monohydrate, potassium carbonate, sodium bicarbonate, potassium bicarbonate, and mixtures thereof. When these salts are added to the composition of the present invention, they are typically present at a level of from about 0.1% to about 5%, preferably from about 0.2% to about 3%, more preferably from about 0.3% to about 2%, by weight of the composition. When these salts are added to the composition of the present invention it is preferably that incompatible metal salts not be present in the invention. Preferably, when these salts are used the composition should be essentially free of zinc and other incompatible metal ions, e.g., Ca, Fe, Ba, etc. which form water-insoluble salts.

(d). Zeolites

When the clarity of the solution is not needed, and the solution is not sprayed on fabrics, other optional odor absorbing materials, e.g., zeolites and/or activated carbon, can also be used. A preferred class of zeolites is characterized as "intermediate" silicate/aluminate zeolites. The intermediate zeolites are characterized by $SiO_2/AlO_2$ molar ratios of less than about 10. Preferably the molar ratio of $SiO_2/AlO_2$ ranges from about 2 to about 10. The intermediate zeolites have an advantage over the "high" zeolites. The intermediate zeolites have a higher affinity for amine-type odors, they are more weight efficient for odor absorption because they have a larger surface area, and they are more moisture tolerant and retain more of their odor absorbing capacity in water than the high zeolites. A wide variety of intermediate zeolites suitable for use herein are commercially available as Valfor® CP301-68, Valfor® 300-63, Valfor® CP300-35, and Valfor® CP300-56, available from PQ Corporation, and the CBV100® series of zeolites from Conteka.

Zeolite materials marketed under the trade name Abscents® and Smellrite®, available from The Union Carbide Corporation and UOP are also preferred. These materials are typically available as a white powder in the 3–5 micron particle size range. Such materials are preferred over the intermediate zeolites for control of sulfur-containing odors, e.g., thiols, mercaptans.

(e). Activated Carbon

The carbon material suitable for use in the present invention is the material well known in commercial practice as an absorbent for organic molecules and/or for air purification purposes. Often, such carbon material is referred to as "activated" carbon or "activated" charcoal. Such carbon is available from commercial sources under such trade names as; Calgon-Type CPG®; Type PCB®; Type SGL®; Type CAL®; and Type OL®.

(f). Mixtures Thereof

Mixtures of the above materials are desirable, especially when the mixture provides control over a broader range of odors.

Perfume

The fabric care composition of the present invention can also optionally provide a "scent signal" in the form of a pleasant odor which provides a freshness impression to the treated fabrics. The scent signal can be designed to provide a fleeting perfume scent. When perfume is added as a scent signal, it is added only at very low levels, e.g., from about 0.001% to about 0.5%, preferably from about 0.003% to about 0.3%, more preferably from about 0.005% to about 0.2%, by weight of the usage composition.

Perfume can also be added as a more intense odor in product and on fabrics. When stronger levels of perfume are preferred, relatively higher levels of perfume can be added.

Any type of perfume can be incorporated into the composition of the present invention. The preferred perfume ingredients are those suitable for use to apply on fabrics and garments. Typical examples of such preferred ingredients are given in U.S. Pat. No. 5,445,747, issued Aug. 29, 1995 to Kvietok et al., incorporated herein by reference.

When long lasting fragrance odor on fabrics is desired, it is preferred to use at least an effective amount of substantive perfume ingredients. Nonlimiting examples of such preferred ingredients are given in U.S. Pat. Nos. 5,500,138 and 5,652,206, issued Mar. 19, 1996 and Jul. 29, 1997, respectively, to Bacon et al., said patents being incorporated herein by reference. It is also preferred to use materials that can slowly release perfume ingredients after the fabric is treated by the fabric care composition of this invention. Examples of materials of this type are given in U.S. Pat. No. 5,531,910, Severns et al., issued Jul. 2, 1996, said patent being incorporated herein by reference.

As used herein, perfume includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

Examples of perfume ingredients useful in the perfumes of the present invention compositions include, but are not limited to, those materials disclosed in said patents.

The perfumes useful in the present invention compositions are preferably substantially free of halogenated materials and nitromusks.

Suitable solvents, diluents or carriers for perfumes ingredients mentioned above are for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution.

Perfume can be present at a level of from 0% to about 15%, preferably from about 0.1% to about 8%, and more preferably from about 0.2% to about 5%, by weight of the finished fabric care composition.

When cyclodextrin is present, it is essential that the perfume be added at a level wherein even if all of the perfume in the composition were to complex with the cyclodextrin molecules when cyclodextrin is present, there will still be an effective level of uncomplexed cyclodextrin molecules present in the solution to provide adequate odor control. In order to reserve an effective amount of cyclodextrin molecules for odor control when cyclodextrin is present, perfume is typically present at a level wherein less than about 90% of the cyclodextrin complexes with the perfume, preferably less than about 50% of the cyclodextrin complexes with the perfume, more preferably, less than about 30% of the cyclodextrin complexes with the perfume, and most preferably, less than about 10% of the cyclodextrin complexes with the perfume. The cyclodextrin to perfume weight ratio should be greater than about 8:1, preferably greater than about 10:1, more preferably greater than about 20:1, even more preferably greater than 40:1 and most preferably greater than about 70:1.

Preferably the perfume is hydrophilic and is composed predominantly of ingredients selected from two groups of ingredients, namely, (a) hydrophilic ingredients having a ClogP of less than about 3.5, more preferably less than about 3.0, and (b) ingredients having significant low detection threshold, and mixtures thereof. Typically, at least about 50%, preferably at least about 60%, more preferably at least about 70%, and most preferably at least about 80% by weight of the perfume is composed of perfume ingredients of the above groups (a) and (b). For these preferred perfumes, the cyclodextrin to perfume weight ratio is typically of from about 2:1 to about 200:1; preferably from about 4:1 to about 100:1, more preferably from about 6:1 to about 50:1, and even more preferably from about 8:1 to about 30:1.

(a). Hydrophilic Perfume Ingredients

The hydrophilic perfume ingredients are more soluble in water, have less of a tendency to complex with the cyclodextrins, and are more available in the odor absorbing composition than the ingredients of conventional perfumes. The degree of hydrophobicity of a perfume ingredient can be correlated with its octanol/water partition coefficient P. The octanol/water partition coefficient of a perfume ingredient is the ratio between its equilibrium concentration in octanol and in water. A perfume ingredient with a greater partition coefficient P is considered to be more hydrophobic. Conversely, a perfume ingredient with a smaller partition coefficient P is considered to be more hydrophilic. Since the partition coefficients of the perfume ingredients normally have high values, they are more conveniently given in the form of their logarithm to the base 10, logP. Thus the preferred perfume hydrophilic perfume ingredients of this invention have logP of about 3.5 or smaller, preferably of about 3.0 or smaller.

The logP of many perfume ingredients have been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are used instead of the experimental logP values in the selection of perfume ingredients which are useful in the present invention.

Non-limiting examples of the more preferred hydrophilic perfume ingredients are allyl amyl glycolate, allyl caproate, amyl acetate, amyl propionate, anisic aldehyde, anisyl acetate, anisole, benzaldehyde, benzyl acetate, benzyl acetone, benzyl alcohol, benzyl formate, benzyl iso valerate, benzyl propionate, beta gamma hexenol, calone, camphor gum, laevo-carveol, d-carvone, laevo-carvone, cinnamic alcohol, cinnamyl acetate, cinnamic alcohol, cinnamyl formate, cinnamyl propionate, cis-jasmone, cis-3-hexenyl acetate, coumarin, cuminic alcohol, cuminic aldehyde, Cyclal C, cyclogalbanate, dihydroeuginol, dihydro isojasmonate, dimethyl benzyl carbinol, dimethyl benzyl carbinyl acetate, ethyl acetate, ethyl aceto acetate, ethyl amyl ketone, ethyl anthranilate, ethyl benzoate, ethyl butyrate, ethyl cinnamate, ethyl hexyl ketone, ethyl maltol, ethyl-2-methyl butyrate, ethyl methylphenyl glycidate, ethyl phenyl acetate, ethyl salicylate, ethyl vanillin, eucalyptol, eugenol, eugenyl acetate, eugenyl formate, eugenyl methyl ether, fenchyl alcohol, flor acetate (tricyclo decenyl acetate), fructone, frutene (tricyclo decenyl propionate), geraniol, geranyl oxyacetaldehyde, heliotropin, hexenol, hexenyl acetate, hexyl acetate, hexyl formate, hinokitiol, hydrotropic alcohol, hydroxycitronellal, hydroxycitronellal diethyl acetal, hydroxycitronellol, indole, isoamyl alcohol, iso cyclo citral, isoeugenol, isoeugenyl acetate, isomenthone, isopulegyl acetate, isoquinoline, keone, ligustral, linalool, linalool oxide, linalyl formate, lyral, menthone, methyl acetophenone, methyl amyl ketone, methyl anthranilate, methyl benzoate, methyl benzyl acetate, methyl cinnamate, methyl dihydrojasmonate, methyl eugenol, methyl heptenone, methyl heptine carbonate, methyl heptyl ketone, methyl hexyl ketone, methyl isobutenyl tetrahydropyran, methyl-N-methyl anthranilate, methyl beta naphthyl ketone, methyl phenyl carbinyl acetate, methyl salicylate, nerol, nonalactone, octalactone, octyl alcohol (octanol-2), para-anisic aldehyde, para-cresol, para-cresyl methyl ether, para hydroxy phenyl butanone, para-methoxy acetophenone, para-methyl acetophenone, phenoxy ethanol, phenoxyethyl propionate, phenyl acetaldehyde, phenylacetaldehyde diethyl ether, phenylethyl oxyacetaldehyde, phenyl ethyl acetate, phenyl ethyl alcohol, phenyl ethyl dimethyl carbinol, prenyl acetate, propyl butyrate, pulegone, rose oxide, safrole, terpineol, vanillin, viridine, and mixtures thereof.

Nonlimiting examples of other preferred hydrophilic perfume ingredients which can be used in perfume compositions of this invention are allyl heptoate, amyl benzoate, anethole, benzophenone, carvacrol, citral, citronellol, citronellyl nitrile, cyclohexyl ethyl acetate, cymal, 4-decenal, dihydro isojasmonate, dihydro myrcenol, ethyl methyl phenyl glycidate, fenchyl acetate, florhydral, gamma-nonalactone, geranyl formate, geranyl nitrile, hexenyl isobutyrate, alpha-ionone, isobornyl acetate, isobutyl benzoate, isononyl alcohol, isomenthol, para-isopropyl phenylacetaldehyde, isopulegol, linalyl acetate, 2-methoxy naphthalene, menthyl acetate, methyl chavicol, musk ketone, beta naphthol methyl ether, neral, nonyl aldehyde, phenyl heptanol, phenyl hexanol, terpinyl acetate, Veratrol, yara—yara, and mixtures thereof.

The preferred perfume compositions used in the present invention contain at least 4 different hydrophilic perfume ingredients, preferably at least 5 different hydrophilic perfume ingredients, more preferably at least 6 different hydrophilic perfume ingredients, and even more preferably at least 7 different hydrophilic perfume ingredients. Most common perfume ingredients which are derived from natural sources are composed of a multitude of components. When each such material is used in the formulation of the preferred perfume compositions of the present invention, it is counted as one single ingredient, for the purpose of defining the invention.

(b). Low Odor Detection Threshold Perfume Ingredients

The odor detection threshold of an odorous material is the lowest vapor concentration of that material which can be olfactorily detected. The odor detection threshold and some odor detection threshold values are discussed in, e.g., "Standardized Human Olfactory Thresholds", M. Devos et al, IRL Press at Oxford University Press, 1990, and "Compilation of Odor and Taste Threshold Values Data", F. A. Fazzalari, editor, ASTM Data Series DS 48A, American Society for Testing and Materials, 1978, both of said publications being incorporated by reference. The use of small amounts of perfume ingredients that have low odor detection threshold values can improve perfume odor character, even though they are not as hydrophilic as perfume ingredients of group (a) which are given hereinabove. Perfume ingredients that do not belong to group (a) above, but have a significantly low detection threshold, useful in the composition of the present invention, are selected from the group consisting of ambrox, bacdanol, benzyl salicylate, butyl anthranilate, cetalox, damascenone, alpha-damascone, gamma-dodecalactone, ebanol, herbavert, cis-3-hexenyl salicylate, alpha-ionone, beta-ionone, alpha-isomethylionone, lilial, methyl nonyl ketone, gamma-undecalactone, undecylenic aldehyde, and mixtures thereof. These materials are preferably present at low levels in addition to the hydrophilic ingredients of group (a), typically less than about 20%, preferably less than about 15%, more preferably less than about 10%, by weight of the total perfume compositions of the present invention. However, only low levels are required to provide an effect.

There are also hydrophilic ingredients of group (a) that have a significantly low detection threshold, and are especially useful in the composition of the present invention. Examples of these ingredients are allyl amyl glycolate, anethole, benzyl acetone, calone, cinnamic alcohol, coumarin, cyclogalbanate, Cyclal C, cymal, 4-decenal, dihydro isojasmonate, ethyl anthranilate, ethyl-2-methyl butyrate, ethyl methylphenyl glycidate, ethyl vanillin, eugenol, flor acetate, florhydral, fructone, frutene, heliotropin, keone, indole, iso cyclo citral, isoeugenol, lyral, methyl heptine carbonate, linalool, methyl anthranilate, methyl dihydrojasmonate, methyl isobutenyl tetrahydropyran, methyl beta naphthyl ketone, beta naphthol methyl ether, nerol, para-anisic aldehyde, para hydroxy phenyl butanone, phenyl acetaldehyde, vanillin, and mixtures thereof. Use of low odor detection threshold perfume ingredients minimizes the level of organic material that is released into the atmosphere.

Antimicrobial Active

Optionally, the fabric care composition of the present invention comprise an effective amount, to kill, or reduce the growth of microbes, of antimicrobial active; preferably from about 0.001% to about 2%, more preferably from about 0.002% to about 1%, even more preferably from about 0.003% to about 0.3%, by weight of the usage composition. The effective antimicrobial active can function as disinfectants/sanitizers, and is useful in providing protection against organisms that become attached to the fabrics.

Given below are nonlimiting examples of antimicrobial actives which are useful in the present invention:

Pyrithiones, especially the zinc complex (ZPT); Octopirox; Parabens, including Methylparaben, Propylparaben, Butylparaben, Ethylparaben, Isopropylparaben, Isobutylparaben, Benzylparaben, Sodium Methylparaben, and Sodium Propylparaben; DMDM Hydantoin (Glydant); Methylchloroisothiazolinone/methylisothiazolinone (Kathon CG); Sodium Sulfite; Sodium Bisulfite; Imidazolidinyl Urea; Diazolidinyl Urea (Germail 2); Sorbic Acid/Potassium Sorbate; Dehydroacetic Acid/Sodium Dehydroacetate; Benzyl Alcohol; Sodium Borate; 2-Bromo-2-nitropropane-1,3-diol (Bronopol); Formalin; Iodopropynyl Butylcarbamate; Boric Acid; Chloroacetamide; Methenamine; Methyldibromo Glutaronitrile; Glutaraldehyde; Hexamidine Isethionate; 5-bromo-5-nitro-1,3-dioxane; Phenethyl Alcohol; o-Phenylphenol/sodium o-phenylphenol; Sodium Hydroxymethylglycinate; Polymethoxy Bicyclic Oxazolidine; Dimethoxane; Thimersol; Dichlorobenzyl alcohol; Captan; Chlorphenenesin; Dichlorophene; Chlorbutanol; Phenoxyethanol; Phenoxyisopropanol; Halogenated Diphenyl Ethers; 2,4,4'-trichloro-2'-hydroxy-diphenyl ether (Triclosan); 2,2'-dihydroxy-5,5'-dibromo-diphenyl ether;

Phenolic Compounds—(including phenol and its homologs, mono- and poly-alkyl and aromatic halophenols, resorcinol and its derivatives, bisphenolic compounds and halogenated salicylanilides); Phenol and its Homologs including Phenol, 2-Methyl Phenol, 3-Methyl Phenol, 4-Methyl Phenol, 4-Ethyl Phenol, 2,4-Dimethyl Phenol, 2,5-Dimethyl Phenol, 3,4-Dimethyl Phenol, 2,6-Dimethyl Phenol, 4-n-Propyl Phenol, 4-n-Butyl Phenol, 4-n-Amyl Phenol, 4-tert-Amyl Phenol, 4-n-Hexyl Phenol, and 4-n-Heptyl Phenol; Mono- and Poly-Alkyl and Aromatic Halophenols including p-Chlorophenol, Methyl p-Chlorophenol, Ethyl p-Chlorophenol, n-Propyl p-Chlorophenol, n-Butyl p-Chlorophenol, n-Amyl p-Chlorophenol, sec-Amyl p-Chlorophenol, n-Hexyl p-Chlorophenol, Cyclohexyl p-Chlorophenol, n-Heptyl p-Chlorophenol, n-Octyl p-Chlorophenol, o-Chlorophenol, Methyl o-Chlorophenol, Ethyl o-Chlorophenol, n-Propyl o-Chlorophenol, n-Butyl o-Chlorophenol, n-Amyl o-Chlorophenol, tert-Amyl o-Chlorophenol, n-Hexyl o-Chlorophenol, n-Heptyl o-Chlorophenol, o-Benzyl p-Chlorophenol, o-benzyl-m-methyl p-Chlorophenol, o-Benzyl-m, m-dimethyl p-Chlorophenol, o-Phenylethyl p-Chlorophenol, o-Phenylethyl-m-methyl p-Chlorophenol, 3-Methyl p-Chlorophenol, 3,5-Dimethyl p-Chlorophenol, 6-Ethyl-3-methyl p-Chlorophenol, 6-n-Propyl-3-methyl p-Chlorophenol, 6-iso-Propyl-3-methyl p-Chlorophenol, 2-Ethyl-3,5-dimethyl p-Chlorophenol, 6-sec-Butyl-3-methyl p-Chlorophenol, 2-iso-Propyl-3,5-dimethyl p-Chlorophenol, 6-Diethylmethyl-3-methyl p-Chlorophenol, 6-iso-Propyl-2-ethyl-3-methyl p-Chlorophenol, 2-sec-Amyl-3,5-dimethyl p-Chlorophenol, 2-Diethylmethyl-3,5-dimethyl p-Chlorophenol, 6-sec-Octyl-3-methyl p-Chlorophenol, p-Chloro-m-cresol, p-Bromophenol, Methyl p-Bromophenol, Ethyl p-Bromophenol, n-Propyl p-Bromophenol, n-Butyl p-Bromophenol, n-Amyl p-Bromophenol, sec-Amyl p-Bromophenol, n-Hexyl p-Bromophenol, cyclohexyl p-Bromophenol, o-Bromophenol, tert-Amyl o-Bromophenol, n-Hexyl o-Bromophenol, n-Propyl-m,m-Dimethyl o-Bromophenol, 2-Phenyl Phenol, 4-Chloro-2-methyl phenol, 4-Chloro-3-methyl phenol, 4-Chloro-3,5-dimethyl phenol, 2,4-dichloro-3,5-dimethylphenol, 3,4,5,6-terabromo-2-methylphenol, 5-methyl-2-pentylphenol, 4-isopropyl-3-methylphenol, para-chloro-meta-xylenol (PCMX), 5-Chloro-2-hydroxydiphenylmethane; Resorcinol and its Derivatives including Resorcinol, Methyl Resorcinol, Ethyl Resorcinol, n-Propyl Resorcinol, n-Butyl Resorcinol, n-Amyl Resorcinol, n-Hexyl Resorcinol, n-Heptyl Resorcinol, n-Octyl Resorcinol, n-Nonyl Resorcinol, Phenyl Resorcinol, Benzyl Resorcinol, Phenylethyl Resorcinol, Phenylpropyl Resorcinol, p-Chlorobenzyl Resorcinol, 5-Chloro 2,4-Dihydroxydiphenyl Methane, 4'-Chloro 2,4-Dihydroxydiphenyl Methane, 5-Bromo 2,4-Dihydroxydiphenyl Methane, and 4'-Bromo 2,4-Dihydroxydiphenyl Methane; Bisphenolic Compounds including 2,2'-, methylene bis (4-chlorophenol), 2,2'-methylene bis (3,4,6-trichlorophenol), 2,2'-methylene bis (4-chloro-6-bromophenol), bis (2-hydroxy-3,5-dichlorophenyl) sulphide, and bis (2-hydroxy-5-chlorobenzyl)sulphide; Benzoic Esters including p-Hydroxybenzoic Acid, Methyl p-Hydroxybenzoic Acid, Ethyl p-Hydroxybenzoic Acid, Propyl p-Hydroxybenzoic Acid, and Butyl p-Hydroxybenzoic Acid.

Another class of antibacterial agents, which are useful in the present invention, are the so-called "natural" antibacterial actives, referred to as natural essential oils. These actives derive their names from their natural occurrence in plants. Typical natural essential oil antibacterial actives include oils of anise, lemon, orange, rosemary, wintergreen, thyme, lavender, cloves, hops, tea tree, citronella, wheat, barley, lemongrass, cedar leaf, cedarwood, cinnamon, fleagrass, geranium, sandalwood, violet, cranberry, eucalyptus, vervain, peppermint, gum benzoin, *Hydastis carradensis, Berberidaceae. daceae, Ratanhiae* and *Curcuma longa*. Also included in this class of natural essential oils are the key chemical components of the plant oils which have been found to provide the antimicrobial benefit. These chemicals include, but are not limited to anethol, catechole, camphene, thymol, eugenol, eucalyptol, ferulic acid, farnesol, hinokitiol, tropolone, limonene, menthol, methyl salicylate, salicylic acid, thymol, terpineol, verbenone, berberine, ratanhiae extract, caryophellene oxide, citronellic acid, curcumin, nerolidol, geraniol and benzoic acid.

Additional active agents are antibacterial metal salts. This class generally includes salts of metals in groups 3b–7b, 8 and 3a–5a. Specifically are the salts of aluminum, zirconium, zinc, silver, gold, copper, lanthanum, tin, mercury, bismuth, selenium, strontium, scandium, yttrium, cerium, praseodymiun, neodymium, promethum, samarium, europium, gadolinium, terbium, dysprosium, holmium, erbium, thulium, ytterbium, lutetium and mixtures thereof.

Preferred antimicrobial agents for use herein are the broad spectrum actives selected from the group consisting of Triclosan, phenoxyisopropanol, phenoxyethanol, PCMX, natural essential oils and their key ingredients, and mixtures thereof. The most preferred antimicrobial active for use in the present invention is Triclosan.

Quaternary Compounds. A wide range of quaternary compounds can also be used as antimicrobial actives, in conjunction with the preferred surfactants, for compositions of the present invention. Non-limiting examples of useful quaternary compounds include: (1) benzalkonium chlorides and/or substituted benzalkonium chlorides such as commercially available Barquat® (available from Lonza), Maquat® (available from Mason), Variquat® (available from Witco/Sherex), and Hyamine® (available from Lonza); (2) di(C6–C 14)alkyl di-short chain ($C_{1-4}$ alkyl and/or hydroxyalkyl) quaternary such as Bardac® products of Lonza. These quaternary compounds contain two relatively short chains, e.g., $C_{1-4}$ alkyl and/or hydroxy alkyl groups and two $C_{6-12}$, preferably $C_{6-10}$, and more preferably $C_8$, alkyl groups, (3) N-(3-chloroallyl) hexaminium chlorides such as Dowicide® and Dowicil® available from Dow; (4) benzethonium chloride such as Hyamine® 1622 from Rohm & Haas; (5) methylbenzethonium chloride represented by Hyamine® 10X supplied by Rohm & Haas, (6) cetylpyridinium chloride such as Cepacol chloride available from of Merrell Labs. Examples of the preferred dialkyl quaternary compounds are di($C_8$–$C_{12}$)dialkyl dimethyl ammonium chloride, such as didecyldimethylammonium chloride (Bardac 22), and dioctyldimethylammonium chloride (Bardac 2050). Typical concentrations for biocidal effectiveness of these quaternary compounds range from about 0.001% to about 0.8%, preferably from about 0.005% to about 0.3%, more preferably from about 0.01% to 0.2%, by weight of the usage composition. The corresponding concentrations for the concentrated compositions are from about 0.003% to about 2%, preferably from about 0.006% to about 1.2%, and more preferably from about 0.1% to about 0.8% by weight of the concentrated compositions.

When cyclodextrin is present, the solubilized, water-soluble antimicrobial active is useful in providing protection against organisms that become attached to the treated fabrics. The antimicrobial should be cyclodextrin-compatible, e.g., not substantially forming complexes with the cyclodextrin in the odor absorbing composition when cyclodextrin is present. The free, uncomplexed antimicrobial, e.g., antibacterial, active provides an optimum antibacterial performance.

Sanitization of fabrics can be achieved by the compositions of the present invention containing, antimicrobial materials, e.g., antibacterial halogenated compounds, quaternary compounds, and phenolic compounds.

Biguanides. Some of the more robust cyclodextrin-compatible antimicrobial halogenated compounds which can function as disinfectants/sanitizers as well as finish product preservatives (vide infra), and are useful in the compositions of the present invention include 1,1'-hexamethylene bis(5-(p-chlorophenyl)biguanide), commonly known as chlorhexidine, and its salts, e.g., with hydrochloric, acetic and gluconic acids. The digluconate salt is highly water-soluble, about 70% in water, and the diacetate salt has a solubility of about 1.8% in water. When chlorhexidine is used as a sanitizer in the present invention it is typically present at a level of from about 0.001% to about 0.4%, preferably from about 0.002% to about 0.3%, and more preferably from about 0.05% to about 0.2%, by weight of the usage composition. In some cases, a level of from about 1% to about 2% may be needed for virucidal activity.

Other useful biguanide compounds include Cosmoci® CQ®, Vantocil® IB, including poly (hexamethylene biguanide) hydrochloride. Other useful cationic antimicrobial agents include the bis-biguanide alkanes. Usable water soluble salts of the above are chlorides, bromides, sulfates, alkyl sulfonates such as methyl sulfonate and ethyl sulfonate, phenylsulfonates such as p-methylphenyl sulfonates, nitrates, acetates, gluconates, and the like.

Examples of suitable bis biguanide compounds are chlorhexidine; 1,6-bis-(2-ethylhexylbiguanidohexane)dihydrochloride; 1,6-di-($N_1$,$N_1$'-phenyldiguanido-$N_5$,$N_5$')hexane tetrahydrochloride; 1,6-di-($N_1$,$N_1$'-phenyl-$N_1$,$N_1$'-methyldiguanido-$N_5$,$N_5$')hexane dihydrochloride; 1,6-di($N_1$,$N_1$'-o-chlorophenyldiguanido-$N_5$,$N_5$')-hexane dihydrochloride; 1,6-di($N_1$,$N_1$'-2,6-dichlorophenyldiguanido-$N_5$,$N_5$')hexane dihydrochloride; 1,6-di[$N_1$,$N_1$'-.beta.-(p-methoxyphenyl) diguanido-$N_5$,$N_5$']-hexane dihydrochloride; 1,6-di($N_1$,$N_1$'-.alpha.-methyl-.beta.-phenyldiguanido-$N_5$,$N_5$')-hexane dihydrochloride; 1,6-di($N_1$,$N_1$'-p-nitrophenyldiguanido-$N_5$, $N_5$')hexane dihydrochloride;.omega.:.omega.'-di-($N_1$,$N_1$'-phenyldiguanido-$N_5$,$N_5$')-di-n-propylether dihydrochloride; .omega:omega'-di($N_1$,$N_1$'-p-chlorophenyldiguanido-$N_5$, $N_5$')-di-n-propylether tetrahydrochloride; 1,6-di($N_1$,$N_1$'-2,4-dichlorophenyldiguanido-$N_5$,$N_5$')hexane tetrahydrochloride; 1,6-di($N_1$,$N_1$'-p-methylphenyldiguanido-$N_5$,$N_5$')hexane dihydrochloride; 1,6-di($N_1$,$N_1$'-2,4,5-trichlorophenyldiguanido-$N_5$,$N_5$')hexane tetrahydrochloride; 1,6-di[$N_1$,$N_1$'-.alpha.-(p-chlorophenyl) ethyldiguanido-$N_5$,$N_5$'] hexane dihydrochloride;.omega.:.omega.'di($N_1$, $N_1$'-p-chlorophenyldiguanido-$N_5$,$N_5$')m-xylene dihydrochloride; 1,12-di($N_1$,$N_1$'-p-chlorophenyldiguanido-$N_5$,$N_5$') dodecane dihydrochloride; 1,10-di($N_1$, $N_1$'-phenyldiguanido-$N_5$,$N_5$')-decane tetrahydrochloride; 1,12-di($N_1$,$N_1$'-phenyldiguanido-$N_5$,$N_5$') dodecane tetrahydrochloride; 1,6-di($N_1$,$N_1$'-o-chlorophenyldiguanido-$N_5$, $N_5$') hexane dihydrochloride; 1,6-di($N_1$,$N_1$'-p-chlorophenyldiguanido-$N_5$,$N_5$')-hexane tetrahydrochloride; ethylene bis (1-tolyl biguanide); ethylene bis (p-tolyl biguanide); ethylene bis(3,5-dimethylphenyl biguanide); ethylene bis(p-tert-amylphenyl biguanide); ethylene bis(nonylphenyl biguanide); ethylene bis (phenyl biguanide); ethylene bis (N-butylphenyl biguanide); ethylene bis (2,5-diethoxyphenyl biguanide); ethylene bis(2,4-dimethylphenyl biguanide); ethylene bis(o-diphenylbiguanide); ethylene bis(mixed amyl naphthyl biguanide); N-butyl ethylene bis(phenylbiguanide); trimethylene bis(o-tolyl biguanide); N-butyl trimethylene bis(phenyl biguanide); and the corresponding pharmaceutically acceptable salts of all of the above such as the acetates; gluconates; hydrochlorides; hydrobromides; citrates; bisulfites; fluorides; polymaleates; N-coconutalkylsarcosinates; phosphites; hypophosphites; perfluorooctanoates; silicates; sorbates; salicylates; maleates; tartrates; fumarates; ethylenediaminetetraacetates; iminodiacetates; cinnamates; thiocyanates; arginates; pyromellitates; tetracarboxybutyrates; benzoates; glutarates; monofluorophosphates; and perfluoropropionates, and mixtures thereof. Preferred antimicrobials from this group are 1,6-di-($N_1$,$N_1$'-phenyldiguanido-$N_5$,$N_5$')-hexane tetrahydrochloride; 1,6-di($N_1$, $N_1$'-o-chlorophenyldiguanido-$N_5$,$N_5$')-hexane dihydrochloride; 1,6-di($N_1$,$N_1$'-2,6-dichlorophenyldiguanido-$N_5$,$N_5$')hexane dihydrochloride; 1,6-di($N_1$,$N_1$'-2,4-dichlorophenyldiguanido-$N_5$,$N_5$')hexane tetrahydrochloride; 1,6-di [$N_1$,$N_1$'-.alpha.-(p-chlorophenyl) ethyldiguanido-$N_5$,$N_5$'] hexane dihydrochloride;.omega.:.omega.'di($N_1$, $N_1$'-p-chlorophenyldiguanido-$N_5$,$N_5$')m-xylene dihydrochloride; 1,12-di($N_1$,$N_1$'-p-chlorophenyldiguanido-$N_5$,$N_5$') dodecane dihydrochloride; 1,6-di($N_1$, $N_1$'-o-chlorophenyldiguanido-$N_5$,$N_5$') hexane dihydrochloride; 1,6-di($N_1$,$N_1$'-p-chlorophenyldiguanido-$N_5$,$N_5$')-hexane tetrahydrochloride; and mixtures thereof; more preferably, 1,6-di($N_1$,$N_1$'-o-chlorophenyldiguanido-$N_5$,$N_5$')-hexane dihydrochloride; 1,6-di($N_1$,$N_1$'-2,6-dichlorophenyldiguanido-$N_5$,$N_5$')hexane dihydrochloride; 1,6-di ($N_1$,$N_1$'-2,4-dichlorophenyldiguanido-$N_5$,$N_5$')hexane tetrahydrochloride; 1,6-di[$N_1$,$N_1$'-.alpha.-(p-chlorophenyl) ethyldiguanido-$N_5$,$N_5$'] hexane dihydrochloride;.omega.:.omega.'di($N_1$,$N_1$'-p-chlorophenyldiguanido-$N_5$,$N_5$')m-xylene dihydrochloride; 1,12-di($N_1$',$N_1$'-p-chlorophenyldiguanido-$N_5$,$N_5$') dodecane dihydrochloride; 1,6-di($N_1$, $N_1$'-o-chlorophenyldiguanido-$N_5$,$N_5$') hexane dihydrochloride; 1,6-di($N_1$,$N_1$'-p-chlorophenyldiguanido-$N_5$,$N_5$')-hexane tetrahydrochloride; and mixtures thereof. As stated hereinbefore, the bis biguanide of choice is chlorhexidine its salts, e.g., digluconate, dihydrochloride, diacetate, and mixtures thereof.

The surfactants, when added to the antimicrobials tend to provide improved antimicrobial action. This is especially true for the siloxane surfactants, and especially when the siloxane surfactants are combined with the chlorhexidine antimicrobial actives.

Aminocarboxylate Chelators

Chelators, e.g., ethylenediaminetetraacetic acid (EDTA), hydroxyethylene-diaminetriacetic acid, diethylenetriaminepentaacetic acid, and other aminocarboxylate chelators, and mixtures thereof, and their salts, and mixtures thereof, can optionally be used to increase antimicrobial and preservative effectiveness against Gram-negative bacteria, especially *Pseudomonas* species. Although sensitivity to EDTA and other aminocarboxylate chelators is mainly a characteristic of *Pseudomonas* species, other bacterial species highly susceptible to chelators include *Achromobacter, Alcaligenes, Azotobacter, Escherichia, Salmonella, Spirillum*, and *Vibrio*. Other groups of organisms also show increased sensitivities to these chelators, including fungi and yeasts. Furthermore, aminocarboxylate chelators can help, e.g., maintaining product clarity, protecting fragrance and perfume components, and preventing rancidity and off odors.

Although these aminocarboxylate chelators may not be potent biocides in their own right, they function as potentiators for improving the performance of other antimicrobials/preservatives in the compositions of the present invention. Aminocarboxylate chelators can potentiate the performance of many of the cationic, anionic, and nonionic antimicrobials/preservatives, phenolic compounds, and isothiazolinones, that are used as antimicrobials/preservatives in the composition of the present invention. Nonlimiting examples of cationic antimicrobials/preservatives potentiated by aminocarboxylate chelators in solutions are chlorhexidine salts (including digluconate, diacetate, and dihydrochloride salts), and Quaternium-15, also known as Dowicil 200, Dowicide Q, Preventol D1, benzalkonium chloride, cetrimonium, myristalkonium chloride, cetylpyridinium chloride, lauryl pyridinium chloride, and the like. Nonlimiting examples of useful anionic antimicrobials/preservatives which are enhanced by aminocarboxylate chelators are sorbic acid and potassium sorbate. Nonlimiting examples of useful nonionic antimicrobials/preservatives which are potentiated by aminocarboxylate chelators are DMDM hydantoin, phenethyl alcohol, monolaurin, imidazolidinyl urea, and Bronopol (2-bromo-2-nitropropane-1,3-diol).

Examples of useful phenolic antimicrobials/preservatives potentiated by these chelators are chloroxylenol, phenol, tert-butyl hydroxyanisole, salicylic acid, resorcinol, and sodium o-phenyl phenate. Nonlimiting examples of isothiazolinone antimicrobials/preservatives which are enhanced by aminocarboxylate chelators are Kathon, Proxel and Promexal.

The optional chelators are present in the compositions of this invention at levels of, typically, from about 0.01% to about 0.3%, more preferably from about 0.02% to about 0.1%, most preferably from about 0.02% to about 0.05% by weight of the usage compositions to provide antimicrobial efficacy in this invention.

Free, uncomplexed aminocarboxylate chelators are required to potentiate the efficacy of the antimicrobials. Thus, when excess alkaline earth (especially calcium and magnesium) and transitional metals (iron, manganese, copper, and others) are present, free chelators are not available and antimicrobial potentiation is not observed. In the case where significant water hardness or transitional metals are available or where product esthetics require a specified chelator level, higher levels may be required to allow for the availability of free, uncomplexed aminocarboxylate chelators to function as antimicrobial/preservative potentiators.

Antimicrobial Preservative

Optionally, but preferably, an antimicrobial preservative can be added to the composition of the present invention, preferably solubilized, water-soluble, antimicrobial preservative, to protect the fabric care polysaccharide with globular structure and/or other easily degradable organic ingredients such as cyclodextrin, because these molecules are made up, e.g., of varying numbers of glucose units which can make them a prime breeding ground for certain microorganisms, especially when in aqueous compositions. This drawback can lead to the problem of storage stability of fabric care solutions for any significant length of time. Contamination by certain microorganisms with subsequent microbial growth can result in an unsightly and/or malodorous solution. Because microbial growth in the fabric care solutions is highly objectionable when it occurs, it is highly preferable to include an antimicrobial preservative, preferably solubilized, water-soluble, antimicrobial preservative, which is effective for inhibiting and/or regulating microbial growth in order to increase storage stability of the preferably clear, aqueous odor-absorbing solution containing the fabric care polysaccharide with globular structure.

It is preferable to use a broad spectrum preservative, e.g., one that is effective on both bacteria (both gram positive and gram negative) and fungi. A limited spectrum preservative, e.g., one that is only effective on a single group of microorganisms, e.g., fungi, can be used in combination with a broad spectrum preservative or other limited spectrum preservatives with complimentary and/or supplementary activity. A mixture of broad spectrum preservatives can also be used. In some cases where a specific group of microbial contaminants is problematic (such as Gram negatives), aminocarboxylate chelators can be used alone or as potentiators in conjunction with other preservatives. These chelators which include, e.g., ethylenediaminetetraacetic acid (EDTA), hydroxyethylenediaminetriacetic acid, diethylenetriaminepentaacetic acid, and other aminocarboxylate chelators, and mixtures thereof, and their salts, and mixtures thereof, can increase preservative effectiveness against Gram-negative bacteria, especially *Pseudomonas* species.

Antimicrobial preservatives useful in the present invention include biocidal compounds, i.e., substances that kill microorganisms, or biostatic compounds, i.e., substances that inhibit and/or regulate the growth of microorganisms. Suitable preservatives are disclosed in U.S. Pat. Nos. 5,534,165; 5,578,563; 5,663,134; 5,668,097; 5,670,475; and 5,714,137, Trinh et al. issued Jul. 9, 1996; Nov. 26, 1996; Sep. 2, 1997; Sep. 16, 1997; Sep. 23, 1997; and Feb. 3, 1998 respectively, all of said patents being incorporated hereinbefore by reference. Many antimicrobial preservatives are given under the section on Antimicrobial Active given herein above. Water insoluble antimicrobial preservatives such as paraben and triclosan are useful in the fabric care compositions of the present invention, but they require the use of a solubilizer, an emulsifier, a dispersing agent, or the like, such as a surfactant and/or cyclodextrin to effectively distribute said preservative in the liquid composition. Preferred antimicrobial preservatives are those that are water-soluble and are effective at low levels. Water-soluble preservatives useful in the present invention are those that have a solubility in water of at least about 0.3 g per 100 ml of water, i.e., greater than about 0.3% at room temperature, preferably greater than about 0.5% at room temperature.

The water-soluble antimicrobial preservative in the present invention is included at an effective amount. The term "effective amount" as herein defined means a level sufficient to prevent spoilage, or prevent growth of inadvertently added microorganisms, for a specific period of time. In other words, the preservative is not being used to kill microorganisms on the surface onto which the composition is deposited in order to eliminate odors produced by microorganisms. Instead, it is preferably being used to prevent spoilage of the fabric care polysaccharide with globular structure solution in order to increase the shelf-life of the composition. Preferred levels of preservative are from about 0.0001% to about 0.5%, more preferably from about 0.0002% to about 0.2%, most preferably from about 0.0003% to about 0.1%, by weight of the usage composition.

The preservative can be any organic preservative material which will not cause damage to fabric appearance, e.g., discoloration, coloration, bleaching. Preferred water-soluble preservatives include organic sulfur compounds, halogenated compounds, cyclic organic nitrogen compounds, low molecular weight aldehydes, quaternary ammonium compounds, dehydroacetic acid, phenyl and phenolic compounds, and mixtures thereof.

The preservatives of the present invention can be used in mixtures in order to control a broad range of microorganisms.

Bacteriostatic effects can sometimes be obtained for aqueous compositions by adjusting the composition pH to an acid pH, e.g., less than about pH 4, preferably less than about pH 3, or a basic pH, e.g., greater than about 10, preferably greater than about 11.

Fabric Softening Active

The fabric care composition herein can optionally contain fabric softening active. A liquid rinse-added composition typically contains from about 1% to about 75%, preferably from about 2% to about 65%, more preferably from about 3% to about 45%, and even more preferably from about 4% to about 35% by weight of the composition, of a fabric softener active. For a dryer-added composition, the levels are from about 1% to about 99%, preferably from about 10% to about 80%, more preferably from about 20% to about 70%, and even more preferably from about 25% to about 60% of fabric softening active. For a spray-on composition the levels are from about 0.05% to about 10%, preferably from about 0.1% to about 7%, more preferably from about 0.5% to about 5%.

The rinse-added fabric care compositions containing fabric softening actives herein can comprise liquid compositions that can be either dispersions or clear.

Dispersion Compositions

Stable "dispersion" compositions can be prepared like those disclosed in U.S. Pat. No. 4,661,269, issued Apr. 28, 1987, to T. Trinh et al., and in U.S. Pat. No. 5,545,340, issued Aug. 13, 1996, to Wahl et al., said patents being incorporated herein by reference. Suitable optional components in addition to the softening active are disclosed hereinafter. The dispersion liquid compositions herein can be both dilute and concentrated, but are preferably concentrated.

Clear Compositions

Preferred compositions are concentrate and clear, comprising:

I. from about 2% to about 80%, preferably from about 13% to about 75%, more preferably from about 17% to about 70%, and even more preferably from about 19% to about 65%, by weight of the composition, of fabric softening active, having a phase transition temperature of less than about 50° C., preferably less than about 35° C., more preferably less than about 20° C., and even more preferably less than about 0° C., preferably being biodegradable fabric softening active containing unsaturated alkyl groups and/or branched fatty alkyl groups, said unsaturated alkyl groups having an average Iodine Value (IV) of at least about 40, a level of polyunsaturation preferably being at least about 5%, and with the level of C18:3 acyl groups in the starting fatty acyl source feedstock for making the said softening active preferably being less than about 1% by weight.

II. less than about 40%, preferably from about 10% to about 35%, more preferably from about 12% to about 25%, and even more preferably from about 14% to about 20%, by weight of the composition of principal solvent having a ClogP of from about −2.0 to about 2.6, preferably from about −1.7 to about 1.7, and more preferably from about −1.0 to about 1.0, and preferably having some degree of asymmetry; optionally, but preferably, an effective amount, sufficient to improve clarity, of low molecular weight water soluble solvents like ethanol, isopropanol, propylene glycol, 1,3-propanediol, propylene carbonate, etc.; and optionally, but preferably, an effective amount to improve clarity, of water soluble calcium and/or magnesium salt, preferably chloride;

II. optionally, but highly preferred for clear/translucent compositions, at least an effective level of principal solvent preferably having a ClogP of from about −2.0 to about 2.6, more preferably from about −1.7 to about 1.6, and even more preferably from about 1.0 to about 1.0, as defined hereinafter, typically at a level that is less than about 40%, preferably from about 1% to about 25%, more preferably from about 3% to about 8% by weight of the composition;

III. optionally, but preferably, from about 0.1% to about 10% by weight, preferably from about 0.75% to about 2.5% by weight of the composition, and more preferably from about 1% to about 2% by weight of the composition of electrolyte as defined hereinafter;

IV. optionally, but preferably, from 0% to about 15%, preferably from about 0.1% to about 7%, and more preferably from about 1% to about 6%, by weight of the composition of phase stabilizer, preferably surfactant containing alkoxylation, and also preferably having an HLB of from about 8 to about 20, more preferably from about 10 to about 18, and even more preferably from about 11 to about 15; and V. the balance water, minor ingredients and/or water soluble solvents.

The preferred principal solvent and/or electrolyte levels, as well as the identity of the principal solvent, are selected normally according to the level and identity of the softener. Preferred levels and identity of principal solvent, electrolyte, and phase stabilizer which will yield clear stable compositions are taught in copending U.S. patent application Ser. No. 09/309,128, filed May 10, 1999, Frankenbach et al., incorporated herein by reference.

ClogP of a solvent is the calculated logarithm to the base 10 of the octanol/water partition coefficient (P) of said solvent. ClogP values are conveniently calculated by the "CLOGP" program, available from Daylight Chemical Information Systems, Inc. (Daylight CIS), Irvine, Calif. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem.—Chim. Theor., 19, 71 (1984).

Fabric Softening Actives

Fabric softening actives that can be used herein are disclosed, at least generically for the basic structures, in U.S. Pat. No. 3,408,361, Mannheimer, issued Oct. 29, 1968; U.S. Pat. No. 4,709,045; Kubo et al., issued Nov. 24, 1987; U.S. Pat. No. 4,233,451, Pracht et al., issued Nov. 11, 1980; U.S. Pat. No. 4,127,489, Pracht et al., issued Nov. 28, 1979; U.S. Pat. No. 3,689,424, Berg et al., issued Sep. 5, 1972; U.S. Pat. No. 4,128,485, Baumann et al., issued Dec. 5, 1978; U.S. Pat. No. 4,161,604, Elster et al., issued Jul. 17, 1979; U.S. Pat. No. 4,189,593, Wechsler et al., issued Feb. 19, 1980; U.S. Pat. No. 4,339,391, Hoffman et al., issued Jul. 13, 1982 U.S. Pat. No. 3,861,870, Edwards and Diehl; U.S. Pat. No. 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; U.S. Pat. No. 4,237,016, Rudkin, Clint, and Young; U.S. Pat. No. 4,885,102, Yamamura et al., issued Dec. 5, 1989; U.S. Pat. No. 4,937,008, Yamamura et al., issued Jun. 26, 1990; and U.S. Pat. No. 5,133,885, Contor et al., issued Jul. 28, 1992; Case 4768C, Trinh et al.; and European patent applications 91/336,267, Rutzen et a.l. and 91/423,894, Contor et al. and International Patent WO 91/01295, Trius et al., published Feb. 7, 1991, all of said patents and applications being incorporated herein by reference.

Other preferred fabric softening actives for liquid rinse-added compositions are disclosed in U.S. Pat. No. 4,661,269, issued Apr. 28, 1987, to T. Trinh, E. H. Wahl, D. M. Swartley and R. L. Hemingway. Biodegradable ester and/or amide linked fabric softening actives are disclosed, e.g., in U.S. Pat. No. 5,545,340, issued Aug. 13, 1996, to Wahl et al. Biodegradable unsaturated ester and/or amide linked fabric softening actives in concentrated clear compositions are disclosed in U.S. Pat. No. 5,759,990, issued Jun. 2, 1998 in the names of Wahl, Tordil, Trinh, Carr, Keys, and Meyer, and in U.S. Pat. No. 5,747,443, issued May 5, 1998 in the names of Wahl, Trinh, Gosselink, Letton, and Sivik. All said patents are incorporated herein by reference. Examples of suitable amine softening actives that can be used in the present invention are disclosed in PCT application WO 99/06509, K. A. Grimm, D. R. Bacon, T. Trinh, E. H. Wahl, and H. B. Tordil, published on Feb. 11, 1999, said application being incorporated herein by reference.

Any fabric softening active, including quaternary and non-quaternary softening actives, with saturated, partially saturated, unsaturated an/or highly unsaturated, with straight, linear alkyl chains and/or branched alkyl groups, can be use in the rinse-added fabric care composition of the present invention. Biodegradable fabric softening actives are preferred.

A preferred fabric care composition herein uses fabric softening active with highly unsaturated and/or branched hydrophobic chains, preferably biodegradable, selected from the highly unsaturated and/or branched fabric softening actives, and mixtures thereof. These highly unsaturated and/or branched fabric softening actives have the required properties for permitting high usage levels to provide additional fabric appearance benefits, including recovery of fabric color appearance, improved color integrity, and anti-wrinkling benefits. Fabric softening actives with saturated and/or low degree of unsaturation, e.g., Iodine Value of less than about 10, and fabric softening actives with unsaturated chains having the trans configuration, can normally provide a better softening performance per unit weight, but are more difficult to concentrate, thus can be used in compositions with lower levels of fabric softening active, typically below about 30%, preferably below 25%, more preferably below 20%, by weight of the composition.

Preferred fabric softening actives of the invention comprise a majority of compounds as follows:

Diester Quaternary Ammonium Fabric Softening Active Compound (DEQA)

(1) The first type of DEQA preferably comprises, as the principal active, compounds of the formula $$\{R_{4-m}—N^+—[(CH_2)_n—Y—R^1]_m\}A^-$$

wherein each R substituent is either hydrogen, a short chain $C_1$–$C_6$, preferably $C_1$–$C_3$ alkyl or hydroxyalkyl group, e.g., methyl (most preferred), ethyl, propyl, hydroxyethyl, and the like, poly ($C_{2-3}$alkoxy) preferably polyethoxy group, benzyl, or mixtures thereof; each m is 2 or 3; each n is from 1 to about 4; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$–$C_{22}$, preferably $C_{14}$–$C_{20}$, with each $R^1$ being a hydrocarbyl, or substituted hydrocarbyl group, and $A^-$ can be any softener-compatible anion, preferably, chloride, bromide, methylsulfate, ethylsulfate, sulfate, and nitrate, more preferably chloride or methyl sulfate. (As used herein, the "percent of softening active" containing a given $R^1$ group is based upon taking a percentage of the total active based upon the percentage that the given $R^1$ group is, of the total $R^1$ groups present.)

(2) A second type of DEQA active has the general formula:

$$[R_3N^+CH_2CH(YR^1)(CH_2YR^1)]A^-$$

wherein each Y, R, $R^1$, and $A^-$ have the same meanings as before. Such compounds include those having the formula:

$$[CH_3]_3\,N^{(+)}[CH_2CH(CH_2O(O)CR^1)O(O)CR^1]Cl^{(-)}$$

where each R is a methyl or ethyl group and preferably each $R^1$ is in the range of $C_{15}$ to $C_{19}$.

These types of agents and general methods of making them are disclosed in U.S. Pat. No. 4,137,180, Naik et al., issued Jan. 30, 1979, which is incorporated herein by reference. An example of a preferred DEQA of formula (2) is the "propyl" ester quaternary ammonium fabric softening active having the formula 1,2-di(acyloxy)-3-trimethylammoniopropane chloride, where the acyl is the same as that of $FA^1$ mixture disclosed hereinafter.

These biodegradable quaternary ammonium fabric softening compounds preferably contain the group $C(O)R^1$ which is derived, primarily from saturated fatty acids, such as stearic acid, but more preferably derived from partially saturated fatty acids and/or partially hydrogenated fatty acids from natural sources, e.g., derived from animal fat, such as tallow fatty acids. Also preferred are unsaturated fatty acids, e.g., oleic acid, and polyunsaturated fatty acids, such as those derived from vegetable oils, such as, canola oil, safflower oil, peanut oil, sunflower oil, corn oil, soybean oil, tall oil, rice bran oil, etc. Non-limiting examples of fatty acids (FA) are listed in U.S. Pat. No. 5,759,990 at column 4, lines 45–66. Fabric softening actives containing unsaturated and polyunsaturated fatty acids are preferred in formulating concentrated, clear fabric softening compositions of the present invention.

Mixtures of fatty acids can be used, and are preferred. Nonlimiting examples of fatty acids that can be blended, to form fatty acid mixtures (FA's) of this invention are as follows:

| Fatty Acyl Group | $FA^1$ | $FA^2$ | $FA^3$ |
|---|---|---|---|
| $C_{14}$ | 0 | 0 | 1 |
| $C_{16}$ | 3 | 11 | 25 |
| $C_{18}$ | 3 | 4 | 20 |
| C14:1 | 0 | 0 | 0 |
| C16:1 | 1 | 1 | 0 |
| C18:1 | 79 | 27 | 45 |
| C18:2 | 13 | 50 | 6 |

-continued

| Fatty Acyl Group | $FA^1$ | $FA^2$ | $FA^3$ |
|---|---|---|---|
| C18:3 | 1 | 7 | 0 |
| Unknowns | 0 | 0 | 3 |
| Total | 100 | 100 | 100 |
| IV | 99 | 125–138 | 56 |
| cis/trans (C18:1) | 5–6 | Not Available | 7 |
| TPU | 14 | 57 | 6 |

$FA^1$ is a partially hydrogenated fatty acid prepared from canola oil, $FA^2$ is a fatty acid prepared from soy bean oil, and $FA^3$ is a slightly hydrogenated tallow fatty acid.

Iodine Value (referred to as "IV" herein) is used to define the level of unsaturation of a fatty acid. As used herein, Iodine Value of the "parent" fatty acid, or "corresponding" fatty acid that the $R^1$ group is derived from, is also used to define the level of unsaturation of a fabric softening active. The IV of the parent fatty acids of these $R^1$ group is from about 0 to about 140, more preferably from about 40 to about 130, on the average. For concentrate, clear compositions, The IV is preferably from about 70 to about 140, more preferably from about 80 to about 130, and even more preferably from about 90 to about 115, on the average.

It is preferred that at least a majority of the fatty acyl groups are unsaturated, e.g., from about 50% to 100%, preferably from about 55% to about 100%, more preferably from about 60% to about 100%. The cis/trans ratio for the unsaturated fatty acyl groups is important, with a preferred cis/trans ratio of from 1:1 to about 50:1, the minimum being 1:1, preferably at least 3:1, and more preferably from about 4:1 to about 20:1.

The long chain hydrocabon groups can also comprise branched chains, e.g., from isostearic acid, for at least part of the groups. The total of active represented by the branched chain groups, when they are present, is typically from about 1% to about 100%, preferably from about 10% to about 70%, more preferably from about 20% to about 50%.

The unsaturated, including the polyunsaturated, fatty acyl groups not only provide surprisingly effective softening, but also provide better absorbency characteristics, good antistatic characteristics, and superior recovery after freezing and thawing. These highly unsaturated/branched materials provide excellent softening while minimizing loss of water absorbency and "greasy" fabric feel. These two characteristics allow one to use higher levels of softening active than would be ordinarily desirable, which provides several additional benefits, including noticeable color maintenance, protection, and/or recovery for colored fabrics, especially colored cotton and cotton blend fabrics, improved anti-wrinkling benefit, improved fiber integrity, i.e., less damage to fabrics, improved antistatic benefits, and a high level of softness.

The highly unsaturated materials are also easier to formulate into concentrated premixes that maintain their low viscosity and are therefore easier to process, e.g., pump, mixing, etc. These highly unsaturated materials with only a low amount of solvent that normally is associated with such materials, i.e., from about 5% to about 20%, preferably from about 8% to about 25%, more preferably from about 10% to about 20%, weight of the total softening active/solvent mixture, are also easier to formulate into concentrated, stable dispersion compositions of the present invention, even at ambient temperatures.

It will be understood that substituents R and $R^1$ can optionally be substituted with various groups such as alkoxyl or hydroxyl groups, so long as the $R^1$ groups maintain their basically hydrophobic character. The preferred compounds can be considered to be biodegradable diester variations of ditallow dimethyl ammonium chloride (hereinafter referred to as "DTDMAC"), which is a widely used fabric softening active. A preferred long chain DEQA is the DEQA prepared from sources containing high levels of polyunsaturation, i.e., N,N-di(acyl-oxyethyl)-N,N-dimethyl ammonium chloride, where the acyl is derived from fatty acids containing sufficient polyunsaturation.

As used herein, when the diester (m=2) is specified, it can include the monoester (m=1) and/or triester (m=3) that is present. Preferably, at least about 70% of the DEQA is in the diester form, and from 0% to about 30% can be DEQA monoester. For softening, under no/low detergent carry-over laundry conditions the percentage of monoester should be as low as possible, preferably no more than about 15%. However, under high, anionic detergent surfactant or detergent builder carry-over conditions, some monoester or monoamide can be preferred. The overall ratios of diester to monoester, or diamide to monoamide, are from about 100:1 to about 2:1, preferably from about 50:1 to about 5:1, more preferably from about 13:1 to about 8:1. Under high detergent carry-over conditions, the di/monoester ratio is preferably about 11:1. The level of monoester, or monoamide, present can be controlled in manufacturing the DEQA.

The above compounds, used as the biodegradable quaternized ester-amine or amido-amine, softening material in the practice of this invention, can be prepared using standard reaction chemistry. In one synthesis of a diester variation of DTDMAC, an amine of the formula $RN(CH_2CH_2OH)_2$ is esterified at both hydroxyl groups with an acid chloride of the formula $R^1C(O)Cl$, then quaternized with an alkyl halide, RX, to yield the desired reaction product (wherein R and $R^1$ are as defined hereinbefore). However, it will be appreciated by those skilled in the chemical arts that this reaction sequence allows a broad selection of agents to be prepared.

Yet another DEQA softening active that is suitable for the formulation of the concentrated, liquid fabric care compositions of the present invention, has the above formula (1) wherein one R group is a $C_{1-4}$ hydroxy alkyl group, or polyalkoxy group, preferably hydroxy alky, more preferably hydroxyethyl, group. An example of such a hydroxyethyl ester active is di(acyloxyethyl)(2-hydroxyethyl)methyl ammonium methyl sulfate, where the acyl is derived from the fatty acids described hereinbefore, e.g., oleic acid. Such DEQA is a quaternized product of condensation between: (a)—a fraction of saturated or unsaturated, linear or branched fatty acids, or of derivatives of said acids, said fatty acids or derivatives each possessing a hydrocarbon chain in which the number of atoms is between 5 and 21, and (b) triethanolamine, characterized in that said condensation product has an acid value, measured by titration of the condensation product with a standard KOH solution against a phenolphthalein indicator, of less than about 6.5. The acid value is preferably less than or equal to about 5, more preferably less than about 3. Indeed, the lower the AV, the better softness performance is obtained.

The acid value is determined by titration of the condensation product with a standard KOH solution against a phenolphthalein indicator according to ISO#53402. The AV is expressed as mg KOH/g of the condensation product.

For optimum softness benefit, it is preferred that the reactants are present in a molar ratio of fatty acid fraction to triethanolamine of from about 1:1 to about 2.5:1.

It has also been found that the optimum softness performance is also affected by the detergent carry-over laundry conditions, and more especially by the presence of the anionic surfactant in the solution in which the softening composition is used. Indeed, the presence of anionic surfactant that is usually carried over from the wash will interact with the softener compound, thereby reducing its performance. Thus, depending on usage conditions, the mole ratio of fatty acid/triethanolamine can be critical. Accordingly, where no rinse occurs between the wash cycle and the rinse cycle containing the softening compound, a high amount of anionic surfactant will be carried over in the rinse cycle containing the softening compound. In this instance, it has been found that a fatty acid fraction/triethanolamine mole ratio of about 1.4:1 to about 1.8:1 is preferred. By high amount of anionic surfactant, it is meant that the presence of anionic in the rinse cycle at a level such that the molar ratio anionic surfactant/cationic softener compound of the invention is at least about 1/10.

The compositions can also contain medium-chain cationic ammonium fabric softening compound, including DEQAs having the above formula (1) and/or formula (2), below, wherein:

each Y is —O—(O)C—, —(R)N—(O)C—, —C(O)—N(R)—, or —C(O)—O—, preferably —O—(O)C—;

m is 2 or 3, preferably 2;

each n is 1 to 4, preferably 2;

each R is as defined hereinbefore;

each $R^1$, or $YR^1$ hydrophobic group is a saturated, $C_8$–$C_{14}$, preferably a $C_{12-14}$ hydrocarbyl, or substituted hydrocarbyl substituent (the IV is preferably about 10 or less, more preferably less than about 5), [The sum of the carbons in the hydrophobic group is the number of carbon atoms in the $R^1$ group, or in the $YR^1$ group when Y is —O—(O)C— or —(R)N—(O)C—.] and the counterion, $A^-$, is the same as above. Preferably $A^-$ does not include phosphate salts.

The saturated $C_8$–$C_{14}$ fatty acyl groups can be pure derivatives or can be mixed chainlengths.

Suitable fatty acid sources for said fatty acyl groups are coco, lauric, caprylic, and capric acids.

For $C_{12}$–$C_{14}$ (or $C_{11}$–$C_{13}$) hydrocarbyl groups, the groups are preferably saturated, e.g., the IV is preferably less than about 10, preferably less than about 5.

It will be understood that substituents R and $R^1$ can optionally be substituted with various groups such as alkoxyl or hydroxyl groups, and can be straight, or branched so long as the $R^1$ groups maintain their basically hydrophobic character.

The DEQA actives described hereinabove can contain a low level of the fatty acids which can be unreacted starting material and/or by-product of any partial degradation, e.g., hydrolysis, of the softening actives in the finished compositions. It is preferred that the level of free fatty acid be low, preferably below about 10%, more preferably below about 5%, by weight of the softening active.

Other types of fabric softening actives can be used in the rinse-added fabric care compositions of the present invention:

(3) The DEQA actives described hereinabove also include the neutralized amine softening actives wherein at least one R group is a hydrogen atom. A non-limiting example of actives of this type is the chloride salt of (unsaturated alkoyloxyethyl)(unsaturated alkylamidotrimethylene)methylamine. Other examples of suitable amine softening actives are disclosed in PCT application WO 99/06509, K. A. Grimm, D. R. Bacon, T. Trinh, E. H. Wahl, and H. B. Tordil, published on Feb. 11, 1999, said application being incorporated herein by reference.

(4) Polyquaternary Ammonium Softening Actives. Fabric softening actives carrying more than one positive quaternary ammonium charge are also useful in the rinse-added compositions of the present invention. An example of this type of softening active is that having the formula:

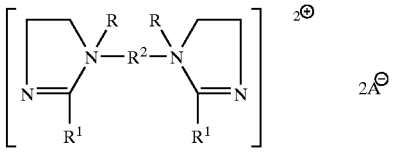

wherein each R is H or a short chain $C_1$–$C_6$, preferably $C_1$–$C_3$ alkyl or hydroxyalkyl group, e.g., methyl (most preferred), ethyl, propyl, hydroxyethyl, and the like, benzyl, or $(R^2\ O)_{2\text{-}4}H$; each $R^1$ is a $C_6$–$C_{22}$, preferably $C_{14}$–$C_{20}$ hydrocarbyl, or substituted hydrocarbyl substituent, preferably $C_{10}$–$C_{20}$ alkyl or alkenyl (unsaturated alkyl, including polyunsaturated alkyl, also referred to sometimes as "alkylene"), most preferably $C_{12}$–$C_{18}$ alkyl or alkenyl; each $R^2$ is a $C_{1\text{-}6}$ alkylene group, preferably an ethylene group; and $A^-$ are defined as below. Fabric softening actives having the following formula:

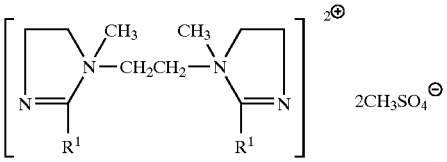

wherein $R^1$ is derived from oleic acid is available from Witco Company.

The following polyquaternary ammonium compounds are disclosed by reference herein as also suitable for use in this invention: European Patent Application EP 0,803,498, A1, Robert O. Keys and Floyd E. Friedli, filed Apr. 25, 1997; British Pat. 808,265, issued Jan. 28, 1956 to Arnold Hoffman & Co., Incorporated; British Pat. 1,161,552, Koebner and Potts, issued Aug. 13, 1969; DE 4,203,489 A1, Henkel, published Aug. 12, 1993; EP 0,221,855, Topfl, Heinz, and Jorg, issued Nov. 3, 1986; EP 0,503,155, Rewo, issued Dec. 20, 1991; EP 0,507,003, Rewo, issued Dec. 20, 1991; EPA 0,803,498, published Oct. 29, 1997; French Pat. 2,523,606, Marie-Helene Fraikin, Alan Dillarstone, and Marc Couterau, filed Mar. 22, 1983; Japanese Pat. 84-273918, Terumi Kawai and Hiroshi Kitamura, 1986; Japanese Pat. 2-011,545, issued to Kao Corp., Jan. 16, 1990; U.S. Pat. No. 3,079,436, Hwa, issued Feb. 26, 1963; U.S. Pat. No. 4,418,054, Green et al., issued Nov. 29, 1983; U.S. Pat. No. 4,721,512, Topfl, Abel, and Binz, issued Jan. 26, 1988; U.S. Pat. No. 4,728,337, Abel, Topfl, and Riehen, issued Mar. 1, 1988; U.S. Pat. No. 4,906,413, Topfl and Binz, issued Mar. 6, 1990; U.S. Pat. No. 5,194,667, Oxenrider et al., issued Mar. 16, 1993; U.S. Pat. No. 5,235,082, Hill and Snow, issued Aug. 10, 1993; U.S. Pat. No. 5,670,472, Keys, issued Sep. 23, 1997; Weirong Miao, Wei Hou, Lie Chen, and Zongshi Li, Studies on Multifunctional Finishing Agents, Riyong Huaxue Gonye, No. 2, pp. 8–10, 1992; Yokagaku, Vol 41, No. 4 (1992); and Disinfection, Sterilization, and Preservation, 4th Edition, published 1991 by Lea & Febiger, Chapter 13, pp. 226–30. All of these references are incorporated herein, in their entirety, by reference. The products formed by quaternization of reaction products of fatty acid with N,N,N',N', tetraakis(hydroxyethyl)-1,6-diaminohexane are also suitable for this invention.

(5) Softening active having the formula:

$$R_{4\text{-}m}—N^{(+)}—R^1{}_mA^-$$

wherein each m is 2 or 3, each $R^1$ is a $C_6$–$C_{22}$, preferably $C_{14}$–$C_{20}$, but no more than one being less than about $C_{12}$ and then the other is at least about 16, hydrocarbyl, or substituted hydrocarbyl substituent, preferably $C_{10}$–$C_{20}$ alkyl or alkenyl, most preferably $C_{12}$–$C_{18}$ alkyl or alkenyl, and where the Iodine Value of a fatty acid containing this $R^1$ group is from 0 to about 140, more preferably from about 40 to about 130; with a cis/trans ratio of from about 1:1 to about 50:1, the minimum being 1:1, preferably from about 2:1 to about 40:1, more preferably from about 3:1 to about 30:1, and even more preferably from about 4:1 to about 20:1; each $R^1$ can also be a branched chain $C_{14}$–$C_{22}$ alkyl group, preferably a branched chain $C_{16}$–$C_{18}$ group; each R is H or a short chain $C_1$–$C_6$, preferably $C_1$–$C_3$ alkyl or hydroxyalkyl group, e.g., methyl (most preferred), ethyl, propyl, hydroxyethyl, and the like, benzyl, or $(R^2\ O)_{2\text{-}4}H$; and $A^-$ is a softening active compatible anion, preferably, chloride, bromide, methylsulfate, ethylsulfate, sulfate, and nitrate, more preferably chloride and methyl sulfate;

(6) Softening active having the formula:

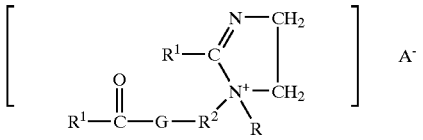

wherein each R, $R^1$, and $A^-$ have the definitions given above; each $R^2$ is a $C_{1\text{-}6}$ alkylene group, preferably an ethylene group; and G is an oxygen atom or an —NR— group;

(7) Softening active having the formula:

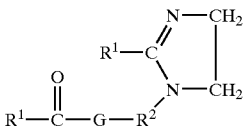

wherein $R^1$, $R^2$ and G are defined as above;

(8) Reaction products of substantially unsaturated and/or branched chain higher fatty acids with dialkylenetriamines in, e.g., a molecular ratio of about 2:1, said reaction products containing compounds of the formula:

$$R^1—C(O)—NH—R^2—NH—R^3—NH—C(O)—R^1$$

wherein $R^1$, $R^2$ are defined as above, and each $R^3$ is a $C_{1\text{-}6}$ alkylene group, preferably an ethylene group;

(9) Softening active having the formula:

$$[R^1—C(O)—NR—R^2—N(R)_2—R^3—NR—C(O)—R^1]^+A^-$$

wherein R, $R^1$, $R^2$, $R^3$ and $A^-$ are defined as above;

(10) The reaction product of substantially unsaturated and/or branched chain higher fatty acid with hydroxyalkylalkylenediamines in a molecular ratio of about 2:1, said reaction products containing compounds of the formula:

$$R^1—C(O)—NH—R^2—N(R^3OH)—C(O)—R^1$$

wherein $R^1$, $R^2$ and $R^3$ are defined as above; and

(11) Mixtures thereof.

Examples of Compound (5) are dialkylenedimethylammonium salts such as dicanoladimethylammonium chloride, dicanoladimethylammonium methylsulfate, di(partially hydrogenated soybean, cis/trans ratio of about 4:1)dimethylammonium chloride, dioleyldimethylammonium chloride. Dioleyldimethylammonium chloride and di(canola)dimethylammonium chloride are preferred. An example of commercially available dialkylenedimethylammonium salts usable in the present invention is dioleyldimethylammonium chloride available from Witco Corporation under the trade name Adogen® 472.

An example of Compound (6) is 1-methyl-1-oleylamidoethyl-2-oleylimidazolinium methylsulfate wherein $R^1$ is an acyclic aliphatic $C_{15}$–$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft® 3690.

An example of Compound (7) is 1-oleylamidoethyl-2-oleylimidazoline wherein $R^1$ is an acyclic aliphatic $C_{15}$–$C_{17}$ hydrocarbon group, $R^2$ is an ethylene group, and G is a NH group.

An example of Compound (8) is reaction products of oleic acids with diethylenetriamine in a molecular ratio of about 2:1, said reaction product mixture containing N,N"-dioleoyldiethylenetriamine with the formula:

$$R^1—C(O)—NH—CH_2CH_2—NH—CH_2CH_2—NH—C(O)—R^1$$

wherein $R^1$—C(O) is oleoyl group of a commercially available oleic acid derived from a vegetable or animal source, such as Emersol® 223LL or Emersol® 7021, available from Henkel Corporation, and $R^2$ and $R^3$ are divalent ethylene groups.

An example of Compound (9) is a difatty amidoamine based softening active having the formula:

$$[R^1—C(O)—NH—CH_2CH_2—N(CH_3)(CH_2CH_2OH)—CH_2CH_2—NH—C(O)—R^1]^+ CH_3SO_4^-$$

wherein $R^1$—C(O) is oleoyl group, available commercially from the Witco Corporation under the trade name Varisoft® 222LT.

An example of Compound (10) is reaction products of oleic acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is oleoyl group of a commercially available oleic acid derived from a vegetable or animal source, such as Emersol® 223LL or Emersol® 7021, available from Henkel Corporation.

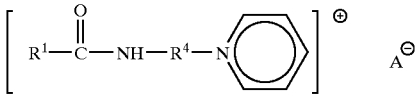

wherein $R^1$, $R^2$ and $A^-$ are defined as herein above; and

(17) Monoalkyl diquaternary salts, e.g., that having the formula:

$$A^-[R^1—N^{(+)}(R)_2—R^2N^{(+)}(R)_3]A^-$$

wherein R, $R^1$, $R^2$ and $A^-$ are defined as herein above; and

(18) Mixtures thereof.

Examples of Compound (12) are the monoalkenyltrimethylammonium salts such as monooleyltrimethylammonium chloride, monocanolatrimethylammonium chloride, and soyatrimethylammonium chloride. Monooleyltrimethylammonium chloride and monocanolatrimethylammonium chloride are preferred. Other examples of Compound (12) are soyatrimethylammonium chloride available from Witco Corporation under the trade name Adogen® 415, erucyltrimethylammonium chloride wherein $R^1$ is a $C_{22}$ hydrocarbon group derived from a natural source; soyadimethylethylammonium ethylsulfate wherein $R^1$ is a $C_{16}$–$C_{18}$ hydrocarbon group, $R^5$ is a methyl group, $R^6$ is an ethyl group, and $A^-$ is an ethylsulfate anion; and methyl bis(2-hydroxyethyl)oleylammonium chloride wherein $R^1$ is a $C_{18}$ hydrocarbon group, $R^5$ is a 2-hydroxyethyl group and $R^6$ is a methyl group.

An example of Compound (14) is 1-ethyl-1-(2-hydroxyethyl)-2-isoheptadecylimidazolinium ethylsulfate wherein $R^1$ is a $C_{17}$ hydrocarbon group, $R^2$ is an ethylene group, $R^5$ is an ethyl group, and $A^-$ is an ethylsulfate anion.

An example of Compound (17) is N-tallow pentamethyl propane diammonium dichloride, with the formula:

$$Cl^-[(tallowalkyl)—N^{(+)}(CH_3)_2—CH_2—CH_2—N^{(+)}(CH_3)_3]Cl^-$$

available from Witco Corporation under the trade name Adogen® 477.

Anion A

In the cationic nitrogenous salts herein, the anion $A^-$, which is any softening active compatible anion, provides electrical neutrality. Most often, the anion used to provide electrical neutrality in these salts is from a strong acid, especially a halide, such as chloride, methylsulfate, bromide, or iodide. However, other anions can be used, such as ethylsulfate, acetate, formate, sulfate, carbonate, and the like. Chloride and methylsulfate are preferred herein as anion A.

Dryer-Added Compositions. The fabric softening compound, or compounds, which are useful in the dryer-added fabric care composition can be selected from cationic, nonionic, amphoteric and/or anionic fabric softening compound.

The typical cationic fabric softening compounds include the water-insoluble quaternary-ammonium fabric softening actives, the most commonly used having been di(long alkylchain)dimethylammonium (C1–C4 alkyl)sulfate or chloride, preferably the methyl sulfate, compounds including the following:

1) di(tallowalkyl)dimethylammonium methyl sulfate (DTDMAMS);
2) di(hydrogenated tallowalkyl)dimethylammonium methyl sulfate;
3) di(hydrogenated tallowalkyl)dimethylammonium chloride (DTDMAC);
4) distearyldimethylammonium methyl sulfate;
5) dioleyldimethylammonium methyl sulfate;
6) dipalmitylhydroxyethylmethylammonium methyl sulfate;
7) stearylbenzyldimethylammonium methyl sulfate;
8) tallowalkyltrimethylammonium methyl sulfate;
9) (hydrogenated tallowalkyl)trimethylammonium methyl sulfate;
10) ($C_{12-14}$ alkyl)hydroxyethyldimethylammonium methyl sulfate;
11) ($C_{12-18}$ alkyl)di(hydroxyethyl)methylammonium methyl sulfate;
12) di(stearoyloxyethyl)dimethylammonium chloride;
13) di(tallowoyloxyethyl)dimethylammonium methyl sulfate;
14) ditallowalkylimidazolinium methyl sulfate;
15) 1-(2-tallowylamidoethyl)-2-tallowylimidazolinium methyl sulfate; and
16) mixtures thereof.

The currently preferred compounds, like 12) and 13) are more environmentally-friendly materials, being rapidly biodegradable quaternary ammonium compounds that are alternatives to the traditionally used di(long alkyl chain)dimethylammonium methyl sulfate. Such quaternary ammonium compounds can contain long chain alk(en)yl groups interrupted by functional groups such as carboxy groups. Said materials and fabric softening compositions containing them are disclosed in numerous publications such as EP-A-0,040,562, and EP-A-0,239,910. Similar quaternary ammonium compounds useful in the dryer-added compositions are those given hereinabove for rinse-added compositions.

Nonionic softening actives can also be used in dryer-added compositions of the present invention. Typically, such nonionic fabric softening materials have an HLB of from about 2 to about 9, more typically from about 3 to about 7. In general, the materials selected should be relatively crystalline, higher melting, (e.g., >25° C., preferably >40° C.) and relatively water-insoluble.

The level of nonionic softener in the solid composition, when present, is typically from about 0.1% to about 50%, preferably from about 5% to about 30%.

Highly preferred optional nonionic softening agents for use in the present invention are $C_{10}$–$C_{26}$ acyl sorbitan esters and polyglycerol monostearate. Sorbitan esters are esterified dehydration products of sorbitol. Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.) The foregoing types of complex mixtures of anhydrides of sorbitol are collectively referred to herein as "sorbitan." It will be recognized that this "sorbitan" mixture will also contain some free, uncyclized sorbitol.

The preferred sorbitan ester comprises a member selected from the group consisting of $C_{10}$–$C_{26}$ acyl sorbitan monoesters and $C_{10}$–$C_{26}$ acyl sorbitan diesters. It is also preferred that a significant amount of trisorbitan esters are present in the ester mixture. Ester mixtures having from 20–50% mono-ester, 25–50% di-ester and 10–35% of tri- and tetra-esters are preferred. For the purpose of the present invention, sorbitan esters containing unsaturation (e.g., sorbitan monooleate) can be utilized.

Details, including formula, of the preferred sorbitan esters can be found in U.S. Pat. No. 4,128,484, incorporated herein by reference.

Certain derivatives of the preferred sorbitan esters herein, especially the "lower" ethoxylates thereof, i.e., mono-, di-, and tri-esters wherein one or more of the unesterified —OH groups contain one to about twenty ethylene oxide units (e.g., Tweens®) are also useful in the composition of the present invention. Therefore, for purposes of the present invention, the term "sorbitan ester" includes such derivatives.

Other preferred nonionic softeners are fatty acid partial esters of polyhydric alcohols, or anhydrides thereof, wherein the alcohol, or anhydride, contains from about 2 to about 18, preferably from about 2 to about 8, carbon atoms, and each fatty acid moiety contains from about 8 to about 30, preferably from about 12 to about 20, carbon atoms. Typically, such softeners contain from about one to about 3, preferably about 2 fatty acid groups per molecule. The polyhydric alcohol portion of the ester can be ethylene glycol, glycerol, poly (e.g., di-, tri-, tetra, penta-, and/or hexa-) glycerol, xylitol, sucrose, erythritol, and/or pentaerythritol.

Dryer-added fabric care compositions employed herein can contain as a softener component, at a level of from about 1% to about 60%, preferably from about 5% to about 50%, more preferably from about 10% to about 40%, by weight of the composition of a carboxylic acid salt of a tertiary amine and/or ester amine which has the formula:

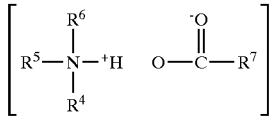

wherein $R^5$ is a long chain aliphatic group containing from about 8 to about 30 carbon atoms; $R^6$ and $R^4$ are the same or different from each other and are selected from the group consisting of aliphatic groups containing from about 1 to about 30, preferably 1, carbon atoms, hydroxyalkyl groups of the Formula —$R^8$OH wherein $R^8$ is an alkylene group of from about 2 to about 30 carbon atoms, and alkyl ether groups of the formula $R^9(OC_nH_{2n})_m$— wherein $R^9$ is alkyl or alkenyl of from about 1 to about 30, preferably 2 or 3, carbon atoms or hydrogen, n is 2 or 3, and m is from about 1 to about 30, preferably from 1 to about 5; wherein $R^4$, $R^5$, $R^6$, $R^8$, and $R^9$ chains can be ester interrupted groups; and wherein $R^7$ is selected from the group consisting of unsubstituted alkyl, alkenyl, aryl, alkaryl and aralkyl of about 8 to about 30 carbon atoms, and substituted alkyl, alkenyl, aryl, alkaryl, and aralkyl of from about 1 to about 30 carbon atoms wherein the substituents are selected from the group consisting of halogen, carboxyl, and hydroxyl.

This component provides the following benefits: superior odor, and/or improved fabric softening performance, compared to similar composition which utilize primary amine or ammonium compounds as the sole fabric conditioning agent. Either $R^4$, $R^5$, $R^6$, $R^7$, $R^8$, and/or $R^9$ chains can contain unsaturation.

Examples of preferred tertiary amines as starting material for the reaction between the amine and carboxylic acid to form the tertiary amine salts are: lauryldimethylamine, myristyldimethylamine, stearyldimethylamine, tallowdimethylamine, coconutdimethylamine, dilaurylmethylamine, distearylmethylamine, ditallowmethylamine, oleyldimethylamine, dioleylmethylamine, lauryldi(3-hydroxypropyl)amine, stearyldi(2-hydroxyethyl)amine, trilaurylamine, laurylethylmethylamine, and $$C_{18}H_{37}N(C_2H_4O)_{10}H.$$

Preferred carboxylic acids are stearic, oleic, lauric, myristic, palmitic, and mixtures thereof.

The amine salt can be formed by a simple addition reaction, well known in the art, disclosed in U.S. Pat. No. 4,237,155, Kardouche, issued Dec. 2, 1980, which is incorporated herein by reference. Excessive levels of free amines can result in odor problems, and generally free amines provide poorer softening performance than the amine salts.

For dryer-added compositions, the actives disclosed in copending application Ser. No. 08/937,536, filed Sep. 25, 1997, for DRYER-ADDED FABRIC SOFTENER COMPOSITION USAGE TO PROVIDE COLOR AND OTHER FABRIC APPEARANCE BENEFITS by J. W. Smith, A. Corona, T. Trinh, and R. Wu are especially suitable, said application being incorporated herein by reference. Additional fabric softening materials can be used in addition or alternatively to the above fabric softeners. These can be selected from other nonionic, amphoteric and/or anionic fabric softening materials. Disclosure of such materials can be found in U.S. Pat. No. 4,327,133; U.S. Pat. No. 4,421,792; U.S. Pat. No. 4,426,299; U.S. Pat. No. 4,460,485; U.S. Pat. No. 3,644,203; U.S. Pat. No. 4,661,269; U.S. Pat. No. 4,439,335; U.S. Pat. No. 3,861,870; U.S. Pat. No. 4,308,151; U.S. Pat. No. 3,886,075; U.S. Pat. No. 4,233,164; U.S. Pat. No. 4,401,578; U.S. Pat. No. 3,974,076; U.S. Pat. No. 4,237,016 and EP 472,178, incorporated herein by reference.

Principal Solvent System

The principal solvent, when present, is typically used at an effective level up to about 40% by weight, preferably from about 1% to about 25%, more preferably from about 3% to about 8%, by weight of the composition. The principal solvent can be used most effectively when in combination with high electrolyte level and/or the phase stabilizers, as disclosed in U.S. patent application Ser. No. 09/309,128. E.g., without the high level of electrolyte, the ClogP of the principal solvent system disclosed therein would typically be limited to a range of from about 0.15 to about 0.64 as disclosed in U.S. Pat. No. 5,747,443.

With the electrolyte present, levels of principal solvent that are substantially less than about 15% by weight of the composition can be used, which is preferred for odor, safety and economy reasons. The phase stabilizer as defined hereinafter, in combination with a very low level of principal solvent is sufficient to provide good clarity and/or stability of the composition when the electrolyte is present. Said electrolyte and/or said phase stabilizer can be used to either make a composition translucent or clear, or can be used to increase the temperature range at which the composition is translucent or clear.

Principal solvents are efficient in that they provide the maximum advantage for a given weight of solvent. It is understood that "solvent", as used herein, refers to the effect of the principal solvent and not to its physical form at a given temperature, since some of the principal solvents are solids at ambient temperature.

Principal solvents that can be present are selected to minimize solvent odor impact in the composition and to provide a low viscosity to the final composition.

The principal solvents are typically selected from those having a ClogP of from −2.0 to 2.6, preferably from −1.7 to 1.6, and more preferably from −1.0 to 1.0.

The most preferred solvents can be identified by the appearance of the dilute treatment compositions used to treat fabrics. These dilute compositions have dispersions of fabric softener that exhibit a more uni-lamellar appearance than conventional fabric softener compositions. The closer to uni-lamellar the appearance, the better the compositions seem to perform. These compositions provide surprisingly good fabric softening as compared to similar compositions prepared in the conventional way with the same fabric softener active.

Operable solvents have been disclosed, listed under various listings, e.g., aliphatic and/or alicyclic diols with a given number of carbon atoms; monols; derivatives of glycerine; alkoxylates of diols; and mixtures of all of the above can be found in said U.S. Pats. Nos. 5,759,990 and 5,747,443 and PCT application WO 97/03169 published on 30 Jan. 1997, said patents and application being incorporated herein by reference, the most pertinent disclosure appearing at pages 24–82 and 94–108 (methods of preparation) of the said WO 97/03169 specification and in columns 11–54 and 66–78 (methods of preparation) of the '443 patent. Some inoperable solvents listed in the '443 disclosure can be used in mixtures with operable solvents and/or with the high electrolyte levels and/or phase stabilizers, to make concentrated fabric softener compositions that meet the stability/clarity requirements set forth herein.

There is a clear similarity between the acceptability (formulatability) of a saturated diol and its unsaturated homologs, or analogs, having higher molecular weights. The unsaturated homologs/analogs have the same formulatability as the parent saturated solvent with the condition that the unsaturated solvents have one additional methylene (viz., $CH_2$) group for each double bond in the chemical formula. In other words, there is an apparent "addition rule" in that for each good saturated solvent of this invention, which is suitable for the formulation of clear, concentrated fabric softener compositions, there are suitable unsaturated solvents where one, or more, $CH_2$ groups are added while, for each $CH_2$ group added, two hydrogen atoms are removed from adjacent carbon atoms in the molecule to form one carbon—carbon double bond, thus holding the number of hydrogen atoms in the molecule constant with respect to the chemical formula of the "parent" saturated solvent. This is due to a surprising fact that adding a —$CH_2$— group to a solvent chemical formula has an effect of increasing its ClogP value by about 0.53, while removing two adjacent hydrogen atoms to form a double bond has an effect of decreasing its ClogP value by about a similar amount, viz., about 0.48, thus about compensating for the —$CH_2$— addition. Therefore one goes from a preferred saturated solvent to the preferred higher molecular weight unsaturated analogs/homologs containing at least one more carbon atom by inserting one double bond for each additional $CH_2$ group, and thus the total number of hydrogen atoms is kept the same as in the parent saturated solvent, as long as the ClogP value of the new solvent remains within the effective range. The following are some illustrative examples:

It is possible to substitute for part of the principal solvent mixture a secondary solvent, or a mixture of secondary solvents, which by themselves are not operable as a principal solvent of this invention, as long as an effective amount of the operable principal solvents of this invention is still present in the liquid concentrated, clear fabric softener composition. An effective amount of the principal solvents of this invention is at least greater than about 1%, preferably more than about 3%, more preferably more than about 5% of the composition, when at least about 15% of the softener active is also present.

Principal solvents preferred for improved clarity at 50° F. are 1,2-hexanediol; 1,2-pentanediol; hexylene glycol; 1,2-butanediol; 1,4-cyclohexanediol; pinacol; 1,5-hexanediol; 1,6-hexanediol; and/or 2,4-dimethyl-2,4-pentanediol.

Electrolyte

The clear rinse-added fabric care compositions containing a high level of fabric softening agent of this invention can optionally, but preferably, contain an effective amount of electrolyte, e.g., from about 0.5% to about 10%, preferably from about 0.75% to about 3%, and more preferably from about 1% to about 2%, by weight of the composition. U.S. Pat. No. 5,759,990, incorporated herein by reference, discloses that the principal solvent in clear formulations should have a ClogP of from about 0.15 to about 0.64. An effective amount of electrolyte allows the use of principal solvents with a ClogP of from about −2.0 to about 2.6, preferably from about −1.7 to about 1.6, and more preferably from about −1.0 to about 1.0. The principal solvents are also more effective with the high electrolyte level, thus allowing one to use less of such principal solvents. Electrolyte also helps to alleviate a thickening phenomenon some concentrate, clear fabric softener compositions are diluted.

Suitable inorganic salts for use as electrolyte include $MgI_2$, $MgBr_2$, $MgCl_2$, $Mg(NO_3)_2$, $Mg_3(PO_4)_2$, $Mg_2P_2O_7$, $MgSO_4$, magnesium silicate, NaI, NaBr, NaCl, NaF, $Na_3(PO_4)$, $NaSO_3$, $Na_2SO_4$, $Na_2SO_3$, $NaNO_3$, $NaIO_3$, $Na_3(PO_4)$, $Na_4P_2O_7$, sodium silicate, sodium metasilicate, sodium tetrachloroaluminate, sodium tripolyphosphate (STPP), $Na_2Si_3O_7$, sodium zirconate, $CaF_2$, $CaCl_2$, $CaBr_2$, $CaI_2$, $CaSO_4$, $Ca(NO_3)_2$, Ca, KI, KBr, KCl, KF, $KNO_3$, $KIO_3$, $K_2SO_4$, $K_2SO_3$, $K_3(PO_4)$, $K_4(P_2O_7)$, potassium pyrosulfate, potassium pyrosulfite, LiI, LiBr, LiCl, LiF, $LiNO_3$, $AlF_3$, $AlCl_3$, $AlBr_3$, $AlI_3$, $Al_2(SO_4)_3$, $Al(PO_4)$, $Al(NO_3)_3$, aluminum silicate; including hydrates of these salts and including combinations of these salts or salts with mixed cations e.g. potassium alum $AlK(SO_4)_2$ and salts with mixed anions, e.g. potassium tetrachloroaluminate and sodium tetrafluoroaluminate. Salts incorporating cations from groups IIIa, IVa, Va, VIa, VIIa, VIII, Ib, and IIb on the periodic chart with atomic numbers >13 are also useful in reducing dilution viscosity but less preferred due to their tendency to change oxidation states and thus they can adversely affect the odor or color of the formulation or lower weight efficiency. Salts with cations from group Ia or Ia with atomic numbers >20 as well as salts with cations from the lactinide or actinide series are useful in reducing dilution viscosity, but less preferred due to lower weight efficiency or toxicity. Mixtures of above salts are also useful.

Organic salts useful in this invention include, magnesium, sodium, lithium, potassium, zinc, and aluminum salts of the carboxylic acids including formate, acetate, proprionate, pelargonate, citrate, gluconate, lactate aromatic acids e.g. benzoates, phenolate and substituted benzoates or phenolates, such as phenolate, salicylate, polyaromatic acids terephthalates, and polyacids e.g. oxylate, adipate, succinate, benzenedicarboxylate, benzenetricarboxylate. Other useful organic salts include carbonate and/or hydrogencarbonate ($HCO_3^{-1}$) when the pH is suitable, alkyl and aromatic sulfates and sulfonates e.g. sodium methyl sulfate, benzene sulfonates and derivatives such as xylene sulfonate, and amino acids when the pH is suitable. Electrolytes can comprise mixed salts of the above, salts neutralized with mixed cations such as potassium/sodium tartrate, partially neutralized salts such as sodium hydrogen tartrate or potassium hydrogen phthalate, and salts comprising one cation with mixed anions.

Generally, inorganic electrolytes are preferred over organic electrolytes for better weight efficiency and lower costs. Mixtures of inorganic and organic salts can be used. Typical levels of electrolyte in the compositions are less than about 10%. Preferably from about 0.5% to about 5% by weight, more preferably from about 0.75% to about 2.5%, and most preferably from about 1% to about 2% by weight of the fabric softener composition.

Phase Stabilizer

Phase stabilizers are highly desirable to formulating a clear or translucent fabric softener composition with high electrolyte levels of the present invention. The phase stabilizers provide an improved range of temperatures at which the compositions are clear and stable. They allow more electrolyte to be used without instability. They can also reduce the amount of principal solvent needed to achieve clarity and/or stability. Typical levels of the optional phase stabilizer in the softening compositions are from about 0.1% to about 15%, preferably from about 0.3% to about 7%, more preferably from about 1% to about 5% by weight of the composition.

The phase stabilizers useful in the compositions of the present invention are selected surface actives materials commonly comprise of hydrophobic and hydrophilic moieties. A preferred hydrophilic moiety is polyalkoxylated group, preferably polyethoxylated group.

Preferred phase stabilizers are nonionic surfactants derived from saturated and/or unsaturated primary, secondary, and/or branched, amine, amide, amine-oxide fatty alcohol, fatty acid, alkyl phenol, and/or alkyl aryl carboxylic acid compounds, each preferably having from about 6 to about 22, more preferably from about 8 to about 18, carbon atoms in a hydrophobic chain, more preferably an alkyl or alkylene chain, wherein at least one active hydrogen of said compounds is ethoxylated with ≦50, preferably ≦30, more preferably from about 5 to about 15, and even more preferably from about 8 to about 12, ethylene oxide moieties to provide an HLB of from about 8 to about 20, preferably from about 10 to about 18, and more preferably from about 11 to about 15. he various stabilizers have different advantages. For example, alkoxylated cationic materials or cationic surfactant complexes improve softness and provide enhanced wrinkle release benefits. In order to reduce the amount of principal solvent used, the preferred phase stabilizers are alkoxylated alkyls, alkoxylated acyl amides, alkoxylated alkyl amines or alkoxylated quaternary alkyl ammonium salts, surfactant complexes, and mixtures thereof.

Suitable phase stabilizers also include nonionic surfactants with bulky head groups selected from:

a. surfactants having the formula $$R^1—C(O)—Y'—[C(R^5)]_m—CH_2O(R_2O)_zH$$

wherein $R^1$ is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)—; and mixtures thereof; and A is selected from the following groups: H; $R^1$; $—(R^2—O)_z—H$; $—(CH_2)_xCH_3$; phenyl, or substituted aryl, wherein 0≦x≦ about 3 and z is from about 5 to about 30; each $R^2$ is selected from the following groups or combinations of the following groups: —$(CH_2)_n$— and/or —$[CH(CH_3)CH_2]$—; and each $R^5$ is selected from the following groups: —OH; and —$O(R^2O)_z$—H; and m is from about 2 to about 4;

b. surfactants having the formulas:

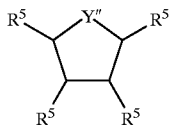

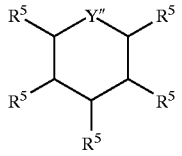

wherein Y"=N or O; and each $R^5$ is selected independently from the following: —H, —OH, —$(CH_2)xCH_3$, —$O(OR^2)_z$—H, —$OR^1$, —$OC(O)R^1$, and —$CH(CH_2$—$(OR^2)_{z''}$—H)—$CH_2$—$(OR^2)_{z'}$—$C(O)R^1$, x and $R^1$ are as defined above and $5 \leqq z, z', \text{and } z'' \leqq 20$, more preferably $5 \leqq z+z'+z'' \leqq 20$, and most preferably, the heterocyclic ring is a five member ring with Y"=O, one $R^5$ is —H, two $R^5$ are —O—$(R^2O)z$—H, and at least one $R^5$ is the following structure —$CH(CH^2$—$(OR^2)_{z''}$—H)—$CH_2$—$(OR^2)_{z''}$—$C(O)R^1$ with $8 \leqq z+z'+z'' \leqq 20$ and $R^1$ is a hydrocarbon with from 8 to 20 carbon atoms and no aryl group;

c. polyhydroxy fatty acid amide surfactants of the formula:

$$R^2—C(O)—N(R^1)—Z$$

wherein: each $R^1$ is H, $C_1$–$C_4$ hydrocarbyl, $C_1$–$C_4$ alkoxyalkyl, or hydroxyalkyl; and $R^2$ is a $C_5$–$C_{31}$ hydrocarbyl moiety; and each Z is a polyhydroxyhydrocarbyl moiety having a linear hydrocarbyl chain with at least 3 hydroxyls directly connected to the chain, or an ethoxylated derivative thereof; and each R' is H or a cyclic mono- or polysaccharide, or alkoxylated derivative thereof; and d. mixtures thereof.

Suitable phase stabilizers also include surfactant complexes formed by one surfactant ion being neutralized with surfactant ion of opposite charge or an electrolyte ion that is suitable for reducing dilution viscosity and block copolymer surfactants comprising polyethylene oxide moieties and propylene oxide moieties.

Examples of representative phase stabilizers include:

(1)—Alkyl or Alkyl-Aryl Alkoxylated Nonionic Surfactants

Suitable alkyl alkoxylated nonionic surfactants are generally derived from saturated or unsaturated primary, secondary, and branched fatty alcohols, fatty acids, alkyl phenols, or alkyl aryl (e.g., benzoic) carboxylic acid, where the active hydrogen(s) is alkoxylated with ≦ about 30 alkylene, preferably ethylene, oxide moieties (e.g. ethylene oxide and/or propylene oxide). These nonionic surfactants for use herein preferably have from about 6 to about 22 carbon atoms on the alkyl or alkenyl chain, and are in either straight chain or branched chain configuration, preferably straight chain configurations having from about 8 to about 18 carbon atoms, with the alkylene oxide being present, preferably at the primary position, in average amounts of ≦ about 30 moles of alkylene oxide per alkyl chain, more preferably from about 5 to about 15 moles of alkylene oxide, and most preferably from about 8 to about 12 moles of alkylene oxide. Preferred materials of this class also have pour points of about 70° F. and/or do not solidify in these clear formulations. Examples of alkyl alkoxylated surfactants with straight chains include Neodol® 91-8, 25-9, 1-9, 25-12, 1-9, and 45-13 from Shell, Plurafac® B-26 and C-17 from BASF, and Brij® 76 and 35 from ICI Surfactants. Examples of branched alkyl alkoxylated surfactants include Tergitol® 15-S-12, 15-S-15, and 15-S-20 from Union Carbide and Emulphogene® BC-720 and BC-840 from GAF. Examples of alkyl-aryl alkoxylated surfactants include Igepale® CO-620 and CO-710, from Rhone Poulenc, Triton® N-111 and N-150 from Union Carbide, Dowfax® 9N5 from Dow and Lutensol® AP9 and AP14, from BASF.

(2)—Alkyl or Alkyl-Aryl Amine or Amine Oxide Nonionic Alkoxylated Surfactants

Suitable alkyl alkoxylated nonionic surfactants with amine functionality are generally derived from saturated or unsaturated, primary, secondary, and branched fatty alcohols, fatty acids, fatty methyl esters, alkyl phenol, alkyl benzoates, and alkyl benzoic acids that are converted to amines, amine-oxides, and optionally substituted with a second alkyl or alkyl-aryl hydrocarbon with one or two alkylene oxide chains attached at the amine functionality each having ≦ about 50 moles alkylene oxide moieties (e.g. ethylene oxide and/or propylene oxide) per mole of amine. The amine, amide or amine-oxide surfactants for use herein have from about 6 to about 22 carbon atoms, and are in either straight chain or branched chain configuration, preferably there is one hydrocarbon in a straight chain configuration having about 8 to about 18 carbon atoms with one or two alkylene oxide chains attached to the amine moiety, in average amounts of ≦50 about moles of alkylene oxide per amine moiety, more preferably from about 5 to about 15 moles of alkylene oxide, and most preferably a single alkylene oxide chain on the amine moiety containing from about 8 to about 12 moles of alkylene oxide per amine moiety. Preferred materials of this class also have pour points about 70° F. and/or do not solidify in these clear formulations. Examples of ethoxylated amine surfactants include Berol® 397 and 303 from Rhone Poulenc and Ethomeens® C/20, C25, T/25, S/20, S/25 and Ethodumeens® T/20 and T25 from Akzo.

Preferably, the compounds of the alkyl or alkyl-aryl alkoxylated surfactants and alkyl or alkyl-aryl amine, amide, and amine-oxide alkoxylated have the following general formula:

$$R^1{}_m—Y—[(R^2—O)_z—H]_p$$

wherein each $R^1$ is selected from the group consisting of saturated or unsaturated, primary, secondary or branched chain alkyl or alkyl-aryl hydrocarbons; said hydrocarbon chain preferably having a length of from about 6 to about 22, more preferably from about 8 to about 18 carbon atoms, and even more preferably from about 8 to about 15 carbon atoms, preferably, linear and with no aryl moiety; wherein each $R^2$ is selected from the following groups or combinations of the following groups: —$(CH_2)_n$— and/or —$[CH(CH_3)CH_2]$—; wherein about $1<n \leqq$ about 3; Y is selected from the following groups: —O—; —$N(A)_q$—; —C(O)O—; —(O←)$N(A)_q$—; —B—$R^3$—O—; —B—$R^3$—$N(A)_q$—; —B—$R^3$—C(O)O—; —B—$R^3$—N(→O)(A)—; and mixtures thereof; wherein A is selected from the following groups: H; $R^1$; —$(R^2—O)_z$—H; —$(CH_2)_xCH_3$; phenyl, or substituted aryl, wherein $0 \leqq x \leqq$ about 3 and B is selected from the following groups: —O—; —N(A)—; —C(O)O—; and mixtures thereof in which A is as defined above; and wherein each $R^3$ is selected from the following groups: $R^2$; phenyl; or substituted aryl. The terminal hydrogen in each alkoxy chain can be replaced by a short chain $C_{1-4}$ alkyl or acyl group to "cap" the alkoxy chain. z is from about 5 to about 30. p is the number of ethoxylate chains, typically one or two, preferably one and m is the number of hydrophobic chains, typically one or two, preferably one and q is a number that completes the structure, usually one.

Preferred structures are those in which m=1, p=1 or 2, and $5 \leqq z \leqq 30$, and q can be 1 or 0, but when p=2, q must be 0; more preferred are structures in which m=1, p=1 or 2, and $7 \leqq z \leqq 20$; and even more preferred are structures in which m=1, p=1 or 2, and $9 \leqq z \leqq 12$. The preferred y is 0.

(3)—Alkoxylated and Non-Alkoxylated Nonionic Surfactants with Bulky Head Groups

Suitable alkoxylated and non-alkoxylated phase stabilizers with bulky head groups are generally derived from saturated or unsaturated, primary, secondary, and branched fatty alcohols, fatty acids, alkyl phenol, and alkyl benzoic acids that are derivatized with a carbohydrate group or heterocyclic head group. This structure can then be optionally substituted with more alkyl or alkyl-aryl alkoxylated or non-alkoxylated hydrocarbons. The heterocyclic or carbohydrate is alkoxylated with one or more alkylene oxide chains (e.g. ethylene oxide and/or propylene oxide) each having ≦about 50, preferably ≦ about 30, moles per mole of heterocyclic or carbohydrate. The hydrocarbon groups on the carbohydrate or heterocyclic surfactant for use herein have from about 6 to about 22 carbon atoms, and are in either straight chain or branched chain configuration, preferably there is one hydrocarbon having from about 8 to about 18 carbon atoms with one or two alkylene oxide chains carbohydrate or heterocyclic moiety with each alkylene oxide chain present in average amounts of ≦ about 50, preferably ≦about 30, moles of carbohydrate or heterocyclic moiety, more preferably from about 5 to about 15 moles of alkylene oxide per alkylene oxide chain, and most preferably between about 8 and about 12 moles of alkylene oxide total per surfactant molecule including alkylene oxide on both the hydrocarbon chain and on the heterocyclic or carbohydrate moiety. Examples of phase stabilizers in this class are Tween® 40, 60, and 80 available from ICI Surfactants.

Preferably the compounds of the alkoxylated and non-alkoxylated nonionic surfactants with bulky head groups have the following general formulas:

$$R^1—C(O)—Y'—[C(R^5)]_m—CH_2O(R_2O)_zH$$

wherein $R^1$ is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)—; and mixtures thereof; and A is selected from the following groups: H; $R^1$; $—(R^2—O)_z—H$; $—(CH_2)_xCH_3$; phenyl, or substituted aryl, wherein $0 \leqq x \leqq$ about 3 and z is from about 5 to about 30; each R is selected from the following groups or combinations of the following groups: $—(CH_2)_n—$ and/or $—[CH(CH_3)CH_2]—$; and each $R^5$ is selected from the following groups: —OH; and $—O(R^2O)_z—H$; and m is from about 2 to about 4;

Another useful general formula for this class of surfactants is

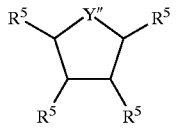

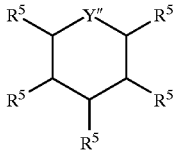

wherein Y"=N or O; and each $R^5$ is selected independently from the following: —H, —OH, $—(CH_2)_xCH_3$, $—(OR^2)_z—H$, $—OR^1$, $—OC(O)R^1$, and $—CH_2(CH_2—(OR^2)_{z''}—H)—CH_2—(OR^2)_{z'}—C(O)R^1$. With x $R^1$, and $R^2$ as defined above in section D above and z, z', and z" are all from about 5≦ to ≦ about 20, more preferably the total number of z+z'+z" is from about 5≦ to ≦ about 20. In a particularly preferred form of this structure the heterocyclic ring is a five member ring with Y"=O, one $R^5$ is —H, two $R^5$ are $—O—(R^2O)_z—H$, and at least one $R^5$ has the following structure $—CH(CH_2—(OR^2)_{z''}—H)—CH_2—(OR^2)_{z'}—OC(O)R^1$ with the total z+z'+z"=to from about 8≦ to ≦ about 20 and $R^1$ is a hydrocarbon with from about 8 to about 20 carbon atoms and no aryl group.

Another group of surfactants that can be used are polyhydroxy fatty acid amide surfactants of the formula:

$$R^6—C(O)—N(R^7)—W$$

wherein: each $R^7$ is H, $C_1$–$C_4$ hydrocarbyl, $C_1$–$C_4$ alkoxyalkyl, or hydroxyalkyl, e.g., 2-hydroxyethyl, 2-hydroxypropyl, etc., preferably $C_1$–$C_4$ alkyl, more preferably $C_1$ or $C_2$ alkyl, most preferably $C_1$ alkyl (i.e., methyl) or methoxyalkyl; and $R^6$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and W is a polyhydroxyhydrocarbyl moiety having a linear hydrocarbyl chain with at least 3 hydroxyls directly connected to the chain, or an alkoxylated derivative (preferably ethoxylated or propoxylated) thereof W preferably will be derived from a reducing sugar in a reductive amination reaction; more preferably W is a glycityl moiety. W preferably will be selected from the group consisting of $—CH_2—(CHOH)_n—CH_2OH$, $—CH(CH_2OH)—(CHOH)_n—CH_2OH$, $—CH_2—(CHOH)_2(CHOR')(CHOH)—CH_2OH$, where n is an integer from 3 to 5, inclusive, and R' is H or a cyclic mono- or poly-saccharide, and alkoxylated derivatives thereof. Most preferred are glycityls wherein n is 4, particularly $—CH_2—(CHOH)_4—CH_2O$. Mixtures of the above W moieties are desirable.

$R^6$ can be, for example, N-methyl, N-ethyl, N-propyl, N-isopropyl, N-butyl, N-isobutyl, N-2-hydroxyethyl, N–1-methoxypropyl, or N-2-hydroxypropyl.

$R^6—CO—N<$ can be, for example, cocamide, stearamide, oleamide, lauramide, myristamide, capricamide, palmitamide, tallowamide, etc.

W can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

(4)—Alkoxylated Cationic Quaternary Ammonium Surfactants

Alkoxylated cationic quaternary ammonium surfactants suitable for this invention are generally derived from fatty alcohols, fatty acids, fatty methyl esters, alkyl substituted phenols, alkyl substituted benzoic acids, and/or alkyl substituted benzoate esters, and/or fatty acids that are converted to amines which can optionally be further reacted with another long chain alkyl or alkyl-aryl group; this amine compound is then alkoxylated with one or two alkylene oxide chains each having ≦ about 50 moles alkylene oxide moieties (e.g. ethylene oxide and/or propylene oxide) per mole of amine. Typical of this class are products obtained from the quaternization of aliphatic saturated or unsaturated, primary, secondary, or branched amines having one or two hydrocarbon chains from about 6 to about 22 carbon atoms alkoxylated with one or two alkylene oxide chains on the amine atom each having less than ≦ about 50 alkylene oxide moieties. The amine hydrocarbons for use herein have from about 6 to about 22 carbon atoms, and are in either straight chain or branched chain configuration, preferably there is one alkyl hydrocarbon group in a straight chain configuration having about 8 to about 18 carbon atoms. Suitable quaternary ammonium surfactants are made with one or two alkylene oxide chains attached to the amine moiety, in average amounts of ≦ about 50 moles of alkylene oxide per alkyl chain, more preferably from about 3 to about 20 moles of alkylene oxide, and most preferably from about 5 to about 12 moles of alkylene oxide per hydrophobic, e.g., alkyl group. Preferred materials of this class also have a pour points below about 70° F. and/or do not solidify in these clear formulations. Examples of suitable phase stabilizers of this type include Ethoquad® 18/25, C/25, and O/25 from Akzo and Variquat®-66 (soft tallow alkyl bis(polyoxyethyl) ammonium ethyl sulfate with a total of about 16 ethoxy units) from Witco.

Preferably, the compounds of the ammonium alkoxylated cationic surfactants have the following general formula:

$$\{R^1{}_{m-Y-[(R^2-O)_z-H]_p}\}^+X^-$$

wherein $R^1$ and $R^2$ are as defined previously in section D above;

Y is selected from the following groups: $=N^+-(A)_q$; $-(CH_2)_n-N^+-(A)_q$; $-B-(CH_2)_n-N^+-(A)_2$; -(phenyl)-$N^+-(A)_q$; -(B-phenyl)-$N^+-(A)_q$; with n being from about 1 to about 4.

Each A is independently selected from the following groups: H; $R^1$; $-(R^2O)_z-H$; $-(CH_2)_xCH_3$; phenyl, and substituted aryl; where $0 \leqq x \leqq$ about 3; and B is selected from the following groups: —O—; —NA—; $-NA_2$; —C(O)O—; and —C(O)N(A)—; wherein $R^2$ is defined as hereinbefore; q=1 or 2; and $X^-$ is an anion which is compatible with fabric softener actives and adjunct ingredients.

Preferred structures are those in which m=1, p=1 or 2, and about $5 \leqq z \leqq$ about 50, more preferred are structures in which m=1, p=or 2, and about $7 \leqq z \leqq$ about 20, and most preferred are structures in which m=1, p=1 or 2, and about $9 \leqq z \leqq$ about 12.

(5)—Surfactant Complexes

Surfactant complexes are considered to be surfactant ions neutralized with a surfactant ion of opposite charge or a surfactant neutralized with an electrolyte that is suitable for reducing dilution viscosity, an ammonium salt, or a polycationic ammonium salt. For the purpose of this invention, if a surfactant complex is formed by surfactants of opposite charge, it is preferable that the surfactants have distinctly different chain lengths e.g. a long-chain surfactant complexed with a short-chain surfactant to enhance the solubility of the complex and it is more preferable that the that the long chain surfactant be the amine or ammonium containing surfactant. Long chain surfactants are defined as containing alkyl chains with from about 6 to about 22 carbon atoms. These alkyl chains can optionally contain a phenyl or substituted phenyl group or alkylene oxide moieties between the chain and the head group. Short chain surfactants are defined as containing alkyl chains with less than 6 carbons and optionally these alkyl chains could contain a phenyl or substituted phenyl group or alkylene oxide moieties between the alkyl chain and the head group. Examples of suitable surfactant complexes include mixtures of Armeen® APA-10 and calcium xylene sulfonate, Armeen APA-10 and magnesium chloride, lauryl carboxylate and triethanol amine, linear alkyl benzene sulfonate and $C_5$-dimethyl amine, or alkyl ethoxylated sulfate and tetrakis N,N,N'N' (2-hydroxylpropyl) ethylenediamine.

Preferably, long-chain surfactants for making complexes have the following general formula:

$$R^1-Y^2$$

wherein $R^1$ is as hereinbefore from section D above and $Y^2$ can be chosen from the following structures: $-N(A)_2$; $-C(O)N(A)_2$; $-(O\leftarrow)N(A)_2$; $-B-R^3-N(A)_2$; $-B-R^3-C(O)N(A)_2$; $-B-R^3-N(\rightarrow O)(A)_2$; $-CO_2^-$; $-SO_3^{-2}$; $-OSO_3^{-2}$; $-O(R^2O)_xCO_2$; $-O(R^2O)_xSO_3^{-2}$; and $-O(R^2O)_xOSO_3^{-2}$; with B and $R^3$ as is hereinbefore section D above and $0 \leqq x \leqq 4$.

Preferably, short-chain surfactants for making complexes have the following general formula:

$$R^4-Y^2$$

wherein $R^1$, $R^3$, B, and $Y^2$ are as hereinbefore and $R^4$ can be chosen from the following: $-(CH_2)_yCH_3$; $-(CH_2)_y$-phenyl or $-(CH_2)_y$-substituted phenyl with $0 \leqq y \leqq 6$.

(6)—Block Copolymers Obtained by Copolymerization of Ethylene Oxide and Propylene Oxide Suitable polymers include a copolymer having blocks of terephthalate and polyethylene oxide. More specifically, these polymers are comprised of repeating units of ethylene and/or propylene terephthalate and polyethylene oxide terephthalate at a preferred molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymer is in the range of from about 5,000 to about 55,000.

Another preferred polymer is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

Highly preferred polymers have the generic formula:

$$X-(OCH_2CH_2)_n-[O-C(O)-R^1-C(O)-O-R^2)_u-[O-C(O)-R^1-C(O)-O)-(CH_2CH_2O)_n-X \quad (1)$$

in which X can be any suitable capping group, with each X being selected from the group consisting of H, and alkyl or acyl groups containing from about 1 to about 4 carbon atoms, preferably methyl, n is selected for water solubility and generally is from about 6 to about 113, preferably from about 20 to about 50, and u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the desired properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 1,4-phenylene moieties (from 0 to about 50% moieties other than 1,4-phenylene) are adequate. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixture thereof. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the polymer in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these polymers is contained in European Patent Application 185,427, Gosselink, published Jun. 25, 1986, incorporated herein by reference.

Other preferred copolymers include surfactants, such as the polyoxypropylene/polyoxyethylene/polyoxypropylene (PO/EO/PO) reverse block polymers.

The copolymer can optionally contain propylene oxide in an amount up to about 15% by weight. Other preferred copolymer surfactants can be prepared by the processes described in U.S. Pat. No. 4,223,163, issued Sep. 16, 1980, Builloty, incorporated herein by reference.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Certain of the block polymer surfactant compounds designated PLURONIC® and TETRONIC® by the BASF-Wyandotte Corp., Wyandotte, Mich., are suitable in compositions of the invention.

A particularly preferred copolymer contains from about 40% to about 70% of a polyoxypropylene/polyoxyethylene/polyoxypropylene block polymer blend comprising about 75%, by weight of the blend, of a reverse block copolymer of polyoxyethylene and polyoxypropylene containing 17 moles of ethylene oxide and 44 moles of propylene oxide; and about 25%, by weight of the blend, of a block copolymer of polyoxyethylene and polyoxypropylene initiated with trimethylolpropane and containing 99 moles of propylene oxide and 24 moles of ethylene oxide per mole of trimethylolpropane.

Suitable for use as copolymer are those having relatively high hydrophilic-lipophilic balance (HLB).

Other polymers useful herein include the polyethylene glycols having a molecular weight of from about 950 to about 30,000 which can be obtained from the Dow Chemical Company of Midland, Mich. Such compounds for example, have a melting point within the range of from about 30° C. to about 100° C., can be obtained at molecular weights of 1,450, 3,400, 4,500, 6,000, 7,400, 9,500, and 20,000. Such compounds are formed by the polymerization of ethylene glycol with the requisite number of moles of ethylene oxide to provide the desired molecular weight and melting point of the respective polyethylene glycol.

(7)—Alkyl Amide Alkoxylated Nonionic Surfactants

Suitable surfactants have the formula:

$$R—C(O)—N(R^4)_n—[(R^1O)_x(R^2O)_yR^3]_m$$

wherein R is $C_{7-21}$ linear alkyl, $C_{7-21}$ branched alkyl, $C_{7-21}$ linear alkenyl, $C_{7-21}$ branched alkenyl, and mixtures thereof. Preferably R is $C_{8-18}$ linear alkyl or alkenyl.

$R^1$ is $—CH_2—CH2—$, $R_2$ is $C_3$–$C_4$ linear alkyl, $C_3$–$C_4$ branched alkyl, and mixtures thereof; preferably $R^2$ is $—CH(CH_3)—CH_2—$. Surfactants which comprise a mixture of R1 and R2 units preferably comprise from about 4 to about 12 $—CH_2—CH_2—$ units in combination with from about 1 to about 4 $—CH(CH_3)—CH_2—$ units. The units may be alternating or grouped together in any combination suitable to the formulator. Preferably the ratio of $R^1$ units to $R^2$ units is from about 4:1 to about 8:1. Preferably an $R^2$ unit (i.e. $—C(CH_3)H—CH_2—$) is attached to the nitrogen atom followed by the balance of the chain comprising from about 4 to 8 $—CH_2—CH_2—$ units.

$R^3$ is hydrogen, $C_1$–$C_4$ linear alkyl, $C_3$–$C_4$ branched alkyl, and mixtures thereof; preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the R4 unit is absent.

The index m is 1 or 2, the index n is 0 or 1, provided that m+n equals 2; preferably m is equal to 1 and n is equal to 1, resulting in one $—[(R^1O)_x(R^2O)_yR^3]$ unit and R4 being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all the alkyleneoxy units are ethyleneoxy units.

Examples of suitable ethoxylated alkyl amide surfactants are Rewopal® $C_6$ from Witco, Amidox® C5 from Stepan, and Ethomid® O/17 and Ethomid® HT/60 from Akzo.; and (8)—Mixtures Thereof.

Auxiliary Whiteness Preservatives

Auxiliary whiteness preservatives are optionally, but preferably incorporated in order to improve fabric whiteness. Auxiliary whiteness preservatives can be used together with the metal chelant to give an extra boost to whiteness maintenance.

1. Brighteners

Optical brighteners also known as fluorescent whitening agents (FWAs) or fluorescent brighteners preserve whiteness by compensating for the yellow appearance by adding a complementary color to the fabric and thus the undesired yellowing is rendered invisible. When a white fabric is stored for a length of time, it can appear to be yellow. Not to be bound by theory, but it is believed that auto-oxidation of polyunsaturated materials such as body fatty acids or fabric softener actives generate compounds that appear yellow on white fabrics, because these compounds absorb short-wavelength light, light in the range of violet to blue or wavelengths between about 370 nm to 550 nm. Optical brighteners absorb light in the range of ultraviolet light and emit light via fluorescence in the blue to blue violet range of the spectrum. Thus optical brighteners replace this missing part of the spectrum on yellowing fabric and so a white appearance is retained.

The product contains from about 0.005% to about 5%, preferably from about 0.05% to about 3%, more preferably from about 0.1% to about 2%, even more preferably from about 0.15% to about 1%, by weight of the composition, optical brightener. Lower levels of brightener are used in the presence of the metal chelating compound. In the absence of the metal chelating compound, higher levels of brightener are preferred.

Preferred optical brighteners are colorless on the substrate and do not absorb in the visible part of the spectrum. Preferred optical brighteners are also lightfast, meaning that these do not degrade substantially in sunlight. Optical brighteners suitable for use in this invention absorb light in the ultraviolet portion of the spectrum between 275 nm and about 400 nm and emit light in the violet to violet-blue range of the spectrum from about 400 nm to about 550 nm. Preferably, the optical brightener will contain an uninterrupted chain of conjugated double bounds. Optical brighteners are typically, but not limited to, derivatives of stilbene or 4,4'-diaminostilbene, biphenyl, five-membered heterocycles such as triazoles, oxazoles, imidiazoles, etc., or six-membered heterocycles (coumarins, naphthalamide, s-triazine, etc.). Many specific brightener structures are described in *The Kirk-Othmer Encyclopedia of Chemistry* 3rd Ed., pp 214–226 and in references therein U.S. Pat. No. 5,759,990 at column 21, lines 15–60; said references being incorporated herein by reference as suitable for use in this invention. Ionic brighteners with a positive or negative charge are preferred as this improves solubility in the compositions disclosed herein and thus are easier to formulate and are more stable. Cationic brighteners are also preferred since these can compete effectively with cationic fabric softeners to partition to the surface of the fabric.

Some preferred, but nonlimiting brighteners are Optiblanc® GL and Optiblanc® LSN from 3V Inc., Weehawken, N.J., Tinopals® CBS SP Slurry 33, PLC, UNPA-GX, 4BM, 4BMS, 5BM, 5BMS, 5BM-GX, AMS-GX, DMS-X, DCS Liquid, K, ERN, LCS, LFW, and TAS, Univex®, SK, ERN, and AT, from Ciba, High Point, N.C., Blankophor® FBW, FB, LPG, and HRS, from Mobay. In addition to preventing auto-oxidation, some brighteners also prevent dye transfer.

2. Bluing Agents

Bluing agents also act to preserve whiteness by compensating for the yellow appearance by again adding a complementary color to the fabric and thus the undesired yellowing is no longer noticeable. Like optical brighteners, bluing agents replace this missing part of the spectrum and so a white appearance is retained.

3. UV Absorbers

Not to be bound by theory, but UV absorbers can operate by protecting the fabric and any fabric softener compound deposited on the fabric from UV exposure. UV light is know to initiate auto-oxidation processes and UV absorbers can be deposited on fabric in such a way that UV light is blocked from the fabric and unsaturated fatty materials, thus preventing the initiation of auto-oxidation.

5. Oxidative Stabilizers

Oxidative stabilizers can be present in the compositions of the present invention and these prevent yellowing by acting as a scavenger for the oxidative processes, thus preventing and/or terminating auto-oxidation, or by reversing oxidation and thus reversing yellowing. The term "oxidative stabilizer," as used herein, includes antioxidants and reductive agents. These agents are present at a level of from 0% to about 2%, preferably from about 0.01% to about 0.2%, more preferably from about 0.035% to about 0.1% for antioxidants, and, preferably, from about 0.01% to about 0.2% for reductive agents.

Examples of antioxidants that can be added to the compositions and in the processing of this invention include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products, Inc., under the trade name Tenox®-6; butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1,1-diphosphonic acid (etidronic acid), and Tiron®, available from Kodak with a chemical name of 4,5-dihydroxy-m-benzene-sulfonic acid/sodium salt, and DTPA®, available from Aldrich with a chemical name of diethylenetriaminepentaacetic acid.

Oxidative stabilizers can also be added at any point during the process of making fabric softener raw materials where polyunsaturated compounds would be present. E.g., these could be added into oils used to make fatty acids, during fatty acid making and/or storage during fabric softener making and/or storage. These assure good odor stability under long term storage conditions.

Other Optional Ingredients

The fabric care composition of the present invention can optionally contain adjunct odor-controlling materials, chelating agents, antistatic agents, insect and moth repelling agents, colorants, especially bluing agents, antioxidants, and mixtures thereof in addition to the cyclic silicone molecules. The total level of optional ingredients is low, preferably less than about 5%, more preferably less than about 3%, and even more preferably less than about 2%, by weight of the usage composition. These optional ingredients exclude the other ingredients specifically mentioned hereinbefore. Incorporating adjunct odor-controlling materials can enhance the capacity of the cyclodextrin to control odors as well as broaden the range of odor types and molecule sizes which can be controlled. Such materials include, for example, metallic salts, water-soluble cationic and anionic polymers, zeolites, water-soluble bicarbonate salts, and mixtures thereof.

Water-Soluble Polyionic Polymers

Some water-soluble polyionic polymers, e.g., water-soluble cationic polymer and water-soluble anionic polymers can be used in the composition of the present invention to provide additional odor control benefits.

Cationic Polymers, e.g., Polyamines

Water-soluble cationic polymers, e.g., those containing amino functionalities, amido functionalities, and mixtures thereof, are useful in the present invention to control certain acid-type odors.

Anionic Polymers, e.g., Polyacrylic Acid

Water-soluble anionic polymers, e.g., polyacrylic acids and their water-soluble salts are useful in the present invention to control certain amine-type odors. Preferred polyacrylic acids and their alkali metal salts have an average molecular weight of less than about 20,000, more preferably less than 5,000000, preferably less than 10,000, more preferably from about 500 to about 5,000. Polymers containing sulfonic acid groups, phosphoric acid groups, phosphonic acid groups, and their water-soluble salts, and mixtures thereof, and mixtures with carboxylic acid and carboxylate groups, are also suitable.

Water-soluble polymers containing both cationic and anionic functionalities are also suitable. Examples of these polymers are given in U.S. Pat. No. 4,909,986, issued Mar. 20, 1990 to N. Kobayashi and A. Kawazoe, incorporated herein by reference. Another example of water-soluble polymers containing both cationic and anionic functionalities is a copolymer of dimethyldiallyl ammonium chloride and acrylic acid, commercially available under the trade name Merquat 280® from Calgon.

When a water-soluble polymer is used it is typically present at a level of from about 0.001% to about 3%, preferably from about 0.005% to about 2%, more preferably from about 0.01% to about 1%, and even more preferably from about 0.05% to about 0.5%, by weight of the usage composition.

Antistatic Agents

The composition of the present invention can optionally contain an effective amount of antistatic agent to provide the treated clothes with in-wear static. Preferred antistatic agents are those that are water soluble in at least an effective amount, such that the composition remains a clear solution. Examples of these antistatic agents are monoalkyl cationic quaternary ammonium compounds, e.g., mono($C_{10}$—$C_{14}$ alkyl)trimethyl ammonium halide, such as monolauryl trimethyl ammonium chloride, hydroxycetyl hydroxyethyl dimethyl ammonium chloride, available under the trade name Dehyquart E® from Henkel, and ethyl bis(polyethoxy ethanol) alkylammonium ethylsulfate, available under the trade name Variquat 66® from Witco Corp., polyethylene glycols, polymeric quaternary ammonium salts, such as polymers conforming to the general formula:

$$-[N(CH_3)_2-(CH_2)_3-NH-CO-NH-(CH_2)_3-N(CH_3)_2^{+}-CH_2CH_2OCH_2CH_2]-_x^{2+}2x[Cl^-]$$

available under the trade name Mirapol A-15® from Rhône-Poulenc, and $$-[N(CH_3)_2-(CH_2)_3-NH-CO-(CH_2)_4-CO-NH-(CH_2)_3-N(CH_3)_2-(CH_2CH_2OCH_2CH_2]-_x^{+}x[Cl^-],$$

available under the trade name Mirapol AD-1® from Rhône-Poulenc, quaternized polyethyleneimines, vinylpyrrolidone/methacrylamidopropyltrimethylammonium chloride copolymer, available under the trade name Gafquat HS-100® from GAF; triethonium hydrolyzed collagen ethosulfate, available under the trade name Quat-Pro E® from Maybrook; neutralized sulfonated polystyrene, available, e.g., under the trade name Versa TL-130® from Alco Chemical, neutralized sulfonated styrene/maleic anhydride copolymers, available, e.g., under the trade name Versa TL-4® from Alco Chemical; and mixtures thereof.

It is preferred that a no foaming, or low foaming, agent is used, to avoid foam formation during fabric treatment. It is also preferred that polyethoxylated agents such as polyethylene glycol or Variquat 66® are not used when alpha-cyclodextrin is used. The polyethoxylate groups have a strong affinity to, and readily complex with, alpha-cyclodextrin which in turn depletes the uncomplexed cyclodextrin available for odor control.

When an antistatic agent is used it is typically present at a level of from about 0.05% to about 10%, preferably from about 0.1% to about 5%, more preferably from about 0.3% to about 3%, by weight of the usage composition.

Insect and/or Moth Repelling Agent

The composition of the present invention can optionally contain an effective amount of insect and/or moth repelling agents. Typical insect and moth repelling agents are pheromones, such as anti-aggregation pheromones, and other natural and/or synthetic ingredients. Preferred insect and moth repellent agents useful in the composition of the present invention are perfume ingredients, such as citronellol, citronellal, citral, linalool, cedar extract, geranium oil, sandalwood oil, 2-(diethylphenoxy)ethanol, 1-dodecene, etc. Other examples of insect and/or moth repellents useful in the composition of the present invention are disclosed in U.S. Pat. Nos. 4,449,987, 4,693,890, 4,696,676, 4,933,371, 5,030,660, 5,196,200, and in "Semio Activity of Flavor and Fragrance Molecules on Various Insect Species", B. D. Mookherjee et al., published in *Bioactive Volatile Compounds from Plants*, ASC Symposium Series 525, R. Teranishi, R. G. Buttery, and H. Sugisawa, 1993, pp. 35–48, all of said patents and publications being incorporated herein by reference. When an insect and/or moth repellent is used it is typically present at a level of from about 0.005% to about 3%, by weight of the usage composition.

Colorant

Colorants and dyes, especially bluing agents, can be optionally added to the fabric care compositions for visual appeal and performance impression. When colorants are used, they are used at extremely low levels to avoid fabric staining. Preferred colorants for use in the present compositions are highly water-soluble dyes, e.g., Liquitint® dyes available from Milliken Chemical Co. Non-limiting examples of suitable dyes are, Liquitint Blue HP®, Liquitint Blue 65®, Liquitint Patent Blue®, Liquitint Royal Blue®, Liquitint Experimental Yellow 8949-43®, Liquitint Green HMC®, Liquitint Yellow II®, and mixtures thereof, preferably Liquitint Blue HP®, Liquitint Blue 65®, Liquitint Patent Blue®, Liquitint Royal Blue®, Liquitint Experimental Yellow 8949-43®, and mixtures thereof.

Optional Anti-Clogging Agent

Optional anti-clogging agent which enhances the wetting and anti-clogging properties of the composition, especially when starch is present, is chosen from the group of polymeric glycols of alkanes and olefins having from 2 to about 6, preferably 2 carbon atoms. The anti-clogging agent inhibits the formation of "plugs" in the spray nozzle. An example of the preferred anti-clogging agent is polyethylene glycol having an average molecular weight of from about 800 to about 12,000, more preferably from about 1,400 to about 8,000. When used, the anti-clogging agent is present at a level of from about 0.01% to about 1%, preferably from about 0.05% to about 0.5%, more preferably, from about 0.1% to about 0.3% by weight of the usage composition.

Builders

The compositions according to the present invention can further comprise a builder or builder system, especially for detergent compositions. Any conventional builder system is suitable for use herein including aluminosilicate materials, silicates, polycarboxylates, alkyl- or alkenyl-succinic acid and fatty acids, materials such as ethylenediamine tetraacetate, diethylene triamine pentamethyleneacetate, metal ion sequestrants such as aminopolyphosphonates, particularly ethylenediamine tetramethylene phosphonic acid and diethylene triamine pentamethylenephosphonic acid. Phosphate builders can also be used herein.

The present invention can include a suitable builder or detergency salt. The level of detergent salt/builder can vary widely depending upon the end use of the composition and its desired physical form. When present, the compositions will typically comprise at least about 1% builder and more typically from about 10% to about 80%, even more typically from about 15% to about 50% by weight, of the builder. Lower or higher levels, however, are not meant to be excluded.

Inorganic or P-containing detergent salts include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulphates, and aluminosilicates. However, non-phosphate salts are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Examples of suitable silicate builders, carbonate salts, aluminosilicate builders, polycarboxylate builders, citrate builders, 3,3-dicarboxy-4-oxa-1,6-hexanedioate builders and related compounds disclosed in U.S. Pat. No. 4,566,984, to Bush, succinic acid builders, phosphorous-based builders and fatty acids, are disclosed in U.S. Pat. Nos. 5,576,282, 5,728,671 and 5,707,950.

Additional suitable builders can be an inorganic ion exchange material, commonly an inorganic hydrated aluminosilicate material, more particularly a hydrated synthetic zeolite such as hydrated zeolite A, X, B, HS or MAP.

Specific polycarboxylates suitable for the present invention are polycarboxylates containing one carboxy group include lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydro-furan-cis, cis, cis-tetracarboxylates, 2,5-tetrahydro-furan-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic poly-carboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

Preferred builder systems for use in the present compositions include a mixture of a water-insoluble aluminosilicate builder such as zeolite A or of a layered silicate (SKS6), and a water-soluble carboxylate chelating agent such as citric acid.

Preferred builder systems include a mixture of a water-insoluble aluminosilicate builder such as zeolite A, and a water soluble carboxylate chelating agent such as citric acid. Preferred builder systems for use in liquid detergent compositions of the present invention are soaps and polycarboxylates.

Other suitable water-soluble organic salts are the homo- or copolymeric acids or their salts, in which the polycarboxylic acid comprises at least two carboxyl radicals separated from each other by not more than two carbon atoms. Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 5% to 80% by weight of the composition preferably from 10% to 70% and most usually from 30% to 60% by weight.

Bleaching Agent

Additional optional detergent ingredients that can be included in the detergent compositions of the present invention include bleaching agents such as hydrogen peroxide, PB1, PB4 and percarbonate with a particle size of 400–800 microns. These bleaching agent components can include one or more oxygen bleaching agents and, depending upon the bleaching agent chosen, one or more bleach activators. When present oxygen bleaching compounds will typically be present at levels of from about 1% to about 25%.

The bleaching agent component for use herein can be any of the bleaching agents useful for detergent compositions including oxygen bleaches as well as others known in the art. The bleaching agent suitable for the present invention can be an activated or non-activated bleaching agent.

Examples of suitable bleaching agents are disclosed in U.S. Pat. Nos. 5,707,950 and 5,576,282.

The hydrogen peroxide releasing agents can be used in combination with, for example, the bleach activators disclosed in U.S. Pat. No. 5,707,950 or Phenolsulfonate ester of N-nonanoyl-6-aminocaproic acid ($NACA^-$ OBS), described in WO94/28106), which are perhydrolyzed to form a peracid as the active bleaching species, leading to improved bleaching effect. Also suitable activators are acylated citrate esters.

Useful bleaching agents, including peroxyacids and bleaching systems comprising bleach activators and peroxygen bleaching compounds for use in detergent compositions according to the invention are described in WO95/27772, WO95/27773, WO95/27774, WO95/27775 and U.S. Pat. No. 5,707,950.

Metal-containing catalysts for use in bleach compositions, include cobalt-containing catalysts such as pentamine acetate cobalt(III) salts and manganese-containing catalysts such as those described in EPA 549 271; EPA 549 272; EPA 458 397; U.S. Pat. No. 5,246,621; EPA 458 398; U.S. Pat. No. 5,194,416 and U.S. Pat. No. 5,114,611. Bleaching composition comprising a peroxy compound, a manganese-containing bleach catalyst and a chelating agent is described in the patent application No 94870206.3. All of the above patents and applications being incorporated herein by reference.

Dye Transfer Inhibiting Agents

The fabric care compositions of the present invention can also include compounds for inhibiting dye transfer from one fabric to another of solubilized and suspended dyes encountered during fabric laundering and conditioning operations involving colored fabrics.

Polymeric Dye Transfer Inhibiting Agents

The fabric care compositions according to the present invention can also comprise from 0.001% to 10%, preferably from 0.01% to 2%, more preferably from 0.05% to 1% by weight of polymeric dye transfer inhibiting agents. Said polymeric dye transfer inhibiting agents are normally incorporated into fabric care compositions in order to inhibit the transfer of dyes from colored fabrics onto fabrics washed therewith. These polymers have the ability to complex or adsorb the fugitive dyes washed out of dyed fabrics before the dyes have the opportunity to become attached to other articles in the wash or the rinse.

Especially suitable polymeric dye transfer inhibiting agents are polyvinylpyrrolidone polymers, poly(4-vinylpyridine-N-oxide), polyamine N-oxide polymers, copolymers of N-vinylpyrrolidone and N-vinylimidazole, polyvinyloxazolidones and polyvinylimidazoles or mixtures thereof. Examples of such dye transfer inhibiting agents are disclosed in U.S. Pat. No. 5,804,219, issued Sep. 8, 1998 to T. Trinh, S. L.-L. Sung, H. B. Tordil, and P. A. Wendland, and in U.S. Pat. Nos. 5,707,950 and 5,707,951, all are incorporated herein by reference.

Additional suitable dye transfer inhibiting agents include, but are not limited to, cross-linked polymers. Cross-linked polymers are polymers whose backbone are interconnected to a certain degree; these links can be of chemical or physical nature, possibly with active groups n the backbone or on branches; cross-linked polymers have been described in the Journal of Polymer Science, volume 22, pages 1035–1039.

In one embodiment, the cross-linked polymers are made in such a way that they form a three-dimensional rigid structure, which can entrap dyes in the pores formed by the three-dimensional structure. In another embodiment, the cross-linked polymers entrap the dyes by swelling.

Such cross-linked polymers are described in the co-pending European patent application 94870213.9.

Chlorine Scavenging Agents

Chlorine scavenging agents are actives that react with chlorine, or with chlorine-generating materials, such as hypochlorite, to eliminate or reduce the bleaching activity of the chlorine materials. Chlorine is used in many parts of the world to sanitize water. To make sure that the water is safe, a small amount, typically about 1 to 2 ppm of chlorine is left in the water. It has been found that this small amount of chlorine in the tap water can cause fading of some fabric dyes. For rinse-added compositions, it is suitable to incorporate enough chlorine scavenging agent to neutralize about 1 ppm, preferably 2 ppm, more preferably 3 ppm, and even more preferably 10 ppm of chlorine in rinse water.

Suitable levels of the optional chlorine scavengers in the rinse-added composition of the present invention range from about 0.01% to about 10%, preferably from about 0.02% to about 5%, more preferably from about 0.05% to about 4%.

The fabric softener compositions, and especially the preferred compositions herein, can contain an effective amount of chlorine scavenger, preferably selected from the group consisting of:

a. amines and their salts;
b. ammonium salts;
c. amino acids and their salts;
d. polyamino acids and their salts;
e. polyethyleneimines and their salts;
f. polyamines and their salts;
g. polyamineamides and their salts;
h. polyacrylamides; and
i. mixtures thereof.

Non-limiting examples of chlorine scavengers include amines, preferably primary and secondary amines, including primary and secondary fatty amines, and alkanolamines; and their salts; ammonium salts, e.g., chloride, bromide, citrate, sulfate; amine-functional polymers and their salts; amino acid homopolymers with amino groups and their salts, such as polyarginine, polylysine, polyhistidine; amino acid copolymers with amino groups and their salts, including 1,5-di-ammonium-2-methyl-panthene dichloride and lysine monohydrochloride; amino acids and their salts, preferably those having more than one amino group per molecule, such as arginine, histidine, and lysine, reducing anions such as sulfite, bisulfite, thiosulfate, and nitrite. antioxidants such as ascorbate, carbamate, phenols; and mixtures thereof.

Preferred chlorine scavengers are water soluble, especially, low molecular weight primary and secondary amines of low volatility, e.g., monoethanolamine, diethanolamine, tris(hydroxymethyl)aminomethane, hexamethylenetetramine, and their salts, and mixtures thereof. Suitable chlorine scavenger polymers include: water soluble amine-functional polymers, e.g., polyethyleneimines, polyamines, polyamineamides, polyacrylamides, and their salts, and mixtures thereof. The preferred polymers are polyethyleneimines; the polyamines, including, e.g., di(higher alkyl) cyclic amines and their condensation products, and polymers containing amino groups; polyamineamides, and their salts; and mixtures thereof. Preferred polymers for use in the fabric softening compositions of the present invention are polyethyleneimines and their salts. Preferred polyethyleneimines have a molecular weight of less than about 2000, more preferably from about 200 to about 1500. The water solubility is preferably at least about 1 g/100 g water, more preferably at least about 3 g/100 g water, even more preferably at least about 5 g/100 g water.

Some polyamines with the general formula $(R_1)_2N(CX_2)_nN(R^2)_2$ can serve both as a chlorine scavenging agent and a "chelant" color care agent. Non-limiting examples of such preferred polyamines are N,N,N',N'-tetrakis(2-hydroxypropyl) ethylenediamine and N,N,N',N",N"-penta(2-hydroxypropyl)diethylenetriamine.

Preferred polymeric chlorine scavengers have an average molecular weight of less than about 5,000, more preferably from about 200 to about 2,000, even more preferably from about 200 to about 1,000. Low molecular weight polymers are easier to remove from fabrics than higher molecular weight polymers, resulting in less buildup of the chlorine scavenger and therefore less discoloration of the fabrics. Liquid chlorine scavengers can be used in liquid softener compositions, but amine-functional chlorine scavengers are preferably neutralized by an acid, before they are added into the compositions.

Polymeric Soil Release Agents

Soil release agents, usually polymers, are especially desirable additives at levels of from about 0.05% to about 5%, preferably from about 0.1% to about 4%, more preferably from about 0.2% to about 3%. Suitable soil release agents are disclosed in U.S. Pat. No. 4,702,857, Gosselink, issued Oct. 27, 1987; U.S. Pat. No. 4,711,730, Gosselink and Diehl, issued Dec. 8, 1987; U.S. Pat. No. 4,713,194, Gosselink issued Dec. 15, 1987; U.S. Pat. No. 4,877,896, Maldonado, Trinh, and Gosselink, issued Oct. 31, 1989; U.S. Pat. No. 4,956,447, Gosselink, Hardy, and Trinh, issued Sep. 11, 1990; and U.S. Pat. No. 4,749,596, Evans, Huntington, Stewart, Wolf, and Zimmerer, issued Jun. 7, 1988, said patents being incorporated herein by reference.

Especially desirable optional ingredients are polymeric soil release agents comprising block copolymers of polyalkylene terephthalate and polyoxyethylene terephthalate, and block copolymers of polyalkylene terephthalate and polyethylene glycol. The polyalkylene terephthalate blocks preferably comprise ethylene and/or propylene groups. Many such soil release polymers are nonionic.

A preferred nonionic soil release polymer has the following average structure:

$$CH_3O(CH_2CH_2O)_{40}—[C(O)—C_6H_4—C(O)—OCH_2CH(CH_3)O—]_5—C(O)—C_6H_4—C(O)—(OCH_2CH_2—)_{40}OCH_3.$$

Such soil release polymers are described in U.S. Pat. No. 4,849,257, Borcher, Trinh and Bolich, issued Jul. 18, 1989, said patent being incorporated herein by reference.

Another highly preferred nonionic soil release polymer is described in New Zealand Pat. No. 242,150, issued Aug. 7, 1995 to Pan, Gosselink, and Honsa, said patent is incorporated herein by reference.

The polymeric soil release agents useful in the present invention can include anionic and cationic polymeric soil release agents. Suitable anionic polymeric or oligomeric soil release agents are disclosed in U.S. Pat. No. 4,018,569, Trinh, Gosselink and Rattinger, issued Apr. 4, 1989, said patent being incorporated herein by reference. Other suitable polymers are disclosed in U.S. Pat. No. 4,808,086, Evans, Huntington, Stewart, Wolf, and Zimmerer, issued Feb. 24, 1989, said patent being incorporated herein by reference. Suitable cationic soil release polymers are described in U.S. Pat. No. 4,956,447, Gosselink, Hardy, and Trinh, issued Sep. 11, 1990, said patent being incorporated hereinbefore by reference.

Dye Fixing Agents

The optional dye fixing agents, or "fixatives", are materials which are useful to improve the appearance of dyed fabrics by minimizing the loss of dye from fabrics due to washing.

Many dye fixing agents are cationic, and are based on quaternized nitrogen compound or on nitrogen compounds having a strong cationic charge which is formed in situ under the conditions of usage. Cationic fixatives are available under various trade names from several suppliers. Representative examples include: CROSCOLOR® PMF and CROSCOLOR® NOFF available from Crosfield; INDOSOL® E-50 (polyethyleneamine-based) and SANDOFIX® TPS from Sandoz; and CARTAFIX® CB from Clariant. Additional non-limiting examples include SANDOFIX SWE (a cationic resinous compound) from Sandoz; REWIN® SRF, REWIN® SRF-O and REWIN DWR from CHT-Beitlich GMBH; Tinofix® ECO, Tinofix® FRD and Solfin® from Ciba-Geigy. Preferred optional dye fixing agents for use in the compositions of the present invention are SANDOFIX TPS and CARTAFIX CB.

Other cationic dye fixing agents are described in "Aftertreatments for Improving the Fastness of Dyes on Textile Fibres", Christopher C. Cook, *Rev. Prog. Coloration*, Vol. XII, (1982). Optional dye fixing agents suitable for use in the present invention are ammonium compounds such as fatty acid-diamine condensates inter alia the hydrochloride, acetate, metosulphate and benzyl hydrochloride salts of diamine esters. Non-limiting examples include oleyldiethyl aminoethylamide, oleylmethyl diethylenediamine methosulphate, monostearylethylene diaminotrimethylammonium methosulphate. In addition, the N-oxides of tertiary amines; derivatives of polymeric alkyldiamines, polyamine-cyanuric chloride condensates, and aminated glycerol dichlorohydrins are suitable for use as dye fixatives in the compositions of the present invention.

Another class of optional dye fixing agents suitable for use in the present invention are cellulose reactive dye fixing agents. The cellulose reactive dye fixatives may be suitably combined with one or more dye fixatives described herein above in order to comprise a "dye fixative system".

The term "cellulose reactive dye fixing agent" is defined herein as "a dye fixative agent which reacts with the cellulose fibers upon application of heat or upon a heat treatment either in situ or by the formulator".

Typically cellulose reactive dye fixing agents are compounds which contain a cellulose reactive moiety. Non limiting examples of these compounds include halogenotriazines, vinyl sulphones, epichlorhydrine derivatives, hydroxyethylene urea derivatives, formaldehyde condensation products, polycarboxylates, glyoxal and glutaraldehyde derivatives, and mixtures thereof. Further examples can be found in "Textile Processing and Properties", Tyrone L. Vigo, at page 120 to 121, Elsevier (1997), which discloses specific electrophilic groups and their corresponding cellulose affinity.

Preferred hydroxyethylene urea derivatives include dimethyloldihydroxy ethylene, urea, and dimethyl urea glyoxal. Preferred formaldehyde condensation products include the condensation products derived from formaldehyde and a group selected from an amino-group, an imino-group, a phenol group, an urea group, a cyanamide group and an aromatic group. Commercially available compounds among this class are Sandofix WE 56 from Clariant, Zetex E from Zeneca and Levogen BF from Bayer. Preferred polycarboxylates derivatives include butane tetracarboxilic acid derivatives, citric acid derivatives, polyacrylates and derivatives thereof. A referred cellulosic reactive dye fixing agent is Indosol CR (hydroxyethylene urea derivative) from Clariant. Other preferred cellulosic reactive dye fixing agents are Rewin DWR and Rewin WBS from CHT R. Beitlich.

The compositions of the present invention optionally comprise from about 0.001% to about 40%, preferably from about 0.5% to more preferably to about 10%, more preferably from about 1% to about 5%, by weight of the fabric care composition, of one or more dye fixing agents.

Dispersants

The detergent composition of the present invention can also contain dispersants. Suitable water-soluble organic salts are the homo- or co-polymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 1,000 to 100,000.

Especially, copolymer of acrylate and methylacrylate such as the 480N having a molecular weight of 4000, at a level from 0.5–20% by weight of composition can be added in the detergent compositions of the present invention.

The compositions of the invention can contain a lime soap peptiser compound, which has a lime soap dispersing power (LSDP), as defined hereinafter of no more than 8, preferably no more than 7, most preferably no more than 6. The lime soap peptiser compound is preferably present at a level from 0% to 20% by weight.

A numerical measure of the effectiveness of a lime soap peptiser is given by the lime soap dispersant power (LSDP) which is determined using the lime soap dispersant test as described in an article by H. C. Borghetty and C. A. Bergman, J. Am. Oil. Chem. Soc., volume 27, pages 88–90, (1950). This lime soap dispersion test method is widely used by practitioners in this art field being referred to, for example, in the following review articles; W. N. Linfield, Surfactant science Series, Volume 7, page 3; W. N. Linfield, Tenside surf. det., volume 27, pages 159–163, (1990); and M. K. Nagarajan, W. F. Masler, Cosmetics and Toiletries, volume 104, pages 71–73, (1989). The LSDP is the % weight ratio of dispersing agent to sodium oleate required to disperse the lime soap deposits formed by 0.025 g of sodium oleate in 30 ml of water of 333 ppm $CaCO_3$ (Ca:Mg=3:2) equivalent hardness.

Surfactants having good lime soap peptizer capability will include certain amine oxides, betaines, sulfobetaines, alkyl ethoxysulfates and ethoxylated alcohols.

Exemplary surfactants having a LSDP of no more than 8 for use in accord with the present invention include $C_{16}$–$C_{18}$ dimethyl amine oxide, $C_{12}$–$C_{18}$ alkyl ethoxysulfates with an average degree of ethoxylation of from 1–5, particularly $C_{12}$–$C_{15}$ alkyl ethoxysulfate surfactant with a degree of ethoxylation of amount 3 (LSDP=4), and the $C_{14}$–$C_{15}$ ethoxylated alcohols with an average degree of ethoxylation of either 12 (LSDP=6) or 30, sold under the tradenames Lutensol A012 and Lutensol A030 respectively, by BASF GmbH.

Polymeric lime soap peptizers suitable for use herein are described in the article by M. K. Nagarajan, W. F. Masler, to be found in Cosmetics and Toiletries, volume 104, pages 71–73, (1989).

Hydrophobic bleaches such as 4-[N-octanoyl-6-aminohexanoyl]benzene sulfonate, 4-[N-nonanoyl-6-aminohexanoyl]benzene sulfonate, 4-[N-decanoyl-6-aminohexanoyl] benzene sulfonate and mixtures thereof; and nonanoyloxy benzene sulfonate together with hydrophilic/hydrophobic bleach formulations can also be used as lime soap peptizers compounds.

Examples of other suitable dispersing agents are disclosed in U.S. Pat. Nos. 5,576,282 and 5,728,671.

Enzymes

Optional enzymes are useful in the compositions, especially wash-added and rinse-added compositions, of the present invention to improve cleaning, odor control and/or fabric appearance benefits. Preferred enzymes include laundry detergent and/or fabric care applicable enzymes like protease, amylase, lipase, cutinase and/or cellulase.

Examples of suitable enzymes are disclosed in U.S. Pat. Nos. 5,576,282, 5,728,671 and 5,707,950.

Particularly useful proteases are described in PCT publications: WO 95/30010 published Nov. 9, 1995 by The Procter & Gamble Company; WO 95/30011 published Nov. 9, 1995 by The Procter & Gamble Company; and WO 95/29979 published Nov. 9, 1995 by The Procter & Gamble Company.

In addition to the peroxidase enzymes disclosed in U.S. Pat. Nos. 5,576,282, 5,728,671 and 5,707,950, other suitable peroxidase enzymes are disclosed in European Patent application EP No. 96870013.8, filed Feb. 20, 1996. Also suitable is the laccase enzyme.

Preferred enhancers are substituted phenthiazine and phenoxasine 10-Phenothiazinepropionicacid (PPT), 10-ethylphenothiazine-4-carboxylic acid (EPC), 10-phenoxazinepropionic acid (POP) and 10-methylphenoxazine (described in WO 94/12621) and substituted syringates (C3–C5 substituted alkyl syringates) and phenols. Sodium percarbonate or perborate are preferred sources of hydrogen peroxide.

Said peroxidases are normally incorporated in the detergent composition at levels from 0.0001% to 2% of active enzyme by weight of the detergent composition.

Other preferred enzymes that can be included in the fabric care or detergent compositions of the present invention include lipases. Suitable lipase enzymes for detergent usage include those produced by microorganisms of the *Pseudomonas* group, such as *Pseudomonas stutzeri* ATCC 19.154, as disclosed in British Patent 1,372,034. Suitable lipases include those which show a positive immunological cross-reaction with the antibody of the lipase, produced by the microorganism *Pseudomonas fluorescent* IAM 1057. This lipase is available from Amano Pharmaceutical Co. Ltd., Nagoya, Japan, under the trade name Lipase P "Amano," hereinafter referred to as "Amano-P". Other suitable commercial lipases include Amano-CES, lipases ex *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. Especially suitable lipases are lipases such as M1 Lipase$^R$ and Lipomax$^R$ (Gist-Brocades) and Lipolase$^R$ and Lipolase Ultra$^R$(Novo) which have found to be very effective when used in combination with the compositions of the present invention.

Also suitable are cutinases [EC 3.1.1.50] which can be considered as a special kind of lipase, namely lipases which do not require interfacial activation. Addition of cutinases to detergent compositions have been described in e.g. WO 88/09367 (Genencor).

The lipases and/or cutinases are normally incorporated in the detergent composition at levels from 0.0001% to 2% of active enzyme by weight of the detergent composition.

Known amylases (α and/or β) can be included for removal of carbohydrate-based stains. WO 94/02597, Novo Nordisk A/S published Feb. 3, 1994, describes cleaning compositions which incorporate mutant amylases. See also WO94/18314, Genencor, published Aug. 18, 1994 and WO95/10603, Novo Nordisk A/S, published Apr. 20, 1995. Other amylases known for use in detergent compositions include both α- and β-amylases. α-Amylases are known in the art and include those disclosed in U.S. Pat. No. 5,003,257; EP 252,666; WO 91/00353; FR 2,676,456; EP 285,123; EP 525,610; EP 368,341; and British Patent Specification No. 1,296,839 (Novo). Other suitable amylase are stability-enhanced amylases including Purafact Ox Am$^R$ described in WO 94/18314, published Aug. 18, 1994 and WO96/05295, Genencor, published Feb. 22, 1996 and amylase variants from Novo Nordisk A/S, disclosed in WO 95/10603, published April 95.

Examples of commercial α-amylases products are TERMAMYL®, BAN®, FUNGAMYL® and DURAMYL®, all available from Novo Nordisk A/S Denmark. WO95/26397 describes other suitable amylases: α-amylases characterised by having a specific activity at least 25% higher than the specific activity of TERMAMYL® at a temperature range of 25° C. to 55° C. and at a pH value in the range of 8 to 10, measured by the PHADEBAS® α-amylase activity assay. Other amylolytic enzymes with improved properties with respect to the activity level and the combination of thermostability and a higher activity level are described in WO95/35382.

The cellulases usable in the present invention include both bacterial or fungal cellulases. Preferably, they will have a pH optimum of between 5 and 12 and an activity above 50 CEVU (Cellulose Viscosity Unit). Suitable cellulases are disclosed in U.S. Pat. No. 4,435,307, Barbesgoard et al, J61078384 and WO96/02653 which discloses fungal cellulase produced respectively from *Humicola insolens, Trichoderma, Thielavia* and *Sporotrichum*. EP 739 982 describes cellulases isolated from novel *Bacillus* species. Suitable cellulases are also disclosed in GB-A-2.075.028; GB-A-2.095.275; DE-OS-2.247.832 and WO95/26398.

Examples of such cellulases are cellulases produced by a strain of *Humicola insolens* (*Humicola grisea* var. *thermoidea*), particularly the *Humicola* strain DSM 1800. Other suitable cellulases are cellulases originated from *Humicola insolens* having a molecular weight of about 50 KDa, an isoelectric point of 5.5 and containing 415 amino acids; and a ~43 kD endoglucanase derived from *Humicola insolens*, DSM 1800, exhibiting cellulase activity; a preferred endoglucanase component has the amino acid sequence disclosed in PCT Patent Application No. WO 91/17243. Also suitable cellulases are the EGIII cellulases from *Trichoderma longibrachiatum* described in WO94/21801, Genencor, published Sep. 29, 1994. Especially suitable cellulases are the cellulases having color care benefits. Examples of such cellulases are cellulases described in European patent application No. 91202879.2, filed Nov. 6, 1991 (Novo). Carezyme and Celluzyme (Novo Nordisk A/S) are especially useful. See also WO91/17244 and WO91/21801. Other suitable cellulases for fabric care and/or cleaning properties are described in WO96/34092, WO96/17994 and WO95/24471. Suitable cellulases and their appropriate levels useful in rinse-added compositions of the present invention are described in U.S. Pat. No. 5,445,747, issued Aug. 29, 1995 to L. L. Kvietok, T. Trinh and J. A. Hollingshead. All these patents are incorporated herein by reference.

Said cellulases are normally incorporated in the detergent composition at levels from 0.0001% to 2% of active enzyme by weight of the detergent composition.

The above-mentioned enzymes can be of any suitable origin, such as vegetable, animal, bacterial, fungal and yeast origin. Purified or non-purified forms of these enzymes can be used. Also included by definition, are mutants of native enzymes. Mutants can be obtained e.g. by protein and/or genetic engineering, chemical and/or physical modifications of native enzymes. Common practice as well is the expression of the enzyme via host organisms in which the genetic material responsible for the production of the enzyme has been cloned.

Enzymes are normally incorporated in the detergent composition at levels from 0.0001% to 2% of active enzyme by weight of the detergent composition. The enzymes can be added as separate single ingredients (prills, granulates, stabilized liquids, etc. containing one enzyme) or as mixtures of two or more enzymes (e.g. cogranulates).

Other suitable detergent ingredients that can be added are enzyme oxidation scavengers. Examples of such enzyme oxidation scavengers are ethoxylated tetraethylene polyamines.

A range of enzyme materials and means for their incorporation into synthetic detergent compositions is also disclosed in WO 9307263 and WO 9307260 to Genencor International, WO 8908694 to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilized by various techniques. Enzyme stabilization techniques are disclosed and exemplified in U.S. Pat. No. 3,600,319, Aug. 17, 1971, Gedge et al, EP 199,405 and EP 200,586, Oct. 29, 1986, Venegas. Enzyme stabilization systems are also described, for example, in U.S. Pat. No. 3,519,570. A useful *Bacillus*, sp. AC13 giving proteases, xylanases and cellulases, is described in WO 9401532 to Novo.

Enzymes can also be used to control certain types of malodor, especially malodor from urine and other types of excretions, including regurgitated materials. Proteases are especially desirable. The activity of commercial enzymes depends very much on the type and purity of the enzyme being considered. Enzymes that are water soluble proteases like pepsin, tripsin, ficin, bromelin, papain, rennin, and mixtures thereof are particularly useful.

For odor control purpose, enzymes are normally incorporated at levels sufficient to provide up to about 5 mg by weight, preferably from about 0.001 mg to about 3 mg, more preferably from about 0.002 mg to about 1 mg, of active enzyme per gram of the aqueous compositions. Stated otherwise, the aqueous compositions herein can comprise from about 0.0001% to about 0.5%, preferably from about 0.001% to about 0.3%, more preferably from about 0.005% to about 0.2% by weight of a commercial enzyme preparation. Protease enzymes are usually present in such commercial preparations at levels sufficient to provide from 0.0005 to 0.1 Anson units (AU) of activity per gram of aqueous composition.

Nonlimiting examples of suitable, commercially available, water soluble proteases are pepsin, tripsin, ficin, bromelin, papain, rennin, and mixtures thereof. Papain can be isolated, e.g., from papaya latex, and is available commercially in the purified form of up to, e.g., about 80% protein, or cruder, technical grade of much lower activity. Other suitable examples of proteases are the subtilisins which are obtained from particular strains of *B. subtilis* and *B. licheniforms*. Another suitable protease is obtained from a strain of *Bacillus*, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo. Proteolytic enzymes suitable for removing protein-based stains that are commercially available include those sold under the trade names ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985); Protease B (see European Patent Application Serial No. 87303761.8, filed Apr. 28, 1987, and European Patent Application 130,756, Bott et al, published Jan. 9, 1985); and proteases made by Genencor International, Inc., according to one or more of the following patents: Caldwell et al, U.S. Pat. Nos. 5,185,258, 5,204,015 and 5,244,791.

A wide range of enzyme materials and means for their incorporation into liquid compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Other enzyme materials useful for liquid formulations, and their incorporation into such formulations, are disclosed in U.S. Pat. No. 4,261,868, Hora et al, issued Apr. 14, 1981. Enzymes can be stabilized by various techniques, e.g., those disclosed and exemplified in U.S. Pat. No. 3,600,319, issued Aug. 17, 1971 to Gedge, et al., European Patent Application Publication No. 0 199 405, Application No. 86200586.5, published Oct. 29, 1986, Venegas, and in U.S. Pat. No. 3,519,570. All of the above patents and applications are incorporated herein, at least in pertinent part.

Enzyme-polyethylene glycol conjugates are also preferred. Such polyethylene glycol (PEG) derivatives of enzymes, wherein the PEG or alkoxy-PEG moieties are coupled to the protein molecule through, e.g., secondary amine linkages. Suitable derivatization decreases immunogenicity, thus minimizes allergic reactions, while still maintaining some enzymatic activity. An example of protease-PEG's is PEG-subtilisin Carlsberg from *B. lichenniformis* coupled to methoxy-PEGs through secondary amine linkage, and is available from Sigma-Aldrich Corp., St. Louis, Mo.

Heavy Metal Chelating Agents

The wash-added fabric care compositions herein can also optionally contain one or more iron and/or manganese chelating agents. Suitable chelating agents is selected from the group consisting of amino carboxylates, amino phosphonates, polyfunctionally-substituted aromatic chelating agents and mixtures thereof. The chelating agents disclosed in said U.S. Pat. No. 5,759,990 at column 26, line 29 through column 27, line 38 are suitable. Other examples of suitable chelating agents are disclosed in U.S. Pat. No. 5,728,671.

A suitable amine-based metal chelator that can be used herein is ethylenediamine-N,N'-disuccinate (EDDS). EDDS is described in U.S. Pat. No. 4,704,233, and has the formula (shown in free acid form):

$$HN(L)C_2H_4N(L)H$$

wherein L is a $CH_2(COOH)CH_2(COOH)$ group.

The compositions herein can also contain water-soluble methyl glycine diacetic acid (MGDA) salts (or acid form) as a chelant or co-builder useful with, for example, insoluble builders such as zeolites, layered silicates and the like.

If utilized, these chelating agents will generally comprise from about 0.1% to about 15% by weight of the detergent compositions herein. More preferably, if utilized, the chelating agents will comprise from about 0.1% to about 3.0% by weight of such compositions.

For rinse-added compositions, preferred metal chelating agents contain amine and especially tertiary amine moieties since these tend to be fabric substantive and very effectively chelate copper and iron as well as other metals. A preferred amine-based metal chelating compound for use in compositions of the present invention has the following general structure:

$$(R_1)(R_2)N(CX_2)_nN(R_3)(R_4)$$

wherein X is selected from the group consisting of hydrogen, linear or branched, substituted or unsubstituted alkyl having from 1 to 10 carbons atoms and substituted or unsubstituted aryl having at least 6 carbon atoms; n is an integer from 0 to 6; $R_1$, $R_2$, $R_3$, and $R_4$ are independently selected from the group consisting of alkyl; aryl; alkaryl; arylalkyl; hydroxyalkyl; polyhydroxyalkyl; polyalkylether having the formula —$((CH2)_yO)_zR_7$ where $R_7$ is hydrogen or a linear, branched, substituted or unsubstituted alkyl chain having from 1 to 10 carbon atoms and where y is an integer from 2 to 10 and z is an integer from 1 to 30; alkoxy; polyalkoxy having the formula: —$(O(CH_2)_y)_zR_7$; the group —$C(O)R_8$ where $R_8$ is alkyl; alkaryl; arylalkyl; hydroxyalkyl; polyhydroxyalkyl and polyalkyether as defined in $R_1$, $R_2$, $R_3$, and $R_4$; $(CX_2)_nN(R_5)(R_6)$ with no more than one of $R_1$, $R_2$, $R_3$, and $R_4$ being $(CX_2)_nN(R_5)(R_6)$ and wherein $R_5$ and $R_6$ are alkyl; alkaryl; arylalkyl; hydroxyalkyl; polyhydroxyalkyl; polyalkylether; alkoxy and polyalkoxy as defined in $R_1$, $R_2$, $R_3$, and $R_4$; and either of $R_1$+$R_3$ or $R_4$ or $R_2$+$R_3$ or $R_4$ can combine to form a cyclic substituent.

Preferred chelating agents include those where $R_1$, $R_2$, $R_3$, and $R_4$ are independently selected from the group consisting of alkyl groups having from 1 to 10 carbon atoms and hydroxyalkyl groups having from 1 to 5 carbon atoms, preferably ethyl, methyl, hydroxyethyl, hydroxypropyl and isohydroxypropyl. The preferred chelating agent has more than about 1% nitrogen by weight of the compound, and preferably more than 7%. A preferred chelating agent is tetrakis-(2-hydroxylpropyl) ethylenediamine (TPED).

The rinse-added composition contains at least about 0.01%, preferably at least about 0.05%, more preferably at least about 0.10% and less than about 10%, preferably less than about 5% and more preferably less than about 1% of chelating agent, by weight of the composition.

Suds Suppressor

Another optional ingredient is a suds suppressor, exemplified by silicones, and silica-silicone mixtures. Examples of suitable suds suppressors are disclosed in U.S. Pat. Nos. 5,707,950 and 5,728,671. These suds suppressors are normally employed at levels of from 0.001% to 2% by weight of the composition, preferably from 0.01% to 1% by weight.

Aqueous Carrier

The preferred carrier of the present invention is water. The water which is used can be distilled, deionized, or tap water. Water is the main liquid carrier due to its low cost, availability, safety, and environmental compatibility. Aqueous solutions are preferred for wrinkle control and odor control.

Water is very useful for fabric wrinkle removal or reduction. Not to be bound by theory, it is believed that water breaks many intrafiber and interfiber hydrogen bonds that keep the fabric in a wrinkle state. It also swells, lubricates and relaxes the fibers- to help the wrinkle removal process.

Water serves as the liquid carrier for the fabric care branched polysaccharide and other soluble and/or dispersible optional ingredients.

Water also serves as the liquid carrier for the cyclodextrins, and facilitates the complexation reaction between the cyclodextrin molecules and any malodorous molecules that are on the fabric when it is treated. The dilute aqueous solution also provides the maximum separation of cyclodextrin molecules on the fabric and thereby maximizes the chance that an odor molecule will interact with a cyclodextrin molecule. It has recently also been discovered that water has an unexpected odor controlling effect of its own. It has been discovered that the intensity of the odor generated by some polar, low molecular weight organic amines, acids, and mercaptans is reduced when the odor-contaminated fabrics are treated with an aqueous solution. Not to be bound by theory, it is believed that water solubilizes and depresses the vapor pressure of these polar, low molecular weight organic molecules, thus reducing their odor intensity.

The level of liquid carrier in the compositions of the present invention is typically greater than about 80%, preferably greater than about 90%, more preferably greater than about 95%, by weight of the composition. When a concentrated composition is used, the level of liquid carrier is typically from about 2% to about 98%, by weight of the composition, preferably from about 35% to about 97%, more preferably from about 60% to about 95%, by weight of the composition.

Optionally, in addition to water, the carrier can contain a low molecular weight organic solvent that is highly soluble in water, e.g., ethanol, propanol, isopropanol, and the like, and mixtures thereof. Low molecular weight alcohols can help the treated fabric to dry faster. The optional solvent is also useful in the solubilization of some adjunct shape retention polymers described hereinbefore. The optional water soluble low molecular weight solvent can be used at a level of up to about 50%, typically from about 0.1% to about 25%, preferably from about 2% to about 15%, more preferably from about 5% to about 10%, by weight of the total composition. Factors that need to consider when a high level of solvent is used in the composition are odor, flammability, and environment impact.

II. Article of Manufacture

The present invention also relates to an article of manufacture comprising the fabric care composition in a package, in association with instructions for how to use the composition to treat fabrics correctly, in order to obtain the desirable fabric care results, viz, wrinkle removal and/or reduction, wrinkle resistance, fiber strengthening/anti-wear, fabric wear reduction, fabric shrinkage prevention and/or reduction, fabric pill prevention and/or reduction, shrinkage prevention and/or reduction, fabric color maintenance, fabric color fading reduction, soiling prevention and/or reduction, and/or fabric shape retention, and mixtures thereof. A preferred article of manufacture comprises said composition in a spray dispenser, in association with instructions for how to use the composition to treat fabrics correctly, including, e.g., the manner and/or amount of composition to spray, and the preferred ways of stretching and/or smoothing of the fabrics to remove wrinkles, as will be described with more detailed herein below. It is important that the instructions be as simple and clear as possible, so that using pictures and/or icons is desirable.

Spray Dispenser

An article of manufacture herein comprises a spray dispenser. The fabric care composition is placed into a spray dispenser in order to be distributed onto the fabric. Said spray dispenser for producing a spray of liquid droplets can be any of the manually activated means as is known in the art, e.g. trigger-type, pump-type, non-aerosol self-pressurized, and aerosol-type spray means, for treating the fabric care composition to small fabric surface areas and/or a small number of garments, as well as non-manually operated, powered sprayers for conveniently treating the wrinkle control composition to large fabric surface areas and/or a large number of garments. The spray dispenser herein does not normally include those that will substantially foam the clear, aqueous fabric care composition. It has been found that the performance is increased by providing smaller particle droplets. Desirably, the Sauter mean particle diameter is from about 10 $\mu$m to about 120 $\mu$m, more preferably, from about 20 $\mu$m to about 100 $\mu$m. Dewrinkling benefits for example are improved by providing small particles (droplets), especially when the surfactant is present.

The spray dispenser can be an aerosol dispenser. Said aerosol dispenser comprises a container which can be constructed of any of the conventional materials employed in fabricating aerosol containers. The dispenser must be capable of withstanding internal pressure in the range of from about 20 to about 110 p.s.i.g., more preferably from about 20 to about 70 p.s.i.g. The one important requirement concerning the dispenser is that it be provided with a valve member which will permit the clear, aqueous fabric care composition contained in the dispenser to be dispensed in the form of a spray of very fine, or finely divided, particles or droplets. The aerosol dispenser utilizes a pressurized sealed container from which the clear, aqueous fabric care composition is dispensed through a special actuator/valve assembly under pressure. The aerosol dispenser is pressurized by incorporating therein a gaseous component generally known as a propellant. Common aerosol propellants, e.g., gaseous hydrocarbons such as isobutane, and mixed halogenated hydrocarbons, can be used. Halogenated hydrocarbon propellants such as chlorofluoro hydrocarbons have been alleged to contribute to environmental problems, and are not preferred. When cyclodextrin is present hydrocarbon propellants are not preferred, because they can form complexes with the cyclodextrin molecules thereby reducing the availability of uncomplexed cyclodextrin molecules for odor absorption. Preferred propellants are compressed air, nitrogen, inert gases, carbon dioxide, etc. A more complete description of commercially available aerosol-spray dispensers appears in U.S. Pat. No. 3,436,772, Stebbins, issued Apr. 8, 1969; and U.S. Pat. No. 3,600,325, Kaufman et al., issued Aug. 17, 1971; both of said references are incorporated herein by reference.

Preferably the spray dispenser can be a self-pressurized non-aerosol container having a convoluted liner and an elastomeric sleeve. Said self-pressurized dispenser comprises a liner/sleeve assembly containing a thin, flexible radially expandable convoluted plastic liner of from about 0.010 to about 0.020 inch thick, inside an essentially cylindrical elastomeric sleeve. The liner/sleeve is capable of holding a substantial quantity of fabric care composition and of causing said composition to be dispensed. A more complete description of self-pressurized spray dispensers can be found in U.S. Pat. No. 5,111,971, Winer, issued May 12, 1992, and U.S. Pat. No. 5,232,126, Winer, issued Aug. 3, 1993; both of said references are herein incorporated by reference. Another type of aerosol spray dispenser is one wherein a barrier separates the fabric care composition from the propellant (preferably compressed air or nitrogen), as disclosed in U.S. Pat. No. 4,260,110, issued Apr. 7, 1981, and incorporated herein by reference. Such a dispenser is available from EP Spray Systems, East Hanover, N.J.

More preferably, the spray dispenser is a non-aerosol, manually activated, pump-spray dispenser. Said pump-spray dispenser comprises a container and a pump mechanism which securely screws or snaps onto the container. The container comprises a vessel for containing the aqueous fabric care composition to be dispensed.

The pump mechanism comprises a pump chamber of substantially fixed volume, having an opening at the inner end thereof. Within the pump chamber is located a pump stem having a piston on the end thereof disposed for reciprocal motion in the pump chamber. The pump stem has a passageway there through with a dispensing outlet at the outer end of the passageway and an axial inlet port located inwardly thereof.

The container and the pump mechanism can be constructed of any conventional material employed in fabricating pump-spray dispensers, including, but not limited to: polyethylene; polypropylene; polyethyleneterephthalate; blends of polyethylene, vinyl acetate, and rubber elastomer. A preferred container is made of clear, e.g., polyethylene terephthalate. Other materials can include stainless steel. A more complete disclosure of commercially available dispensing devices appears in: U.S. Pat. No. 4,895,279, Schultz, issued Jan. 23, 1990; U.S. Pat. No. 4,735,347, Schultz et al., issued Apr. 5, 1988; and U.S. Pat. No. 4,274,560, Carter, issued Jun. 23, 1981; all of said references are herein incorporated by reference.

Most preferably, the spray dispenser is a manually activated trigger-spray dispenser. Said trigger-spray dispenser comprises a container and a trigger both of which can be constructed of any of the conventional material employed in fabricating trigger-spray dispensers, including, but not limited to: polyethylene; polypropylene; polyacetal; polycarbonate; polyethyleneterephthalate; polyvinyl chloride; polystyrene; blends of polyethylene, vinyl acetate, and rubber elastomer. Other materials can include stainless steel and glass. A preferred container is made of clear, e.g. polyethylene terephthalate. The trigger-spray dispenser does not incorporate a propellant gas into the odor-absorbing composition, and preferably it does not include those that will foam the fabric care composition. The trigger-spray dispenser herein is typically one which acts upon a discrete amount of the fabric care composition itself, typically by means of a piston or a collapsing bellows that displaces the composition through a nozzle to create a spray of thin liquid. Said trigger-spray dispenser typically comprises a pump chamber having either a piston or bellows which is movable through a limited stroke response to the trigger for varying the volume of said pump chamber. This pump chamber or bellows chamber collects and holds the product for dispensing. The trigger spray dispenser typically has an outlet check valve for blocking communication and flow of fluid through the nozzle and is responsive to the pressure inside the chamber. For the piston type trigger sprayers, as the trigger is compressed, it acts on the fluid in the chamber and the spring, increasing the pressure on the fluid. For the bellows spray dispenser, as the bellows is compressed, the pressure increases on the fluid. The increase in fluid pressure in either trigger spray dispenser acts to open the top outlet check valve. The top valve allows the product to be forced through the swirl chamber and out the nozzle to form a discharge pattern. An adjustable nozzle cap can be used to vary the pattern of the fluid dispensed.

For the piston spray dispenser, as the trigger is released, the spring acts on the piston to return it to its original position. For the bellows spray dispenser, the bellows acts as the spring to return to its original position. This action causes a vacuum in the chamber. The responding fluid acts to close the outlet valve while opening the inlet valve drawing product up to the chamber from the reservoir.

A more complete disclosure of commercially available dispensing devices appears in U.S. Pat. No. 4,082,223, Nozawa, issued Apr. 4, 1978; U.S. Pat. No. 4,161,288, McKinney, issued Jul. 17, 1985; U.S. Pat. No. 4,434,917, Saito et al., issued Mar. 6, 1984; and U.S. Pat. No. 4,819,835, Tasaki, issued Apr. 11, 1989; U.S. Pat. No. 5,303,867, Peterson, issued Apr. 19, 1994; all of said references are incorporated herein by reference.

A broad array of trigger sprayers or finger pump sprayers are suitable for use with the compositions of this invention. These are readily available from suppliers such as Calmar, Inc., City of Industry, Calif.; CSI (Continental Sprayers, Inc.), St. Peters, Mo.; Berry Plastics Corp., Evansville, Ind., a distributor of Guala® sprayers; or Seaquest Dispensing, Cary, Ill.

The preferred trigger sprayers are the blue inserted Guala® sprayer, available from Berry Plastics Corp., or the Calmar TS800-1A®, TS1300®, and TS-800-2®, available from Calmar Inc., because of the fine uniform spray characteristics, spray volume, and pattern size. More preferred are sprayers with precompression features and finer spray characteristics and even distribution, such as Yoshino sprayers from Japan. Any suitable bottle or container can be used with the trigger sprayer, the preferred bottle is a 17 fl-oz. bottle (about 500 ml) of good ergonomics similar in shape to the Cinch® bottle. It can be made of any materials such as high density polyethylene, polypropylene, polyvinyl chloride, polystyrene, polyethylene terephthalate, glass, or any other material that forms bottles. Preferably, it is made of high density polyethylene or clear polyethylene terephthalate.

For smaller fluid ounce sizes (such as 1 to 8 ounces), a finger pump can be used with canister or cylindrical bottle. The preferred pump for this application is the cylindrical Euromist II® from Seaquest Dispensing. More preferred are those with precompression features.

The article of manufacture herein can also comprise a non-manually operated spray dispenser. By "non-manually operated" it is meant that the spray dispenser can be manually activated, but the force required to dispense the fabric care composition is provided by another, non-manual means. Non-manually operated sprayers include, but are not limited to, powered sprayers, air aspirated sprayers, liquid aspirated sprayers, electrostatic sprayers, and nebulizer sprayers. The fabric care composition is placed into a spray dispenser in order to be distributed onto the fabric.

Powered sprayers include self contained powered pumps that pressurize the aqueous fabric care composition and dispense it through a nozzle to produce a spray of liquid droplets. Powered sprayers are attached directly or remotely through the use of piping/tubing to a reservoir (such as a bottle) to hold the aqueous fabric care composition. Powered sprayers can include, but are not limited to, centrifugal or positive displacement designs. It is preferred that the powered sprayer be powered by a portable DC electrical current from either disposable batteries (such as commercially available alkaline batteries) or rechargeable battery units (such as commercially available nickel cadmium battery units). Powered sprayers can also be powered by standard AC power supply available in most buildings. The discharge nozzle design can be varied to create specific spray characteristics (such as spray diameter and particle size). It is also possible to have multiple spray nozzles for different spray characteristics. The nozzle may or may not contain an adjustable nozzle shroud that would allow the spray characteristics to be altered.

Nonlimiting examples of commercially available powered sprayers are disclosed in U.S. Pat. No. 4,865,255, Luvisotto, issued Sep. 12, 1989 which is incorporated herein by reference. Preferred powered sprayers are readily available from suppliers such as Solo, Newport News, Va. (e.g., Solo Spraystar™ rechargeable sprayer, listed as manual part #: U.S. Pat. No. 460,395) and Multi-sprayer Systems, Minneapolis, Minn. (e.g., model: Spray 1).

Air aspirated sprayers include the classification of sprayers generically known as "air brushes". A stream of pressurized air draws up the aqueous fabric care composition and dispenses it through a nozzle to create a spray of liquid. The fabric care composition can be supplied via separate piping/tubing or more commonly is contained in a jar to which the aspirating sprayer is attached.

Nonlimiting examples of commercially available air aspirated sprayers appears in U.S. Pat. No. 1,536,352, Murray, issued Apr. 22, 1924 and U.S. Pat. No. 4,221,339, Yoshikawa, issues Sep. 9, 1980; all of said references are incorporated herein by reference. Air aspirated sprayers are readily available from suppliers such as The Badger Air-Brush Co., Franklin Park, Ill. (e.g., model #: 155) and Wilton Air Brush Equipment, Woodridge, Ill. (e.g., stock #: 415-4000, 415-4001, 415-4100).

Liquid aspirated sprayers are typical of the variety in widespread use to spray garden chemicals. The aqueous dewrinkling composition is drawn into a fluid stream by means of suction created by a Venturi effect. The high turbulence serves to mix the aqueous fabric care composition with the fluid stream (typically water) in order to provide a uniform mixture/concentration. It is possible with this method of delivery to dispense the aqueous concentrated fabric care composition of the present invention and then dilute it to a selected concentration with the delivery stream.

Liquid aspirated sprayers are readily available from suppliers such as Chapin Manufacturing Works, Batavia, N.Y. (e.g., model #: 6006).

Electrostatic sprayers impart energy to the aqueous fabric care composition via a high electrical potential. This energy serves to atomize and charge the aqueous fabric care composition, creating a spray of fine, charged particles. As the charged particles are carried away from the sprayer, their common charge causes them to repel one another. This has two effects before the spray reaches the target. First, it expands the total spray mist. This is especially important when spraying to fairly distant, large areas. The second effect is maintenance of original particle size. Because the particles repel one another, they resist collecting together into large, heavier particles like uncharged particles do. This lessens gravity's influence, and increases the charged particle reaching the target. As the mass of negatively charged particles approach the target, they push electrons inside the target inwardly, leaving all the exposed surfaces of the target with a temporary positive charge. The resulting attraction between the particles and the target overrides the influences of gravity and inertia. As each particle deposits on the target, that spot on the target becomes neutralized and no longer attractive. Therefore, the next free particle is attracted to the spot immediately adjacent and the sequence continues until the entire surface of the target is covered. Hence, charged particles improve distribution and reduce drippage.

Nonlimiting examples of commercially available electrostatic sprayers appears in U.S. Pat. No. 5,222,664, Noakes, issued Jun. 29, 1993; U.S. Pat. No. 4,962,885, Coffee, issued Oct. 16, 1990; U.S. Pat. No. 2,695,002, Miller, issued November 1954; U.S. Pat. No. 5,405,090, Greene, issued Apr. 11, 1995; U.S. Pat. No. 4,752,034, Kuhn, issued Jun. 21, 1988; U.S. Pat. No. 2,989,241, Badger, issued June 1961; all of said patents are incorporated herein by reference. Electrostatic sprayers are readily available from suppliers such as Tae In Tech Co, South Korea and Spectrum, Houston, Tex.

Nebulizer sprayers impart energy to the aqueous dewrinkling composition via ultrasonic energy supplied via a transducer. This energy results in the aqueous fabric care composition to be atomized. Various types of nebulizers include, but are not limited to, heated, ultrasonic, gas, venturi, and refillable nebulizers.

Nonlimiting examples of commercially available nebulizer sprayers appears in U.S. Pat. No. 3,901,443, Mitsui, issued Aug. 26, 1975; U.S. Pat. No. 2,847,248, Schmitt, issued August 1958; U.S. Pat. No. 5,511,726, Greenspan, issued Apr. 30, 1996; all of said patents are incorporated herein by reference. Nebulizer sprayers are readily available from suppliers such as A&D Engineering, Inc., Milpitas, Calif. (e.g., model A&D Un-231 ultrasonic handy nebulizer) and Amici, Inc., Spring City, Pa. (model: swirler nebulizer).

The preferred article of manufacture herein comprises a non-manually operated sprayer, such as a battery-powered sprayer, containing the aqueous fabric care composition. More preferably the article of manufacture comprises a combination of a non-manually operated sprayer and a separate container of the aqueous fabric care composition, to be added to the sprayer before use and/or to be separated for filling/refilling. The separate container can contain an usage composition, or a concentrated composition to be diluted before use, and/or to be used with a diluting sprayer, such as with a liquid aspirated sprayer, as described herein above.

Also, as described hereinbefore, the separate container should have structure that mates with the rest of the sprayer to ensure a solid fit without leakage, even after motion, impact, etc. and when handled by inexperienced consumers. The sprayer desirably can also have an attachment system that is safe and preferably designed to allow for the liquid container to be replaced by another container that is filled. E.g., the fluid reservoir can be replaced by a filled container. This can minimize problems with filling, including minimizing leakage, if the proper mating and sealing means are present on both the sprayer and the container. Desirably, the sprayer can contain a shroud to ensure proper alignment and/or to permit the use of thinner walls on the replacement container. This minimizes the amount of material to be recycled and/or discarded. The package sealing or mating system can be a threaded closure (sprayer) which replaces the existing closure on the filled and threaded container. A gasket is desirably added to provide additional seal security and minimize leakage. The gasket can be broken by action of the sprayer closure. These threaded sealing systems can be based on industry standards. However, it is highly desirable to use a threaded sealing system that has non-standard dimensions to ensure that the proper sprayer/bottle combination is always used. This helps prevent the use of fluids that are toxic, which could then be dispensed when the sprayer is used for its intended purpose.

An alternative sealing system can be based on one or more interlocking lugs and channels. Such systems are commonly referred to as "bayonet" systems. Such systems can be made in a variety of configurations, thus better ensuring that the proper replacement fluid is used. For convenience, the locking system can also be one that enables the provision of a "child-proof" cap on the refill bottle. This "lock-and-key" type of system thus provides highly desirable safety features. There are a variety of ways to design such lock and key sealing systems.

Care must be taken, however, to prevent the system from making the filling and sealing operation too difficult. If desired, the lock and key can be integral to the sealing mechanism. However, for the purpose of ensuring that the correct recharge or refill is used, the interlocking pieces can be separate from the sealing system. E.g., the shroud and the container could be designed for compatibility. In this way, the unique design of the container alone could provide the requisite assurance that the proper recharge/refill is used.

Examples of threaded closures and bayonet systems can be found in U.S. Pat. No. 4,781,311, Nov. 1, 1988 (Angular Positioned Trigger Sprayer with Selective Snap-Screw Container Connection, Clorox), U.S. Pat. No. 5,560,505, Oct. 1, 1996 (Container and Stopper Assembly Locked Together by Relative Rotation and Use Thereof, Cebal SA), and U.S. Pat. No. 5,725,132, Mar. 10, 1998 (Dispenser with Snap-Fit Container Connection, Centico International). All of said patents are incorporated herein by reference.

The present invention also relates to an article of manufacture comprising a fabric care composition for use in spraying and/or misting an entire garment in a manner such that excessive amounts of the fabric/garment care composition are prevented from being released to the open environment, provided in association with instructions for use to ensure that the consumer applies at least an effective amount of fabric care polysaccharied with globular structure and/or fabric care composition, to provide the desired garment care benefit, typically from about 0.001% to about 0.5%, preferably from about 0.01% to about 0.2%, more preferably from about 0.02% to about 0.05%, by weight of the garment.

Other fabric care compositions of the present invention for use to treat fabrics in different steps of the laundry process, e.g., pre-wash, wash cycle, rinse cycle, and drying cycle, can be packaged in association with instructions for how to use the composition to treat fabrics correctly, in order to obtain the desirable fabric care results, viz, wrinkle removal and/or reduction, wrinkle resistance, fiber strengthening/anti-wear, fabric wear reduction, fabric shrinkage prevention and/or reduction, fabric pill prevention and/or reduction, shrinkage prevention and/or reduction, fabric color maintenance, fabric color fading reduction, soiling prevention and/or reduction, and/or fabric shape retention, and mixtures thereof.

III. Method of Use

The fabric care composition, which contains a fabric care polysaccharide with globular structure, and optionally, e.g., adjunct fabric care oligosaccharides, perfume, fiber lubricant, adjunct fabric shape retention polymer, lithium salt, hydrophilic plasticizer, odor control agent including cyclodextrin, antimicrobial actives and/or preservative, surfactant, enzyme, antioxidant, metal chelating agent including aminocarboxylate chelating agent, antistatic agent, insect and moth repelling agent, fabric softener active, electrolyte, chlorine scavenging agent, dye transfer inhibiting agent, dye fixing agent, phase stabilizer, colorant, brightener, soil release agent, builder, dispersant, suds suppressor, etc., and mixtures thereof, can be used by distributing, e.g., by placing, an effective amount of the aqueous solution onto the fabric surface or fabric article to be treated. Distribution can be achieved by using a spray device, a roller, a pad, etc., preferably a spray dispenser. For wrinkle control, for wrinkle removal, an effective amount means an amount sufficient to remove or noticeably reduce the appearance of wrinkles on fabric. Preferably, the amount of fabric care solution is not so much as to saturate or create a pool of liquid on said article or surface and so that when dry there is no visual deposit readily discernible.

The compositions and articles of the present invention which contain a fabric care polysaccharide with globular structure can be used to treat fabrics, garments, and the like, to provide at least one of the following fabric care benefits: wrinkle removal, wrinkle reduction, wrinkle resistance, fabric wear reduction, fabric wear resistance, fabric pilling reduction, fabric color maintenance, fabric color fading reduction, fabric color restoration, fabric soiling reduction, fabric shape retention, and/or fabric shrinkage reduction.

An effective amount of the liquid composition of the present invention is preferably sprayed onto fabric and/or fabric articles include, but are not limited to, clothes, curtains, drapes, upholstered furniture, carpeting, bed linens, bath linens, tablecloths, sleeping bags, tents, car interiors, etc. When the composition is sprayed onto fabric, an effective amount should be deposited onto the fabric, with the fabric becoming damp or totally saturated with the composition, typically from about 5% to about 150%, preferably from about 10% to about 100%, more preferably from about 20% to about 75%, by weight of the fabric. The treated fabric typically has from about 0.005% to about 4%, preferably from about 0.01% to about 2%, more preferably from about 0.05% to about 1%, by weight of the fabric of said fabric care polysaccharide with globular structure. For wrinkle removal, once an effective amount of the composition is sprayed onto the fabric, the fabric is optionally, but preferably stretched. The fabric is typically stretched perpendicular to the wrinkle. The fabric can also be smoothed by hand after it has been sprayed. The smoothing movement works particularly well on areas of clothing that have an interface sewn into them, or on the hems of clothing. Once the fabric has been sprayed and optionally, but preferably, stretched, it is hung until dry. It is preferable that the treatment is performed in accordance with the instructions for use, to ensure that the consumer knows what benefits can be achieved, and how best to obtain these benefits.

The spraying means should be capable of providing droplets with a weight average diameter of from about 5 μm to about 250 μm, preferably from about 8 μm to about 120 μm, more preferably from about 10 μm to about 80 μm. When the compositions are applied in the form of the very small particles (droplets), the distribution is further improved and overall performance is also improved. The presence of the optional surfactant promotes spreading of the solution and the optional antimicrobial active provides improved odor control as well as antimicrobial action, by minimizing the formation of odors.

The fabric care composition can also be applied to fabric via a dipping and/or soaking process followed by a drying step. The application can be done industrially by large scale processes on textiles and/or finished garments and clothings, or in consumer's home by the use of commercial product.

The present invention also comprises a method of using concentrated liquid or solid fabric care compositions, which are diluted to form compositions with the usage concentrations, as given hereinabove, for use in the "usage conditions". Concentrated compositions comprise a higher level of fabric care polysaccharide with globular structure, typically from about 1% to about 99%, preferably from about 2% to about 65%, more preferably from about 3% to about 25%, by weight of the concentrated fabric care composition. Concentrated compositions are used in order to provide a less expensive product. The concentrated product is preferably diluted with about 50% to about 10,000%, more preferably from about 50% to about 8,000%, and even more preferably from about 50% to about 5,000%, by weight of the composition, of water.

The compositions of the present invention can also be used as ironing aids. An effective amount of the composition can be sprayed onto fabric and the fabric is ironed at the normal temperature at which it should be ironed. The fabric can either be sprayed with an effective amount of the composition, allowed to dry and then ironed, or sprayed and ironed immediately.

In a still further aspect of the invention, the composition can be sprayed and/or misted onto fabrics and/or entire garments in need of de-wrinkling and/or other fabric care benefits in a manner such that excessive amounts of the fabric/garment care composition are prevented from being released to the open environment, provided in association with instructions for use to ensure that the consumer applies at least an effective amount of fabric care polysaccharide with globular structure and/or fabric care composition, to provide the desired garment care benefit. Any spraying mechanism and/or misting mechanism can be used to apply the fabric care composition to fabrics and/or garments. A preferred distribution of the garment care composition is achieved by using a fog form. The mean particulate diameter size of the fabric care composition fog is preferably from about 3 microns to about 50 microns, more preferably from about 5 microns to about 30 microns, and most preferably from about 10 microns to about 20 microns.

Another aspect of the present invention is the method of using an aqueous or solid, preferably powder, fabric care composition for treating fabric in the rinse step, comprising an effective amount of said fabric care polysaccharide with globular structure, and optionally, adjunct fabric care oligosaccharides, fabric softener actives, perfume, electrolytes, chlorine scavenging agents, dye transfer inhibiting agents, dye fixing agents, phase stabilizers, chemical stabilizers including antioxidants, silicones, antimicrobial actives and/or preservatives, chelating agents, aminocarboxylate chelating agents, colorants, enzymes, brighteners, soil release agents, or mixtures thereof. The rinse water should contain typically from about 0.0005% to about 1%, preferably from about 0.0008% to about 0.1%, more preferably from about 0.001% to about 0.02% of the fabric care polysaccharides.

The present invention also relates to a method of using an aqueous or solid, preferably powder or granular, fabric care composition to treat the fabrics in the wash cycle, said compositions comprise fabric care polysaccharide with globular structure, and optionally, adjunct fabric care oligosaccharides, surfactants, builders, perfume, chlorine scavenging agents, dye transfer inhibiting agents, dye fixing agents, dispersants, detergent enzymes, heavy metal chelating agents, suds suppressors, fabric softener actives, chemical stabilizers including antioxidants, silicones, antimicrobial actives and/or preservatives, soil suspending agents, soil release agents, optical brighteners, colorants, and the like, or mixtures thereof. Depending on the selection of optional ingredients, such as the level and type of surfactants, the wash-added fabric care composition can be used as a wash additive composition (when the surfactant level is low) or as a laundry detergent which also has additional fabric care benefits. It is preferable that the treatment is performed in accordance with the instructions for use, to ensure that the consumer knows what benefits can be achieved, and how best to obtain these benefits.

The present invention also relates to a method for treating fabric in the drying step, comprising an effective amount of said fabric care polysaccharide with globular structure, and optionally, adjunct fabric care oligosaccharides, fabric softener actives, distributing agent, perfume, fiber lubricants, fabric shape retention polymers, lithium salts, phase stabilizers, chlorine scavenging agents, dye transfer inhibiting agents, dye fixing agents, chemical stabilizers including antioxidants, silicones, antimicrobial actives and/or preservatives, heavy metal chelating agents, aminocarboxylate chelating agents, enzymes, brighteners, soil release agents, and mixtures thereof. The fabric care composition can take a variety of physical forms including liquid, foams, gel and solid forms such as solid particulate forms. A preferred method comprises the treatment of fabric with a dryer-added fabric care composition in combination with a dispensing means such as a flexible substrate which effectively releases the fabric care composition in an automatic tumble clothes dryer. Such dispensing means can be designed for single usage or for multiple uses. Preferably the composition is applied onto a sheet substrate to form a dryer sheet product. Another preferred method comprises the treatment of fabrics with a fabric care composition dispensed from a a sprayer at the beginning and/or during the drying cycle. It is preferable that the treatment is performed in accordance with the instructions for use, to ensure that the consumer knows what benefits can be achieved, and how best to obtain these benefits.

The present invention also relates to a fabric care method of dipping and/or soaking fabrics before the fabrics is laundered, with a pre-wash fabric care composition containing an effective amount of fabric care polysaccharide with globular structure, and optionally, adjunct fabric care oligosaccharides, surfactants, builders, perfume, chlorine scavenging agents, dye transfer inhibiting agents, dye fixing agents, dispersants, detergent enzymes, heavy metal chelating agents, fabric softener actives, chemical stabilizers including antioxidants, silicones, antimicrobial actives and/or preservatives, soil suspending agents, soil release agents, optical brighteners, colorants, and the like, or mixtures thereof. It is preferable that the treatment is performed in accordance with the instructions for use, to ensure that the consumer knows what benefits can be achieved, and how best to obtain these benefits.

All percentages, ratios, and parts herein, in the Specification, Examples, and claims are by weight and are the normal approximations unless otherwise stated.

The following are non-limiting examples of the instant composition.

Illustrative examples of fabric care polysaccharides with globular structure and with 1,3-β-linked backbone to be used in the following Examples are as follows:

Arabinogalactan A: arabinogalactan fraction that has the average molecular weight of from about 16,000 to about 20,000.

Arabinogalactan B: arabinogalactan fraction that has the average molecular weight of about 100,000.

Arabinogalactan C: arabinogalactan fraction that has the average molecular weight of from about 10,000 to about 150,000.

Illustrative examples of adjunct fabric care oligosaccharide mixtures to be used in the following Examples are as follows:

| | |
|---|---|
| Isomaltooligosaccharide (IMO) Mixture A | |
| Trisaccharides (maltotriose, panose, isomaltotriose) | 40% |
| Disaccharides (maltose, isomaltose) | 25% |
| Monosaccharide (glucose) | 20% |
| Higher branched sugars (4 < DP < 10) | 15% |
| Isomaltooligosaccharide (IMO) Mixture B | |
| Trisaccharides (maltotriose, panose, isomaltotriose) | 25% |
| Disaccharides (maltose, isomaltose) | 56% |
| Monosaccharide (glucose) | 16% |
| Higher branched sugars (DP > 4 < 10) | 4% |
| Branched Oligosaccharide Mixture C | |
| Tetrasaccharides (stachyose) | 32% |
| Trisaccharides (raffinose) | 6% |
| Disaccharides (sucrose, trehalose) | 39% |
| Monosaccharide (glucose, fructose) | 1% |
| Higher branched sugars (4 < DP < 10) | 0–5% |
| Isomaltooligosaccharide (IMO) Mixture D | |
| Trisaccharides (maltotriose, panose, isomaltotriose) | 62% |
| Disaccharides (maltose, isomaltose) | 13% |
| Monosaccharide (glucose) | 1% |
| Higher branched sugars (4 < DP < 10) | 24% |

Illustrative examples of perfume compositions to be used in the following Examples are as follows:

| Perfume Ingredients | Wt. % |
|---|---|
| Volatile Perfume A | |
| alpha-Pinene | 5.0 |
| Dihydro Myrcenol | 10.0 |

-continued

| Perfume Ingredients | Wt. % |
|---|---|
| Eucalyptol | 10.0 |
| Eugenol | 5.0 |
| Flor Acetate | 10.0 |
| Lemon Oil | 10.0 |
| Linalool | 10.0 |
| Linalyl Acetate | 5.0 |
| Orange Terpenes | 15.0 |
| Phenyl Ethyl Alcohol | 20.0 |
| Total | 100.0 |
| Substantive Perfume B | |
| Benzyl Salicylate | 10.0 |
| Coumarin | 5.0 |
| Ethyl Vanillin | 2.0 |
| Ethylene Brassylate | 10.0 |
| Galaxolide | 15.0 |
| Hexyl Cinnamic Aldehyde | 20.0 |
| Gamma Methyl Ionone | 10.0 |
| Lilial | 15.0 |
| Methyl Dihydrojasmonate | 5.0 |
| Patchouli | 5.0 |
| Tonalid | 3.0 |
| Total | 100.0 |
| Hydrophilic Perfume C | |
| Benzophenone | 0.3 |
| Benzyl acetate | 4.0 |
| Benzyl propionate | 1.0 |
| beta gamma Hexenol | 0.3 |
| Cetalox | 0.1 |
| cis 3 Hexenyl acetate | 0.5 |
| cis Jasmone | 0.3 |
| cis-3-Hexenyl salicylate | 0.5 |
| Citral | 0.5 |
| Citronellal nitrile | 0.7 |
| Citronellol | 1.5 |
| Coumarin | 3.0 |
| Cyclal C | 0.3 |
| Cyclo galbanate | 0.4 |
| beta Damascone | 0.1 |
| Dihydro myrcenol | 2.0 |
| Ebanol | 0.5 |
| Flor acetate | 4.5 |
| Florhydral | 1.0 |
| Fructone | 4.0 |
| Frutene | 5.0 |
| Geranyl nitrile | 0.4 |
| Heliotropin | 1.5 |
| Hydroxycitronellal | 3.0 |
| Linalool | 2.5 |
| Linalyl acetate | 0.5 |
| Methyl dihydro jasmonate | 5.0 |
| Methyl heptine carbonate | 0.3 |
| Methyl iso butenyl tetrahydro pyran | 0.2 |
| Methyl phenyl carbinyl acetate | 0.5 |
| Nonalactone | 1.5 |
| P. T. Bucinal | 2.0 |
| para Hydroxy phenylbutanone | 1.3 |
| Phenoxy ethanol | 30.0 |
| Phenyl ethyl acetate | 0.8 |
| Phenyl ethyl alcohol | 15.0 |
| Prenyl acetate | 1.5 |
| Terpineol | 2.0 |
| Verdox | 1.0 |
| Vanillin | 0.5 |
| Total | 100.0 |

The following non-limiting fabric care compositions are prepared by mixing and dissolving the ingredients into clear or translucent solutions, in accord with the present invention:

EXAMPLE IA

| Ingredients | Ia Wt. % | Ib Wt. % | Ic Wt. % | Id Wt. % | Ie Wt. % | If Wt. % |
|---|---|---|---|---|---|---|
| Arabino-galactan A | 0.5 | — | — | 1 | — | — |
| Arabino-galactan B | — | 0.3 | — | — | 0.5 | — |
| Arabino-galactan C | — | — | 0.5 | — | — | 0.5 |
| Volatile Perfume A | — | — | — | 0.1 | — | — |
| Substantive Perfume B | — | — | — | — | 0.03 | — |
| Hydrophilic Perfume C | — | — | — | — | — | 0.05 |
| Polysorbate 60[1] | — | — | — | 0.2 | 0.1 | — |
| Kathon CG | 3 ppm | 3 ppm | 3 ppm | 3 ppm | 3 ppm | 3 ppm |
| Deionized Water | Bal. | Bal. | Bal. | Bal. | Bal. | Bal. |

[1]A mixture of stearate esters of sorbitol and sorbitol anhydride, consisting predominantly of the monoester, condensed with about 20 moles of ethylene oxide.

EXAMPLE IB

| Ingredients | Ig Wt. % | Ih Wt. % | Ii Wt. % | Ij Wt. % | Ik Wt. % | Il Wt. % |
|---|---|---|---|---|---|---|
| Quaternized Arabino-galactan A[2] | 0.5 | — | — | 1 | — | — |
| Curdlan[3] | — | 0.3 | — | — | 0.3 | — |
| Dextran[4] | — | — | 0.6 | — | — | 0.5 |
| Volatile Perfume A | — | — | — | 0.1 | — | — |
| Substantive Perfume B | — | — | — | — | 0.03 | — |
| Hydrophilic Perfume C | — | — | — | — | — | 0.05 |
| Polysorbate 60 | — | — | — | 0.2 | 0.1 | — |
| Kathon CG | 3 ppm | 3 ppm | 3 ppm | 3 ppm | 3 ppm | 3 ppm |
| Deionized Water | Bal. | Bal. | Bal. | Bal. | Bal. | Bal. |

[2]Quaternized arabinogalactan containing about 1.5% by weight of 3-chloro-2-hydroxypropyltrimethyl ammonium chloride.
[3]Average molecular weight of about 72,000.
[4]Average molecular weight of about 40,000.

EXAMPLE II

| Ingredients | IIa Wt. % | IIb Wt. % | IIc Wt. % | IId Wt. % | IIe Wt. % | IIf Wt. % |
|---|---|---|---|---|---|---|
| Arabino-galactan A | 2 | 0.3 | 0.5 | 0.5 | 1 | — |
| Arabino-galactan B | — | — | — | — | — | 1 |
| Oligo-saccharide Mixture A | — | 0.3 | — | — | — | — |
| Oligo-saccharide Mixture B | — | — | 0.5 | — | — | — |

-continued

| Ingredients | IIa Wt. % | IIb Wt. % | IIc Wt. % | IId Wt. % | IIe Wt. % | IIf Wt. % |
|---|---|---|---|---|---|---|
| Oligo-saccharide Mixture C | — | — | — | 0.3 | — | — |
| Oligo-saccharide Mixture D | — | — | — | — | 0.5 | 0.5 |
| Volatile Perfume A | 0.1 | — | — | 0.1 | — | — |
| Substantive Perfume B | 0.2 | — | — | — | 0.03 | — |
| Hydrophilic Perfume C | — | — | 0.05 | — | — | 0.05 |
| Polysorbate 60 | 0.3 | — | — | 0.2 | 0.1 | — |
| Kathon CG | 3 ppm | 3 ppm | 3 ppm | 3 ppm | 3 ppm | 3 ppm |
| Deionized Water | Bal. | Bal. | Bal. | Bal. | Bal. | Bal. |

Fabric care compositions of Examples I and II are usage compositions for, e.g., spraying, soaking, dipping of fabrics, and/or pre-wash treatments.

EXAMPLE III

| Ingredients | IIIa Wt. % | IIIb Wt. % | IIIc Wt. % | IIId Wt. % | IIIe Wt. % | IIIf Wt. % |
|---|---|---|---|---|---|---|
| Arabino-galactan A | 15 | — | — | 5 | — | — |
| Arabino-galactan B | — | 25 | — | — | 15 | — |
| Arabino-galactan C | — | — | 5 | — | — | 25 |
| Perfume A | — | — | — | — | 1 | — |
| Perfume B | — | — | — | 0.3 | — | — |
| Perfume C | — | — | — | — | — | 1.5 |
| Polysorbate 60 | — | — | — | 0.5 | 1.5 | 1 |
| Kathon CG | 5 ppm | 10 ppm | 5 ppm | 5 ppm | 5 ppm | 5 ppm |
| Deionized Water | Bal. | Bal. | Bal. | Bal. | Bal. | Bal. |

EXAMPLE IV

| Ingredients | IVa Wt. % | IVb Wt. % | IVc Wt. % | IVd Wt. % | IVe Wt. % | IVf Wt. % |
|---|---|---|---|---|---|---|
| Arabino-galactan A | 1.5 | — | 20 | 3 | 10 | — |
| Arabino-galactan B | — | 2 | — | — | — | 2 |
| Oligo-saccharide Mixture A | — | — | — | 2 | | — |
| Oligo-saccharide Mixture B | — | — | — | — | 5 | — |
| Oligo-saccharide Mixture C | — | — | 5 | — | — | — |
| Oligo-saccharide Mixture D | 3.5 | 8 | — | — | — | 20 |
| Perfume A | — | — | — | — | 1 | — |
| Perfume B | — | — | — | 0.3 | — | — |

-continued

| Ingredients | IVa Wt. % | IVb Wt. % | IVc Wt. % | IVd Wt. % | IVe Wt. % | IVf Wt. % |
|---|---|---|---|---|---|---|
| Perfume C | — | — | — | — | — | 1.5 |
| Polysorbate 60 | — | — | — | 0.5 | 1.5 | 1 |
| Kathon CG | 5 ppm | 5 ppm | 5 ppm | 5 ppm | 5 ppm | 5 ppm |
| Deionized Water | Bal. | Bal. | Bal. | Bal. | Bal. | Bal. |

Concentrated compositions of Examples III and IV are diluted with water to obtain usage compositions for, e.g., spraying, soaking and/or dipping fabric articles. They can also be used undiluted to treat fabric as wash additive and/or rinse additive compositions.

EXAMPLE V

| Ingredients | Va Wt. % | Vb Wt. % | Vc Wt. % | Vd Wt. % | Ve Wt. % |
|---|---|---|---|---|---|
| Arabinogalactan A | 1 | — | — | — | 1.5 |
| Arabinogalactan B | — | 0.5 | — | 1 | — |
| Arabinogalactan C | — | — | 0.5 | — | — |
| LiBr | 3 | — | — | 2 | 2 |
| Silicone Emulsion A[5] | — | 1.5 | — | — | 2.0 |
| D5 Volatile Silicone | — | — | 0.5 | 0.5 | — |
| Perfume A | — | — | — | — | 0.03 |
| Perfume B | — | — | — | 0.05 | — |
| Perfume C | 0.03 | — | — | — | — |
| Polysorbate 60 | — | — | — | 0.1 | 0.05 |
| Silwet L-7602 | — | — | — | 0.5 | — |
| Silwet L-7622 | — | — | — | — | 0.3 |
| Kathon CG | 3 ppm | 3 ppm | 3 ppm | 3 ppm | 3 ppm |
| Deionized Water | Bal. | Bal. | Bal. | Bal. | Bal. |

[5]DC-2-5932 silicone microemulsion (25% active) from Dow Corning, with a particle size of about 24 nm, a cationic surfactant system, and a silicone with an internal phase viscosity of about 1,200 cps.

EXAMPLE VIA

| Ingredients | VIa Wt. % | VIb Wt. % | VIc Wt. % | VId Wt. % | VIe Wt. % |
|---|---|---|---|---|---|
| Arabinogalactan A | 0.45 | 0.5 | 0.7 | 0.8 | — |
| Arabinogalactan B | — | — | — | — | 0.2 |
| Oligosaccharide Mixture A | 0.05 | — | — | — | — |
| Oligosaccharide Mixture B | — | 1 | — | — | — |
| Oligosaccharide Mixture C | — | — | 0.3 | — | — |
| Oligosaccharide Mixture D | — | — | — | 1.2 | 0.8 |
| LiBr | 3 | — | — | 2 | 2 |
| Silicone Emulsion A[5] | — | 1.5 | — | — | 2.0 |
| D5 Volatile Silicone | — | — | 0.5 | 0.5 | — |
| Perfume A | — | — | — | — | 0.03 |
| Perfume B | — | — | — | 0.05 | — |
| Perfume C | 0.03 | — | — | — | — |
| Polysorbate 60 | — | — | — | 0.1 | 0.05 |
| Silwet L-7602 | — | — | — | 0.5 | — |
| Silwet L-7622 | — | — | — | — | 0.3 |

-continued

| Ingredients | VIa Wt. % | VIb Wt. % | VIc Wt. % | VId Wt. % | VIe Wt. % |
|---|---|---|---|---|---|
| Kathon CG | 3 ppm | 3 ppm | 3 ppm | 3 ppm | 3 ppm |
| Deionized Water | Bal. | Bal. | Bal. | Bal. | Bal. |

[5]DC-2-5932 silicone microemulsion (25% active) from Dow Corning, with a particle size of about 24 nm, a cationic surfactant system, and a silicone with an internal phase viscosity of about 1,200 cps.

EXAMPLE VIB

| Ingredients | VIf Wt. % | VIg Wt. % | VIh Wt. % | VIi Wt. % | VIj Wt. % |
|---|---|---|---|---|---|
| Quaternized Arabinogalactan A | 0.75 | — | — | — | 0.2 |
| Curdlan | — | 0.3 | — | — | — |
| Dextran | — | — | 0.7 | 0.8 | — |
| Oligosaccharide Mixture A | 0.05 | — | — | — | — |
| Oligosaccharide Mixture B | — | 1 | — | — | — |
| Oligosaccharide Mixture C | — | — | 0.3 | — | — |
| Oligosaccharide Mixture D | — | — | — | 1.2 | 0.8 |
| LiBr | 3 | — | — | 2 | 2 |
| Silicone Emulsion A[5] | — | 1.5 | — | — | 2.0 |
| D5 Volatile Silicone | — | — | 0.5 | 0.5 | — |
| Perfume A | — | — | — | — | 0.03 |
| Perfume B | — | — | — | 0.05 | — |
| Perfume C | 0.03 | — | — | — | — |
| Polysorbate 60 | — | — | — | 0.1 | 0.05 |
| Silwet L-7602 | — | — | — | 0.5 | — |
| Silwet L-7622 | — | — | — | — | 0.3 |
| Kathon CG | 3 ppm | 3 ppm | 3 ppm | 3 ppm | 3 ppm |
| Deionized Water | Bal. | Bal. | Bal. | Bal. | Bal. |

EXAMPLE VII

| Ingredients | VIIa Wt. % | VIIb Wt. % | VIIc Wt. % | VIId Wt. % | VIIe Wt. % | VIIf Wt. % |
|---|---|---|---|---|---|---|
| Arabino-galactan A | 0.7 | — | — | 1 | 0.5 | — |
| Arabino-galactan B | — | 0.5 | — | — | — | 0.5 |
| Arabino-galactan C | — | — | 0.5 | — | — | — |
| Copolymer A[6] | 0.4 | — | — | — | — | 0.5 |
| Copolymer B[7] | — | 0.5 | — | 0.3 | — | — |
| Copolymer C[8] | — | — | 0.6 | — | 0.5 | — |
| LiBr | — | — | — | 3 | — | 2 |
| Silicone Emulsion A[5] | — | — | — | — | 1.5 | — |
| D5 Volatile Silicone | — | — | — | — | — | 0.5 |
| Perfume A | 0.06 | — | — | — | — | 0.07 |
| Perfume B | — | 0.03 | — | 0.03 | — | — |
| Perfume C | — | — | 0.04 | — | 0.03 | — |
| Polysorbate 60 | 0.1 | 0.1 | 0.03 | 0.1 | 0.1 | 0.1 |
| Silwet L-7600 | — | — | — | 0.5 | — | — |
| Silwet L-7602 | — | — | — | — | — | 0.7 |
| Kathon CG | 3 ppm | 3 ppm | 3 ppm | 3 ppm | 3 ppm | 3 ppm |

-continued

| Ingredients | VIIa Wt. % | VIIb Wt. % | VIIc Wt. % | VIId Wt. % | VIIe Wt. % | VIIf Wt. % |
|---|---|---|---|---|---|---|
| Deionized Water | Bal. | Bal. | Bal. | Bal. | Bal. | Bal. |

(5)DC-2-5932 silicone microemulsion (25% active) from Dow Corning, with a particle size of about 24 nm, a cationic surfactant system, and a silicone with an internal phase viscosity of about 1,200 cps.
(6)Acrylic acid/tert-butyl acrylate copolymer, with an approximate acrylic acid/tert-butyl acrylate weight ratio of about 25/75 and an average molecular weight of from about 70,000 to about 100,000.
(7)Acrylic acid/tert-butyl acrylate copolymer, with an approximate acrylic acid/tert-butyl acrylate weight ratio of about 35/65 and an average molecular weight of from about 60,000 to about 90,000.
(8)Acrylic acid/tert-butyl acrylate copolymer, with an approximate acrylic acid/tert-butyl acrylate weight ratio of about 20/80 and an average molecular weight of from about 80,000 to about 110,000.

EXAMPLE VIII

| Ingredients | VIIIa Wt. % | VIIIb Wt. % | VIIIc Wt. % | VIIId Wt. % | VIIIVe Wt. % | VIIIf Wt. % |
|---|---|---|---|---|---|---|
| Arabino-galactan A | 0.9 | — | — | 0.5 | 0.75 | 0.7 |
| Arabino-galactan B | — | 0.5 | — | — | — | — |
| Arabino-galactan C | — | — | 0.5 | — | — | — |

-continued

| Ingredients | VIIIa Wt. % | VIIIb Wt. % | VIIIc Wt. % | VIIId Wt. % | VIIIVe Wt. % | VIIIf Wt. % |
|---|---|---|---|---|---|---|
| Oligo-saccharide Mixture A | 0.3 | — | — | — | 0.25 | — |
| Oligo-saccharide Mixture B | — | 1 | — | — | — | — |
| Oligo-saccharide Mixture C | — | — | 0.5 | — | — | — |
| Oligo-saccharide Mixture D | — | — | — | 1.5 | — | 1 |
| Copolymer A(6) | 0.4 | — | — | — | — | 0.5 |
| Copolymer B(7) | — | 0.5 | — | 0.3 | — | — |
| Copolymer C(8) | — | — | 0.6 | — | 0.5 | — |
| LiBr | — | — | — | 3 | — | 2 |
| Silicone Emulsion A(5) | — | — | — | — | 1.5 | — |
| D5 Volatile Silicone | — | — | — | — | — | 0.5 |
| Perfume A | 0.06 | — | — | — | — | 0.07 |
| Perfume B | — | 0.03 | — | 0.03 | — | — |
| Perfume C | — | — | 0.04 | — | 0.03 | — |
| Polysorbate 60 | 0.1 | 0.1 | 0.03 | 0.1 | 0.1 | 0.1 |
| Silwet L-7600 | — | — | — | 0.5 | — | — |
| Silwet L-7602 | — | — | — | — | — | 0.7 |
| Kathon CG | 3 ppm | 3 ppm | 3 ppm | 3 ppm | 3 ppm | 3 ppm |
| Deionized Water | Bal. | Bal. | Bal. | Bal. | Bal. | Bal. |

EXAMPLE IX

| Ingredients | IXa Wt. % | IXb Wt. % | IXc Wt. % | IXd Wt. % | IXe Wt. % | IXf Wt. % |
|---|---|---|---|---|---|---|
| Arabinogalactan A | 0.7 | — | — | — | 7 | 1 |
| Arabinogalactan B | — | 0.5 | — | 0.5 | — | — |
| Arabinogalactan C | — | — | 0.5 | — | — | — |
| Copolymer D(9) | 0.4 | — | — | — | 2 | 0.25 |
| Copolymer E(10) | — | 0.5 | — | — | — | 0.25 |
| Copolymer F(11) | — | — | 0.4 | — | — | — |
| Copolymer G(12) | — | — | — | 0.5 | — | — |
| D5 Volatile Silicone | — | 0.25 | — | — | — | — |
| PDMS 10,000 cst | — | — | — | 0.3 | — | — |
| Silicone Emulsion B(13) | — | — | 1 | — | 2 | — |
| Perfume A | 0.06 | — | — | — | — | 0.07 |
| Perfume B | — | 0.03 | — | 0.03 | — | — |
| Perfume C | — | — | 0.04 | — | 0.5 | — |
| Polysorbate 60 | 0.1 | 0.1 | — | 0.1 | 0.5 | 0.1 |
| Neodol 23-3 | — | 0.25 | — | 0.2 | — | — |
| Neodol 25-3 | — | — | 0.3 | — | 0.3 | 0.25 |
| Silwet L-77 | — | 0.7 | — | 1 | — | — |
| Silwet L-7604 | — | — | 0.5 | — | — | 0.7 |
| Kathon CG | 3 ppm | 3 ppm | 3 ppm | 3 ppm | 5 ppm | 3 ppm |
| Deionized Water | Bal. | Bal. | Bal. | Bal. | Bal. | Bal. |

(9)Acrylic acid/tert-butyl acrylate copolymer, with an approximate acrylic acid/tert-butyl acrylate weight ratio of about 23/77 and an average molecular weight of about 82,000.
(10)Silicone-containing copolymer having t-butyl acrylate/acrylic acid/(polydimethylsiloxane macromer, 10,000 approximate molecular weight) monomer at an approximate 63/20/17 weight ratio, and of an average molecular weight of about 130,000.
(11)Silicone-containing copolymer having t-butylacrylate/acrylic acid/(polydimethylsiloxane macromer, 10,000 approximate molecular weight) monomer at an approximate 65/25/10 weight ratio, and of average molecular weight of about 200,000.
(12)Silicone-containing copolymer having (N,N,N-trimethylammonioethyl methacrylate chloride)/N,N-dimethylacrylamide/(PDMS macromer - 15,000 approximate molecular weight) at an approximate 40/40/20 weight ratio, and of average molecular weight of about 150,000.
(13)DC-1550 silicone microemulsion (25% active) from Dow Corning, with a particle size of about 50 nm, an anionic/nonionic surfactant system, and a silicone with an internal phase viscosity of about 100,000 cps.
The composition of Example IXe is a concentrated composition, to be diluted for use.

EXAMPLE X

| Ingredients | Xa Wt. % | Xb Wt. % | Xc Wt. % | Xd Wt. % | Xe Wt. % | Xf Wt. % |
|---|---|---|---|---|---|---|
| Arabino-galactan A | — | 0.5 | 0.8 | — | 6 | 2 |
| Arabino-galactan B | 0.7 | — | — | — | — | — |
| Arabino-galactan C | — | — | — | 0.35 | — | — |
| Oligo-saccharide Mixture A | 0.7 | — | — | — | — | — |
| Oligo-saccharide Mixture B | — | 1 | — | 0.85 | — | — |
| Oligo-saccharide Mixture C | — | — | 0.2 | — | — | — |
| Oligo-saccharide Mixture D | — | — | — | — | 5 | 0.5 |
| Copolymer D[9] | 0.4 | — | — | — | 2 | 0.25 |
| Copolymer E[10] | — | 0.5 | — | — | — | 0.25 |
| Copolymer F[11] | — | — | 0.4 | — | — | — |
| Copolymer G[12] | — | — | — | 0.5 | — | — |
| D5 Volatile Silicone | — | 0.25 | — | — | — | — |
| PDMS 10,000 cst | — | — | — | 0.3 | — | — |
| Silicone Emulsion B[13] | — | — | 1 | — | 2 | — |
| Perfume A | 0.06 | — | — | — | — | 0.07 |
| Perfume B | — | 0.03 | — | 0.03 | — | — |
| Perfume C | — | — | 0.04 | — | 0.5 | — |
| Polysorbate 60 | 0.1 | 0.1 | — | 0.1 | 0.5 | 0.1 |
| Neodol 23-3 | — | 0.25 | — | 0.2 | — | — |
| Neodol 25-3 | — | — | 0.3 | — | 0.3 | 0.25 |
| Silwet L-77 | — | 0.7 | — | 1 | — | — |
| Silwet L-7604 | — | — | 0.5 | — | — | 0.7 |
| Kathon CG | 3 ppm | 3 ppm | 3 ppm | 3 ppm | 10 ppm | 3 ppm |
| Deionized Water | Bal. | Bal. | Bal. | Bal. | Bal. | Bal. |

The composition of Example Xe is a concentrated composition, to be diluted for use.

EXAMPLE XI

| Ingredients | XIa Wt % | XIb Wt % | XIc Wt % | XId Wt % | XIe Wt % | XIf Wt % |
|---|---|---|---|---|---|---|
| Arabino-galactan A | 0.8 | — | — | 1 | — | 1.5 |
| Arabino-galactan B | — | 0.5 | — | — | 0.7 | — |
| Arabino-galactan C | — | — | 0.5 | — | — | — |
| HPBCD[14] | 1 | — | 0.5 | — | 0.5 | — |
| RAMEB[15] | — | 1 | — | — | — | — |
| HPACD[16] | — | — | 0.5 | — | — | — |
| α-Cyclodextrin | — | — | — | — | 0.5 | 0.5 |
| β-Cyclodextrin | — | — | — | 0.5 | — | 0.5 |
| $ZnCl_2$ | — | 1.0 | — | 1.0 | — | 1 |
| Silwet L-7657 | — | — | — | — | 0.05 | — |
| Perfume C | 0.1 | 0.07 | 0.05 | — | 0.1 | 0.05 |

-continued

| Ingredients | XIa Wt % | XIb Wt % | XIc Wt % | XId Wt % | XIe Wt % | XIf Wt % |
|---|---|---|---|---|---|---|
| Propylene glycol | 0.06 | — | 0.05 | — | 0.03 | — |
| Kathon CG | 3 ppm | 3 ppm | 3 ppm | 3 ppm | 3 ppm | 3 ppm |
| HCl | — | to pH 4.5 | — | to pH 5 | — | to pH 4.5 |
| Distilled water | Bal. | Bal. | Bal. | Bal. | Bal. | Bal. |

[14]Hydroxypropyl beta-cyclodextrin.
[15]Randomly methylated beta-cyclodextrin.
[16]Hydroxypropyl alpha-cyclodextrin.

EXAMPLE XII

| Ingredients | XIIa Wt % | XIIb Wt % | XIIc Wt % | XIId Wt % | XIIe Wt % | XIIf Wt % |
|---|---|---|---|---|---|---|
| Arabino-galactan A | 0.6 | 0.6 | 1 | 0.1 | — | — |
| Arabino-galactan B | — | — | — | — | 0.5 | — |
| Arabino-galactan C | — | — | — | — | — | 0.3 |
| Oligo-saccharide Mixture A | 0.9 | — | — | — | — | — |
| Oligo-saccharide Mixture B | — | 0.4 | — | — | 0.7 | 0.7 |
| Oligo-saccharide Mixture C | — | — | 0.5 | — | — | — |
| Oligo-saccharide Mixture D | | | | 0.9 | | |
| HPBCD[14] | 1 | — | 0.5 | — | 0.5 | — |
| RAMEB[15] | — | 1 | — | — | — | — |
| HPACD[16] | — | — | 0.5 | — | — | — |
| α-Cyclodextrin | — | — | — | — | 0.5 | 0.5 |
| β-Cyclodextrin | — | — | — | 0.5 | — | 0.5 |
| $ZnCl_2$ | — | 1.0 | — | 1.0 | — | 1 |
| Silwet L-7657 | — | — | — | — | 0.05 | — |
| Perfume C | 0.1 | 0.07 | 0.05 | — | 0.1 | 0.05 |
| Propylene glycol | 0.06 | — | 0.05 | — | 0.03 | — |
| Kathon CG | 3 ppm | 3 ppm | 3 ppm | 3 ppm | 3 ppm | 3 ppm |
| HCl | — | to pH 4.5 | — | to pH 5 | — | to pH 4.5 |
| Distilled water | Bal. | Bal. | Bal. | Bal. | Bal. | Bal. |

EXAMPLE XIII

| Ingredients | XIIIa Wt % | XIIIb Wt % | XIIIc Wt % | XIIId Wt % | XIIIe Wt % | XIIIf Wt % |
|---|---|---|---|---|---|---|
| Arabino-galactan A | 0.7 | — | — | 0.5 | 1 | 1 |
| Arabino-galactan B | — | 0.5 | — | — | — | — |
| Arabino-galactan C | — | — | 1 | — | — | — |
| HPBCD | 1.0 | — | — | — | — | — |
| RAMEB | — | 1.0 | — | — | — | — |
| Silwet L-7604 | 0.3 | 0.2 | 0.2 | — | — | 0.1 |
| Chlorhexidine | 0.01 | — | — | — | — | 0.005 |

-continued

| Ingredients | XIIIa Wt % | XIIIb Wt % | XIIIc Wt % | XIIId Wt % | XIIIe Wt % | XIIIf Wt % |
|---|---|---|---|---|---|---|
| Barquat 4250[17] | — | — | 0.03 | — | — | — |
| Bardac 2050[18] | — | — | — | 0.03 | 0.03 | — |
| Perfume C | 0.08 | 0.08 | 0.05 | 0.05 | — | — |
| HCl | to pH 4 | — | — | — | — | — |
| Kathon CG | 3 ppm | 3 ppm | 3 ppm | 3 ppm | 3 ppm | 3 ppm |
| Distilled water | Bal. | Bal. | Bal. | Bal. | Bal. | Bal. |

[17]Benzalkonium chloride, 50% solution.
[18]Dioctyl dimethyl ammonium chloride, 50% solution.

EXAMPLE XIVA

| Ingredients | XIVa Wt % | XIVb Wt % | XIVc Wt % | XIVd Wt % | XIVe Wt % | XIVf Wt % |
|---|---|---|---|---|---|---|
| Arabino-galactan A | 1 | 1 | 0.3 | 0.9 | — | — |
| Arabino-galactan B | — | — | — | — | 0.5 | — |
| Arabino-galactan C | — | — | — | — | — | 0.2 |
| Oligo-saccharide Mixture A | 0.7 | — | — | — | — | — |
| Oligo-saccharide Mixture B | — | 0.5 | — | — | 0.5 | — |
| Oligo-saccharide Mixture C | — | — | 1.2 | — | — | — |
| Oligo-saccharide Mixture D | — | — | — | 0.6 | — | 1.8 |
| HPBCD | 1.0 | — | — | — | — | — |
| RAMEB | — | 1.0 | — | — | — | — |
| Silwet L-7604 | 0.3 | 0.2 | 0.2 | — | — | 0.1 |
| Chlorhexidine | 0.01 | — | — | — | — | 0.005 |
| Barquat 4250[17] | — | — | 0.03 | — | — | — |
| Bardac 2050[18] | — | — | — | 0.03 | 0.03 | — |
| Perfume C | 0.08 | 0.08 | 0.05 | 0.05 | — | — |
| HCl | to pH 4 | — | — | — | — | — |
| Kathon CG | 3 ppm | 3 ppm | 3 ppm | 3 ppm | 3 ppm | 3 ppm |
| Distilled water | Bal. | Bal. | Bal. | Bal. | Bal. | Bal. |

EXAMPLE XIVB

| Ingredients | XIVg Wt % | XIVh Wt % | XIVi Wt % | XIVj Wt % | XIVk Wt % | XIVl Wt % |
|---|---|---|---|---|---|---|
| Quaternized Arabino-galactan A | 0.5 | — | — | 0.6 | — | — |
| Curdlan | — | 0.3 | — | — | 0.2 | — |
| Dextran | — | — | 0.3 | — | — | 0.2 |
| Oligo-saccharide Mixture A | 0.5 | — | — | — | — | — |
| Oligo-saccharide Mixture B | — | 0.5 | — | — | 0.7 | — |
| Oligo-saccharide Mixture C | — | — | 1.2 | — | — | — |
| Oligo-saccharide Mixture D | — | — | — | 0.6 | — | 1.8 |
| HPBCD | 1.0 | — | — | — | — | — |
| RAMEB | — | 1.0 | — | — | — | — |
| Silwet L-7604 | 0.3 | 0.2 | 0.2 | — | — | 0.1 |
| Chlorhexidine | 0.01 | — | — | — | — | 0.005 |
| Barquat 4250 | — | — | 0.03 | — | — | — |
| Bardac 2050 | — | — | — | 0.03 | 0.03 | — |
| Perfume C | 0.08 | 0.08 | 0.05 | 0.05 | — | — |
| HCl | to pH 4 | — | — | — | — | — |
| Kathon CG | 3 ppm | 3 ppm | 3 ppm | 3 ppm | 3 ppm | 3 ppm |
| Distilled water | Bal. | Bal. | Bal. | Bal. | Bal. | Bal. |

The compositions of Examples I to XIV (diluted when appropriate) are sprayed onto clothing using, e.g., the TS-800 sprayer from Calmar, and allowed to evaporate off of the clothing.

The compositions of Examples I to XIV (diluted when appropriate) are sprayed onto clothing, using a blue inserted Guala® trigger sprayer, available from Berry Plastics Corp. and a cylindrical Euromist II® pump sprayer available from Seaquest Dispensing, respectively, and allowed to evaporate off of the clothing.

The compositions of Examples I to XIV (diluted when appropriate) contained in rechargeable battery-operated Solo Spraystar sprayers are sprayed onto large surfaces of fabric, such as several pieces of clothing, and allowed to evaporate off of these surfaces.

The compositions of Examples I to XIV (diluted when appropriate) are used for soaking or dipping of fabrics which are then optionally wrung or squeezed to remove excess liquid and subsequently dried.

Following are Examples for rinse-added fabric care compositions in accordance with the present invention:

EXAMPLE XV

| Ingredients | XVa Wt % | XVb Wt % | XVc Wt % | XVd Wt. % | XVe Wt % |
|---|---|---|---|---|---|
| Arabinogalactan A | 8 | — | — | 20 | — |
| Arabinogalactan B | — | 3 | — | — | 15 |
| Arabinogalactan C | — | — | 5 | — | — |
| Fabric softener A[19] | 4.5 | — | — | — | — |
| Fabric softener B[20] | — | 24 | — | — | — |
| Fabric softener C[21] | — | — | 26 | — | — |
| Fabric softener D[22] | — | — | — | 28 | 28 |
| Fabric softener E[23] | 3.4 | — | — | — | — |
| 1,2-Hexanediol | — | — | 18 | — | — |
| 2-Ethyl-1,3-hexane-diol | — | — | — | 6 | — |
| Neodol 91-8 | — | — | — | 5 | 3 |
| Pluronic L-35 | — | — | — | 1 | |
| Hexylene glycol | — | — | — | — | 3 |
| Hexylene glycol (from softener active) | — | — | — | 2.5 | 2.5 |

-continued

| Ingredients | XVa Wt % | XVb Wt % | XVc Wt % | XVd Wt. % | XVe Wt % |
|---|---|---|---|---|---|
| Ethanol (from softener active) | — | 4.2 | 4.6 | 2.3 | 2.3 |
| Perfume B | 0.3 | 1.3 | 1.3 | 2 | 1.2 |
| Tenox 6 antioxidant | 0.02 | 0.04 | 0.04 | 0.04 | 0.04 |
| $CaCl_2$ | 0.05 | 0.4 | 0.5 | — | 2 |
| $MgCl_2$ | — | — | — | 1.6 | — |
| HCl | to pH 6 | to pH 3.5 | to pH 3.5 | to pH 3 | to pH 3 |
| Kathon CG | 5 ppm | 5 ppm | 5 ppm | 5 ppm | 5 ppm |
| Deionized water and other minor ingredients | Bal. | Bal. | Bal. | Bal. | Bal. |

(19)Di(hydrogenated tallowyl) dimethyl ammonium chloride/hydrogenated tallowyl trimethyl ammonium chloride blend of about 83:17 weight ratio.
(20)Di(acyloxyethyl) dimethyl ammonium chloride wherein the acyl group is derived from soft tallow fatty acids and with a diester-to-monoester weight ratio of about 11:1.
(21)Di(acyloxyethyl) dimethyl ammonium chloride wherein the acyl group is derived from partially hydrogenated canola fatty acids and with a diester-to-monoester weight ratio of about 11:1.
(22)Di(acyloxyethyl)(2-hydroxyethyl)methyl ammonium methyl sulfate wherein the acyl group is derived from partially hydrogenated canola fatty acids.
(23)1-Tallow(amidoethyl)-2-tallowimidazoline.

EXAMPLE XVI

| Ingredients | XVIa Wt % | XVIb Wt % | XVIc Wt % | XVId Wt. % | XVIe Wt % | XVIf Wt % |
|---|---|---|---|---|---|---|
| Arabinogalactan A | 5 | — | — | 5 | 9 | 15 |
| Arabinogalactan B | — | 3 | — | — | — | — |
| Arabinogalactan C | — | — | 2 | — | — | — |
| Oligosaccharide Mixture A | — | 3 | — | — | — | — |
| Oligosaccharide Mixture B | 5 | — | — | — | — | — |
| Oligosaccharide Mixture C | — | — | — | — | 3 | — |
| Oligosaccharide Mixture D | — | — | 8 | 2 | — | — |
| Fabric softener A(19) | 4.5 | — | — | — | — | — |
| Fabric softener B(20) | — | 24 | — | — | — | — |
| Fabric softener C(21) | — | — | 26 | — | — | — |
| Fabric softener D(22) | — | — | — | 28 | 28 | — |
| Fabric softener E(23) | 3.4 | — | — | — | — | — |
| 1,2-Hexanediol | — | — | 18 | — | — | — |
| 2-Ethyl-1,3-hexanediol | — | — | — | 6 | — | — |
| Neodol 91-8 | — | — | — | 5 | 3 | — |
| Pluronic L-35 | — | — | — | 1 | — | — |
| Hexylene glycol | — | — | — | — | 3 | — |
| Hexylene glycol (from softener active) | — | — | — | 2.5 | 2.5 | — |
| Ethanol (from softener active) | — | 4.2 | 4.6 | 2.3 | 2.3 | — |
| Perfume B | 0.3 | 1.3 | 1.3 | 2 | 1.2 | 1.2 |
| Tenox 6 antioxidant | 0.02 | 0.04 | 0.04 | 0.04 | 0.04 | |
| $CaCl_2$ | 0.05 | 0.4 | 0.5 | — | 2 | — |
| $MgCl_2$ | — | — | — | 1.6 | — | — |
| HCl | to pH 6 | to pH 3.5 | to pH 3.5 | to pH 3 | to pH 3 | — |
| Polysorbate 60 | — | — | — | — | — | 1 |
| Deionized water and other minor ingredients | Bal. | Bal. | Bal. | Bal. | Bal. | Bal. |

EXAMPLE XVII

| Ingredients | XVIIa Wt % | XVIIb Wt % | XVIIc Wt % | XVIId Wt. % | XVIIe Wt % | XVIIf Wt % |
|---|---|---|---|---|---|---|
| Arabinogalactan A | 6 | — | — | 15 | — | 30 |
| Arabinogalactan B | — | 20 | — | — | 10 | — |
| Arabinogalactan C | — | — | 16 | — | — | — |
| Fabric softener A(19) | 4.5 | — | — | — | — | — |
| Fabric softener B(20) | — | 22 | 25 | 25 | — | — |
| Fabric softener E(23) | 3.4 | — | — | — | — | — |
| PVPK-15(24) | 1 | 3 | — | — | 5 | — |
| PVNO(25) | — | — | 1 | — | — | — |
| Cellulase(26) | — | — | — | 1 | — | 2— |
| Perfume B | 0.4 | 1.3 | 1.3 | 1.3 | 2 | — |
| Perfume C | — | — | — | — | — | 1.5 |
| Polysorbate 60 | — | — | — | — | 5 | 1 |
| HCl | to pH 5 | to pH 3.5 | to pH 3.5 | to pH 3.5 | — | — |
| Kathon CG | 5 ppm | 5 ppm | 5 ppm | 5 ppm | 5 ppm | 10 ppm |
| Deionized water and minor ingredients | Bal. | Bal. | Bal. | Bal. | Bal. | Bal. |

(19)Di(hydrogenated tallowyl) dimethyl ammonium chloride/hydrogenated tallowyl trimethyl ammonium chloride blend of about 83:17 weight ratio.
(20)Di(acyloxyethyl) dimethyl ammonium chloride wherein the acyl group is derived from soft tallow fatty acids and with a diester-to-monoester weight ratio of about 11:1.
(23)1-Tallow(amidoethyl)-2-tallowimidazoline.
(24)Polyvinylpyrrolidone with an average molecular weight of about 10,000.
(25)Poly(4-vinylpyridine-N-oxide) with an average molecular weight of about 25,000.
(26)The cellulase consists essentially of a homogeneous endoglucanase component, which is immunoreactive with an antibody raised against a hightly purified 43 kD cellulase derived from *Humicola insolens*, DMS 1800, or which is homologous to said 43 kD endoglucanase; the cellulase solution used provides about 5,000 CEVU's per gram.

EXAMPLE XVIII

| Ingredients | XVIIIa Wt % | XVIIIb Wt % | XVIIIc Wt % | XVIIId Wt. % | XVIIIe Wt % | XVIIIf Wt % |
|---|---|---|---|---|---|---|
| Arabinogalactan A | 4 | 5 | — | 15 | — | 16 |
| Arabinogalactan B | — | — | 5— | — | — | — |
| Arabinogalactan C | — | — | — | — | 6 | — |
| Oligosaccharide Mixture A | 6 | — | — | 10 | — | — |
| Oligosaccharide Mixture B | — | 10 | — | — | 6 | — |
| Oligosaccharide Mixture C | | | 5 | | | |
| Oligosaccharide Mixture D | — | — | — | 5 | — | 4 |
| Fabric softener A | 4.5 | — | — | — | — | — |
| Fabric softener B | — | 22 | 25 | 25 | — | — |
| Fabric softener E | 3.4 | — | — | — | — | — |
| PVPK-15 | 1 | 3 | — | — | 5 | — |
| PVNO | — | — | 1 | — | — | — |
| Cellulase(26) | — | — | — | 1 | — | 2 |

-continued

| Ingredients | XVIIIa Wt % | XVIIIb Wt % | XVIIIc Wt % | XVIIId Wt. % | XVIIIe Wt % | XVIIIf Wt % |
|---|---|---|---|---|---|---|
| Perfume B | 0.4 | 1.3 | 1.3 | 1.3 | 2 | — |
| Perfume C | — | — | — | — | — | 1.5 |
| Polysorbate 60 | — | — | — | — | 5 | 1 |
| HCl | to pH 5 | to pH 3.5 | to pH 3.5 | to pH 3.5 | — | — |
| Kathon CG | 3 ppm | 3 ppm | 3 ppm | 3 ppm | 3 ppm | 3 ppm |
| Deionized water and minor ingredients | Bal. | Bal. | Bal. | Bal. | Bal. | Bal. |

EXAMPLE XIX

| Ingredients | XIXa Wt % | XIXb Wt % | XIXc Wt % | XIXd Wt % | XIXe Wt % | XIXf Wt % |
|---|---|---|---|---|---|---|
| Arabinogalactan A | 10 | — | — | — | — | — |
| Arabinogalactan B | — | 16 | — | — | — | — |
| Arabinogalactan C | — | — | 12 | — | — | — |
| Quaternized Arabinogalactan A[2] | — | — | — | 12 | — | — |
| Curdlan[3] | — | — | — | — | 8 | — |
| Dextran[4] | — | — | — | — | — | 12 |
| Fabric softener D[22] | 35 | 35 | 35 | 35 | 35 | 35 |
| TMPD[27] | 5 | 5 | 5 | 5 | 5 | 5 |
| Neodol 91-8 | 6 | 6.5 | 6.5 | 6 | 6.5 | 6.5 |
| Pluronic L-35 | 1 | 1 | 1.5 | 1 | 1 | 1.5 |
| Hexylene glycol (from softener active) | 3.1 | 3.1 | 3.1 | 3.1 | 3.1 | 3.1 |
| Ethanol (from softener active) | 2.9 | 2.9 | 2.9 | 2.9 | 2.9 | 2.9 |
| TPED[28] | 0.75 | 0.75 | 0.75 | 0.75 | 0.75 | 0.75 |
| DTPA[29] | 0.01 | 0.1 | 0.01 | 0.01 | 0.1 | 0.01 |
| Perfume | 2.5 | 3 | 1.8 | 2.5 | 3 | 1.8 |
| $MgCl_2$ | 1.75 | 1 | 1 | 1.75 | 1 | 1 |
| Blue dye | 6 ppm | 6 ppm | 6 ppm | 6 ppm | 6 ppm | 6 ppm |
| HCl | to pH 6 | to pH 3.5 | to pH 3.5 | to pH 6 | to pH 3.5 | to pH 3.5 |
| Kathon CG | 3 ppm | 3 ppm | 3 ppm | 3 ppm | 3 ppm | 3 ppm |
| Deionized water and other minor ingredients | Bal. | Bal. | Bal. | Bal. | Bal. | Bal. |

[22]Di(acyloxyethyl)(2-hydroxyethyl)methyl ammonium methyl sulfate wherein the acyl group is derived from partially hydrogenated canola fatty acids.
[27]2,2,4-Trimethyl-1,3-pentanediol.
[28]Tetrakis-(2-hydroxypropyl) ethylenediamine.
[29]Sodium diethylenetriaminepentaacetate.

EXAMPLE XX

| Ingredients | XXa Wt % | XXb Wt % | XXc Wt % | XXd Wt % | XXe Wt % | XXf Wt % |
|---|---|---|---|---|---|---|
| Arabinogalactan A | 6 | — | — | — | — | — |
| Arabinogalactan B | — | 10 | — | — | — | — |

-continued

| Ingredients | XXa Wt % | XXb Wt % | XXc Wt % | XXd Wt % | XXe Wt % | XXf Wt % |
|---|---|---|---|---|---|---|
| Arabinogalactan C | — | — | 4 | — | — | — |
| Quaternized Arabinogalactan A[2] | — | — | — | 10 | — | — |
| Curdlan[3] | — | — | — | — | 3 | — |
| Dextran[4] | — | — | — | — | — | 8 |
| Oligosaccharide Mixture A | — | — | — | 2 | — | — |
| Oligosaccharide Mixture B | — | — | 8 | — | 5 | — |
| Oligosaccharide Mixture C | — | 6 | — | — | — | — |
| Oligosaccharide Mixture D | 6 | — | — | — | — | 4 |
| Fabric softener D[22] | 35 | 35 | 35 | 35 | 35 | 35 |
| TMPD[27] | 5 | 5 | 5 | 5 | 5 | 5 |
| Neodol 91-8 | 6 | 6.5 | 6.5 | 6 | 6.5 | 6.5 |
| Pluronic L-35 | 1 | 1 | 1.5 | 1 | 1 | 1.5 |
| Hexylene glycol (from softener active) | 3.1 | 3.1 | 3.1 | 3.1 | 3.1 | 3.1 |
| Ethanol (from softener active) | 2.9 | 2.9 | 2.9 | 2.9 | 2.9 | 2.9 |
| TPED[28] | 0.75 | 0.75 | 0.75 | 0.75 | 0.75 | 0.75 |
| DTPA[29] | 0.01 | 0.1 | 0.01 | 0.01 | 0.1 | 0.01 |
| Perfume | 2.5 | 3 | 1.8 | 2.5 | 3 | 1.8 |
| $MgCl_2$ | 1.75 | 1 | 1 | 1.75 | 1 | 1 |
| Blue dye | 6 ppm | 6 ppm | 6 ppm | 6 ppm | 6 ppm | 6 ppm |
| HCl | to pH 6 | to pH 3.5 | to pH 3.5 | to pH 6 | to pH 3.5 | to pH 3.5 |
| Kathon CG | 3 ppm | 3 ppm | 3 ppm | 3 ppm | 3 ppm | 3 ppm |
| Deionized water and other minor ingredients | Bal. | Bal. | Bal. | Bal. | Bal. | Bal. |

Following are Examples for laundry detergent fabric care compositions in accordance with the present invention:

EXAMPLE XXI

| Ingredients | XXIa Wt % | XXIb Wt. % | XXIc Wt % | XXId Wt. % | XXIe Wt. % |
|---|---|---|---|---|---|
| LAS[a] | 8 | 8 | 8 | 7 | 7 |
| C25E3[b] | 3.4 | 3.4 | 3.4 | 3.4 | 3.4 |
| QAS[c] | — | 0.8 | — | 0.8 | 0.8 |
| Zeolite A | 17 | 17 | 17 | 16 | 16 |
| Carbonate | 13 | 24 | 13 | 22 | 22 |
| Silicate | 1.4 | 3 | 1.4 | 3 | 3 |
| Sulfate | 25 | 16 | 24 | 12 | 12 |
| PB4[d] | 9 | 8 | 9 | 8 | 7 |
| TAED[e] | 1.5 | 1.5 | 1.5 | 1.5 | 1.5 |
| DETPMP[f] | 0.25 | 0.25 | 0.25 | 0.25 | 0.25 |
| HEDP[g] | 0.3 | 0.3 | 0.3 | 0.3 | 0.3 |
| Arabinogalactan A | 18 | — | — | 15 | 14 |
| Arabinogalactan B | — | 15 | — | — | — |
| Arabinogalactan C | — | — | 20 | — | — |
| Oligosaccharide Mixture A | — | — | — | 8 | — |
| Oligosaccharide Mixture D | — | — | — | — | 10 |
| Protease | 26 ppm | 26 ppm | 26 ppm | 26 ppm | 26 ppm |
| MA/AA[h] | 0.3 | 0.3 | 0.3 | 0.3 | 0.3 |

-continued

| Ingredients | XXIa Wt % | XXIb Wt. % | XXIc Wt % | XXId Wt. % | XXIe Wt. % |
|---|---|---|---|---|---|
| CMC[i] | 0.2 | 0.2 | 0.2 | 0.2 | 0.2 |
| Photoactivated Bleach | — | 10 ppm | — | 10 ppm | 10 ppm |
| Brightener | 0.09 | 0.09 | 0.09 | 0.09 | 0.09 |
| Perfume | 0.3 | 0.3 | 0.3 | 0.3 | 0.3 |
| Silicone antifoam | 0.5 | 0.5 | 0.5 | 0.5 | 0.5 |
| Moisture and Miscellaneous | Balance | Balance | Balance | Balance | Balance |

[a]Sodium linear $C_{12}$ alkyl benzene sulphonate.
[b]A $C_{12}$—$C_{15}$ predominately linear primary alcohol condensed with an average of 3 moles of ethylene oxide.
[c]$(C_{12}—C_{14})N^{+}(CH_3)_2C_2H_4OH)$
[d]Sodium perborate.4H20.
[e]Tetraacetyl ethylene diamine.
[f]Diethylene triamine penta(methylene phosphonic acid), marketed by Monsanto under the Trade name Dequest 2060.
[g]1,1-Hydroxyethane diphosphonic acid.
[h]Copolymer of 1:4 maleic/acrylic acid, average molecular weight about 70,000–80,000.
[i]Sodium carboxymethyl cellulose.

EXAMPLE XXII

Nil bleach-containing laundry detergent fabric care compositions of particular use in the washing of colored clothing:

| Ingredients | XXIIa Wt % | XXIIb Wt. % | XXIIc Wt % | XXIId Wt. % | XXIIe Wt. % |
|---|---|---|---|---|---|
| Blown Powder | | | | | |
| Zeolite A | 13 | 14 | 13 | 13 | 13 |
| Sodium sulfate | — | 14 | — | 13 | 12 |
| LAS | 2.8 | 3 | 2.8 | 3 | 2.8 |
| DETPMP | 0.4 | 0.5 | 0.4 | 0.5 | 0.5 |
| CMC | 0.4 | 0.4 | 0.4 | 0.4 | 0.4 |
| MA/AA | 3.8 | 4 | 3.8 | 3.5 | 3.8 |
| Agglomerates | | | | | |
| LAS | 5.5 | 5 | 5.5 | 5 | 5 |
| TAS[j] | 3 | 2 | 3 | 2 | 2 |
| Silicate | 4 | 4 | 4 | 4 | 4 |
| Zeolite A | 8 | 13 | 9 | 12 | 12 |
| Carbonate | 8 | 7 | 9 | 6 | 7 |
| Spray On | | | | | |
| Perfume | 0.3 | 0.3 | 0.3 | 0.3 | 0.3 |
| C45E7[k] | 4 | 4 | 4 | 4 | 4 |
| C25E3 | 1.8 | 1.8 | 1.8 | 1.8 | 1.8 |
| Dry additives | | | | | |
| Na Citrate | 9.5 | — | 10 | — | — |
| Na Bicarbonate | 6.5 | 3 | 6.5 | 3 | 3 |
| Na Carbonate | 7.5 | 5 | 7.5 | 4.5 | 4.5 |
| PVPVI/PVNO[l] | 0.5 | 0.5 | 0.5 | 0.5 | 0.5 |
| Arabinogalactan A | 15 | — | — | 15 | — |
| Arabinogalactan B | — | 12 | — | — | 9 |
| Arabinogalactan C | — | — | 12 | — | — |
| Oligosaccharide Mixture C | — | — | — | 5 | — |
| Oligosaccharide Mixture D | — | — | — | — | 9 |
| Protease | 0.026 | 0.016 | 0.026 | 0.016 | 0.016 |
| Lipase | 0.009 | 0.009 | 0.009 | 0.009 | 0.009 |
| Amylase | 0.005 | — | 0.005 | — | — |
| Cellulase | 0.006 | 0.006 | 0.006 | 0.006 | 0.006 |
| Silicone antifoam | 4 | 3 | 4 | 3.5 | 3 |

-continued

| Ingredients | XXIIa Wt % | XXIIb Wt. % | XXIIc Wt % | XXIId Wt. % | XXIIe Wt. % |
|---|---|---|---|---|---|
| Moisture and Miscellaneous | Balance | Balance | Balance | Balance | Balance |

[j]Sodium tallow alkyl sulphate.
[k]A $C_{14}$—$C_{15}$ predominantly linear primary alcohol condensed with an average of 7 moles of ethylene oxide
[l]Copolymer of vinyl-imidazole and vinyl-pyrrolidone/poly (4-vinylpyridine)-N-oxide.

EXAMPLE XXIII

Examples of liquid detergent fabric care compositions according to the present invention:

| Ingredients | XXIIIa Wt % | XXIIIb Wt. % | XXIIIc Wt % | XXIIId Wt % | XXIIIe Wt % |
|---|---|---|---|---|---|
| LAS | 9 | 8 | — | 22 | — |
| C25AS[m] | 4 | 2 | 9 | — | 12 |
| C25E3S[n] | 1 | — | 3 | — | 3.5 |
| C25E7 | 6 | 12 | 2.5 | — | 3.5 |
| TFAA[o] | — | — | 4.5 | — | 7.5 |
| QAS | — | — | — | 3 | — |
| TPKFA[p] | 2 | 12 | 2 | — | 5.5 |
| Canola fatty acids | — | — | 5 | — | 4 |
| Citric | 2 | 1 | 1.5 | 1 | 1 |
| Dodecenyl/tetradecenyl succinic acid | 10 | — | — | 14 | — |
| Oleic acid | 4 | 1 | — | 1 | — |
| Ethanol | 4 | 6 | 2 | 6 | 2 |
| 1,2 Propanediol | 4 | 2 | 6 | 6 | 10 |
| Mono Ethanol Amine | — | — | 5 | — | 8 |
| Tri Ethanol Amine | — | 7 | — | — | — |
| NaOH (pH) | 8 | 7.5 | 7.5 | 8 | 8 |
| Ethoxylated tetraethylene pentamine | 0.5 | 0.5 | 0.2 | — | 0.3 |
| DETPMP | 1 | 0.5 | 1 | 2 | — |
| Soil Release Polymer | 0.3 | 0.3 | 0.1 | — | 0.1 |
| PVNO[q] | — | — | — | — | 0.1 |
| Arabinogalactan A | 15 | — | — | — | — |
| Arabinogalactan B | — | 12 | — | — | — |
| Arabinogalactan C | — | — | 15 | — | — |
| Curdlan | — | — | — | 12 | — |
| Dextran | — | — | — | — | 10 |
| Protease | 50 ppm | 40 ppm | 30 ppm | 0.08 | 60 ppm |
| Lipase | — | — | 2 ppm | — | 30 ppm |
| Amylase | 20 ppm | 50 ppm | 40 ppm | 20 ppm | 50 ppm |
| Cellulase | — | — | 1 ppm | — | 4 ppm |
| Boric acid | 0.1 | — | 2 | 1 | 2.5 |
| Na formate | — | 1 | — | — | — |
| Ca chloride | — | — | 0.01 | — | — |
| Bentonite clay | — | — | — | 3.5 | — |
| Suspending clay | — | — | — | 0.6 | — |
| Water and Miscellaneous | Bal. | Bal. | Bal. | Bal. | Bal. |

[m]Sodium $C_{12}$—$C_{15}$ alkyl sulfate.
[n]$C_{12}$—$C_{15}$ sodium alkyl sulfate condensed with an average of 3 moles of ethylene oxide per mole.
[o]$C_{16}$—$C_{18}$ alkyl N-methyl glucose amide.
[p]C12—C14 topped whole cut fatty acids.
[q]Poly(4-vinylpyridine-N-oxide) dye transfer inhibiting agent.

EXAMPLE XXIV

Examples of liquid detergent fabric care compositions according to the present invention:

| Ingredients | XXIVa Wt % | XXIVb Wt. % | XXIVc Wt % | XXIVd Wt % | XXIVe Wt % |
|---|---|---|---|---|---|
| LAS | 8 | 8 | — | 19 | — |
| C25AS | 4 | 2 | 8 | — | 11 |
| C25E3S | 1 | — | 3 | — | 3.5 |
| C25E7 | 5.5 | 11 | 2.5 | — | 3.5 |
| TFAA | — | — | 4.5 | — | 7.5 |
| QAS | — | — | — | 3 | — |
| TPKFA | 2 | 11 | 2 | — | 5 |
| Canola fatty acids | — | — | 4.5 | — | 4 |
| Citric | 2 | 1 | 1.5 | 1 | 1 |
| Dodecenyl/tetradecenyl succinic acid | 9.5 | — | — | 13 | — |
| Oleic acid | 4 | 1 | — | 1 | — |
| Ethanol | 4 | 6 | 2 | 6 | 2 |
| 1,2 Propanediol | 4 | 2 | 5.5 | 6 | 8 |
| Mono Ethanol Amine | — | — | 5 | — | 7 |
| Tri Ethanol Amine | — | 6 | — | — | — |
| NaOH (pH) | 8 | 7.5 | 7.5 | 8 | 8 |
| Ethoxylated tetraethylene pentamine | 0.5 | 0.5 | 0.2 | — | 0.3 |
| DETPMP | 1 | 0.5 | 1 | 2 | — |
| Soil Release Polymer | 0.3 | 0.3 | 0.1 | — | 0.1 |
| PVNO | — | — | — | — | 0.1 |
| Arabinogalactan A | 12 | | | 15 | |
| Arabinogalactan B | | 12 | | | 10 |
| Arabinogalactan C | | | 5 | | |
| Oligosaccharide Mixture A | 5 | — | — | — | — |
| Oligosaccharide Mixture C | — | 3 | — | — | 5 |
| Oligosaccharide Mixture D | — | — | 12 | 5 | — |
| Protease | 50 ppm | 40 ppm | 30 ppm | 0.08 | 60 ppm |
| Lipase | — | — | 2 ppm | — | 30 ppm |
| Amylase | 20 ppm | 50 ppm | 40 ppm | 20 ppm | 50 ppm |
| Cellulase | — | — | 1 ppm | — | 4 ppm |
| Boric acid | 0.1 | — | 2 | 1 | 2.5 |
| Na formate | — | 1 | — | — | — |
| Ca chloride | — | — | 0.01 | — | — |
| Bentonite clay | — | — | — | 2.5 | — |
| Suspending clay SD3 | — | — | — | 0.5 | — |
| Water and Miscellaneous | Bal. | Bal. | Bal. | Bal. | Bal. |

EXAMPLE XXV

Examples of liquid detergent fabric care compositions for fine fabrics according to the present invention:

| Ingredients | XXVa Wt. % | XXVb Wt % | XXVc Wt. % | XXVd Wt. % |
|---|---|---|---|---|
| Arabinogalactan A | 12 | — | 2 | 9 |
| Arabinogalactan B | — | 9 | — | — |
| Oligosaceharide Mixture C | — | — | 7 | — |
| Oligosaccharide Mixture D | — | — | — | 3 |
| C12–15AE1.8S | 10.3 | 9.7 | 9.7 | 10.3 |
| Neodol 23-9 | — | 0.3 | 0.3 | — |
| Neodol 45-7 | 2.9 | — | — | 2.9 |
| C8–10 Amidopropyl dimethylamine | — | 0.25 | 0.25 | — |
| CFAA[(t)] | — | 1 | 1 | — |
| C12 trimethylammonium chloride | 3.8 | — | — | 3.8 |
| Citric Acid | 0.75 | 1.7 | 1.7 | 0.75 |
| C12–16 Fatty Acid | — | 1.2 | 1.2 | — |
| Ethanol | 1.5 | 1.6 | 1.6 | 1.5 |
| 1,2-Propanediol | 2.6 | 4 | 4 | 2.6 |
| Mono Ethanol Amine | 0.55 | 0.45 | 0.45 | 0.55 |
| Na Formate | 0.07 | 0.45 | 0.45 | 0.07 |
| Na Toluene Sulfonate | 0.25 | 0.2 | 0.2 | 0.25 |
| Borax | 0.1 | 0.5 | 0.5 | 0.1 |

-continued

| Ingredients | XXVa Wt. % | XXVb Wt % | XXVc Wt. % | XXVd Wt. % |
|---|---|---|---|---|
| NaOH | — | 1.7 | 1.7 | — |
| Ethoxylated Tetraethylenepentamine | 0.65 | 0.55 | 0.55 | 0.65 |
| Ethoxylated polyethyleneimine | — | 1.1 | 1.1 | — |
| Protease | 0.07 | 0.03 | 0.03 | 0.07 |
| Amylase | 0.15 | 0.06 | 0.06 | 0.15 |
| Mannanase | 0.15 | — | — | 0.15 |
| Silwet L77 | 3.6 | 0.3 | 0.3 | 3.6 |
| PVNO | 0.25 | — | — | 0.25 |
| Suds Suppressor | — | 0.05 | 0.05 | — |
| Perfume | 0.5 | 0.35 | 0.35 | 0.5 |
| Dye | 7 ppm | — | — | 7 ppm |
| Water and Miscellaneous | Bal. | Bal. | Bal. | Bal. |

[(t)]$C_{12}$—$C_{14}$ alkyl N-methyl glucose amide.

EXAMPLE XXVI

Examples of syndet bar fabric detergent fabric care compositions in accord with the present invention:

| Ingredients | XXVIa Wt % | XXVIb Wt. % | XXVIc Wt. % |
|---|---|---|---|
| C26 AS | 18 | 18 | 18 |
| CFAA | 5 | 5 | 5 |
| LAS (C11–13) | 10 | 10 | 10 |
| Sodium carbonate | 22 | 25 | 20 |
| Sodium pyrophosphate | 6 | 6 | 6 |
| STPP[(s)] | 6 | 6 | 6 |
| Zeolite A | 5 | 5 | 5 |
| CMC | 0.2 | 0.2 | 0.2 |
| Polyacrylate (MW 1400) | 0.2 | 0.2 | 0.2 |
| Coconut monethanolamide | 5 | 5 | 5 |
| Arabinogalactan A | 12 | — | 12 |
| Arabinogalactan B | — | 10 | — |
| Oligosaccharide Mixture D | — | — | 5 |
| Amylase | — | 0.02 | 0.02 |
| Protease | — | 0.3 | 0.3 |
| Perfume | 0.2 | 0.2 | 0.2 |
| Brightener | 0.1 | 0.1 | 0.1 |
| CaSO4 | 1 | 1 | 1 |
| MgSO4 | 1 | 1 | 1 |
| Perfume | 0.2 | 0.3 | 0.2 |
| Water | 4 | 4 | 4 |
| Filler[(t)] | Balance | Balance | Balance |

[(s)]Anhydrous sodium tripolyphosphate.
[(t)]Can be selected from convenient materials such as $CaCO_3$, talc, clay (Kaolinite, Smectite), silicates, and the like.

Following are Examples for fabric care pre-wash and wash additive compositions in accordance with the present invention:

EXAMPLE XXVII

| Ingredients | XXVIIa Wt. % | XXVIIb Wt. % | XXVIIc Wt. % | XXVIId Wt. % |
|---|---|---|---|---|
| Arabinogalactan A | 15 | — | — | — |
| Arabinogalactan B | — | 10 | — | — |
| Arabinogalactan C | — | — | 7 | — |
| Curdlan | — | — | — | 8 |

-continued

| Ingredients | XXVIIa Wt. % | XXVIIb Wt. % | XXVIIc Wt. % | XXVIId Wt. % |
|---|---|---|---|---|
| Dye Fixative Agent[u] | 2 | — | — | — |
| Dye transfer Inhibitor[v] | — | — | — | — |
| Polysorbate 60 | 0.8 | 0.8 | 1 | 0.8 |
| Perfume | 0.5 | 0.5 | 0.8 | 0.5 |
| Kathon CG | 5 ppm | 5 ppm | 5 ppm | 5 ppm |
| Deionized Water | Bal. | Bal. | Bal. | Bal. |

[u]Cartafix CB from Clariant
[v]Polyvinylpyrrolidone 85K

EXAMPLE XXVIII

| Ingredients | XXVIIIa Wt. % | XXVIIIb Wt. % | XXVIIIc Wt. % | XXVIIId Wt. % |
|---|---|---|---|---|
| Araibinogalactan A | 3 | 10 | 10 | 5 |
| Oligosaccharide Mixture A | 5 | — | 5 | — |
| Oligosaccharide Mixture D | — | 10 | — | 10 |
| Dye Fixative Agent[u] | 2.5 | — | — | — |
| Dye transfer Inhibitor[v] | 5 | 7 | — | — |
| Polysorbate 60 | 0.5 | 1 | 1 | 0.5 |
| Perfume | 0.3 | 1 | 0.8 | 0.5 |
| Kathon CG | 5 ppm | 5 ppm | 5 ppm | 5 ppm |
| Deionized Water | Bal. | Bal. | Bal. | Bal. |

EXAMPLE XXIX

| Ingredients | XXIXa Wt. % | XXIXb Wt. % | XXIXc Wt. % | XXIXd Wt. % |
|---|---|---|---|---|
| Arabinogalactan A | 10 | 7 | — | — |
| Arabinogalactan B | — | — | 5 | — |
| Arabinogalactan C | — | — | — | 5 |
| Oligosaccharide Mixture A | — | — | 4 | — |
| Oligosaccharide Mixture B | — | — | — | 5 |
| Oligosaccharide Mixture C | 3 | — | — | — |
| Oligosaccharide Mixture D | — | 7 | — | — |
| Dye Fixative Agent[u] | 2.5 | — | 2 | — |
| Dye transfer Inhibitor[v] | 5 | 5 | 3.5 | 3.5 |
| Polysorbate 60 | 0.8 | 0.7 | 0.7 | 1 |
| Perfume | 0.5 | 0.4 | 0.5 | 1 |
| Kathon CG | 5 ppm | 5 ppm | | 5 ppm |
| Deionized Water | Bal. | Bal. | | Bal. |

The compositions of Examples XXVII–XXIX can be diluted with from about 3 times to about 30 times to make pre-wash soaking solutions to provide fabric care benefits. The compositions of Examples XXVII–XXIX can also be added to wash and/or rinse water to provide fabric care benefits.

What is claimed is:

1. A fabric care composition comprising:

(A) from about 0.001 to about 20, by weight of the composition, of a fabric care polysaccharide with globular structure and having a backbone comprising at least some 1,3-β-glycosidic linkages for providing a fabric with at least one of the following fabric care benefits: wrinkle removal, wrinkle reduction, wrinkle resistance, fabric wear reduction, fabric wear resistance, fabric pilling reduction, fabric color maintenance, fabric color fading reduction, fabric color restoration, fabric soiling reduction, fabric soil release, fabric shape retention, and/or fabric shrinkage reduction;

(B) optionally, from about 0.01% to about 20%, by weight of the composition, of adjunct fabric care oligosaccharide, selected from the group consisting of oligosaccharides, oligosaccharide mixtures, substituted versions of said oligosaccharides and/or mixtures, derivatised versions of said oligosaccharides and/or mixtures, and mixtures thereof;

(C) to remove and/or reduce wrinkles, an effective amount of adjunct wrinkle control agent, selected from the group consisting of fiber lubricant, adjunct fabric shape retention polymer, lithium salts, and mixtures thereof;

(D) optionally, to reduce surface tension, and/or to improve performance and formulatability, an effective amount of surfactant;

(E) optionally, an effective amount to absorb malodor, of odor control agent;

(F) an effective amount to provide olfactory effects of perfume;

(G) optionally, an effective amount, to kill, or reduce the growth of microbes, of antimicrobial active;

(H) optionally, an effective amount to provide improved antimicrobial action of aminocarboxylate chelator;

(I) optionally, an effective amount of antimicrobial preservative, in addition to, or in place of said antimicrobial active; and (J) optionally, an aqueous carrier, said composition optionally being essentially free of any material that would soil or stain fabric under usage conditions.

2. The composition of claim 1 containing from about 0.01% to about 10%, by weight of said fabric care composition, of said fabric care polysaccharide.

3. The composition of claim 1 wherein said fabric care polysaccharide has a molecular weight of from about 5,000 to about 500,000.

4. The composition of claim 1 wherein said fabric care polysaccharide has a size of from about 2 nm to about 300 nm.

5. The composition of claim 1 wherein said fabric care polysaccharide is selected from the group consisting of arabinogalactan, pachyman, curdlan, callose, paramylon, sceleroglucan, lentinan, lichenan, lamirarin, szhizophyllan, grifolan, *sclerotinia selerotiorum* glucan, ompharia lapidescence glucan, and mixtures thereof.

6. The composition of claim 5 wherein said fabric care polysaccharide is arabinogalactan.

7. The composition of claim 6 wherein said arabinogalactan has a molecular weight of from about 6,000 to about 500,000.

8. The composition of claim 7 wherein said arabinogalactan is selected from the group consisting of: arabinogalactan having a molecular weight of from about 14,000 to about 22,000; arabinogalactan having a molecular weight of from about 60,000 to about 120,000; and mixtures thereof.

9. The composition of claim 1 wherein said fabric care composition additionally comprises adjunct fabric care oligosaccharide selected from the group consisting of oligosaccharides, oligosaccharide mixtures, substituted versions of said oligosaccharides and/or mixtures, derivatised versions of said oligosaccharides and/or mixtures, and mixtures thereof.

10. The composition of claim 9 wherein the weight ratio between said adjunct fabric care oligosaccharides and the fabric care polysaccharides is from about 1:99 to about 99:1.

11. The composition of claim 9 containing from about 0.001% to about 20%, by weight of said fabric care composition, of said adjunct fabric care oligosaccharide.

12. The composition of claim 9 wherein said adjunct fabric care oligosaccharide comprises oligosaccharides with a degree of polymerization of from about 1 to about 15, and wherein each monomer is selected from the group consisting of sacharide containing 5 or 6 carbon atoms.

13. The composition of claim 12 wherein said adjunct fabric care oligosaccharide comprises isomaltooligosaccharides with a degree of polymerization of from about 2 to about 10, wherein the glucose units are linked by α-linkages and/or β-linkages.

14. The composition of claim 13 wherein said isomaltooligosaccharides contain from about 3 to about 7 glucose units which are linked by 1,2-α; 1,3-α; 1,4-α-, and 1,6-α-linkages, and mixtures of these linkages.

15. The composition of claim 12 wherein said adjunct fabric care oligosaccharide is selected from the group consisting of isomaltose, isomaltotriose, isomaltotetraose, isomaltooligosaccharide, fructooligosaccharide, levooligosaccharides, galactooligosaccharide, xylooligosaccharide, gentiooligosaccharides, disaccharides, glucose, fructose, galactose, xylose, mannose, arabinose, rhamnose, maltose, sucrose, lactose, maltulose, ribose, lyxose, allose, altrose, gulose, idose, talose, trehalose, nigerose, kojibiose, lactulose, oligosaccharides, maltooligosaccharides, trisaccharides, tetrasaccharides, pentasaccharides, hexasaccharides, oligosacharides from partial hydrolysates of natural polysaccharide sources, and mixtures thereof.

16. The composition of claim 1 wherein said fabric care composition additionally comprises a fiber lubricant.

17. The composition of claim 16 wherein said fiber lubricant is silicone.

18. The composition of claim 17 wherein said silicone is volatile and is present at a level of from about 0.1% to about 5%, by weight of the composition.

19. The composition of claim 18 wherein said volatile silicone has the formula $[(CH_3)_2SiO)]_5$.

20. The composition of claim 17 wherein said silicone is present at a level of from about 0.1% to about 5% by weight of the composition, and is selected from the group consisting of:

(A) polyalkyl silicone with the following structure:

$$A—Si(R_2)—O—[Si(R_2)—O—]_q—Si(R_2)—A$$

wherein each R is an alky, a hydroxy, or a hydroxyalkyl group, and mixtures thereof, having less than about 8 carbon atoms; q is an integer from about 7 to about 8,000; each A is a group selected from hydrogen, methyl, methoxy, ethoxy, hydroxy, and propoxy;

(B) silicone having the formula:

$$HO—Si(CH_3)_2—O]_x—\{Si(OH)[(CH_2)_3—NH—(CH_2)_2—NH_2]O\}_y—H$$

wherein x and y are integers;

(C) silicone material having the formula:

$$(R^1)_aG_{3-a}—Si—(—OSiG_2)_n—OSiG_b(R^1)_{2-b)m}—O—SiG_{3-a}(R^1)_a$$

wherein G is selected from the group consisting of hydrogen OH, and/or $C_1$–$C_5$ alkyl; a denotes 0 or an integer from 1 to 3; b denotes 0 or 1; the sum of n+m is a number from 1 to about 2,000, $R^1$ is a monovalent radical of formula $C_pH_{2p}L$ in which p is an integer from 2 to 4 and L is selected from the group consisting of:

$—N(R^2)CH_2—CH_2—N(R^2)_2$;

$—N(R^2)_2$;

$—N^+(R^2)_3\ A^-$; and $—N^+(R^2)C_2—CH_2N^+H_2\ A^-$ wherein each $R^2$ is chosen from the group consisting of hydrogen, a $C_1$–$C_5$ saturated hydrocarbon radical, and each $A^-$ denotes compatible anion;

(D) silicones having the formula:

$$R^3—N^+(CH_3)_2—Z—[Si(CH_3)_2O]_f—Si(CH_3)_2—Z—N^+(CH_3)_2—R^3.2CH_3COO^-$$

wherein $Z=—CH_2—CH(OH)—CH_2O—CH_2)_3—$ $R^3$ denotes a long chain alkyl group; and f denotes an integer of at least about 2; and (E) mixtures thereof.

21. The composition of claim 20 wherein said silicone is polydialkyl silicone $$A—Si(R_2)—O—[Si(R_2)—O—]_q—Si(R_2)—A$$

with A and R groups being methyl.

22. The composition of claim 1 wherein said fabric care composition additionally comprises from about 0.05% to about 10% by weight of the composition, of shape retention polymer which is a homopolymer and/or a copolymer.

23. The composition of claim 22 wherein said shape retention polymer is a homopolymer and/or copolymer having a glass transition temperature of from about −20° C. to about 150° C. and comprising monomers selected from the group consisting of low molecular weight $C_1$–$C_6$ unsaturated organic mono-carboxylic and/or polycarboxylic acids; esters of said acids with $C_1$–$C_{12}$ alcohols; amides and imides of said acids; low molecular weight unsaturated alcohols; esters of low molecular weight unsaturated alcohols with low molecular weight carboxylic acids; ethers of low molecular weight unsaturated alcohols; polar vinyl heterocyclics; unsaturated amines and amides; salts of said amines with low molecular weight carboxylic acids; $C_1$–$C_4$ alkyl quaternized derivatives of said amines; vinyl sulfonate; low molecular weight unsaturated hydrocarbons and derivatives; and mixtures thereof.

24. The composition of claim 23 wherein said shape retention polymer monomers are selected from the group consisting of: acrylic acid, methacrylic acid, crotonic acid, maleic acid and its half esters, itaconic acid, and esters of said acids with methanol, ethanol, 1-propanol, 2-propanol, 1-butanol, 2-methyl-1-propanol, 1-pentanol, 2-pentanol, 3-pentanol, 2-methyl-1-butanol, 1-methyl-1-butanol, 3-methyl-1-butanol, 1-methyl-1-pentanol, 2-methyl-1-pentanol, 3-methyl-1-pentanol, t-butanol, cyclohexanol, 2-ethyl-1-butanol, neodecanol, 3-heptanol, benzyl alcohol, 2-octanol, 6-methyl-1-heptanol, 2-ethyl-1-hexanol, 3,5-dimethyl-1-hexanol, 3,5,5-trimethyl-1-hexanol, 1-decanol, 1-dodecanol, and mixtures thereof; methyl acrylate; ethyl acrylate; t-butyl acrylate; methyl methacrylate; hydroxyethyl methacrylate; methoxy ethyl methacrylate; N,N-dimethylacrylamide; N-t-butyl acrylamide; maleimides; vinyl alcohol; allyl alcohol; vinyl acetate; vinyl propionate; methyl vinyl ether; vinyl pyrrolidone; vinyl caprolactam; vinyl pyridine; vinyl imidazole; vinyl amine; diethylene triamine; dimethylaminoethyl methacrylate; ethenyl formamide; vinyl sulfonate; ethylene; propylene; butadiene; cyclohexadiene; vinyl chloride; vinylidene chloride; salts thereof and alkyl quaternized derivatives thereof; and mixtures thereof.

25. The composition of claim 24 wherein said shape retention polymer monomers are selected from the group consisting of: acrylic acid; methacrylic acid; methyl acrylate; ethyl acrylate; methyl methacrylate; t-butyl acrylate; t-butyl methacrylate; n-butyl acrylate; n-butyl methacrylate; isobutyl methacrylate; 2-ethylhexyl methacrylate; vinyl alcohol; dimethylaminoethyl methacrylate; N,N-dimethyl acrylamide; N,N-dimethyl methacrylamide; N-t-butyl acrylamide; vinylpyrrolidone; vinyl pyridine; adipic acid; diethylenetriamine; salts thereof and alkyl quaternized derivatives thereof; and mixtures thereof.

26. The composition of claim 22 wherein said shape retention polymer is a copolymer which contains both hydrophilic monomer and hydrophobic monomer.

27. The composition of claim 26 wherein said shape retention copolymer has a hydrophobic monomer/hydrophilic monomer ratio of from about 95:5 to about 20:80, by weight of the copolymer.

28. The composition of claim 22 wherein said shape retention polymer comprises silicone-containing graft and block copolymers having the following properties:

(1) the silicone portion is covalently attached to the non-silicone portion;

(2) the molecular weight of the silicone portion is from about 1,000 to about 50,000; and the non-silicone portion must render the entire copolymer soluble or dispersible in the fabric care composition vehicle and permit the copolymer to deposit on/adhere to the treated fabrics.

29. The composition of claim 28 wherein said shape retention polymer has an average molecular weight of from about 10,000 to about 1,000,000 and comprises from about 5% to about 50% of silicone containing monomers.

30. The composition of claim 1 wherein said fabric care composition additionally comprises from about 0.1% to about 10% by weight of the usage composition, of lithium salt, or hydrate thereof, selected from the group consisting of: lithium bromide, lithium lactate, lithium chloride, lithium tartrate, lithium bitartrate, and mixtures thereof.

31. The composition of claim 1 wherein said fabric care composition additionally comprises of from about 0.01% to about 5%, by weight of the usage composition, of an odor control agent selected from the group consisting of cyclodextrin, zinc salt, copper salt, water soluble carbonate salt, water soluble bicarbonate salt, water soluble anionic polymer, and mixtures thereof.

32. The composition of claim 1 additionally containing at least one of the following adjunct materials: fiber lubricant, shape retention polymer, lithium salt, odor control agent, surfactant, antimicrobial active and/or antibacterial preservative, chelating agent, enzyme, antioxidant, static control agent, fabric softening active, suds suppressor, dye transfer inhibiting agent, dye fixing agent, soil release agent, brightener, dispersant, insect repelling agent, moth repelling agent, and/or liquid carrier.

33. A fabric care composition according to claim 1 which is a rinse-added composition containing from about 0.1% to about 50%, by weight of the composition, of said fabric care polysaccharide, and optionally containing fabric softener active at a level of from about 1% to about 75%, by weight of the composition.

34. The composition of claim 22 wherein said fabric softening active has an Iodine Value of at least about 40, and has a phase transition temperature of less than about 50° C., said composition additionally comprising:

(A) optionally, less than about 40%, by weight of the composition, of principal solvent having a ClogP of from about −2.0 to about 2.6;

(B) optionally, from about 0.1% to about 10%, by weight of the composition, of electrolyte;

(C) optionally, from 0.1% to about 15%, by weight of the composition of phase stabilizer, preferably being a surfactant containing alkoxylation and having an HLB of from about 8 to about 20; and (D) the balance water, minor ingredients and/or water soluble solvents.

35. The fabric care composition of claim 33 additionally containing at least an effective amount of at least one of the following adjunct materials: adjunct fabric care oligosaccharide, perfume, dye transfer inhibiting age, dye fixative agent, chlorine scavenging agent, soil release agent, chemical stabilizer, silicone, antimicrobial active and/or preservative, metal chelating agent, colorant, enzyme, brightener, liquid carrier, or mixtures thereof.

36. A fabric care composition according to claim 1 which is a laundry detergent composition containing from about 0.2% to about 30% by weight of the composition, of said fabric care polysaccharide and from about 0.1% to about 60% by weight of the composition, of surfactant, and additionally containing at least one of the following adjunct materials: adjunct fabric care oligosaccharide, perfume, builder, bleaching agent, dye transfer inhibiting agent, dye fixing agent, odor control agent, brightener, dispersant, heavy metal chelating agent, enzyme, suds suppressor, fabric softening agent, soil release agent, and/or liquid carrier.

37. The composition if claim 36 wherein said composition is in a form selected from the group consisting of liquid, powder, granules, tablets, paste, gel, foam, spray, bar, and stick, wherein said composition is optionally contained in a pouch or attached to a releasable substrate.

38. A fabric care composition according to claim 1 which is an aqueous composition to apply to fabric in the dying step, containing said fabric care polysaccharide at a level of from about 0.01% to about 25%, by weight of the compositions, and optionally containing fabric softener active at a level of from about 0.05% to about 10%, by weight of the composition.

39. A fabric care composition according to claim 1 which is a dryer-added fabric softening composition containing said fabric care polysaccharide at a level of from about 0.01% to about 40%, by weight of the composition, and fabric softener active at a level of from about 1% to about 99%, by weight of the composition.

40. The fabric care composition of claim 38 additionally containing at least an effective amount of at least one of the following adjunct materials: adjunct fabric care oligosaccharide, chlorine scavenging agent, dye transfer inhibiting agent, dye fixative agent, chemical stabilizer, silicone, antimicrobial active and/or preservative, metal chelating agent, brightener, enzyme, soil release agent, liquid carrier, or mixtures thereof.

41. An article of manufacture comprising a fabric care composition comprising from about 0.001% to about 20% of a fabric care polysaccharide with globular structure and having a backbone comprising at least some 1,3 β-glycosidic linkages for providing a fabric with at least one of the following fabric care benefits: wrinkle removal, wrinkle reduction, wrinkle resistance, fabric wear reduction, fabric wear resistance, fabric pilling reduction, fabric color maintenance, fabric color fading reduction, fabric color restoration, fabric soiling reduction, fabric soil release, fabric shape retention, and/or fabric shrinkage reduction, and an effective amount of adjunct wrinkle control agent selected from the group consisting of fiber lubricant, adjunct fabric shape retention polymer, lithium salts, and mixtures thereof, association with instructions for use which direct the consumer to apply at least an effective amount of said polysaccharide to provide at least one of said fabric care benefits.

42. The article of manufacture of claim 41, wherein said composition is an aqueous composition containing from about 0.1% to about 5%, by weight of said fabric care composition, of said fabric care polysaccharide.

43. The article of manufacture of claim 41 wherein said spray dispenser comprises a trigger spray device.

44. The article of manufacture of claim 41 wherein said spray dispenser comprises a non-manually operated spray dispenser.

45. The article of manufacture of claim 44 wherein said non-manually operated spray dispenser is selected from the group consisting of: powered sprayer; air aspirated sprayer; liquid aspirated sprayer; electrostatic sprayer; and nebulizer sprayer.

46. The article of manufacture of claim 41 wherein said composition additionally contains at least one of the following adjunct materials: adjunct fabric care oligosaccharide, fiber lubricant, shape retention polymer, lithium salt, odor control agent, surfactant, antimicrobial active and/or antibacterial preservative, metal chelating agent, enzyme, antioxidant, static control agent, fabric softening active, dye transfer inhibiting agent, dye fixative agent, soil release agent, suds suppressor, brightener, insect repelling agent, moth repelling agent, and/or liquid carrier.

47. The article of manufacture of claim 41 in association with instructions for use to direct the consumer to apply at least an effective amount of said composition and/or said fabric care polysaccharide to said fabric, to provide said fabric with at least one of the following fabric care benefits: wrinkle removal, wrinkle reduction, wrinkle resistance, fabric wear reduction, fabric wear resistance, fabric pilling reduction, fabric color maintenance, fabric color fading reduction, fabric color restoration, fabric soiling reduction, fabric soil release, fabric shape retention, and/or fabric shrinkage reduction.

48. The article of manufacture of claim 47 wherein said instructions for use direct the consumer to apply an amount of composition to provide from about 0.005% to about 4%, by weight of the fabric.

49. The article of manufacture of claim 47 wherein said instructions for use direct the consumer to apply the composition to the fabric in combination with stretching and/or smoothing of fabric, to provide effective wrinkle removal.

50. An article of manufacture comprising the composition of claim 1 to be applied directly to said fabric in a manner such that excessive amounts of the fibric care composition are prevented from being released to the open environment, packaged in association with instructions for use which direct the consumer to apply at least an effective amount of said fabric care polysaccharide with globular structure to said fabric in said manner to provide said fabric care benefits.

51. The article of claim 50 wherein said composition contains from about 0.01% to about 2% of fabric care polysaccharide with globular structure, by weight of the composition.

52. An article of manufacture comprising the composition of claim 1 to pretreat said fabric before washing, packaged in association with instructions for use which direct the consumer to apply at least an effective amount of said composition to said fabric to provide said fabric care benefits.

53. An article of manufacture comprising the composition of claim 1 which is a wash additive composition, packaged in association with instructions for use which direct the consumer to apply at least an effective amount of said composition to said fabric to provide said fabric care benefits.

54. An article of manufacture comprising the composition of claim 1 which is a laundry detergent composition, packaged in association with instructions for use which direct the consumer to apply at least an effective amount of said composition to said fabric to provide the fabric care benefits.

55. An article of manufacture comprising the composition of claim 1 which is a rinse additive composition, packaged in association with instructions for use which direct the consumer to apply at least an effective amount of said composition to said fabric to provide said fabric care benefits.

56. An article of manufacture comprising the composition of claim 1 to apply to fabric in the drying step, packaged in association with instructions for use which direct the consumer to apply at least an effective amount of said composition to sad fabric to provide said fabric care benefits.

57. The article of claim 41 wherein said instructions for use include pictures and/or icons.

58. Fabric having improved characteristics having an effective amount of a fabric care polysaccharide with globular structure and having a backbone comprising at least some 1,3 β-glycosidic linkages attached thereto, an effective amount of adjunct wrinkle control agent selected from the group consisting of fiber lubricant, adjunct fabric shape retention polymer, lithium salts, and mixtures thereof, and having an effective amount to provide olfactory effects of perfume.

59. The fabric of claim 58 wherein said fabric comprises from about 0.005% to about 4%, by weight of the fabric of said fabric care polysaccharide.

60. The fabric of claim 58 wherein said fabric is made of fibers selected from the group consisting of natural fibers, synthetic fibers, and mixtures thereof.

61. The fabric of claim 60 wherein said fabric is made of fibers selected from the group consisting of: cellulosic fibers, proteinaceous fibers, synthetic fibers, long vegetable fibers, and mixtures thereof.

62. The fabric of claim 61 wherein said fabric is selected from the group consisting of cotton, rayon, linen, Tencel, silk, wool and related mammalian fibers, polyester, acrylic, nylon, jute, flax, ramie, coir, kapok, sisal, henequen, abaca, hemp, sunn, and mixtures thereof.

63. The fabric of claim 62 wherein said fabric is selected from the group consisting of cotton, rayon, linen, polyester/cotton blends, silk, wool, polyester, acrylic, nylon, and mixtures thereof.

64. A method for providing a fabric with a fabric care benefit selected from the group consisting of: wrinkle removal, wrinkle reduction, wrinkle resistance, fabric wear reduction, fabric wear resistance, fabric pilling reduction, fabric color maintenance, fabric color fading reduction, fabric color restoration, fabric soiling reduction, fabric soil release, fabric shape retention, fabric shrinkage reduction, and mixtures thereof, wherein said method comprises contacting said fabric with an effective amount of a fabric care composition comprising from about 0.001% to about 20 of a fabric care polysaccharide with globular structure and having a backbone comprising an effective amount of adjunct wrinkle control agent selected from the group consisting of fiber lubricant, adjunct fabric shape retention polymer, lithium salts, and mixtures thereof oligosaccharide, fiber lubricant, shape retention polymer, lithium salt, odor control agent, an antimicrobial active and/or antibacterial preservative surfactant, chelating agent, enzyme, antioxidant, static control agent, fabric softening active, dye transfer inhibiting agent, dye fixing agent, soil release agent, brightener, suds suppressor, builder, bleaching agent, dispersant, insect repelling agent, moth repelling agent, and/or liquid carrier.

65. The method of claim 64 wherein said fabric care composition is an aqueous composition containing from about 0.1% to about 5%, by weight of said fabric care composition, of said fabric care polysaccharide.

66. The method according to claim 64 wherein said aqueous composition is sprayed onto said fabric as droplets by using a spray dispenser.

67. The method of claim 66 wherein said aqueous composition is sprayed onto said fabric as droplets by using a spray dispenser, in combination with stretching and/or smoothing of said fabric.

68. The method of claim 66 wherein said spray dispenser comprises a trigger spray device.

69. The method of claim 66 wherein said spray dispenser comprises a non-manually operated sprayer selected from the group consisting of: power sprayer; air aspirated sprayer; liquid aspirated sprayer; electrostatic sprayer; and nebulizer sprayer.

70. The method of claim 66 wherein said droplets have a weight average diameter of from about 5 $\mu$m to about 250 $\mu$m.

71. The method according to claim 65 wherein said fabric is dipped and/or soaked in said fabric care composition, followed by a squeezing step and/or a drying step.

72. The method according to claim 64 wherein said fabric care composition comprises an aqueous composition containing from about 0.5% to about 40%, by weight of said fabric care composition, of said fabric care polysaccharide, and wherein said fabric is dipped and/or soaked in said fabric care composition, followed by a laundering step.

73. The method according to claim 65 wherein said fabric care composition contains from about 0.2% to about 30% by weight of the composition, of said fabric care polysaccharide and from about 0.1% to about 60% by weight of the composition, of surfactant, and additionally contains at least one of the following adjunct materials: adjunct fabric care oligosaccharide, perfume, builder, bleaching agent, dye transfer inhibiting agent, dye fixing agent, odor control agent, brightener, dispersant, heavy metal chelating agent, enzyme, suds suppressor, fabric softening aactive, soil release agent, and/or liquid carrier.

74. The method according to claim 64 wherein said fabric care composition is a rinse-added composition containing from about 0.1% to about 50%1, by weight of the composition, of said fabric care polysaccharide, and optionally containing fabric softener active at a level of from about 1% to about 75%, by weight of the composition.

75. The method of claim 74 wherein said fabric care composition additionally coins at least one of the following adjunct materials: adjunct fabric care oligosaccharide, perfume, odor control agent, dye transfer inhibiting agent, dye fixative agent, chlorine scavenging agent, soil release agent, chemical stabilizer, silicone, antimicrobial active and/or preservative, material chelating agent, colorant, enzyme, brightener, bluing agent, liquid carrier, or mixtures thereof.

76. The method according to claim 64 wherein said fabric care composition is an aqueous composition to apply to fabric in the drying step, containing said fabric care polysaccharide at a level of from about 0.01% to about 25%, by weight of the composition, and optionally containing fabric softener active at a level of from about 0.05% to about 10%, by weight of the composition.

77. The method according to claim 76 wherein said composition is applied from a spray device.

78. The method according to claim 64 wherein said fabric care composition is a dryer-added fabric softening composition containing said fabric care polysaccharide at a level of from about 0.01% to about 40%, by weight of the composition, and fabric softener active at a level of from about 1% to about 99%, by weight of the composition.

79. The method according to claim 78 wherein said composition is released from a flexible substrate.

80. The method of claim 76 wherein said composition additionally contains at least one of the following adjunct materials: adjunct fabric care oligosaccharide, static control agent, distributing agent, perfume, fiber lubricant, adjunct shape retention polymer, lithium salt, odor control agent, dye transfer inhibiting agent, dye fixative agent, chlorine scavenging agent, soil release agent, brightener, heavy metal chelating agent, enzyme, antimicrobial active, antibacterial preservative, aminocarboxylate chelating agent, antioxidant, and/or liquid carrier.

81. A method for removing fabric wrinkles by treating said fabric with an effective amount of the composition of claim 1.

82. A method for reducing fabric shrinkage by treating said fabric with an effective amount of the composition of claim 1.

83. A method for reducing fabric wear by treating said fabric with an effective amount of the composition of claim 1.

84. A method for reducing the scratchy feel of wool fabric articles by treating said article with an effective amount of the composition of claim 1.

85. A method for providing fabric color care benefits selected from the group consisting of fabric color maintenance, fabric color fading reduction, fabric color restoration, and mixtures thereof, said method comprising treating said fabric with an effective amount of the composition of claim 1.

86. An article of manufacture comprising the composition of claim 1 to be applied directly to a garment in a manner such that excessive amounts of the fabric care composition are prevented from being released to the open environment, packaged in association with instructions for use which direct the consumer to apply at least an effective amount of said fabric care polysaccharide with globular structure to said garment in said manner to provide said fabric care benefits.

87. The article of claim 86 wherein said composition contains from about 0.01% to about 2% of fabric care polysaccharide with globular structure, by weight of the composition.

* * * * *